US007409892B2

(12) United States Patent
Monk

(10) Patent No.: US 7,409,892 B2
(45) Date of Patent: Aug. 12, 2008

(54) BOTTLE OPENER AND BOTTLE CAP COLLECTING AND DISPOSING DEVICE

(76) Inventor: James K. Monk, 13109 Philadelphia Woods La., Orlando, FL (US) 32824

( * ) Notice: Subject to any disclaimer, the term of this patent is extended or adjusted under 35 U.S.C. 154(b) by 0 days.

(21) Appl. No.: 11/744,434

(22) Filed: May 4, 2007

(65) Prior Publication Data

US 2008/0110298 A1 May 15, 2008

Related U.S. Application Data

(60) Provisional application No. 60/747,025, filed on May 11, 2006.

(51) Int. Cl.
*B67B 7/16* (2006.01)
*B67B 7/44* (2006.01)

(52) U.S. Cl. ..... 81/3.08

(58) Field of Classification Search ..... 81/3.08, 81/3.09, 3.55

See application file for complete search history.

(56) References Cited

U.S. PATENT DOCUMENTS 2,090,714 A 8/1937 Wright et al.
2,116,306 A 5/1938 Dziembowski
2,588,687 A 3/1952 Ajouelo
2,728,250 A 12/1955 Robert
2,808,747 A 10/1957 Cohen
3,232,146 A * 2/1966 Prescott ..... 81/3.08
4,414,865 A 11/1983 Brooks et al.
4,615,242 A 10/1986 Milin
4,869,133 A * 9/1989 Irazoqui et al. ..... 81/3.08
5,328,411 A * 7/1994 Thornton, II ..... 473/36
5,617,597 A * 4/1997 Reitz ..... 7/113
7,146,651 B1 * 12/2006 Lapin ..... 2/338
2006/0247075 A1 * 11/2006 Dymling ..... 473/408

* cited by examiner

*Primary Examiner*—David B Thomas
(74) *Attorney, Agent, or Firm*—David G. Maire; Beusse Wolter Sanks Mora & Maire, P.A.

(57) ABSTRACT

A bottle opener for removing bottle caps and for capturing and storing the removed bottle caps. The housing of the opener includes an opening for the insertion of the sealed bottle top and cap. A cap opening device is affixed within the housing opposed the housing opening for receiving the bottle top and cap and for removing the cap from the bottle top. The housing opening is at least partially obstructed by a swiping member, such as an elastomeric material, that permits entry and withdrawal of the bottle top but that prevents the exit of the removed bottle cap.

11 Claims, 139 Drawing Sheets

BOTTLE OPENER AND BOTTLE CAP COLLECTING AND DISPOSING DEVICE

RELATED APPLICATION

This application claims benefit of the May 11, 2006, filing date of U.S. provisional application 60/747,025.

FIELD OF THE INVENTION

The present invention relates generally to the field of bottle cap openers.

BACKGROUND OF THE INVENTION

The bottle opener industry has long been seeking to solve the problems associated with the removal of bottle caps from the bottles, while at the same time capturing, collecting, storing and disposing of the bottle caps in an efficient and economical manner. During the process of opening bottles prior to disposing of the bottle caps, the bottle caps randomly fall on the counter or the floor awaiting independent retrieval for disposal.

U.S. Pat. No. 2,116,306 issued in 1938 for a bottle opener that also functioned to capture and store the removed caps. That device utilized a pivotally mounted decapper that extended outwardly from an enclosure to remove a cap from a bottle and then was pulled inwardly by spring tension to release the cap into a storage volume. The removed cap was held against the decapper by a magnet until the decapper struck a stop that limited its pivoting motion. Such devices are complex, unreliable and expensive to manufacture, and they are not portable.

A much simpler device is described in the 1952 U.S. Pat. No. 2,588,687 wherein a bottle opener with a cap receiver is affixed to a vertical wall such that the removed cap falls by gravity into a receptacle. While simple and reliable, this device is not portable.

A portable cap removing and collecting device is described in the 1955 U.S. Pat. No. 2,728,250. That device utilizes a permanent magnet in conjunction with a sliding lifting hook device which slides beyond a receptacle mouth when the device is upended to remove a cap from a bottle, and then slides back into the receptacle via gravity when the device is uprighted with the removed cap remaining affixed to the hook device by magnetic attraction. A pivotally mounted, retractable, weighted stop member is provided at the mouth of the receptacle to keep the inventory of removed caps from escaping the receptacle when the device is again upended to remove the next cap. The stop device fully closes the mouth to retain the removed caps when upended and fully opens the mouth when uprighted to allow free passage of the removed caps into the receptacle without any obstruction that might otherwise dislodge the cap from the magnet. Here, again, such devices are complex, unreliable and expensive to manufacture.

Finally, in 1986, a relatively simple portable cap collecting opener is described for twist-off caps in U.S. Pat. No. 4,615,242. That device includes a cylindrical member at one end for grabbing and retaining twist-off caps. Optionally, at an opposed end, the device is provided with an opener for removing pry-off bottle caps. Unfortunately, the device functions to capture only the twist-off caps, but it provides no means for retaining the removed pry-off caps.

Thus, further improvements are needed to satisfy the long-standing need for a simple and portable device capable of removing and collecting all types of bottle caps, including pry-off caps.

SUMMARY OF THE INVENTION

The present invention functions to remove, to capture and to store bottle caps with a device that is simple, inexpensive to manufacture, and reliable. Seven design variations are described in the following Detailed Description of Preferred Embodiments, some of which include magnets and moving parts, but the simplest of which include no magnet or actively moving part. The structure and operation of one such embodiment for use with pry-off bottle caps is most clearly illustrated in the sequential illustrations of FIGS. 129-138.

A key design function of a portable bottle opener is the retention of the removed caps within the device as the device is moved about and is tilted during use. The present inventor has innovatively solved this problem with a novel arrangement of very simple structures; i.e. a housing with an opening for receiving the bottle top and cap, a cap engaging device disposed within the housing remote from the opening; and a passive one-way cap gate structure disposed at the opening for allowing the bottle top and cap to enter the housing and for allowing the bottle top to be removed from the housing while at the same time preventing the removed cap from passing out of the opening. The spatial arrangement of the components, with the cap engaging device being inside the housing and remote from the opening, allows the cap gate structure to be made of simple elastomer material in one embodiment. The elastomer material simply bends away from the opening in response to the entry of a bottle top and cap through the opening (FIG. 130), plus it provides a swiping action as the bottle top is removed from the housing (FIG. 133), plus it has enough stiffness to resist opening under the weight of the removed bottle caps (FIG. 134), thereby enabling only one-way passage of the caps through the opening. The space between the prying device and the opening allows the removed cap to drop away from the bottle top as the bottle top is removed from the housing, with the swiping action of the elastomer cap gate structure ensuring separation of the cap from the bottle in all orientations.

BRIEF DESCRIPTION OF THE DRAWINGS

FIG. 120 is a bottom view of design variation 7 set of flexible doors 770 in detail;

FIG. 121 is a top view of design variation 7 set of flexible doors 770 in detail;

FIG. 122 is a side view of design variation 7 set of flexible doors 770 in detail;

FIG. 123 is a front or back view of design variation 7 set of flexible doors 770 in detail;

FIG. 124 is an inside cut-away view of design variation 7 set of flexible doors 770 in detail;

FIG. 125 is a front perspective view of design variation 7 complete with set of flexible doors 770;

FIG. 126 is a bottom view of design variation 7 complete with set of flexible doors 770;

FIG. 127 is a front view of design variation 7 complete with set of flexible doors 770;

FIG. 128 is an inside cut-away view of design variation 7 complete with set of flexible doors 770;

FIG. 129 is an inside cut-away view of step 1 of the bottle opening and bottle cap collecting procedure using design variation 7;

FIG. 130 is an inside cut-away view of step 2 of the bottle opening and bottle cap collecting procedure using design variation 7;

FIG. 131 is an inside cut-away view of step 3 of the bottle opening and bottle cap collecting procedure using design variation 7;

Figure 132:
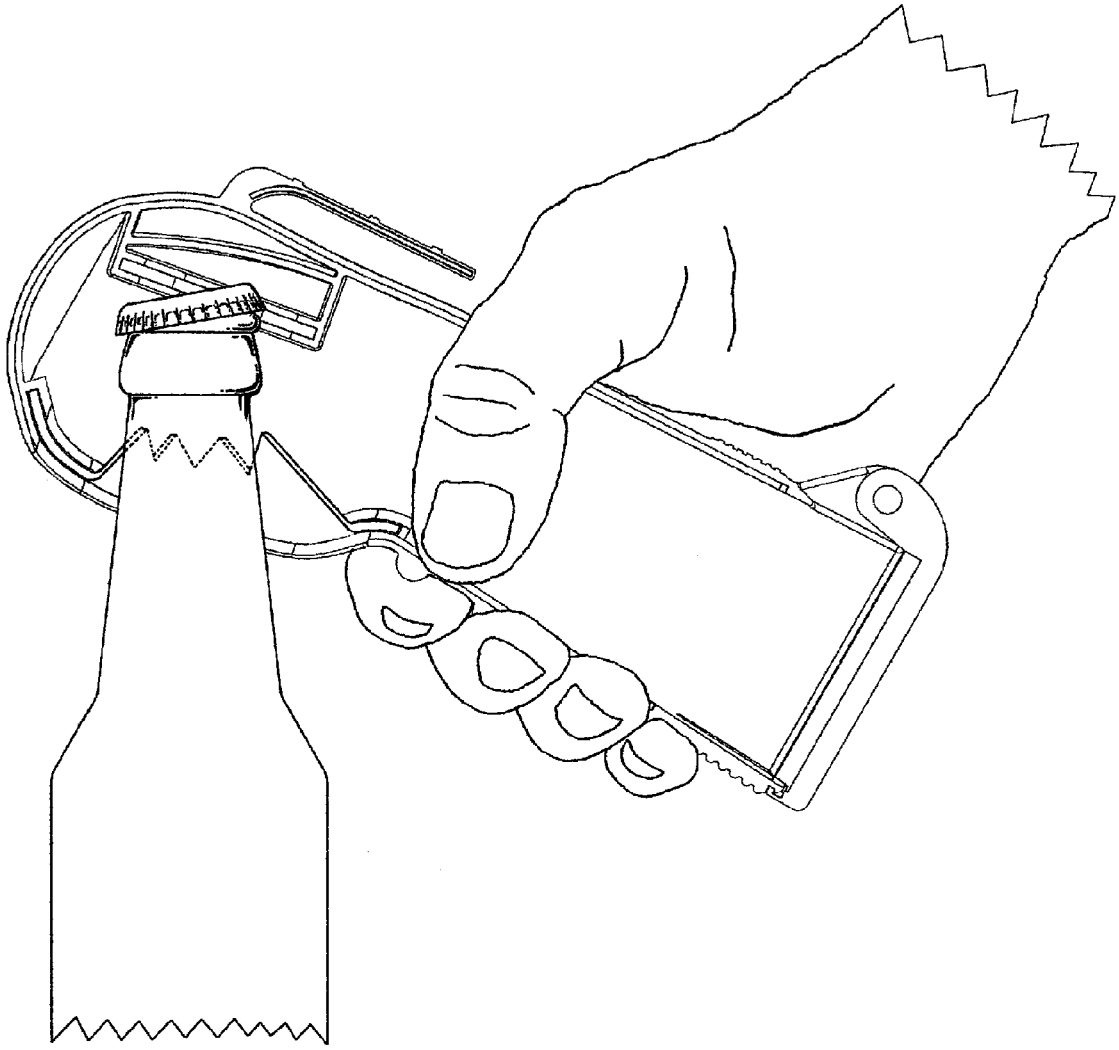
Figure 133:
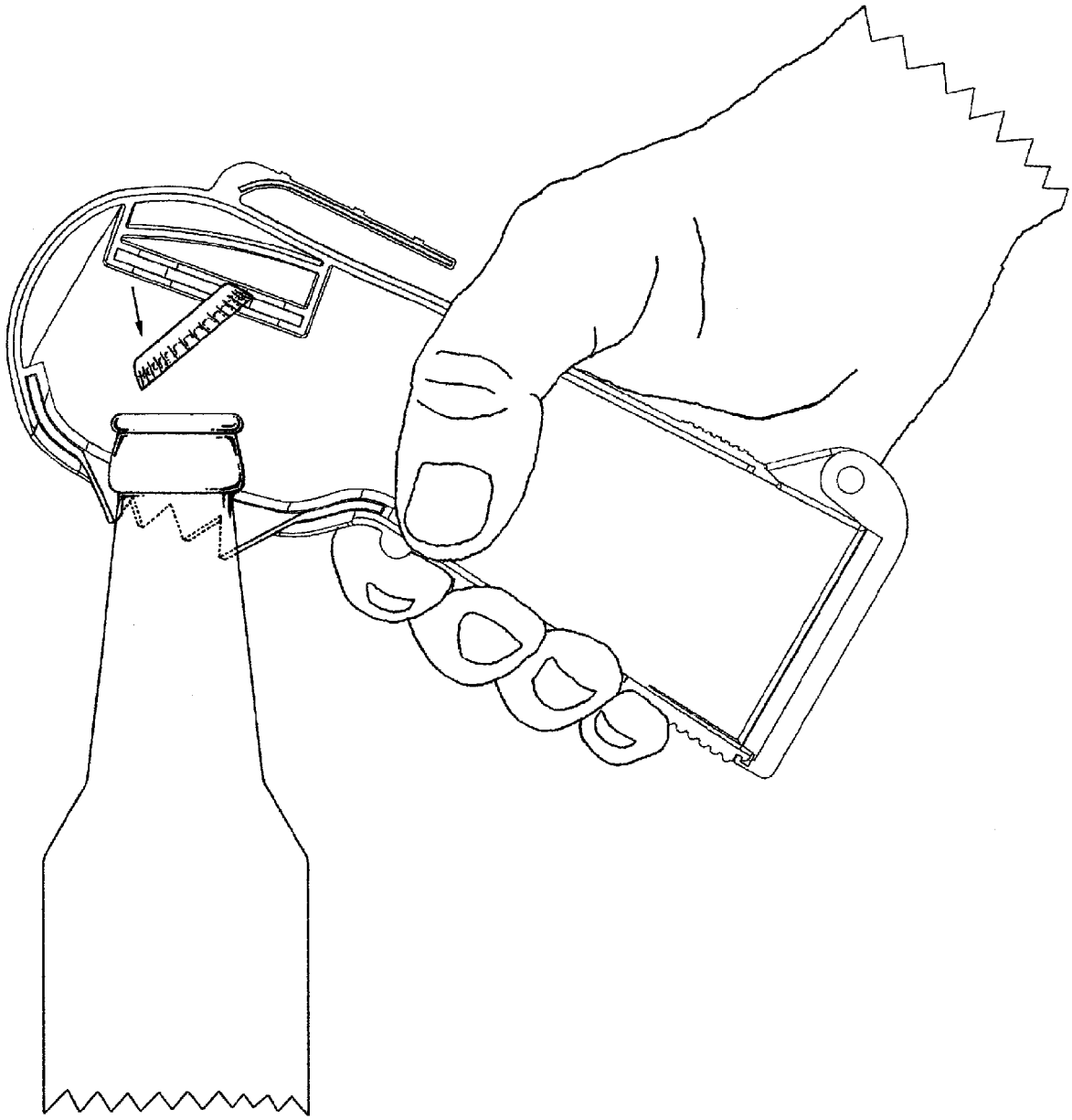
Figure 134:
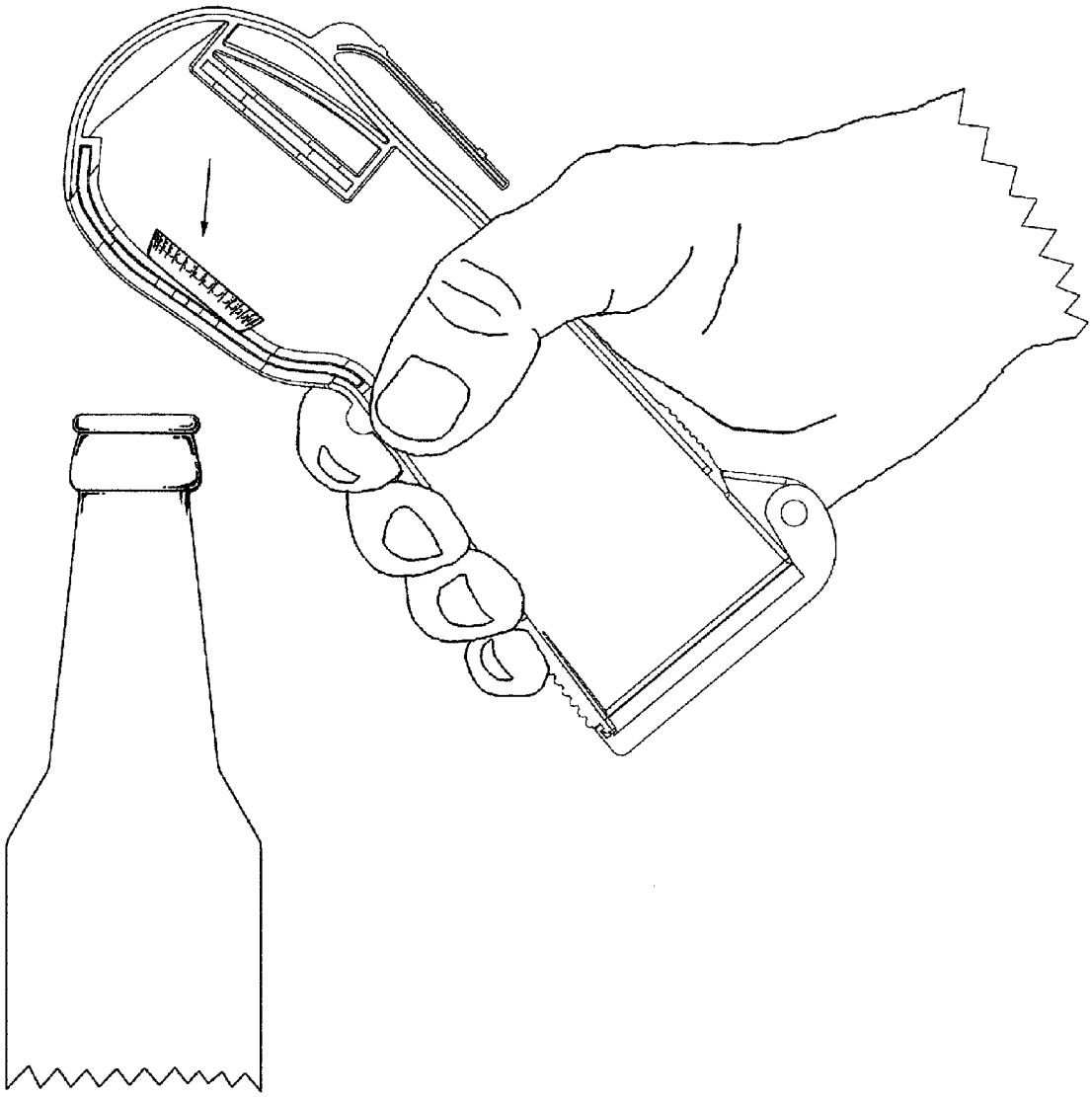
Figure 135:
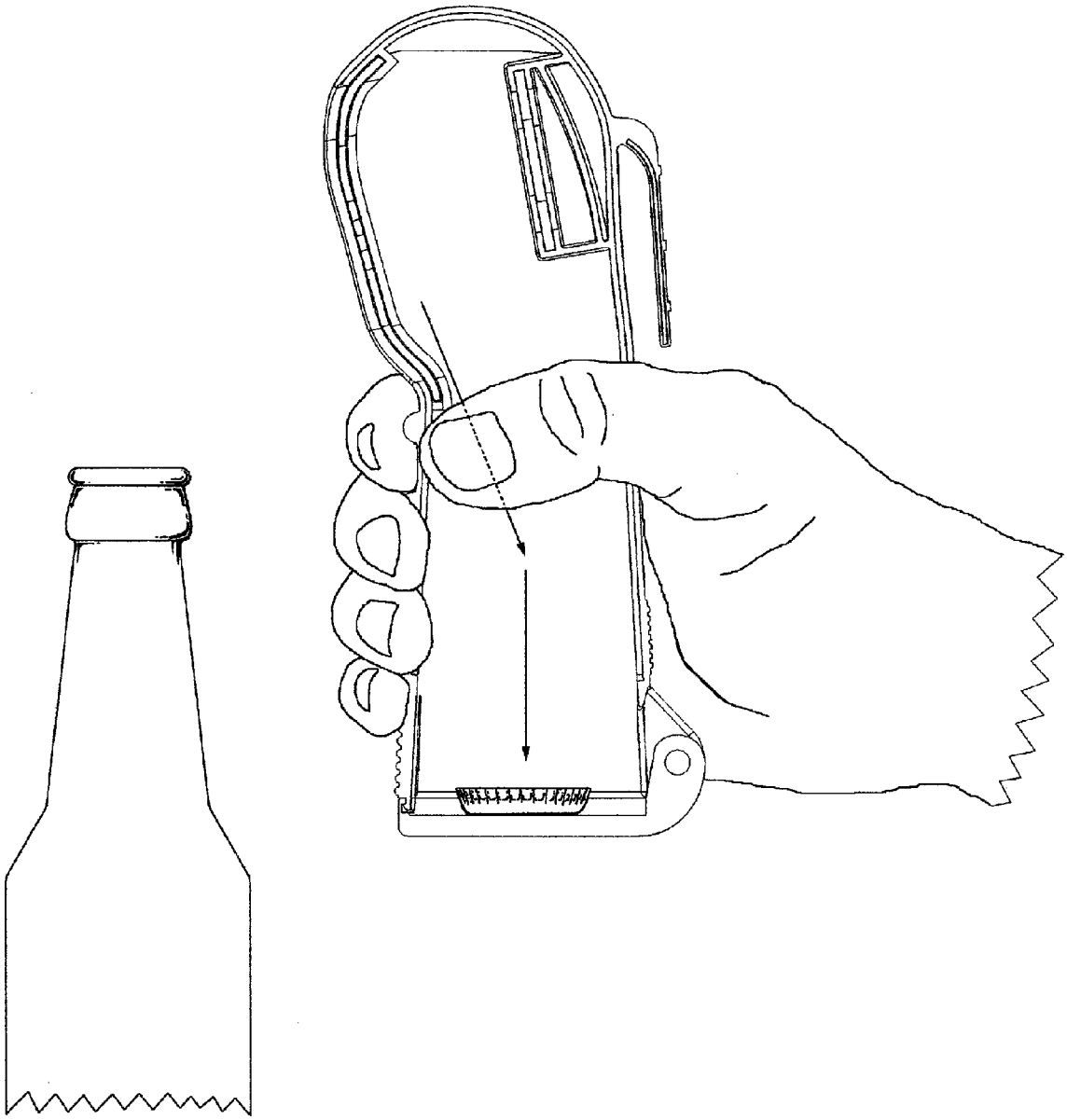
Figure 136:
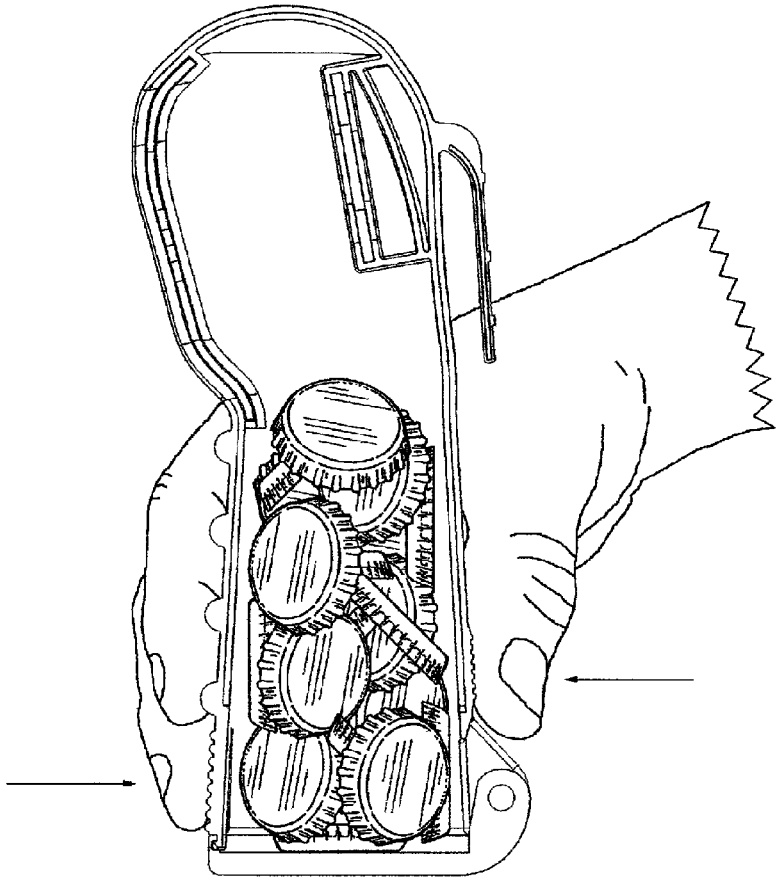
Figure 136:
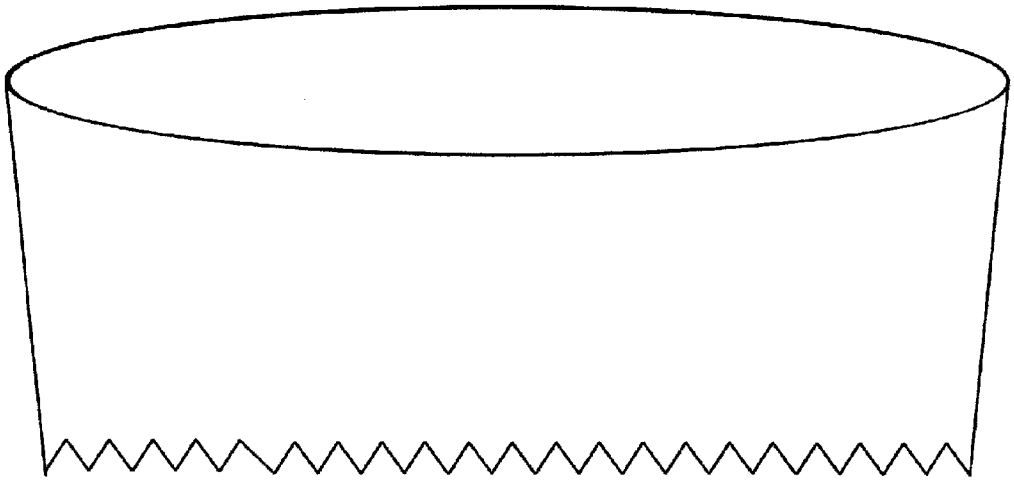
Figure 137:
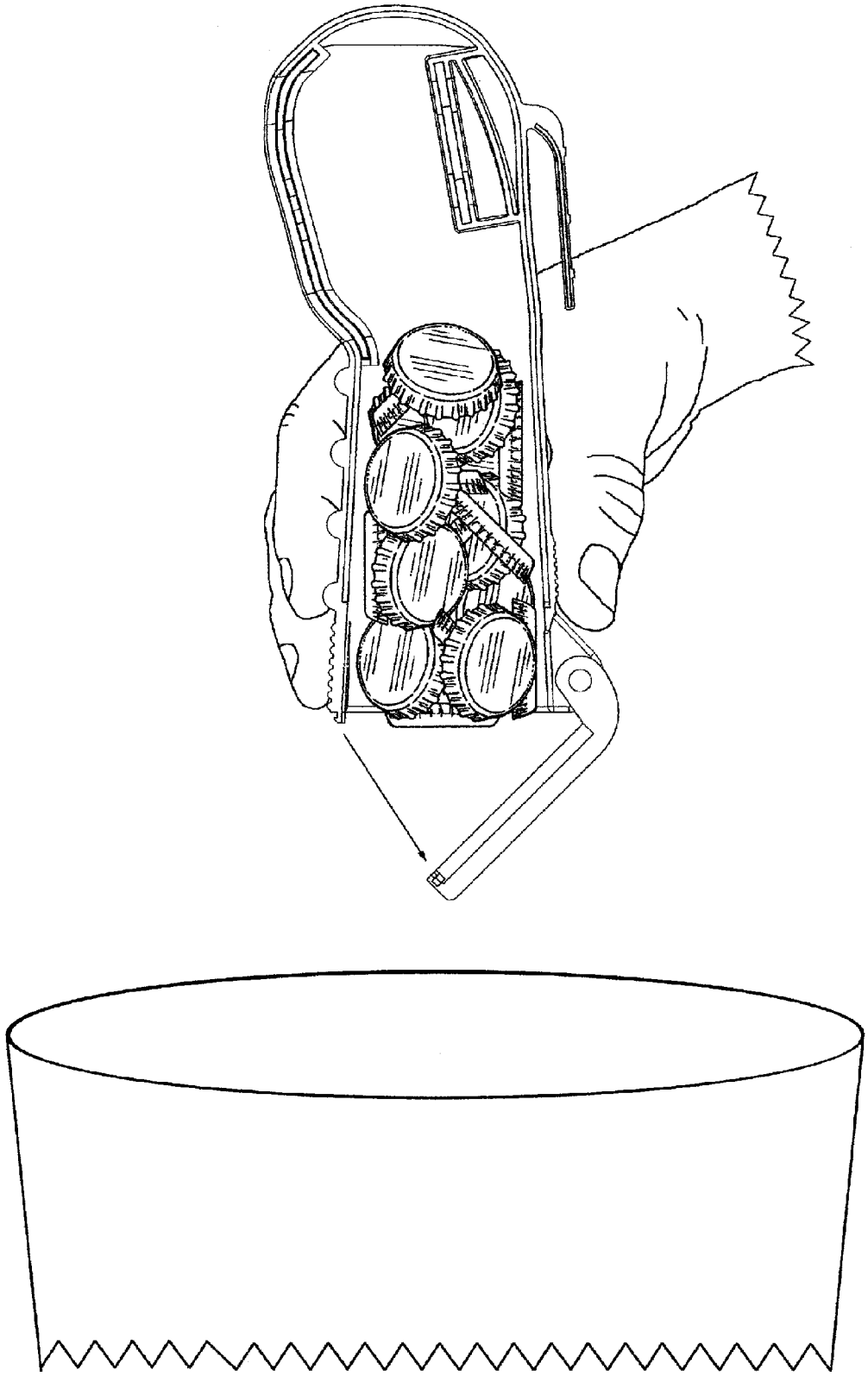
Figure 138:
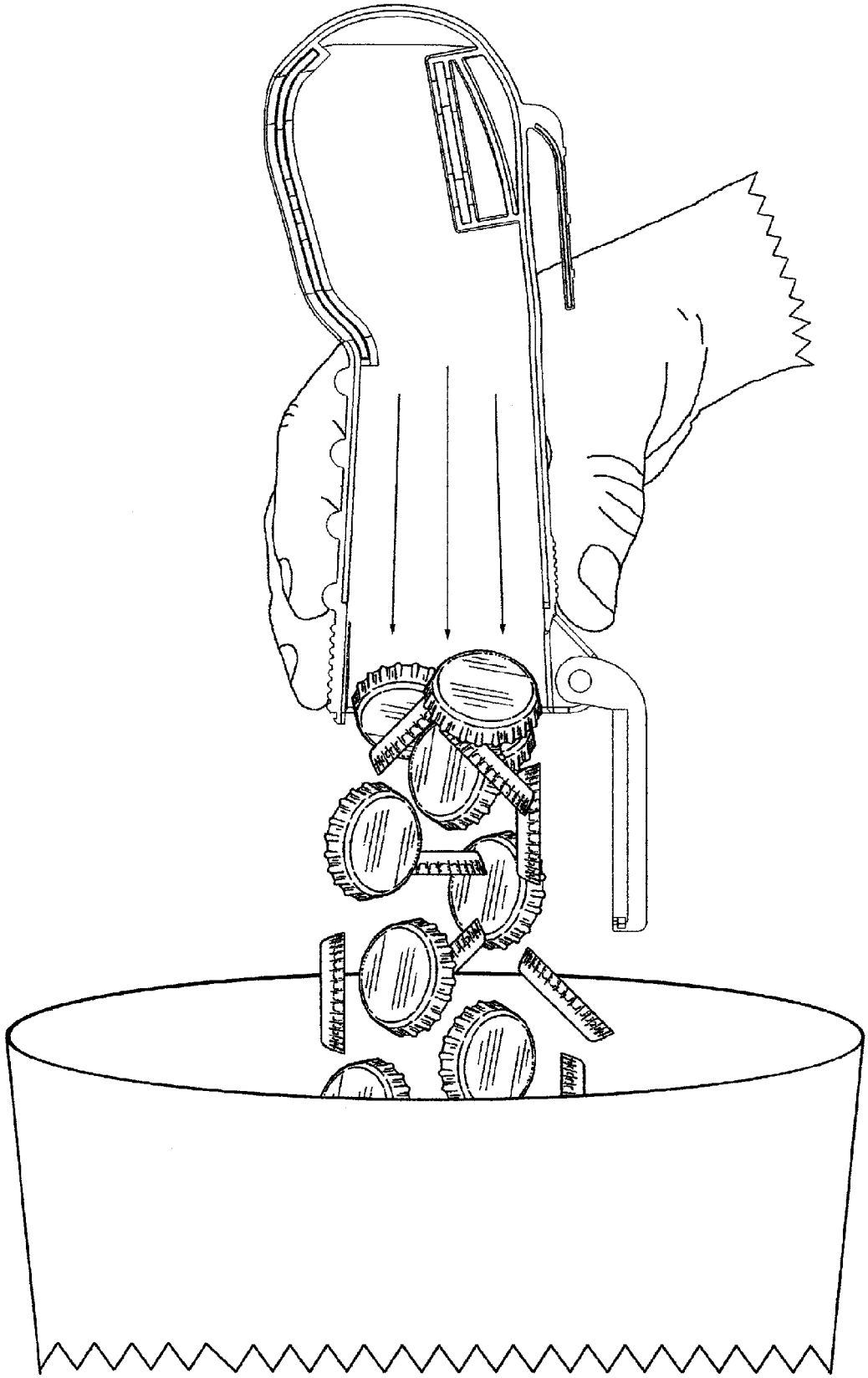
Figure 139:
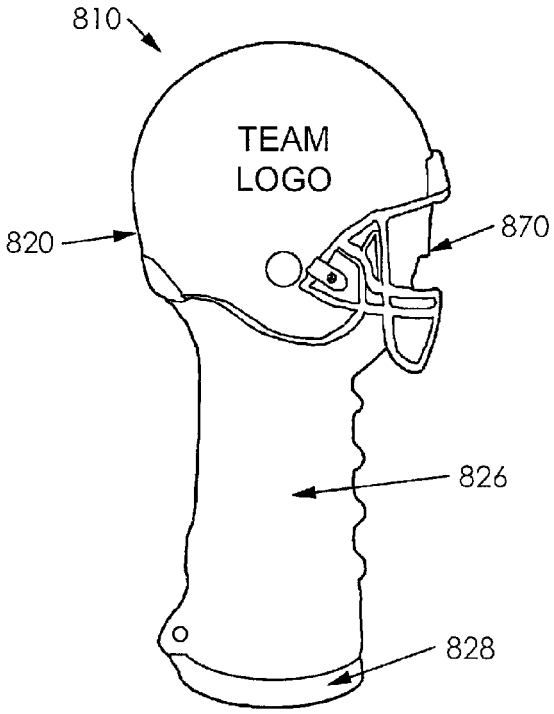
Figure 140:
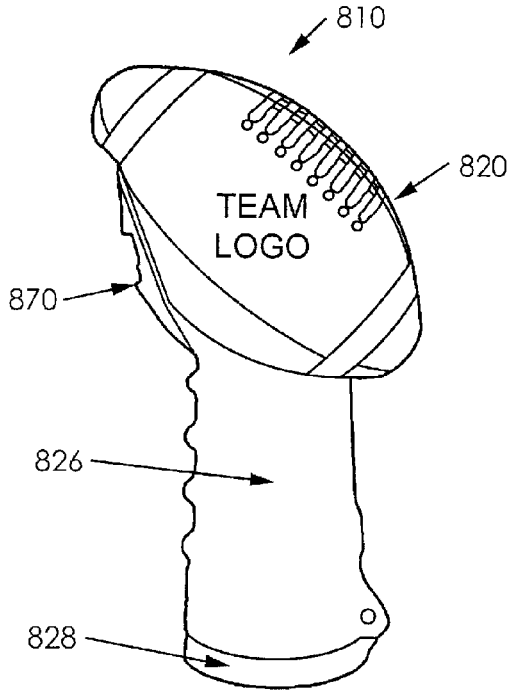
Figure 141:
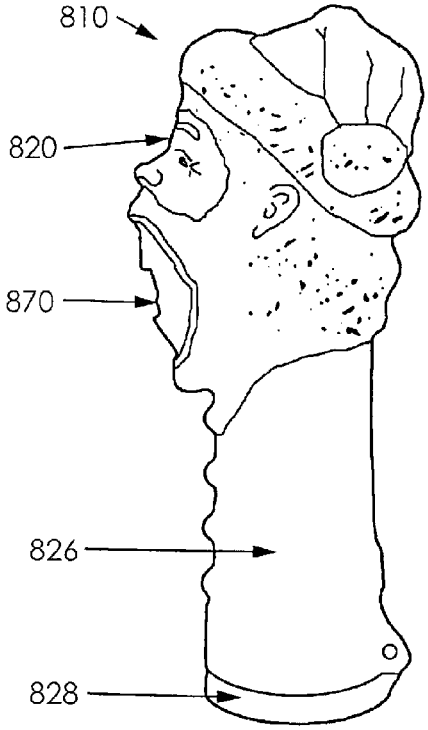
Figure 142:
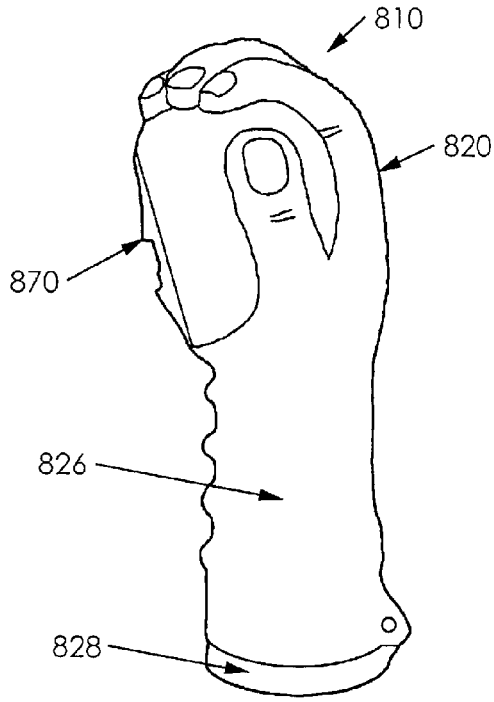

FIG. 132 is an inside cut-away view of step 4 of the bottle opening and bottle cap collecting procedure using design variation 7;

FIG. 133 is an inside cut-away view of step 5 of the bottle opening and bottle cap collecting procedure using design variation 7;

FIG. 134 is an inside cut-away view of step 6 of the bottle opening and bottle cap collecting procedure using design variation 7;

FIG. 135 is an inside cut-away view of step 7 of the bottle opening and bottle cap collecting procedure using design variation 7;

FIG. 136 is an inside cut-away view of step 1 of the bottle cap disposing procedure using design variation 7;

FIG. 137 is an inside cut-away view of step 2 of the bottle cap disposing procedure using design variation 7;

FIG. 138 is an inside cut-away view of step 3 of the bottle cap disposing procedure using design variation 7;

FIG. 139 is a right side view of an alternate exterior design of a bottle opener and bottle cap collecting and disposing device in accordance with the present invention;

FIG. 140 is a left side view of an alternate exterior design of a bottle opener and bottle cap collecting and disposing device in accordance with the present invention;

FIG. 141 is a left side view of an alternate exterior design of a bottle opener and bottle cap collecting and disposing device in accordance with the present invention; and FIG. 142 is a left side view of an alternate exterior design of a bottle opener and bottle cap collecting and disposing device in accordance with the present invention.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

With references initially to FIG. 1, FIG. 2, FIG. 3, FIG. 4 and FIG. 5, design variation 1 of a bottle opener and bottle cap collecting and disposing device 110, in accordance with the present invention, comprises a housing 120 connecting all components of design variation 1. A bottle cap collection chamber 126 is used to store bottle caps. Two vertical, one-way, spring-loaded doors 124 are used to allow a bottle cap to enter into the collection chamber 126, but also prevent a bottle cap from exiting out of the collection chamber 126. The left door 124*a* and the right door 124*b* are similar in size and shape. A moveable assembly 140 of a spring 142 connected from a metal piece shaped for opening bottles 130 to a belt 144 which is extended out of the back of the housing 120 is guided downward by tracks 122 using a thumb grip 148. The left track 122*a* and the right track 122*b* are similar in size and shape. A magnet 146 connected to the front, underside of a belt 144 is used to hold a bottle cap in place during movement of the moveable assembly 140 through the doors 124. Brackets 152 are used to fasten and allow rolling of a free-rolling, rod-shaped piece 154 underneath the belt 144 which will allow steady movement of the moveable assembly 140. The left bracket 152*a* and the right bracket 152*b* are similar in size and shape. A button 127 is used to open the bottom door 128 which will allow the bottle caps to exit out of the collection chamber 126.

110—Design variation 1 of a bottle opener and bottle cap collecting and disposing device.

120—Housing connecting all components of design variation 1.

122—Tracks used to guide 148 straight down 120.

122*a*—Left track used to guide 148 straight down 120.

122*b*—Right track used to guide 148 straight down 120.

124—Vertical, one-way, spring-loaded doors used to allow a bottle cap to enter into 126 but also prevent a bottle cap from exiting out of 126.

124*a*—Left vertical, one-way, spring-loaded door used to allow a bottle cap to enter into 126 but also prevent a bottle cap from exiting out of 126.

124*b*—Right vertical, one-way, spring-loaded door used to allow a bottle cap to enter into 126 but also prevent a bottle cap from exiting out of 126.

126—The bottle cap collection chamber used to store bottle caps.

127—Button used to open 128 to release bottle caps from 126.

128—Door used to prevent bottle caps from falling out of 126 until 127 is pressed.

130—Metal piece shaped for opening bottles.

140—Assembly of 142, 144, 146 and 148 to move the bottle cap from 130 to 126.

142—A spring connected from 130 to 144 to draw back 140 to its original position after the bottle cap is behind 124.

144—A belt connected to 142 extended out of the back of 120 and guided by 122.

146—A magnet connected to the front, underside of 144 used to hold a bottle cap in place for movement through 124.

148—A thumb grip used to allow easy movement of 144 guided down by 122.

152—Brackets used to fasten and allow rolling of 154 underneath 144.

152*a*—Left bracket used to fasten and allow rolling of 154 underneath 144.

152*b*—Right bracket used to fasten and allow rolling of 154 underneath 144.

154—A free-rolling, rod-shaped piece held in place by 152 allowing steady movement of 140.

As illustrated with references to FIG. 6, FIG. 7, FIG. 8, FIG. 9, FIG. 10, FIG. 11, FIG. 12, FIG. 13 and FIG. 14, design variation 2 of a bottle opener and bottle cap collecting and disposing device 210, in accordance with the present invention, comprises a housing 220 connecting all components of design variation 2. A bottle cap collection chamber 226 is used to store bottle caps. A curved, ramp-shaped piece 224 molded into the housing 220 is designed to separate a bottle cap from the location where a magnet 246 connected to the front, underside of a long, belt-shaped piece 244 is moved back by using the thumb grip 248. The housing 220 provides a comfortable grip to the user with the first finger grip ridge 225*a*, the second finger grip ridge 225*b*, the third finger grip ridge 225*c*, the fourth finger grip ridge 225*d* and the fifth finger grip ridge 225*e*. The location where the metal piece shaped for opening bottles resides 232 is also the opening where the bottle caps will enter the housing 220. The location of the bottom door 228 is where the bottle caps will exit the housing 220.

210—Design variation 2 of a bottle opener and bottle cap collecting and disposing device.

220—Housing connecting all components of design variation 2.

224—A curved, ramp-shaped piece molded into 220 designed to separate a bottle cap from the magnet attached to 246 by using 248 to move 244.

225*a*—First finger grip ridge used to provide a comfortable grip to the user.

225*b*—Second finger grip ridge used to provide a comfortable grip to the user.

225*c*—Third finger grip ridge used to provide a comfortable grip to the user.

225*d*—Fourth finger grip ridge used to provide a comfortable grip to the user.

225*e*—Fifth finger grip ridge used to provide a comfortable grip to the user.

226—The bottle cap collection chamber used to store bottle caps.

228—Location where door used to prevent bottle caps from falling out resides.

232—Location where metal piece shaped for opening bottles resides.

244—A long, belt-shaped piece used to connect 248 to 246.

246—Location where a magnet connected to the front, underside is used to hold a bottle cap in place until its separation at 224 takes place.

248—A thumb grip used to allow easy movement of 244 guided down by 220.

As illustrated with references to FIG. 15, FIG. 16, FIG. 17, FIG. 18, FIG. 19, FIG. 20, FIG. 21, FIG. 22 and FIG. 23, design variation 3 of a bottle opener and bottle cap collecting and disposing device 310, in accordance with the present invention, comprises a housing 320 connecting all components of design variation 3. A bottle cap collection chamber 326 is used to store bottle caps. A metal piece shaped for opening bottles 330 is securely fastened at the location where the metal piece shaped for opening bottles resides 332. A triangle-shaped ramp piece 324 molded into the housing 320 is designed to separate a bottle cap 345 from the location where a magnet 346 connected to the front, underside of a long, belt-shaped piece 344 is moved back by using the thumb grip 348. A pressure sensitive button-like shape with latch 327 is used to open the bottom door 328 which prevents bottle caps from falling out of the collection chamber 326. A spring-loaded hinge 329 connecting the housing 320 to the bottom door 328, with resistance to the spring while the bottom door 328 is in the closed position, allows the bottom door 328 to open quickly after pressing the pressure sensitive button-like shape with latch 327.

310—Design variation 3 of a bottle opener and bottle cap collecting and disposing device.

320—Housing connecting all components of design variation 3.

324—A triangle-shaped ramp piece molded into 320 designed to separate a bottle cap or 345 from the magnet attached to 346 by using 348 to move 344.

326—The bottle cap collection chamber used to store bottle caps.

327—Pressure sensitive button-like shape with latch used to open 328 to release bottle caps from 326.

328—Door used to prevent bottle caps from falling out of 326 until 327 is pressed.

329—A spring-loaded hinge connecting 320 to 328 with resistance to the spring while 328 is in the closed position.

330—Metal piece shaped for opening bottles.

332—Location where metal piece shaped for opening bottles resides.

344—A long, belt-shaped piece used to connect 348 to 346.

345—A temporary piece representing a bottle cap.

346—A magnet connected to the front, underside of 344 used to hold a bottle cap or 345 in place until its separation at 324 takes place.

348—A thumb grip used to allow easy movement of 344 guided down by 320.

As illustrated with references to FIG. 24, FIG. 25, FIG. 26, FIG. 27, FIG. 28, FIG. 29, FIG. 30, FIG. 31 and FIG. 32, design variation 4 of a bottle opener and bottle cap collecting and disposing device 410, in accordance with the present invention, comprises a housing 420 connecting all components of design variation 4. A bottle cap collection chamber 426 is used to store bottle caps. A metal piece shaped for opening bottles 430 is securely fastened at the location where the metal piece shaped for opening bottles resides 432. The location of flexible doors 424 used to prevent bottle caps from passing back through the opening of the housing 420 after the user separates the bottle cap from the bottle using the metal piece shaped for opening bottles 430 is also the opening where the top and neck of a bottle is inserted into the housing 420. The location of the left flexible door 424*a* and the location of the right flexible door 424*b* are similar in size and shape. A finger grip ridge 425 molded onto the housing 420 is used to provide a comfortable grip to the user. The first finger grip ridge 425*a*, the second finger grip ridge 425*b*, the third finger grip ridge 425*c* and the fourth finger grip ridge 425*d* are similar in size and shape. A pressure sensitive button-like shape with latch 427 is used to open the bottom door 428 which prevents bottle caps from falling out of the collection chamber 426. A spring-loaded hinge 429 connecting the housing 420 to the bottom door 428, with resistance to the spring while the bottom door 428 is in the closed position, allows the bottom door 428 to open quickly after pressing the pressure sensitive button-like shape with latch 427.

410—Design variation 4 of a bottle opener and bottle cap collecting and disposing device.

420—Housing connecting all components of design variation 4.

424—Location of flexible door used to prevent bottle caps from passing back through the opening of 420 after the user separates the bottle cap from the bottle using 430.

424*a*—Location of left flexible door used to prevent bottle caps from passing back through the opening of 420 after the user separates the bottle cap from the bottle using 430.

424*b*—Location of right flexible door used to prevent bottle caps from passing back through the opening of 420 after the user separates the bottle cap from the bottle using 430.

425—Finger grip ridge used to provide a comfortable grip to the user.

425*a*—First finger grip ridge used to provide a comfortable grip to the user.

425*b*—Second finger grip ridge used to provide a comfortable grip to the user.

425*c*—Third finger grip ridge used to provide a comfortable grip to the user.

425*d*—Fourth finger grip ridge used to provide a comfortable grip to the user.

426—The bottle cap collection chamber used to store bottle caps.

427—Pressure sensitive button-like shape with latch used to open 428 to release bottle caps from 426.

428—Door used to prevent bottle caps from falling out of 426 until 427 is pressed.

429—A spring-loaded hinge connecting 420 to 428 with resistance to the spring while 428 is in the closed position.

430—Metal piece shaped for opening bottles.

432—Location where metal piece shaped for opening bottles resides.

As illustrated with references to FIG. 33, FIG. 34, FIG. 35, FIG. 36, FIG. 37, FIG. 38, FIG. 39, FIG. 40 and FIG. 41, design variation 5 of a bottle opener and bottle cap collecting and disposing device 510, in accordance with the present invention, comprises a housing 520 connecting all components of design variation 5. A bottle cap collection chamber 526 is used to store bottle caps. A belt clip 522 molded into the housing 520 allows the user to hook the bottle opener and bottle cap collecting and disposing device 510 onto his or her belt. A metal piece shaped for opening bottles 530 is securely fastened at the location where the metal piece shaped for opening bottles resides 532. The first extended rectangular-shaped piece 521*a*, the second extended rectangular-shaped piece 521*b*, the third extended rectangular-shaped piece 521*c* and the fourth extended rectangular-shaped piece 521*d* are all used to block the bottle cap from falling behind the metal piece shaped for opening bottles 530 after the bottle cap is separated from the bottle. The location of flexible doors 524 used to prevent bottle caps from passing back through the opening of the housing 520 after the user separates the bottle cap from the bottle using the metal piece shaped for opening bottles 530 is also the opening where the top and neck of a bottle is inserted into the housing 520. The location of the left flexible door 524*a* and the location of the right flexible door 524*b* are similar in size and shape. A finger grip ridge 525 molded onto the housing 520 is used to provide a comfortable grip to the user. The first finger grip ridge 525*a*, the second finger grip ridge 525*b*, the third finger grip ridge 525*c* and the fourth finger grip ridge 525*d* are similar in size and shape. A pressure sensitive button-like shape with latch 527 is used to open the bottom door 528 which prevents bottle caps from falling out of the collection chamber 526. A spring-loaded hinge 529 connecting the housing 520 to the bottom door 528, with resistance to the spring while the bottom door 528 is in the closed position, allows the bottom door 528 to open quickly after pressing the pressure sensitive button-like shape with latch 527. The location of the thumb-supported traction 523 is to be used to show where the placement of the thumb should be while pressing the pressure sensitive button-like shape with latch 527.

510—Design variation 5 of a bottle opener and bottle cap collecting and disposing device.

520—Housing connecting all components of design variation 5.

521*a*—First extended rectangular-shaped piece molded to 520 used to block the bottle cap from falling behind 530 after bottle and bottle cap separation.

521*b*—Second extended rectangular-shaped piece molded to 520 used to block the bottle cap from falling behind 530 after bottle and bottle cap separation.

521*c*—Third extended rectangular-shaped piece molded to 520 used to block the bottle cap from falling behind 530 after bottle and bottle cap separation.

521*d*—Fourth extended rectangular-shaped piece molded to 520 used to block the bottle cap from falling behind 530 after bottle and bottle cap separation.

522—A belt clip molded into 520 to allow the user to hook 510 onto belt.

523—Location of thumb-supported traction to be used while pressing 527.

524—Location of flexible door used to prevent bottle caps from passing back through the opening of 520 after the user separates the bottle cap from the bottle using 530.

524*a*—Location of left flexible door used to prevent bottle caps from passing back through the opening of 520 after the user separates the bottle cap from the bottle using 530.

524*b*—Location of right flexible door used to prevent bottle caps from passing back through the opening of 520 after the user separates the bottle cap from the bottle using 530.

525—Finger grip ridge used to provide a comfortable grip to the user.

525*a*—First finger grip ridge used to provide a comfortable grip to the user.

525*b*—Second finger grip ridge used to provide a comfortable grip to the user.

525*c*—Third finger grip ridge used to provide a comfortable grip to the user.

525*d*—Fourth finger grip ridge used to provide a comfortable grip to the user.

526—The bottle cap collection chamber used to store bottle caps.

527—Pressure sensitive button-like shape with latch used to open 528 to release bottle caps from 526.

528—Door used to prevent bottle caps from falling out of 526 until 527 is pressed.

529—A spring-loaded hinge connecting 520 to 528 with resistance to the spring while 528 is in the closed position.

530—Metal piece shaped for opening bottles.

532—Location where metal piece shaped for opening bottles resides.

Figure 1:
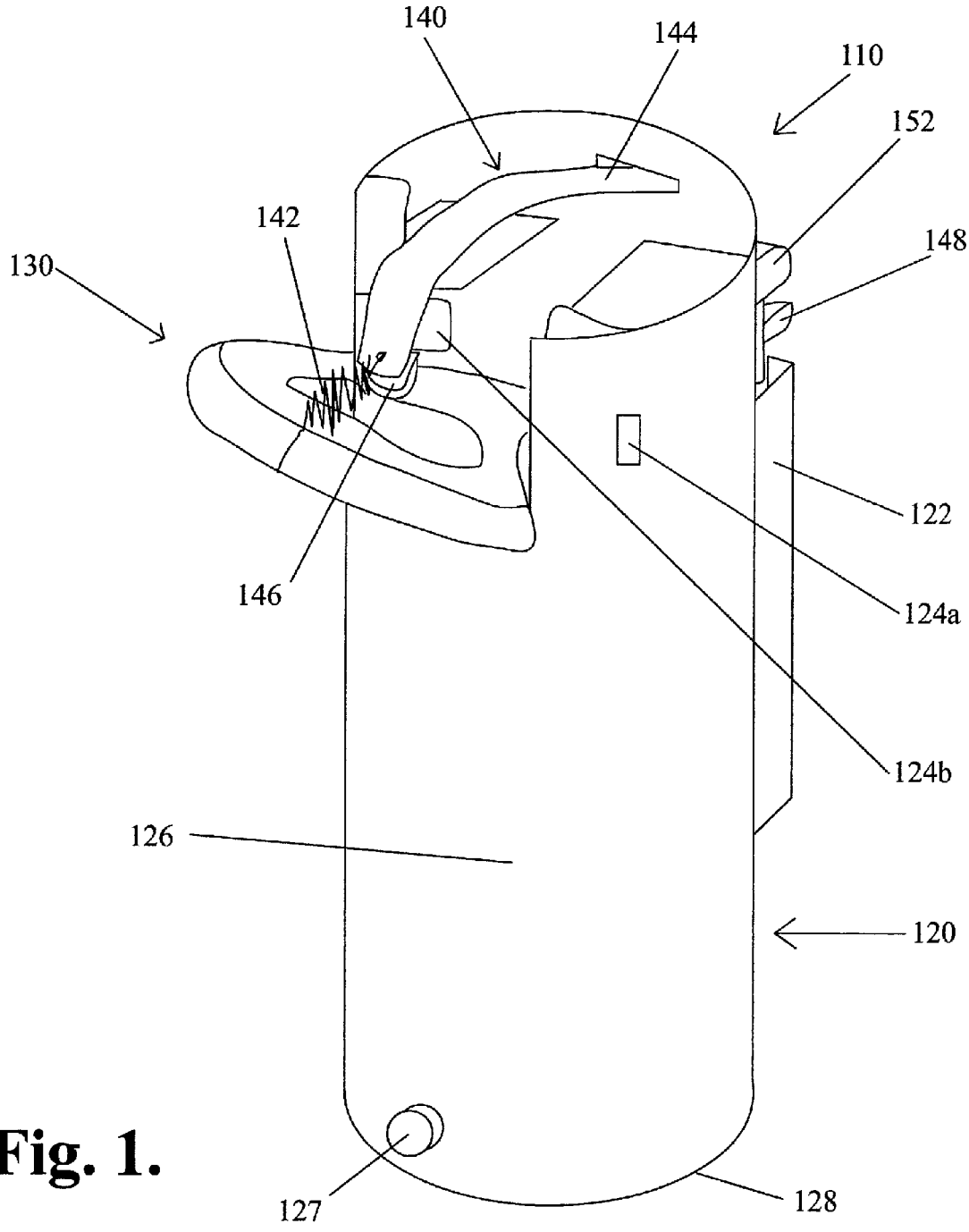
FIG. 1 is a front perspective view of design variation 1 of a bottle opener and bottle cap collecting and disposing device in accordance with the present invention.
Figure 2:
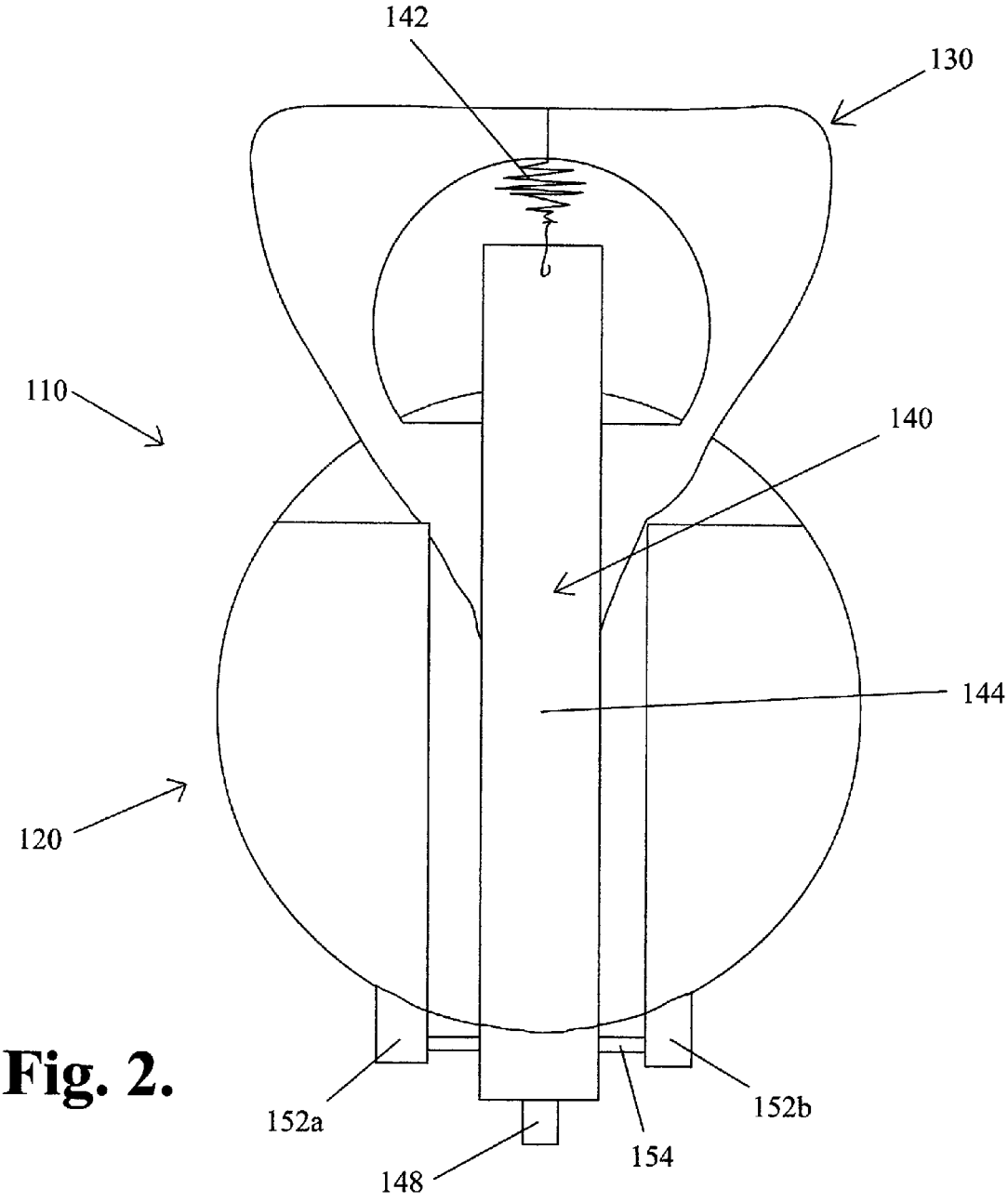
FIG. 2 is a top view of design variation 1.
Figure 3:
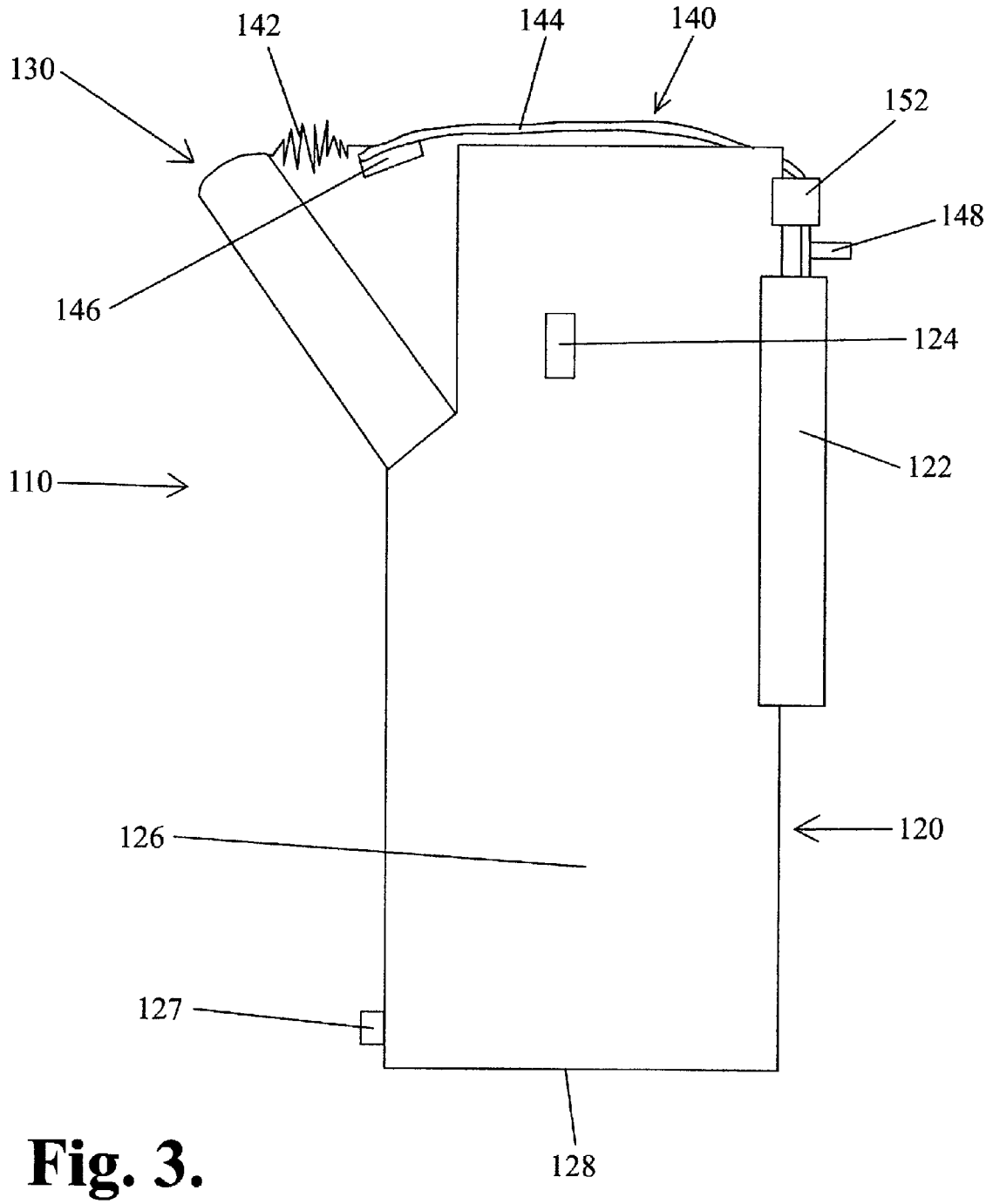
FIG. 3 is a side view of design variation 1.
Figure 4:
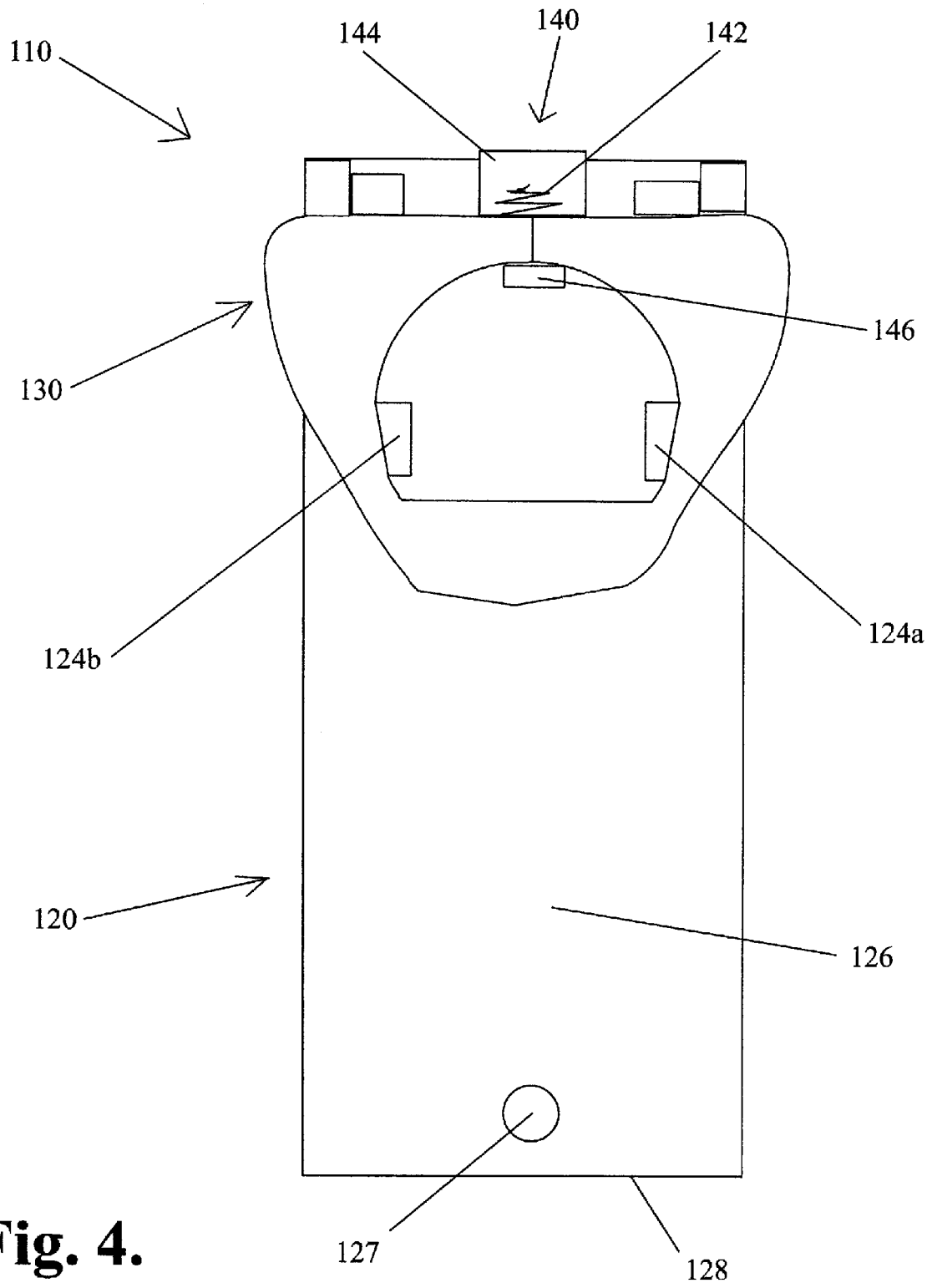
FIG. 4 is a front view of design variation 1.
Figure 5:
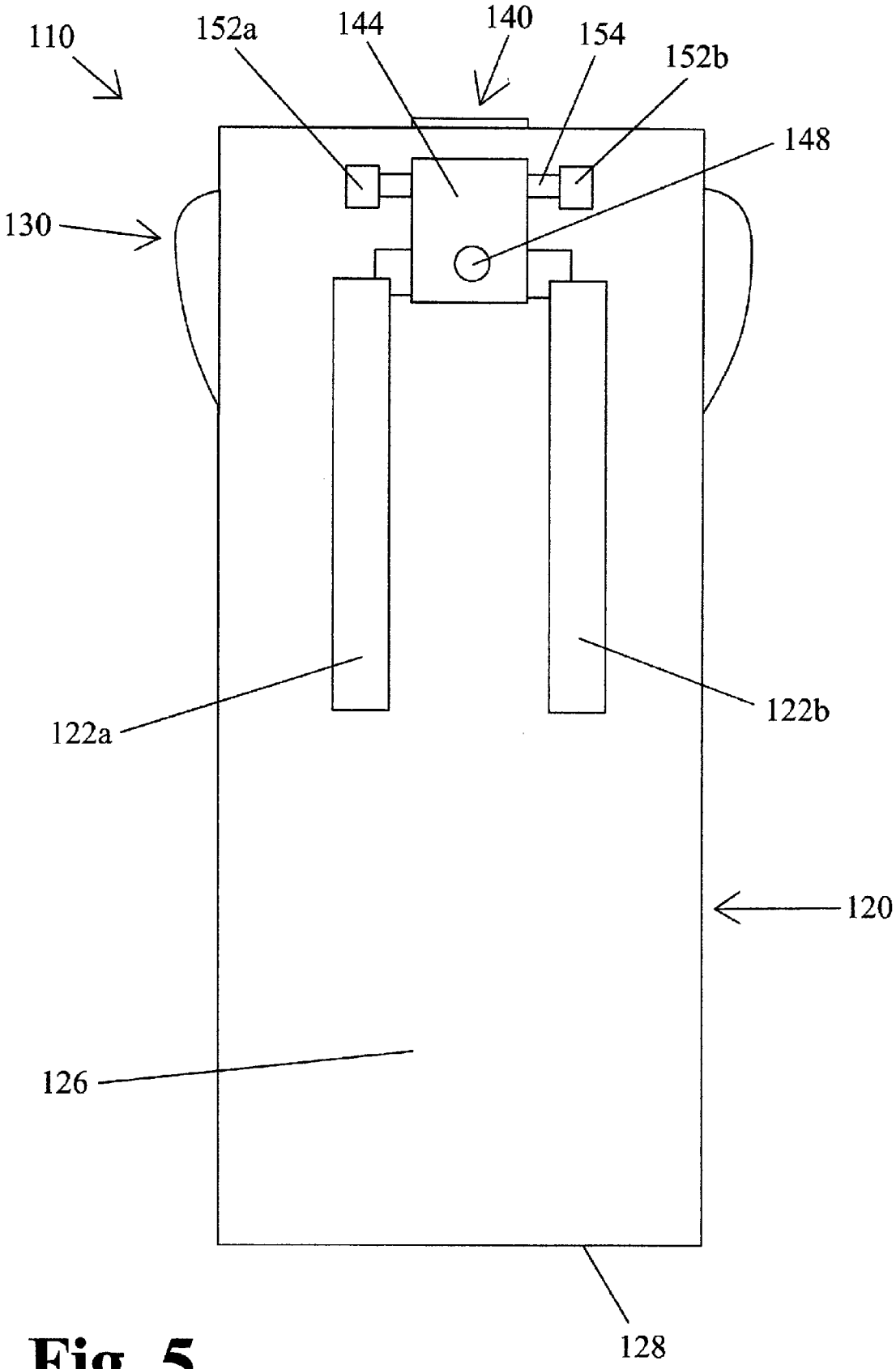
FIG. 5 is a back view of design variation 1.
Figure 6:
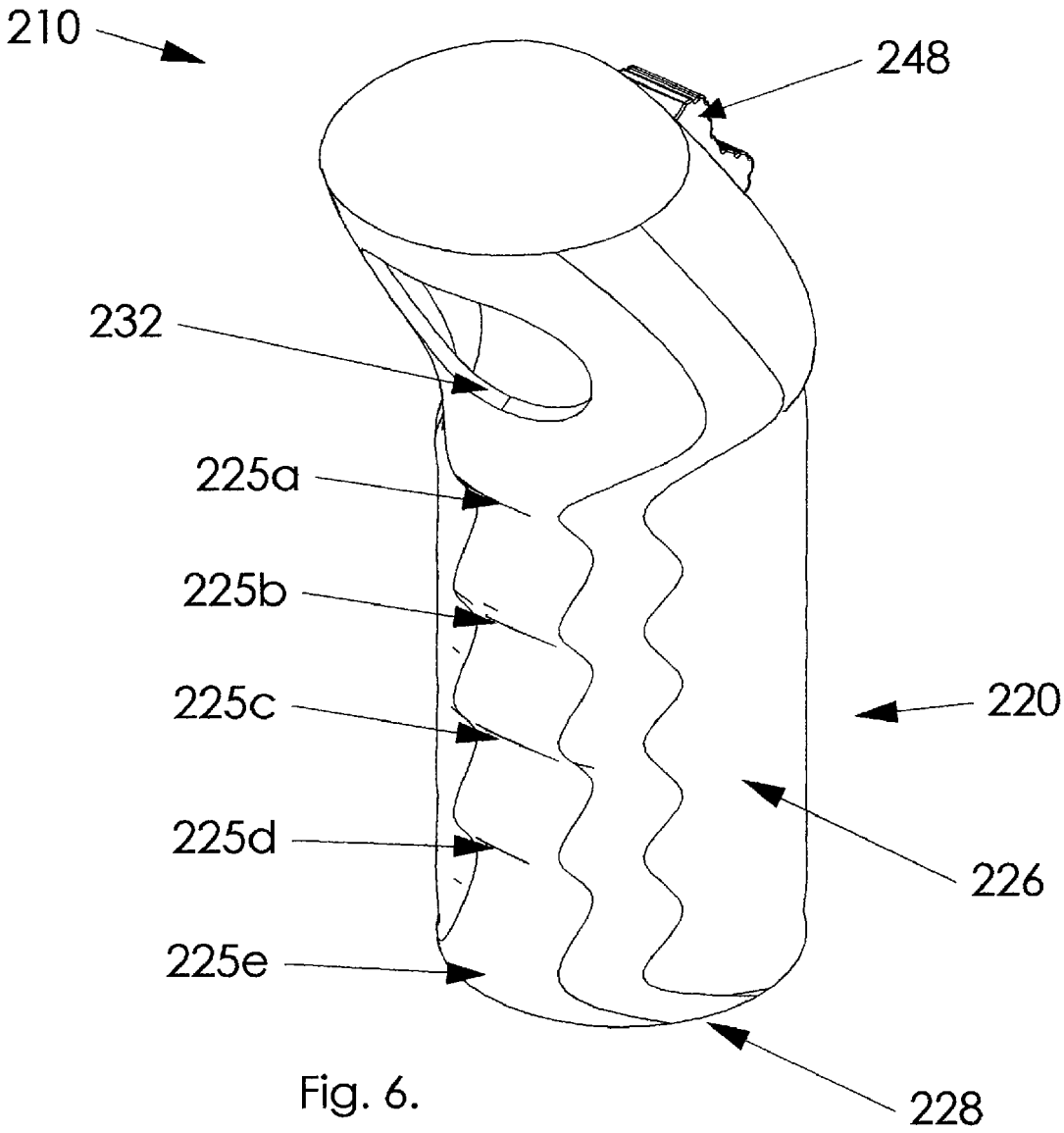
FIG. 6 is a front perspective view of design variation 2 of a bottle opener and bottle cap collecting and disposing device in accordance with the present invention.
Figure 7:
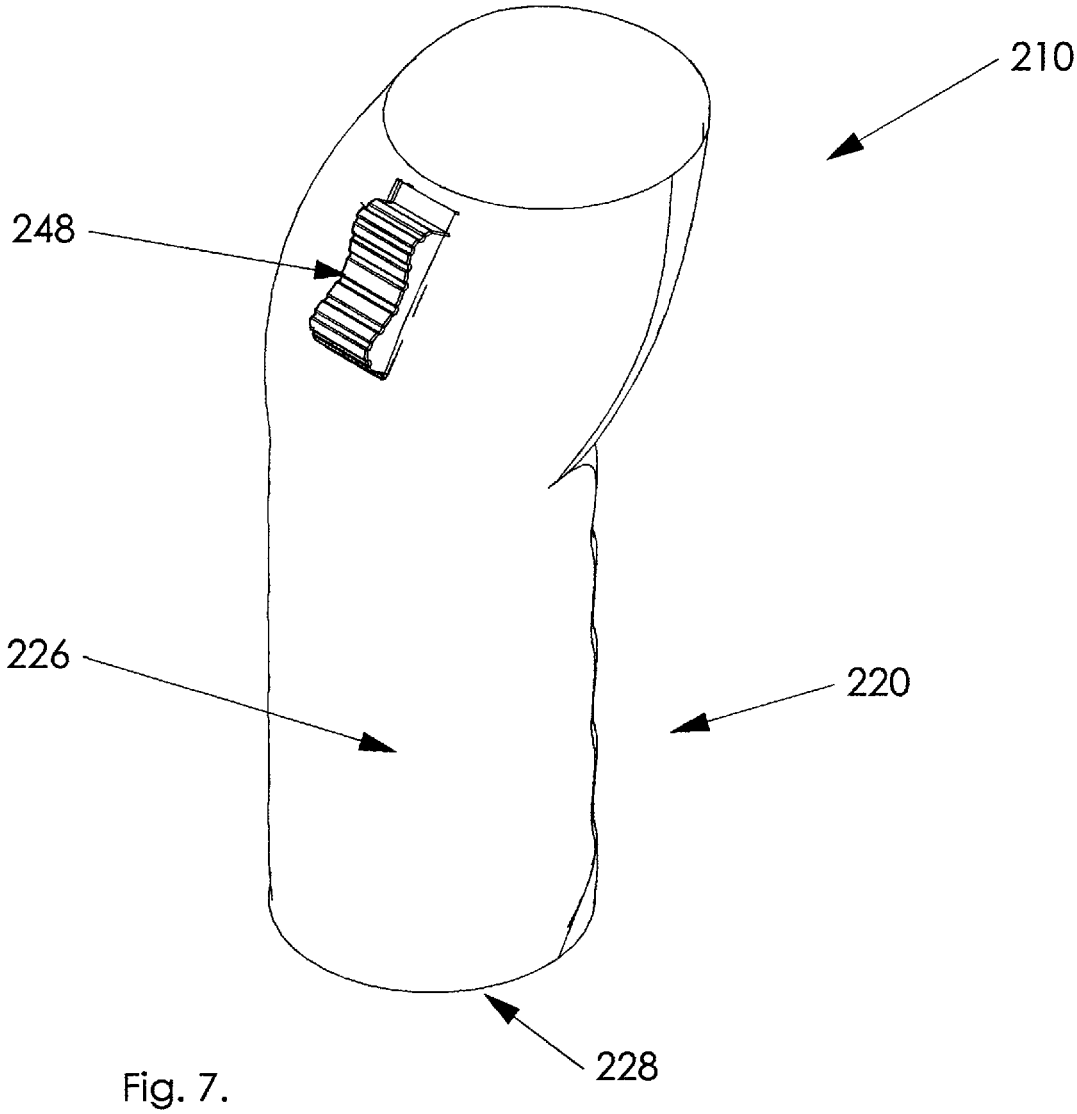
FIG. 7 is a back perspective view of design variation 2.
Figure 8:
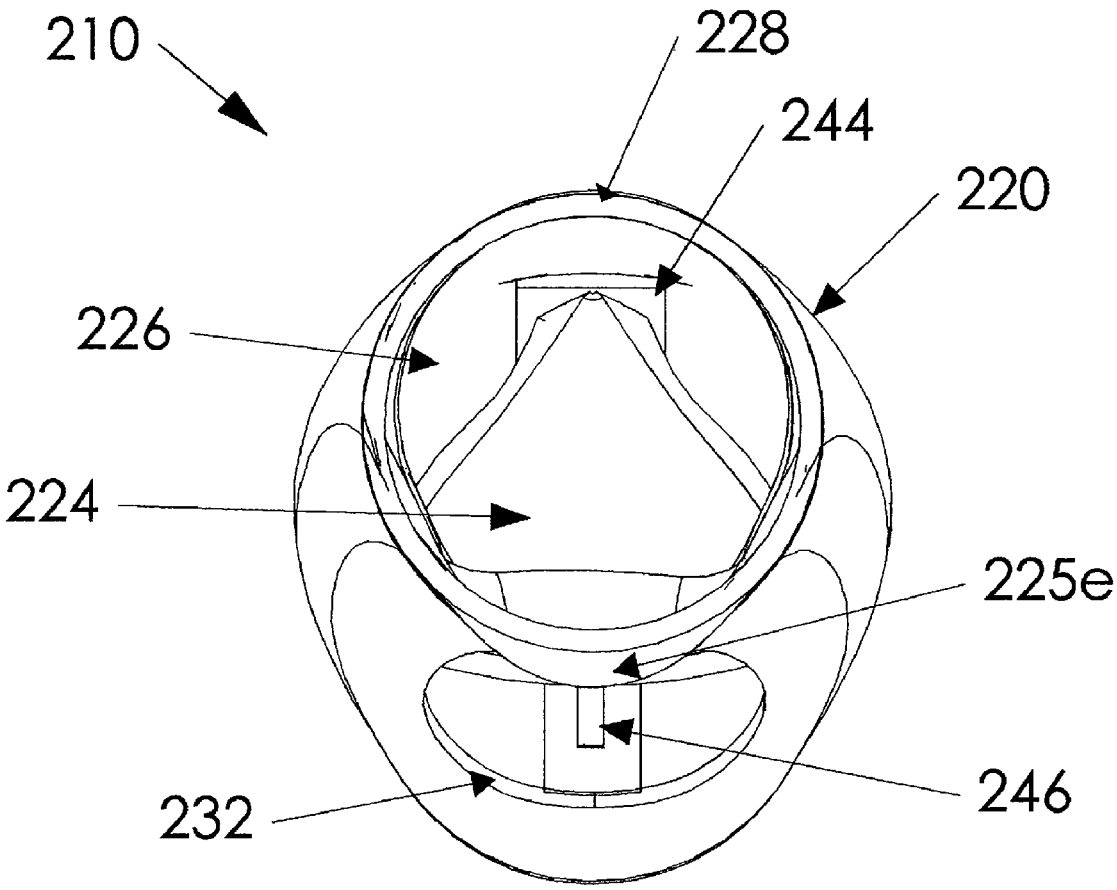
FIG. 8 is a bottom view of design variation 2.
Figure 9:
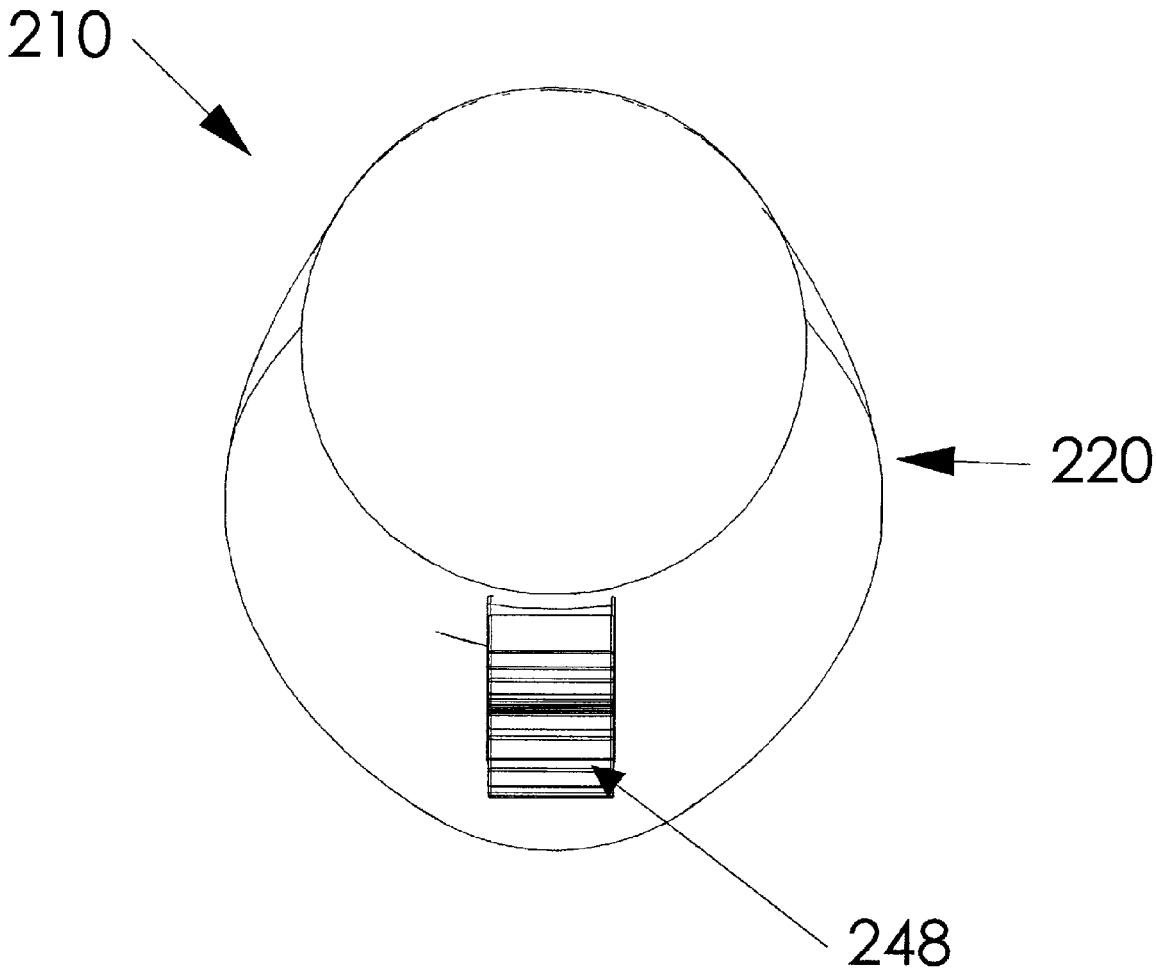
FIG. 9 is a top view of design variation 2.
Figure 10:
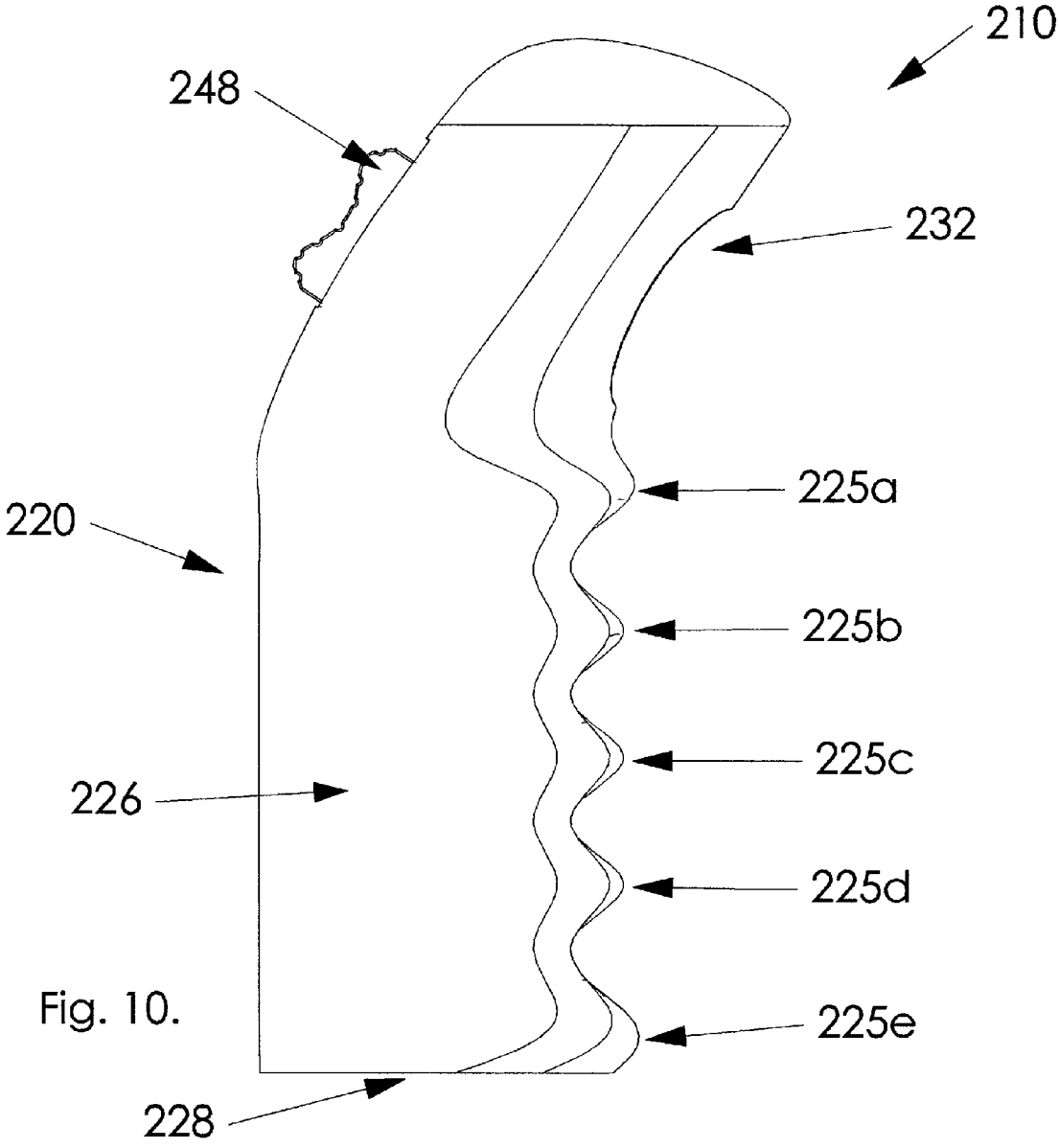
FIG. 10 is a right side view of design variation 2.
Figure 11:
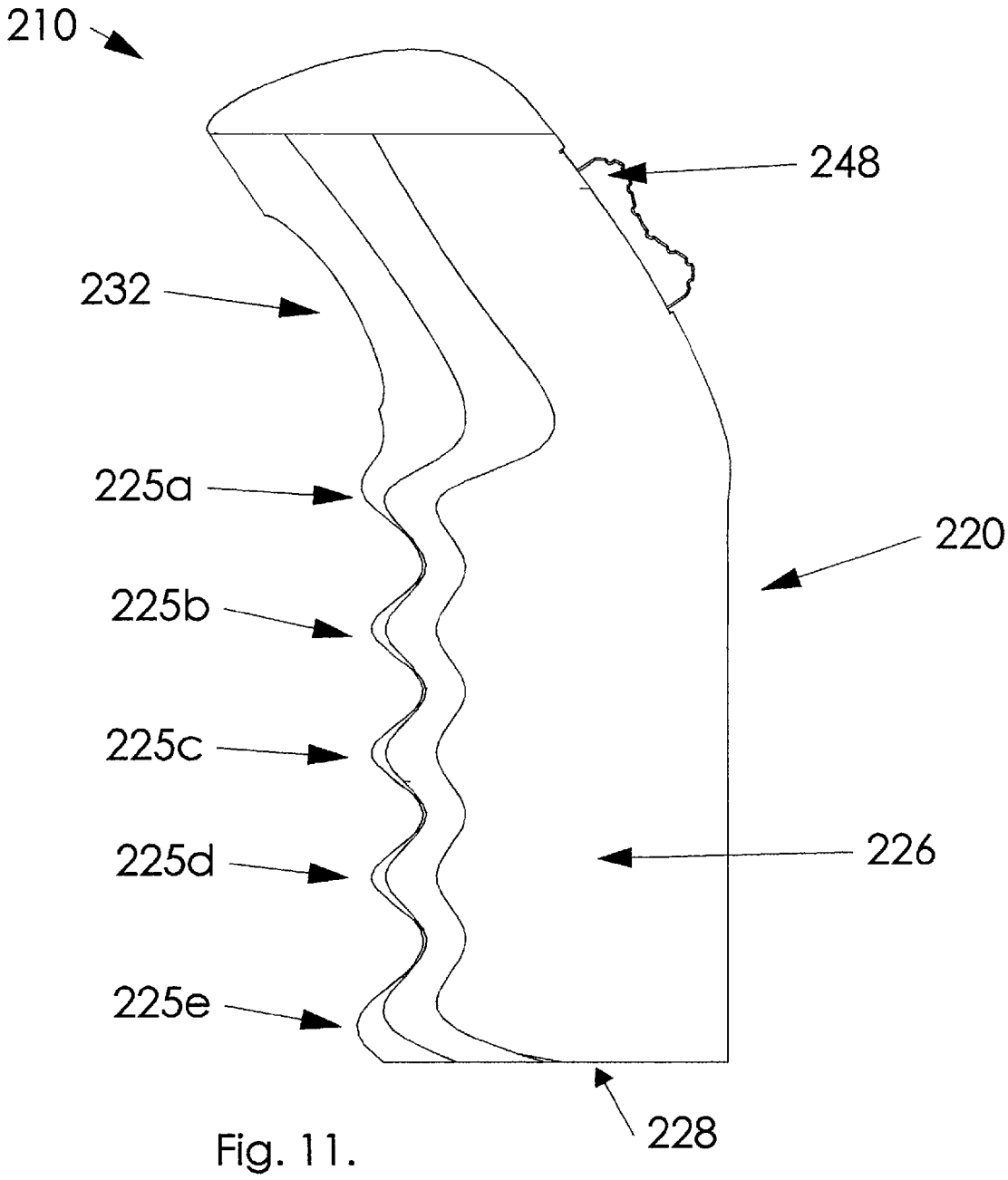
FIG. 11 is a left side view of design variation 2.
Figure 12:
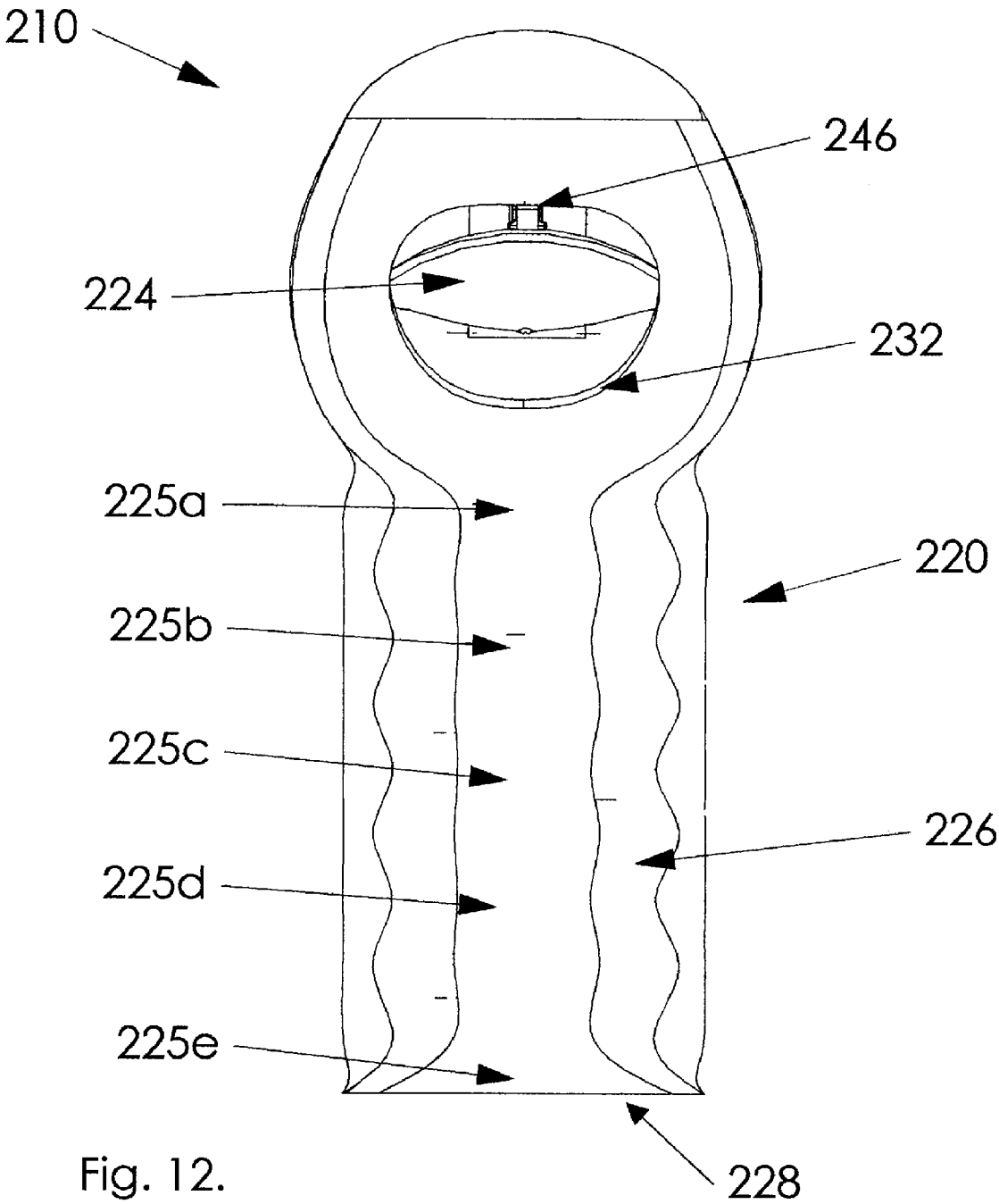
FIG. 12 is a front view of design variation 2.
Figure 13:
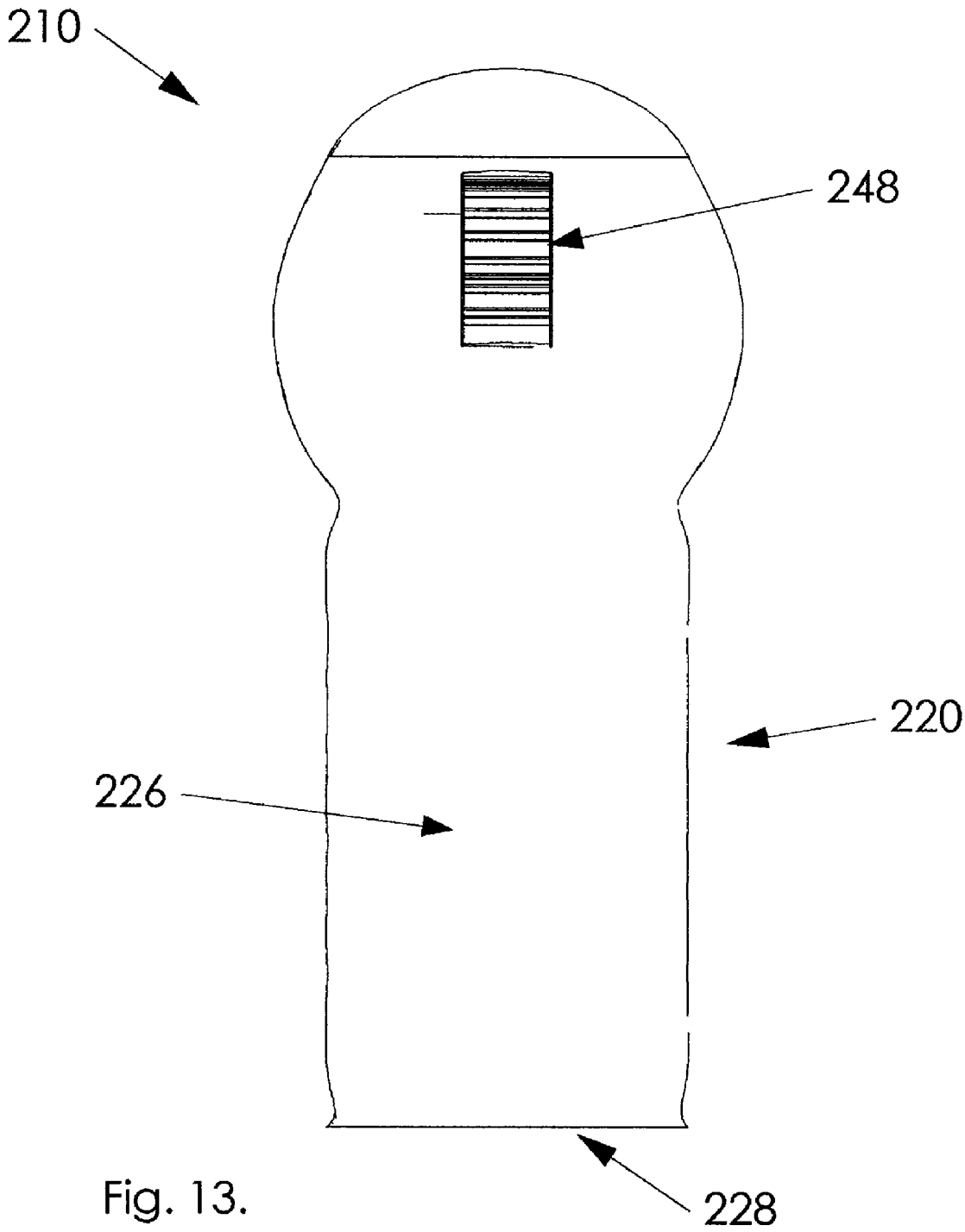
FIG. 13 is a back view of design variation 2.
Figure 14:
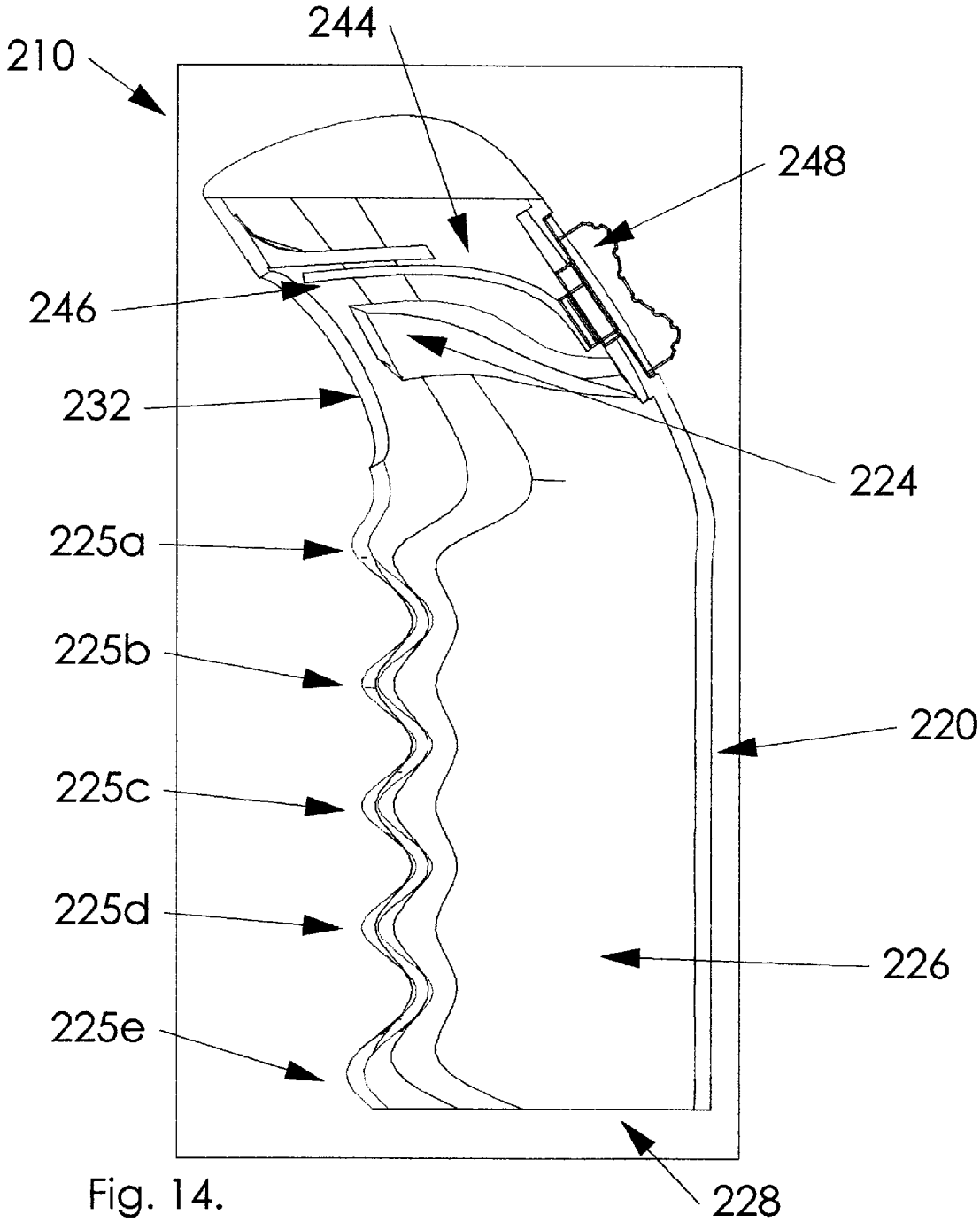
FIG. 14 is an inside cut-away view of design variation 2.
Figure 15:
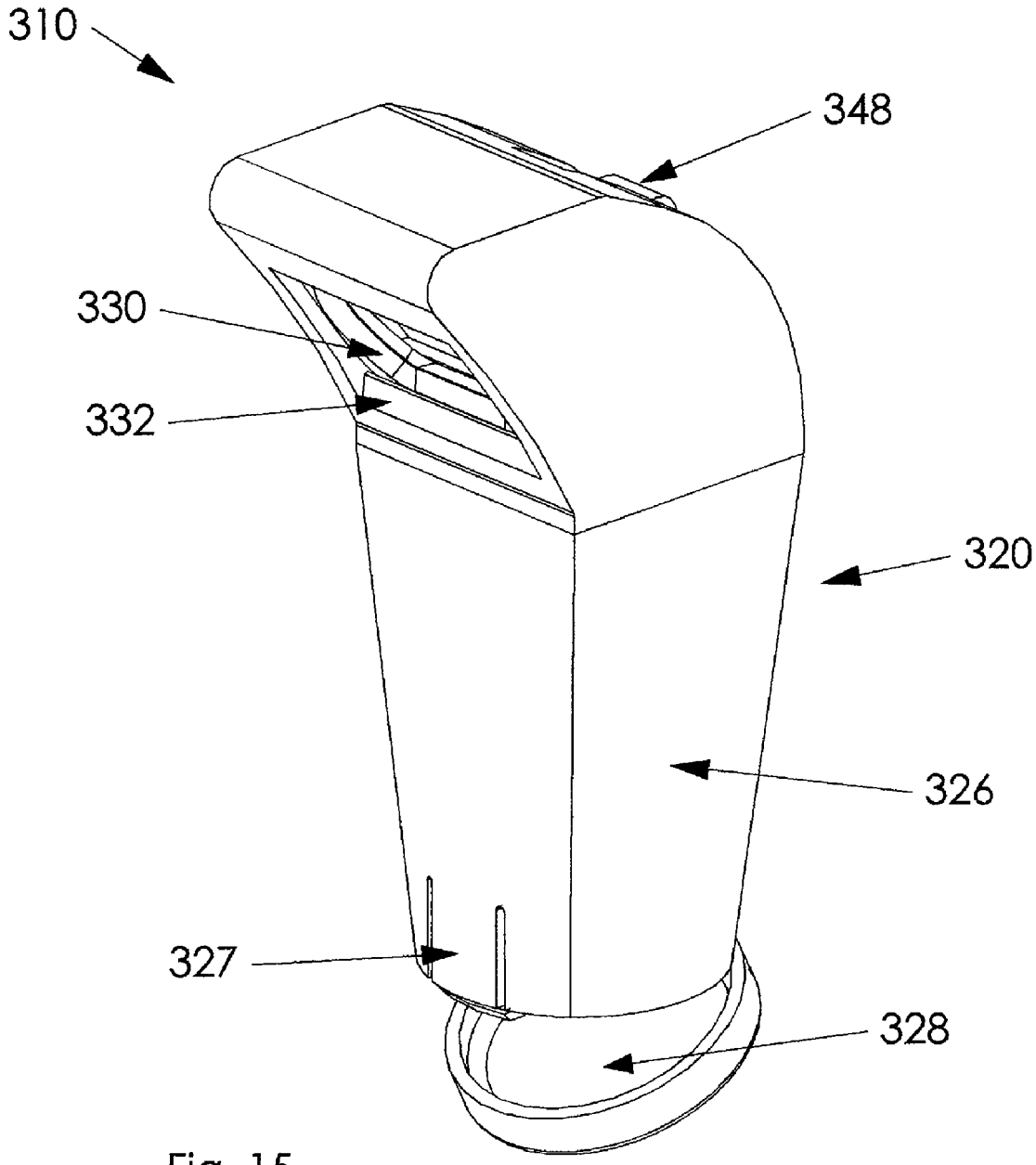
FIG. 15 is a front perspective view of design variation 3 of a bottle opener and bottle cap collecting and disposing device in accordance with the present invention.
Figure 16:
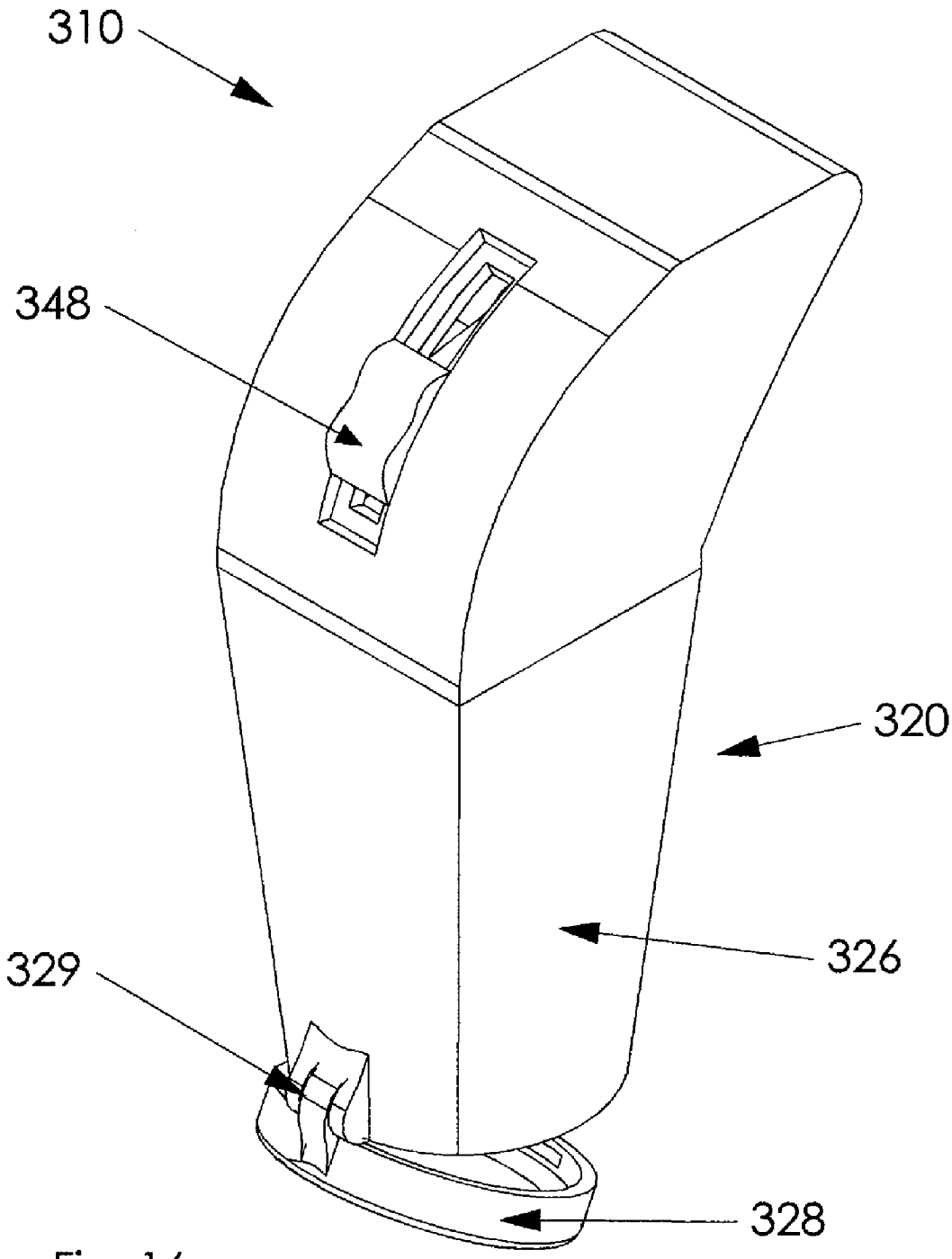
FIG. 16 is a back perspective view of design variation 3.
Figure 17:
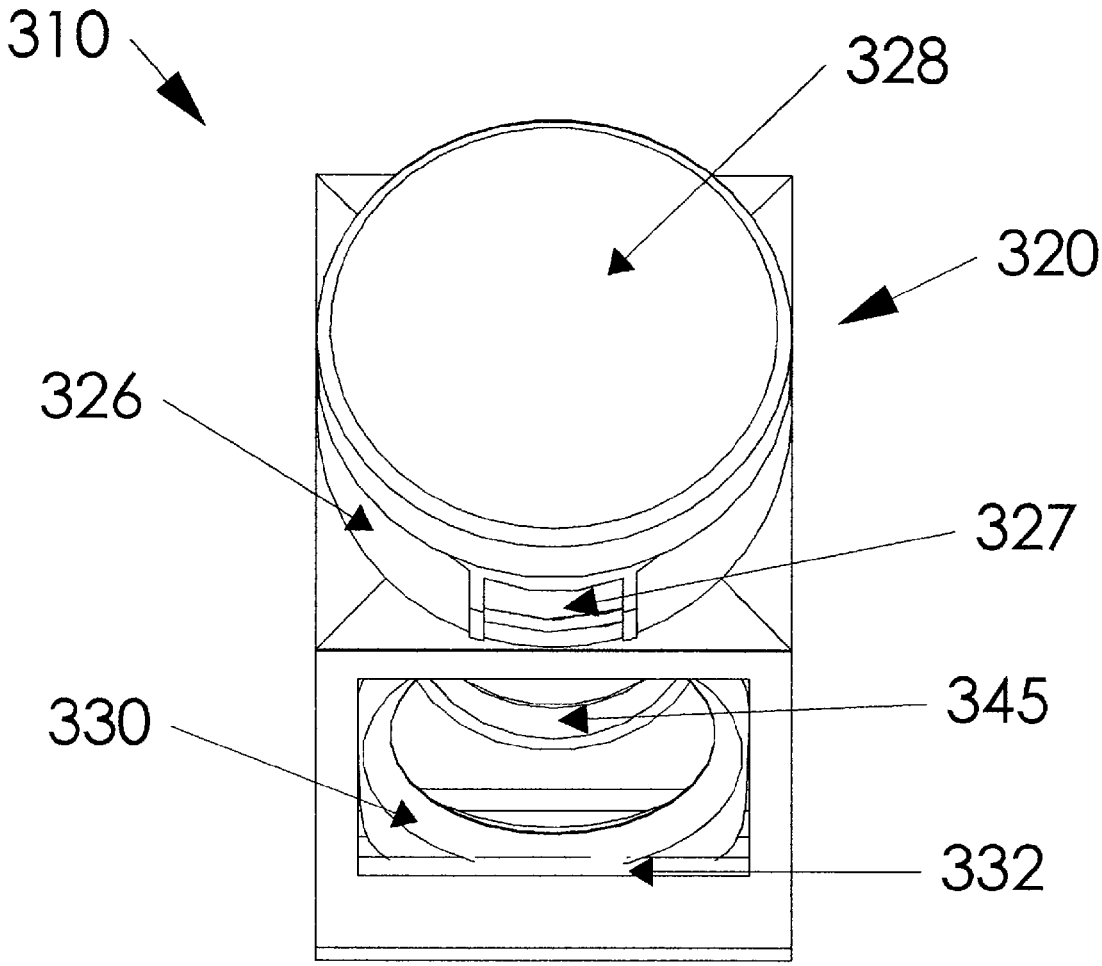
FIG. 17 is a bottom view of design variation 3.
Figure 18:
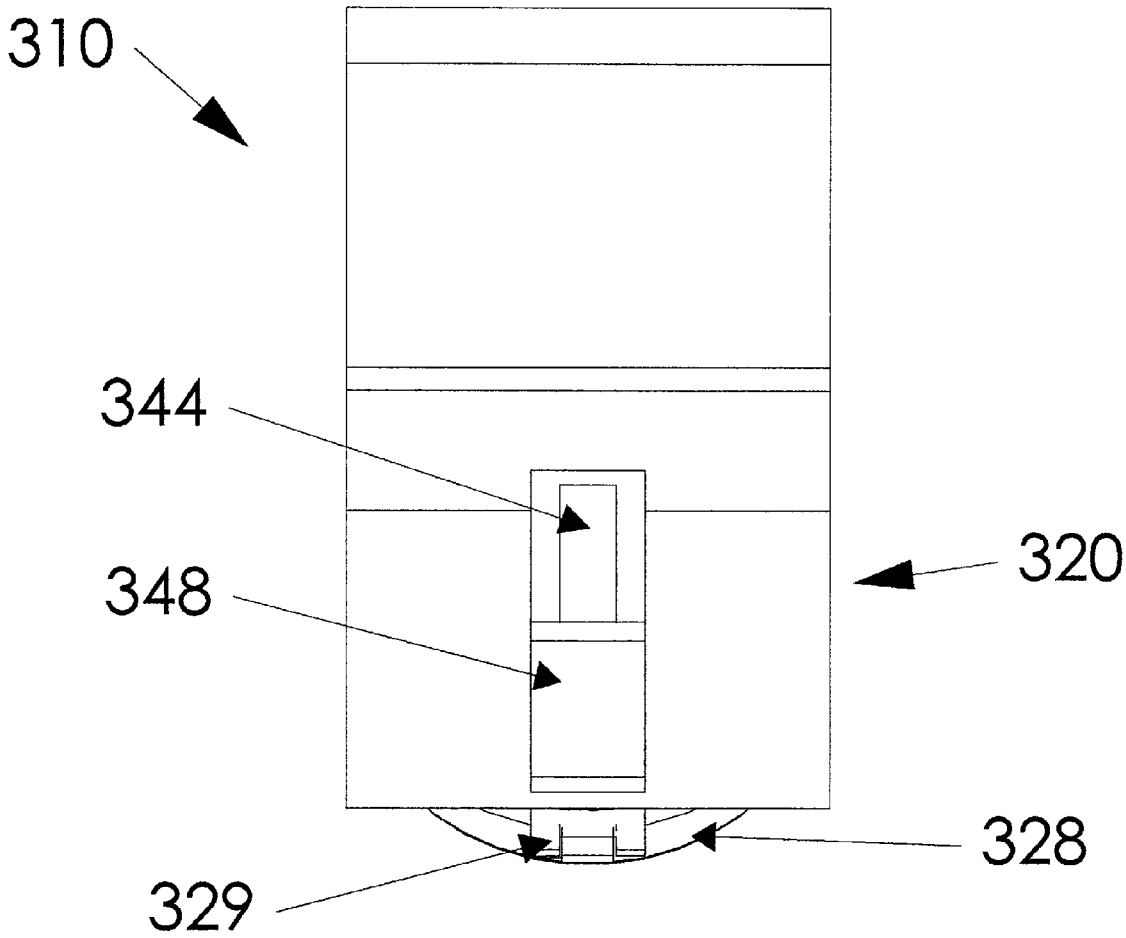
FIG. 18 is a top view of design variation 3.
Figure 19:
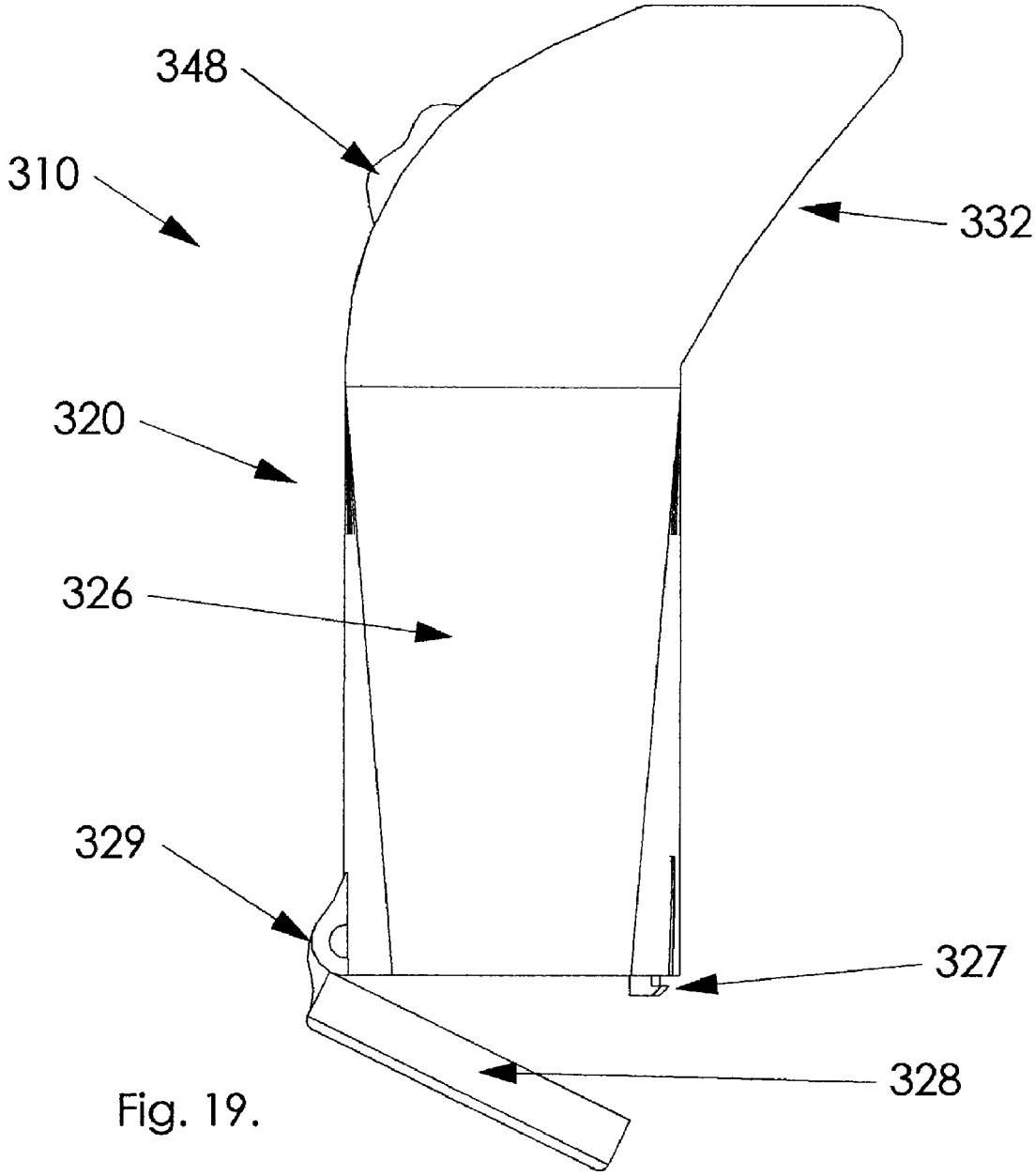
FIG. 19 is a right side view of design variation 3.
Figure 20:
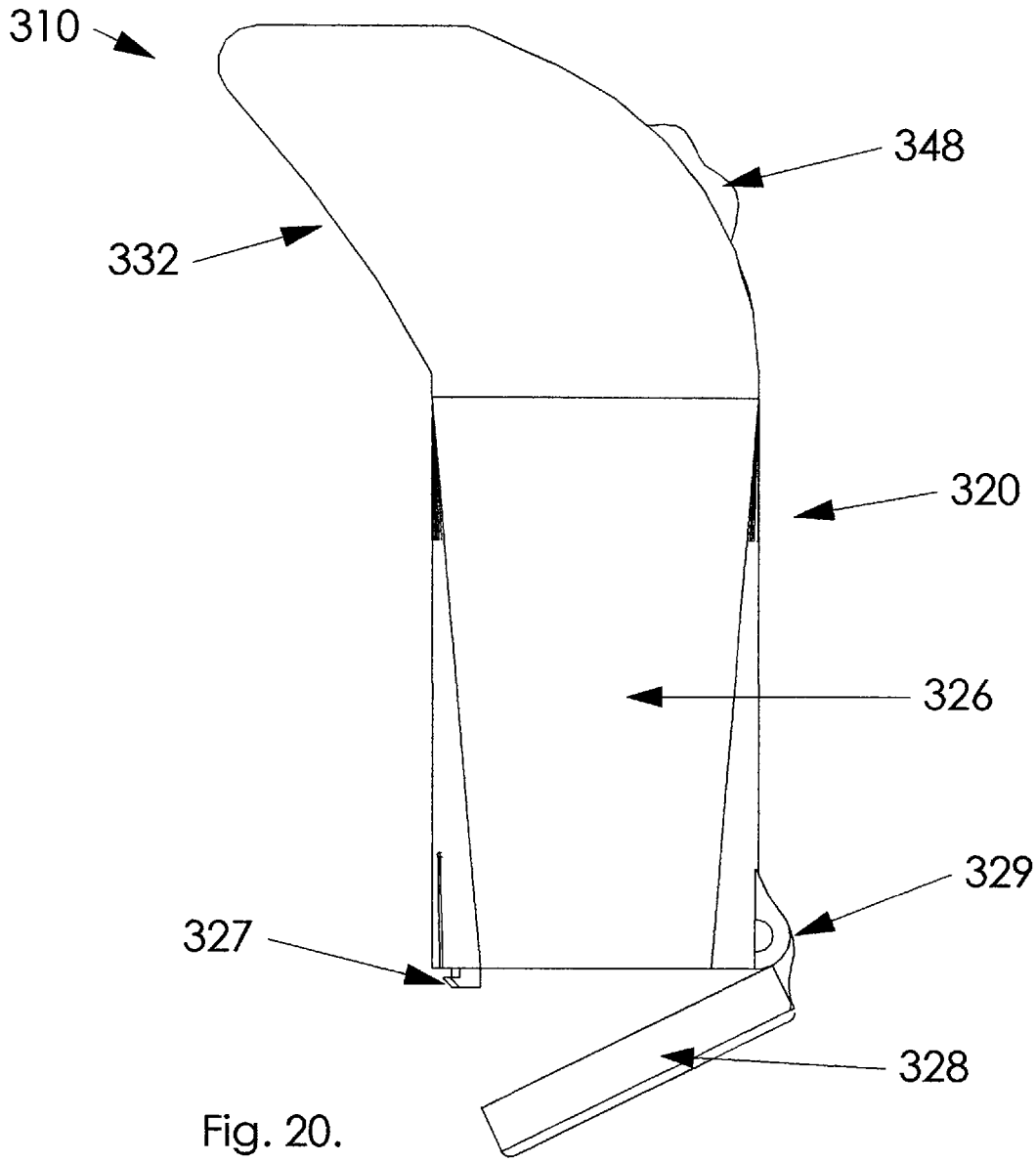
FIG. 20 is a left side view of design variation 3.
Figure 21:
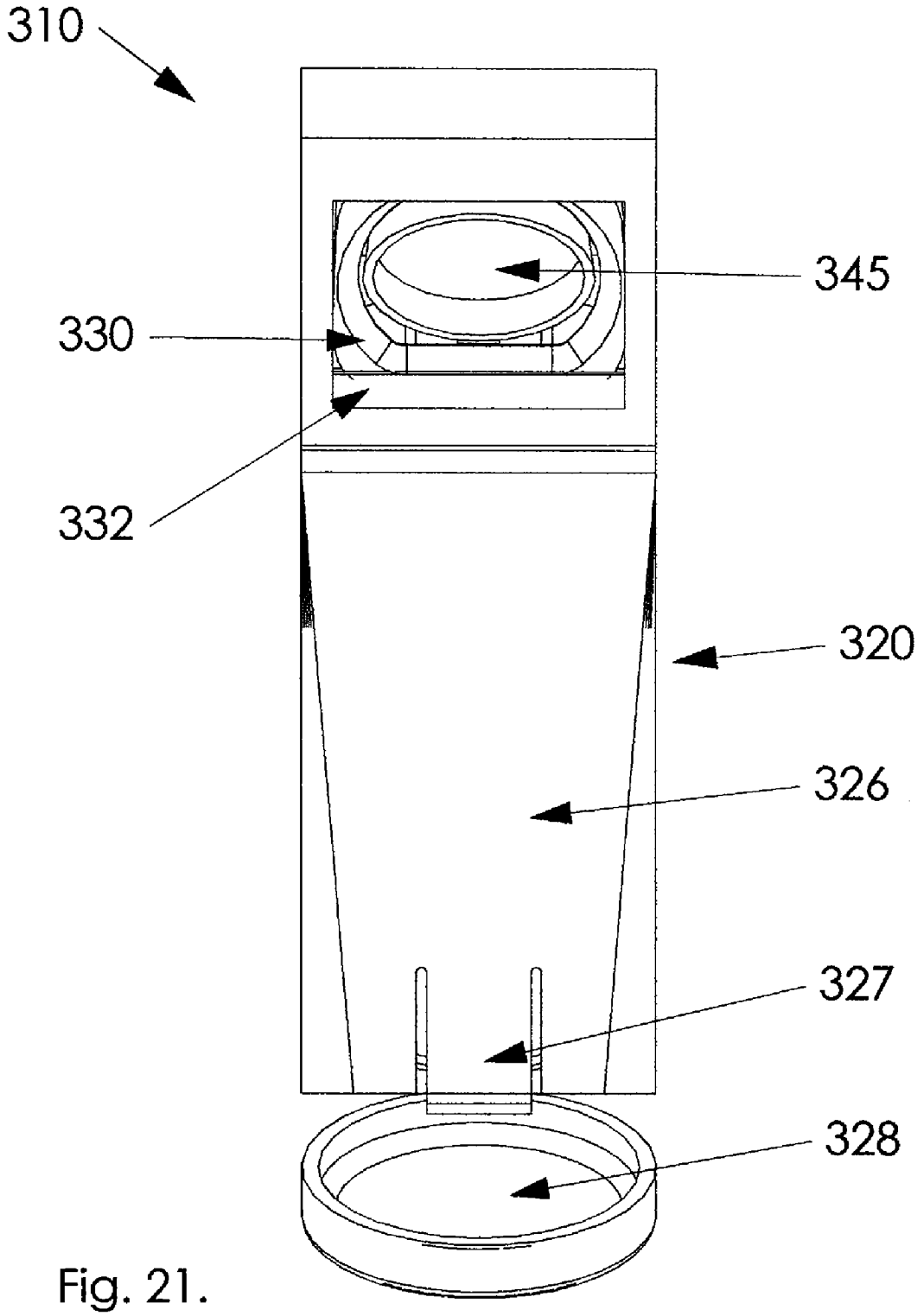
FIG. 21 is a front view of design variation 3.
Figure 22:
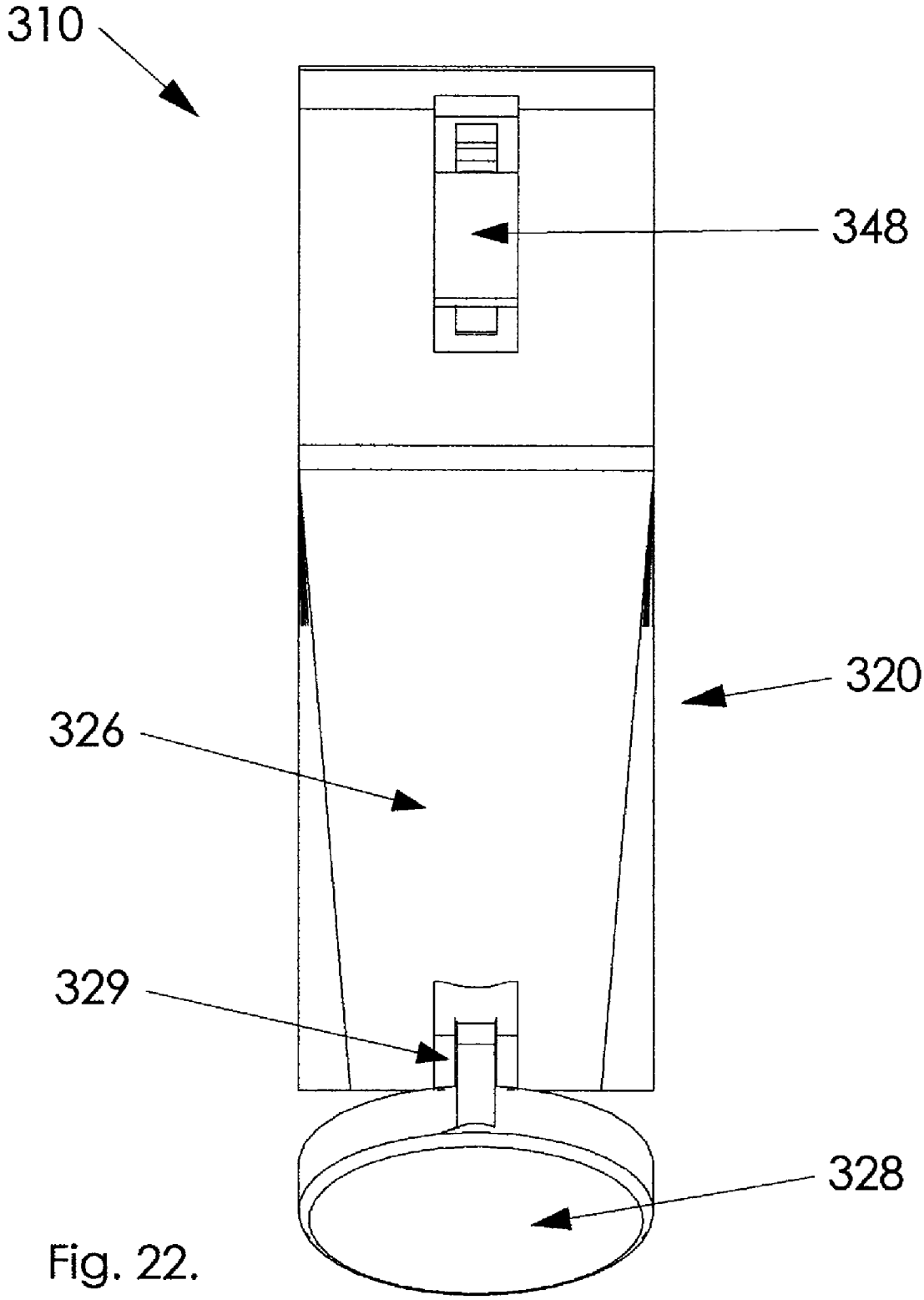
FIG. 22 is a back view of design variation 3.
Figure 23:
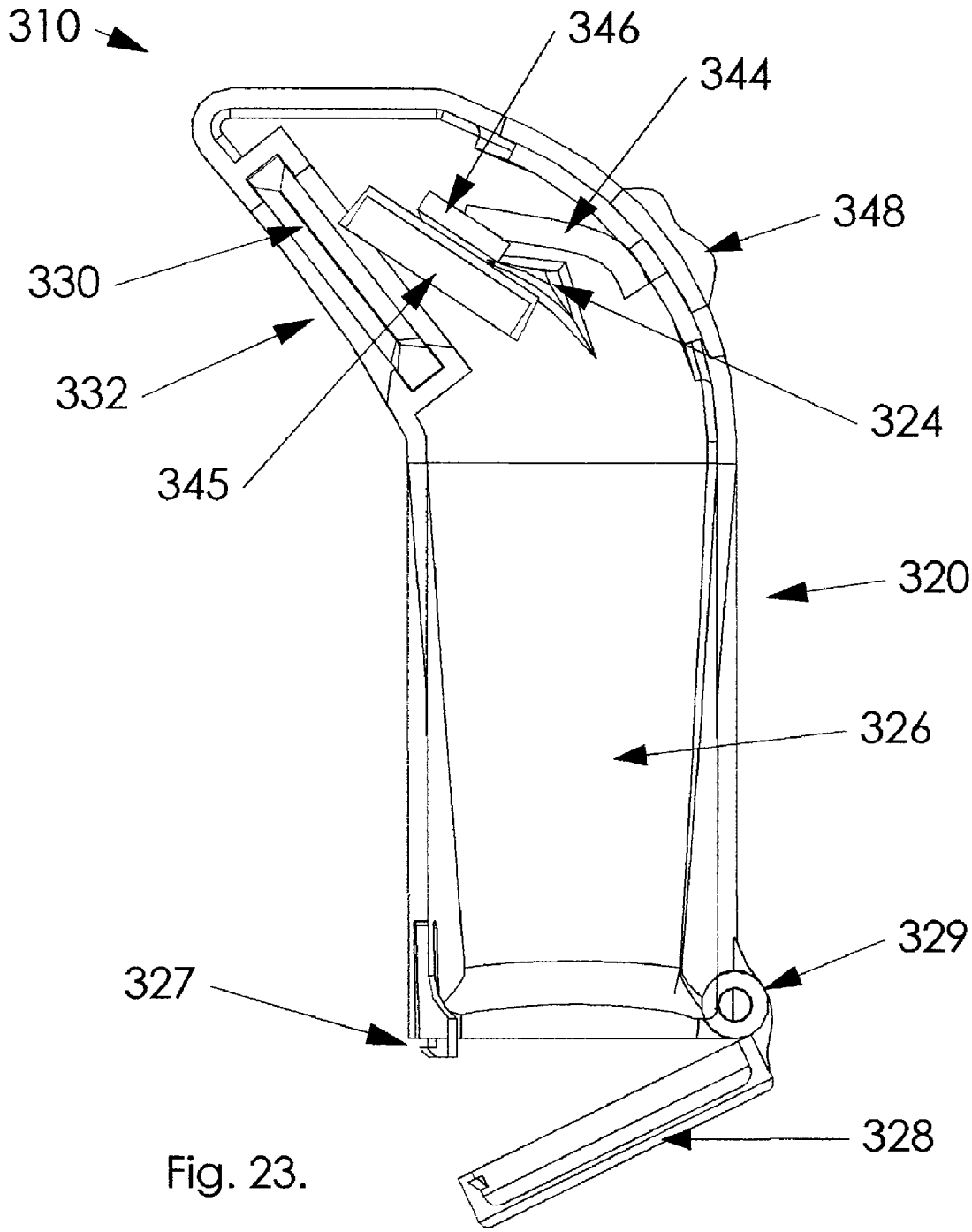
FIG. 23 is an inside cut-away view of design variation 3.
Figure 24:
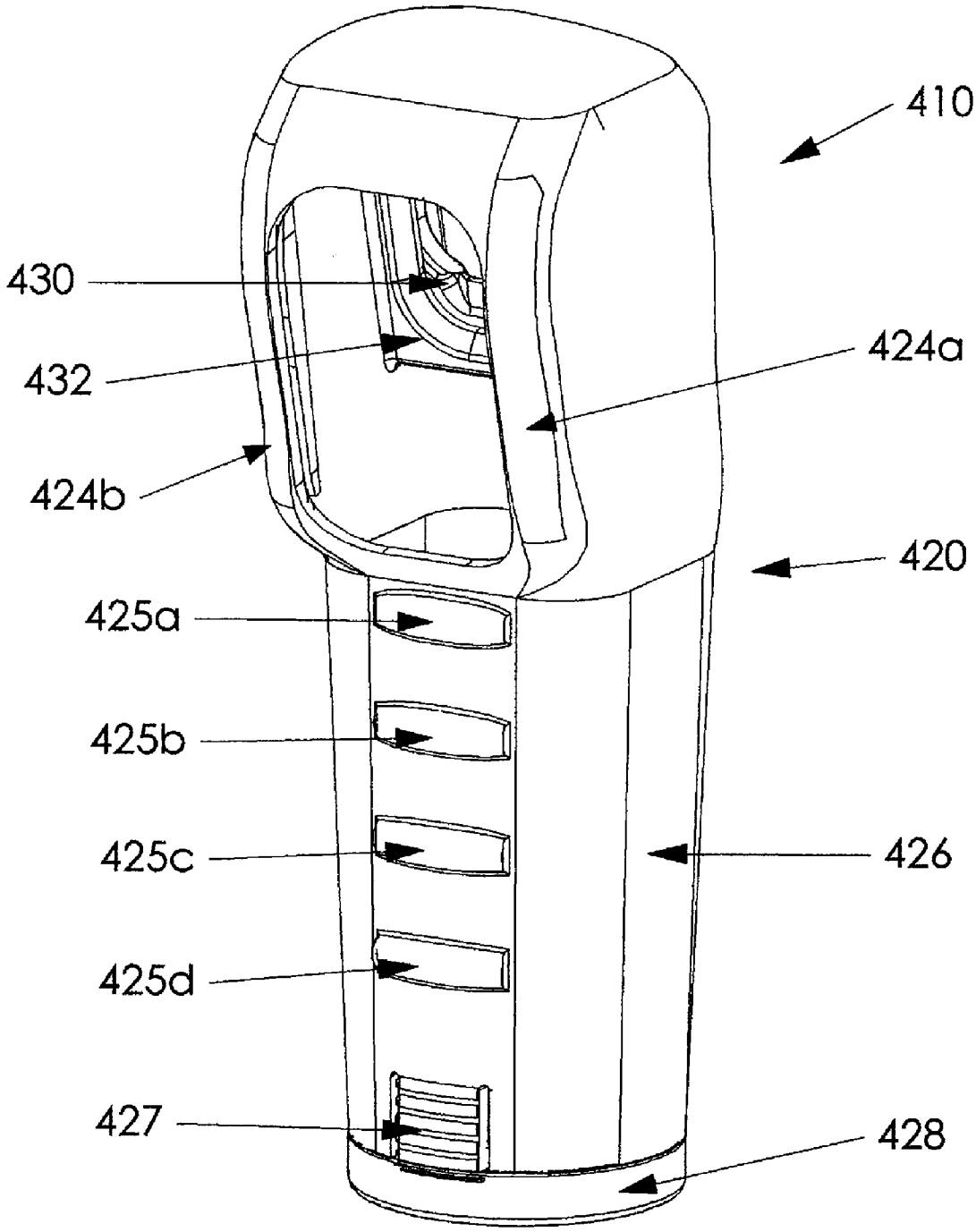
FIG. 24 is a front perspective view of design variation 4 of a bottle opener and bottle cap collecting and disposing device in accordance with the present invention.
Figure 25:
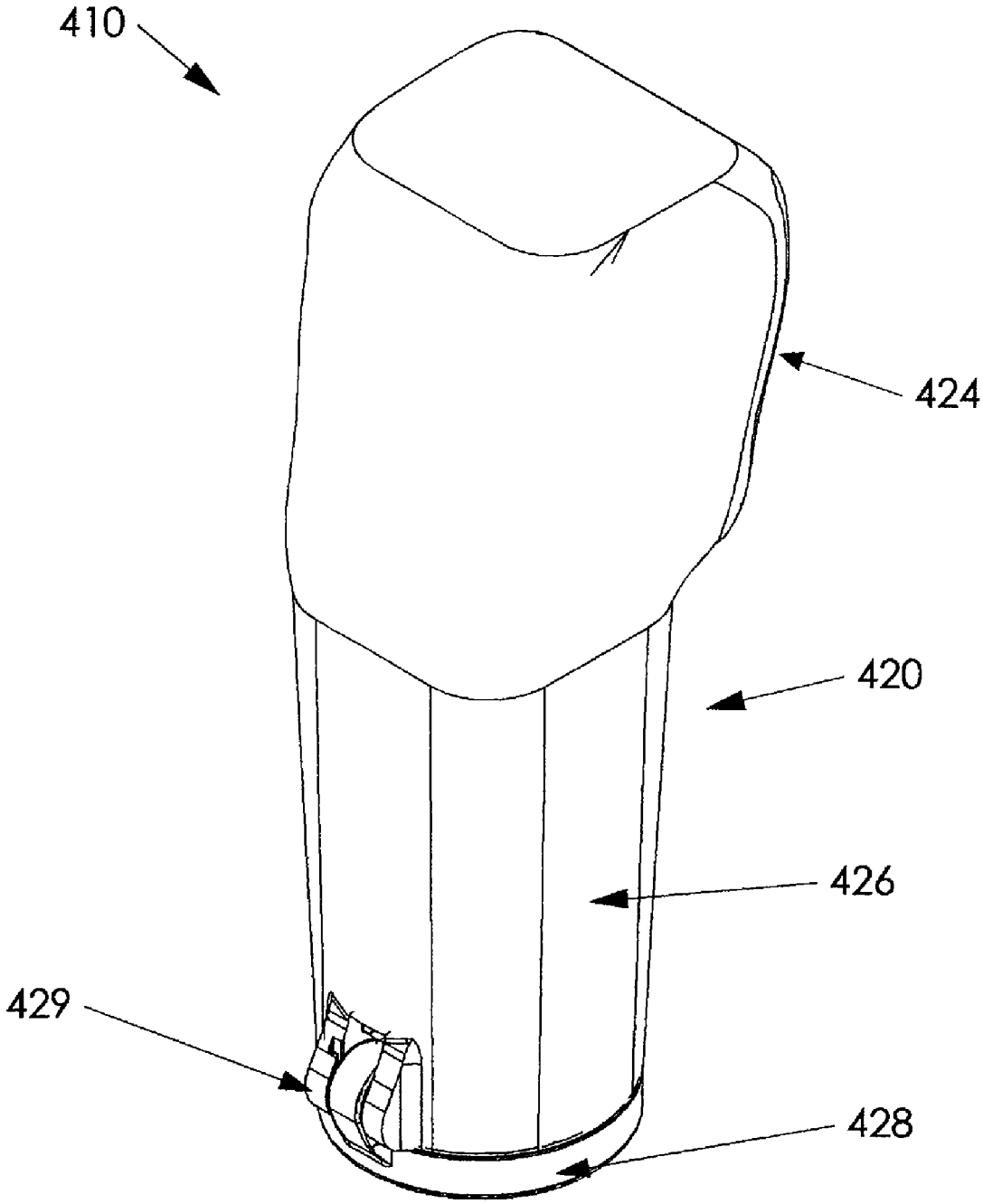
FIG. 25 is a back perspective view of design variation 4.
Figure 26:
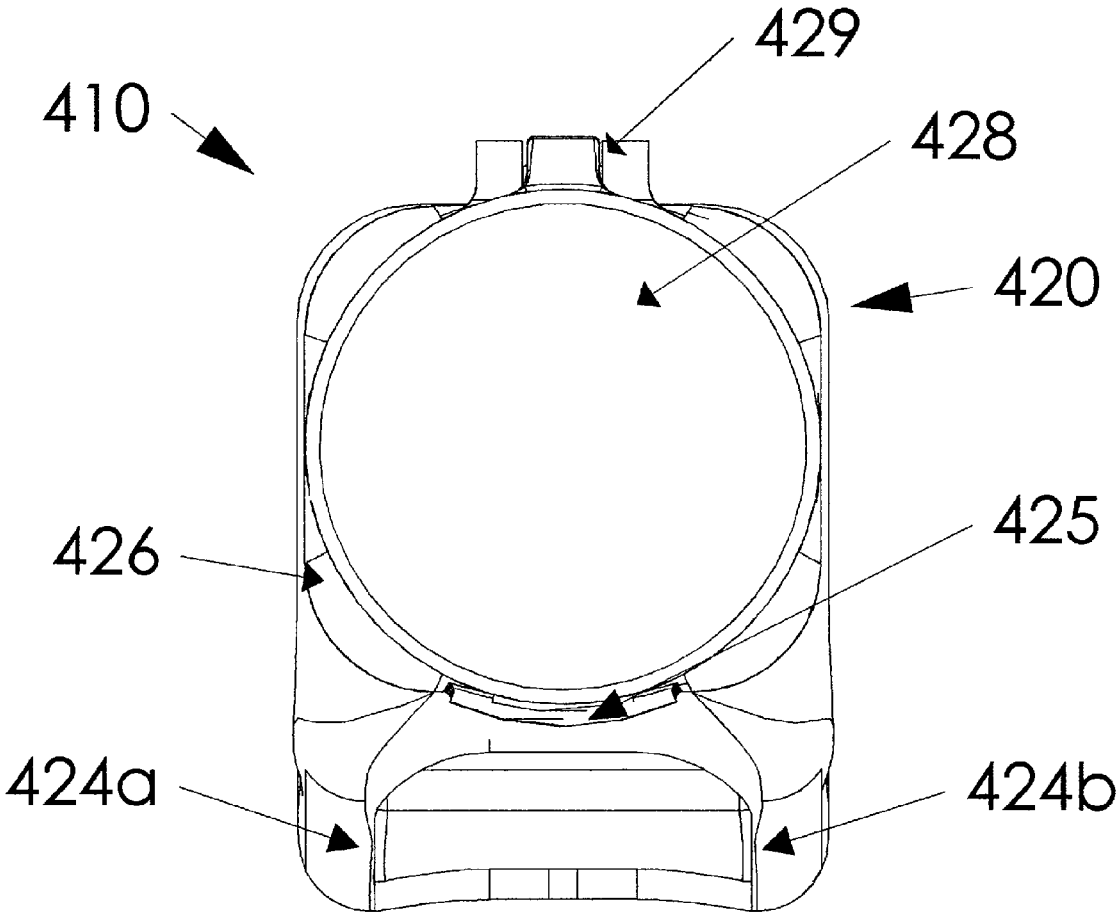
FIG. 26 is a bottom view of design variation 4.
Figure 27:
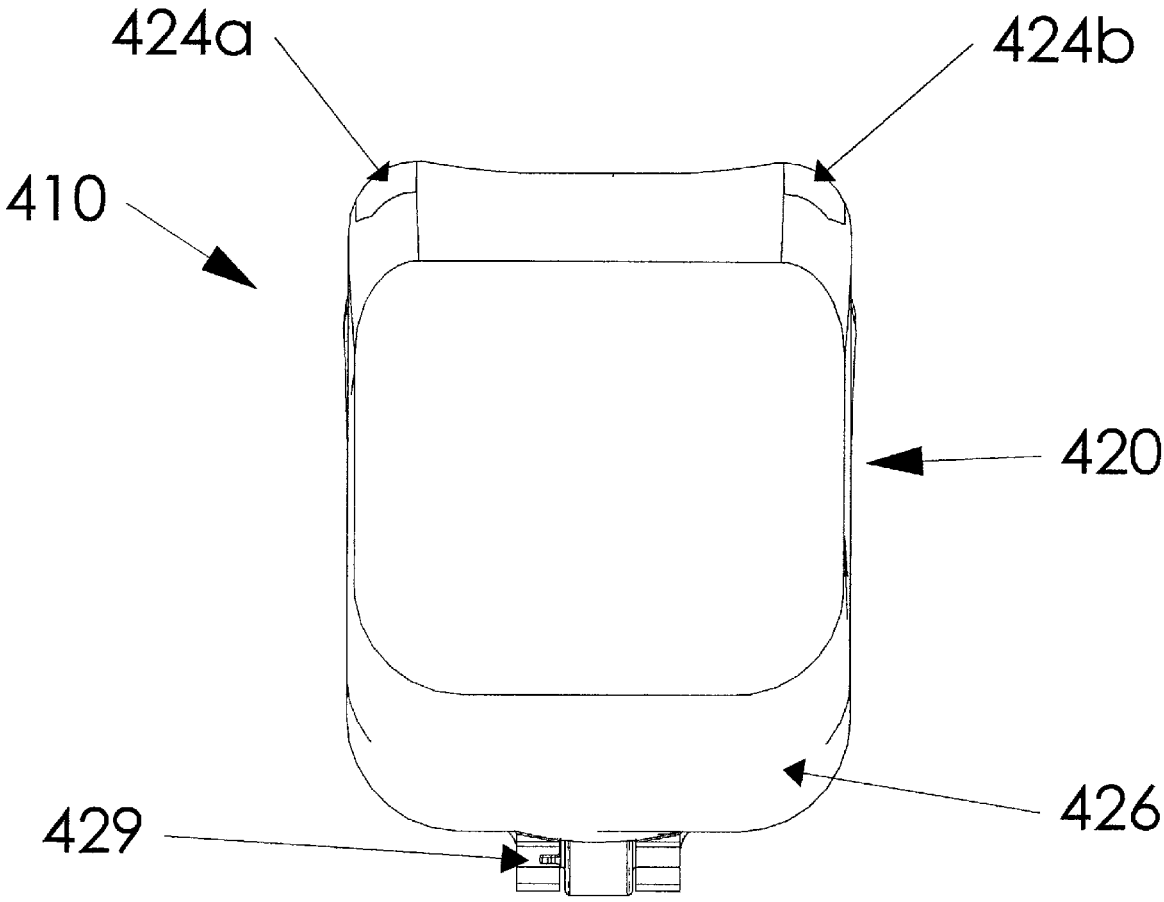
FIG. 27 is a top view of design variation 4.
Figure 28:
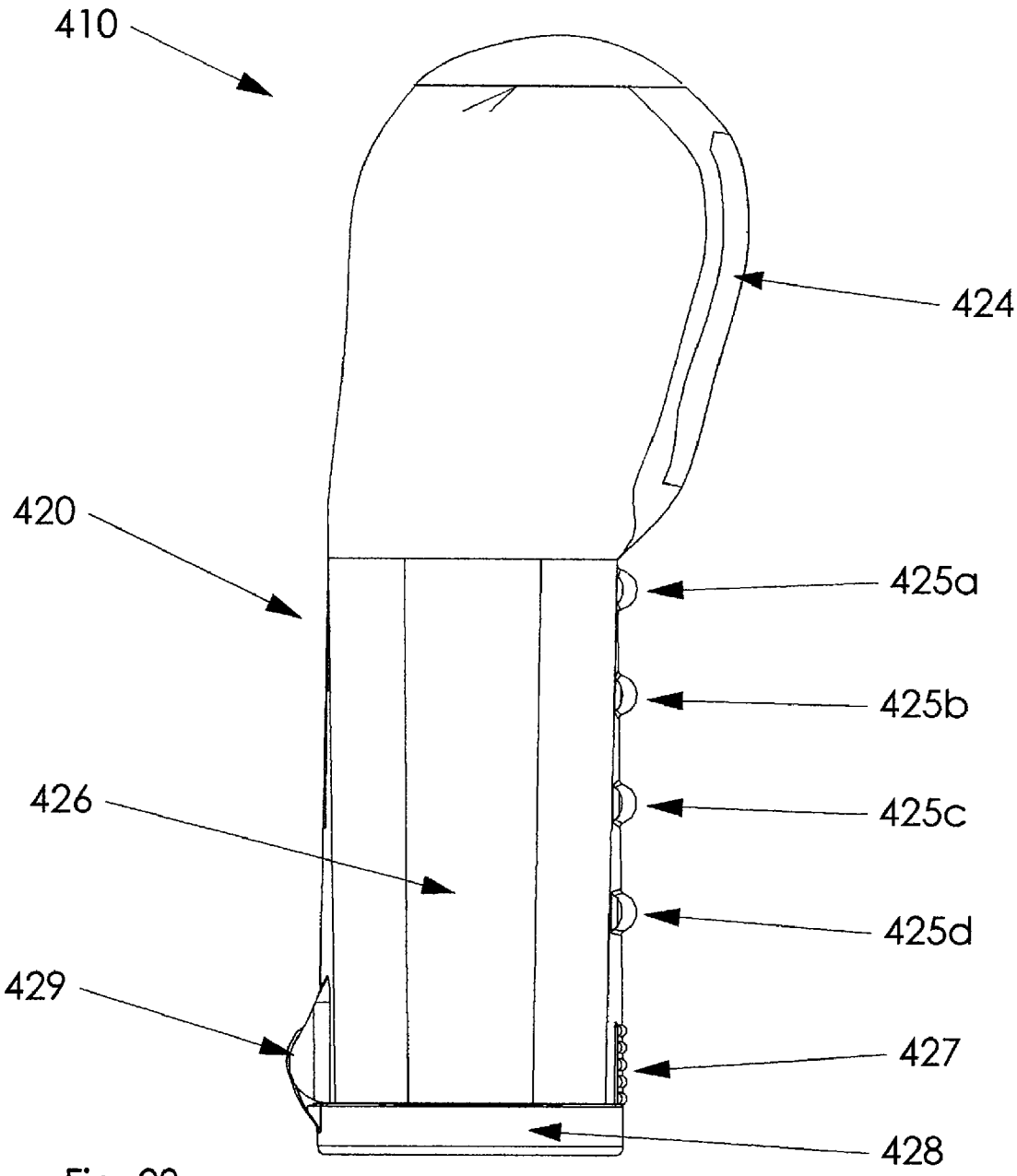
FIG. 28 is a right side view of design variation 4.
Figure 29:
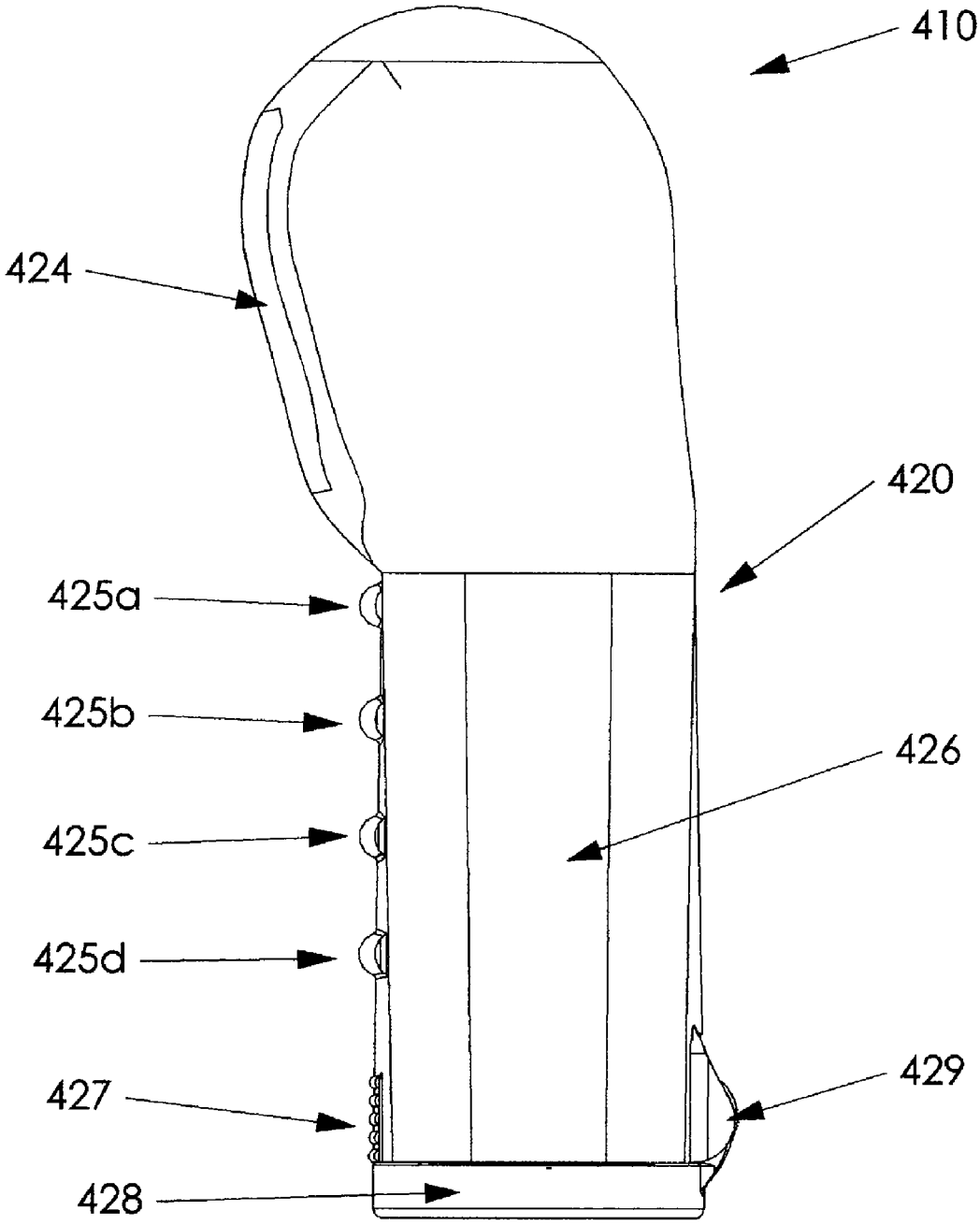
FIG. 29 is a left side view of design variation 4.
Figure 30:
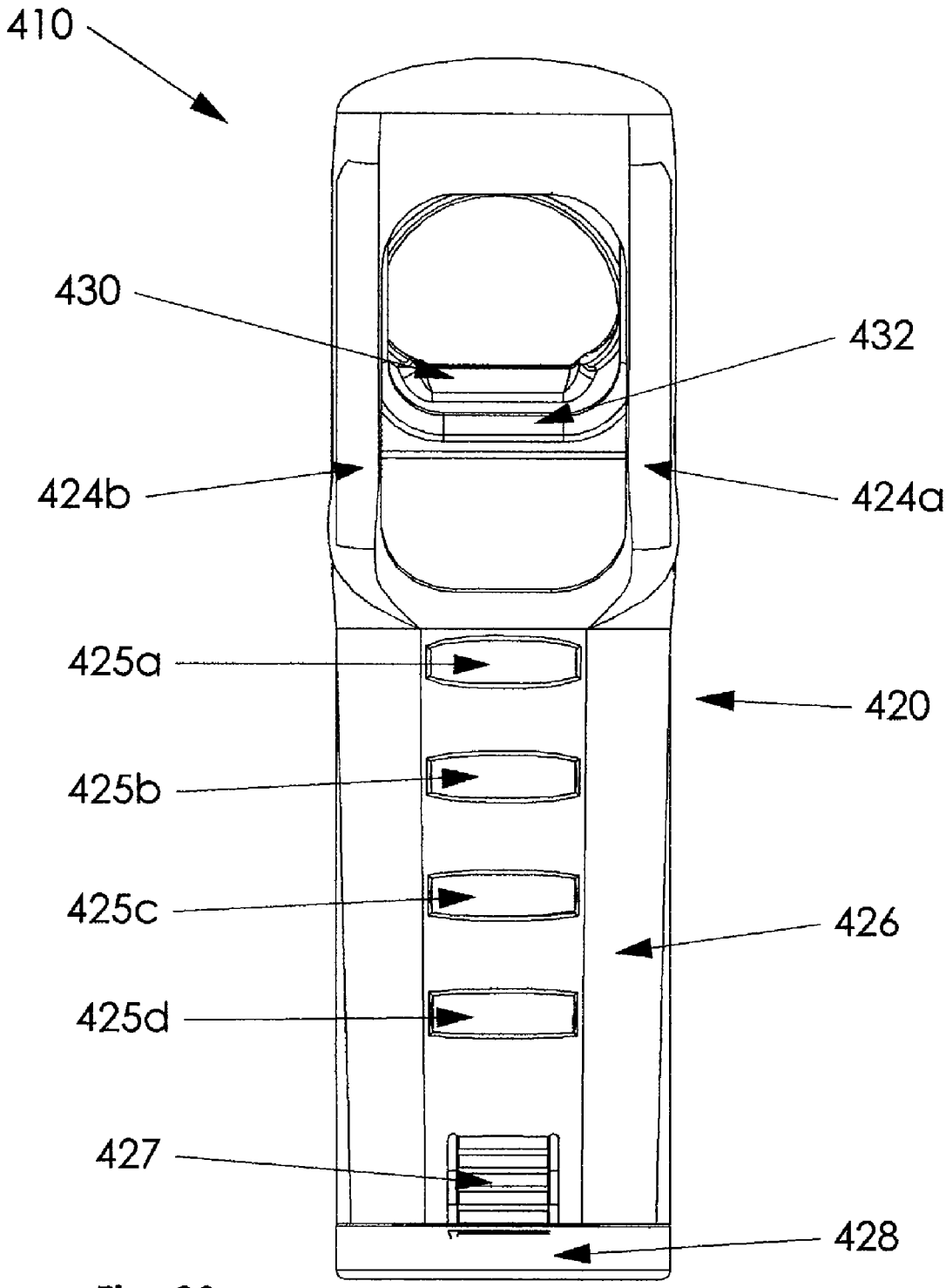
FIG. 30 is a front view of design variation 4.
Figure 31:
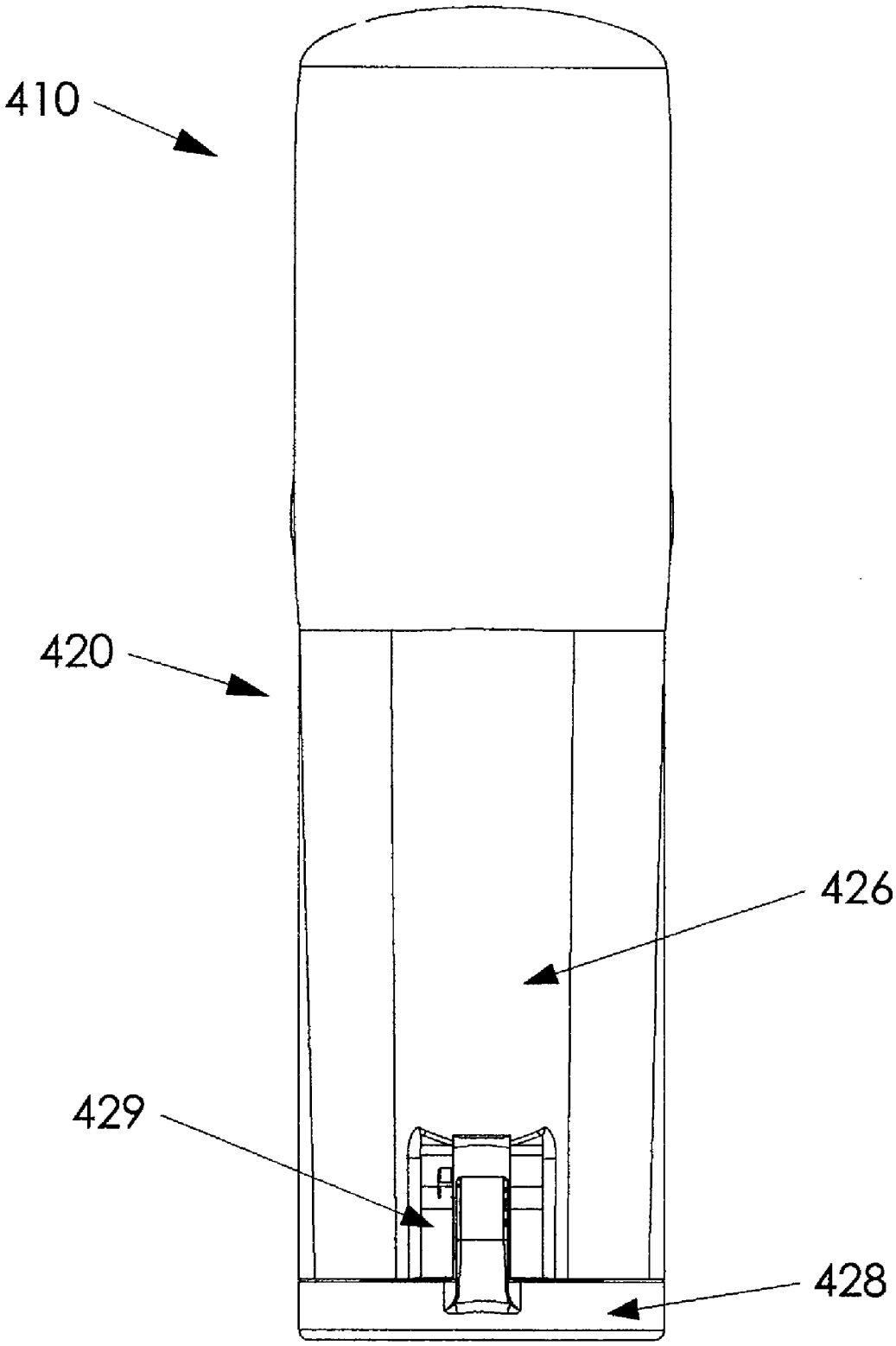
FIG. 31 is a back view of design variation 4.
Figure 32:
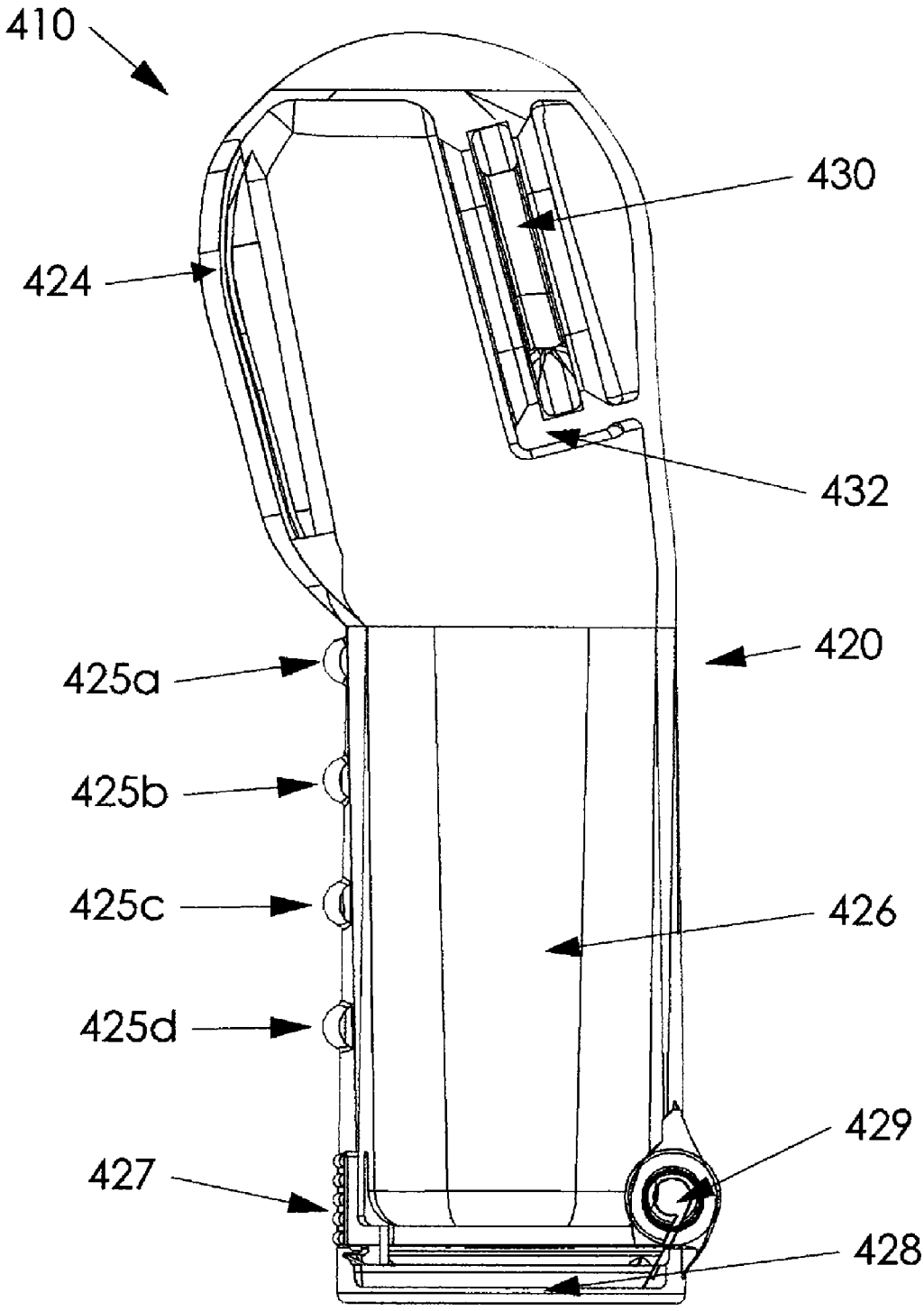
FIG. 32 is an inside cut-away view of design variation 4.
Figure 33:
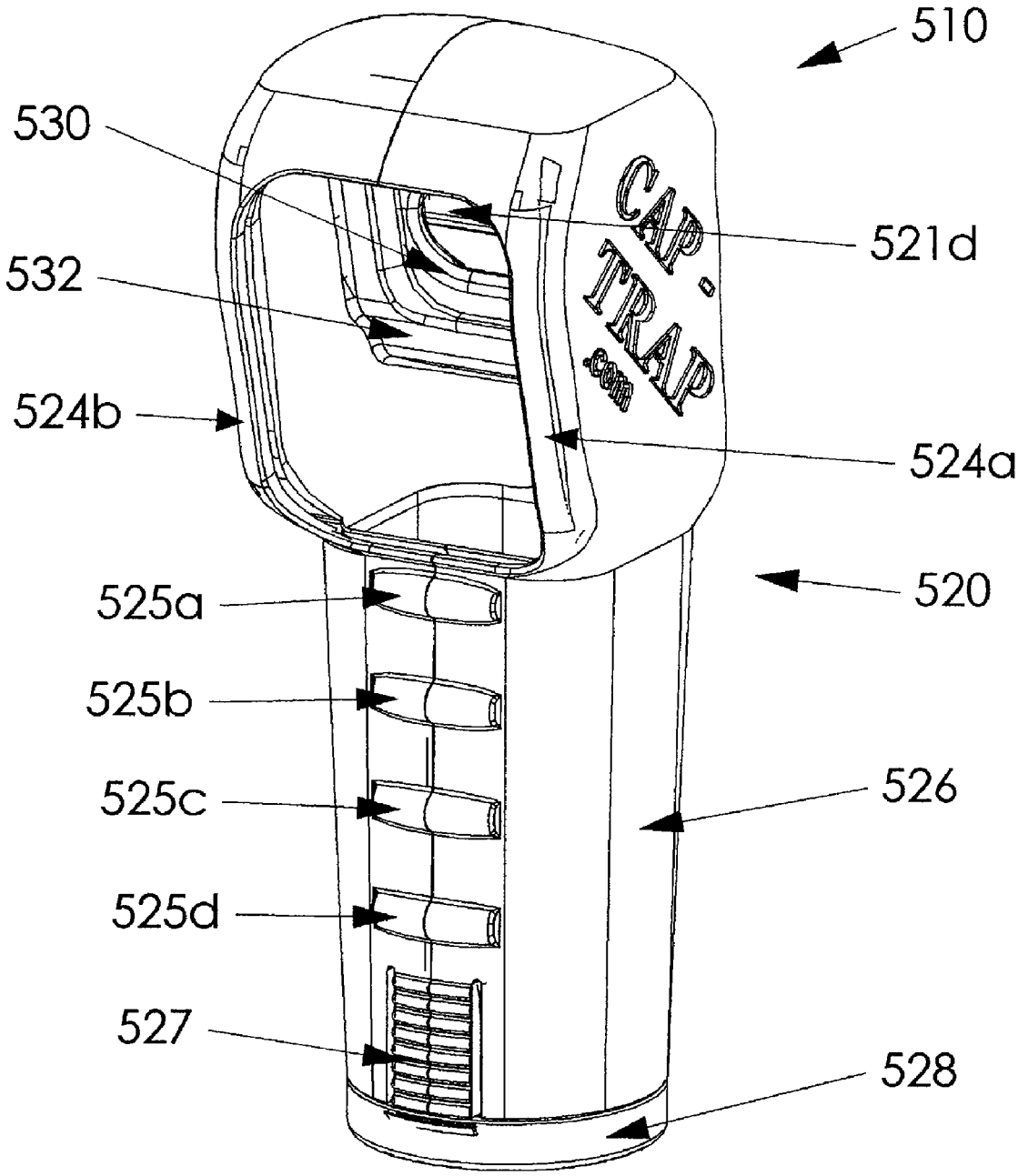
FIG. 33 is a front perspective view of design variation 5 of a bottle opener and bottle cap collecting and disposing device in accordance with the present invention.
Figure 34:
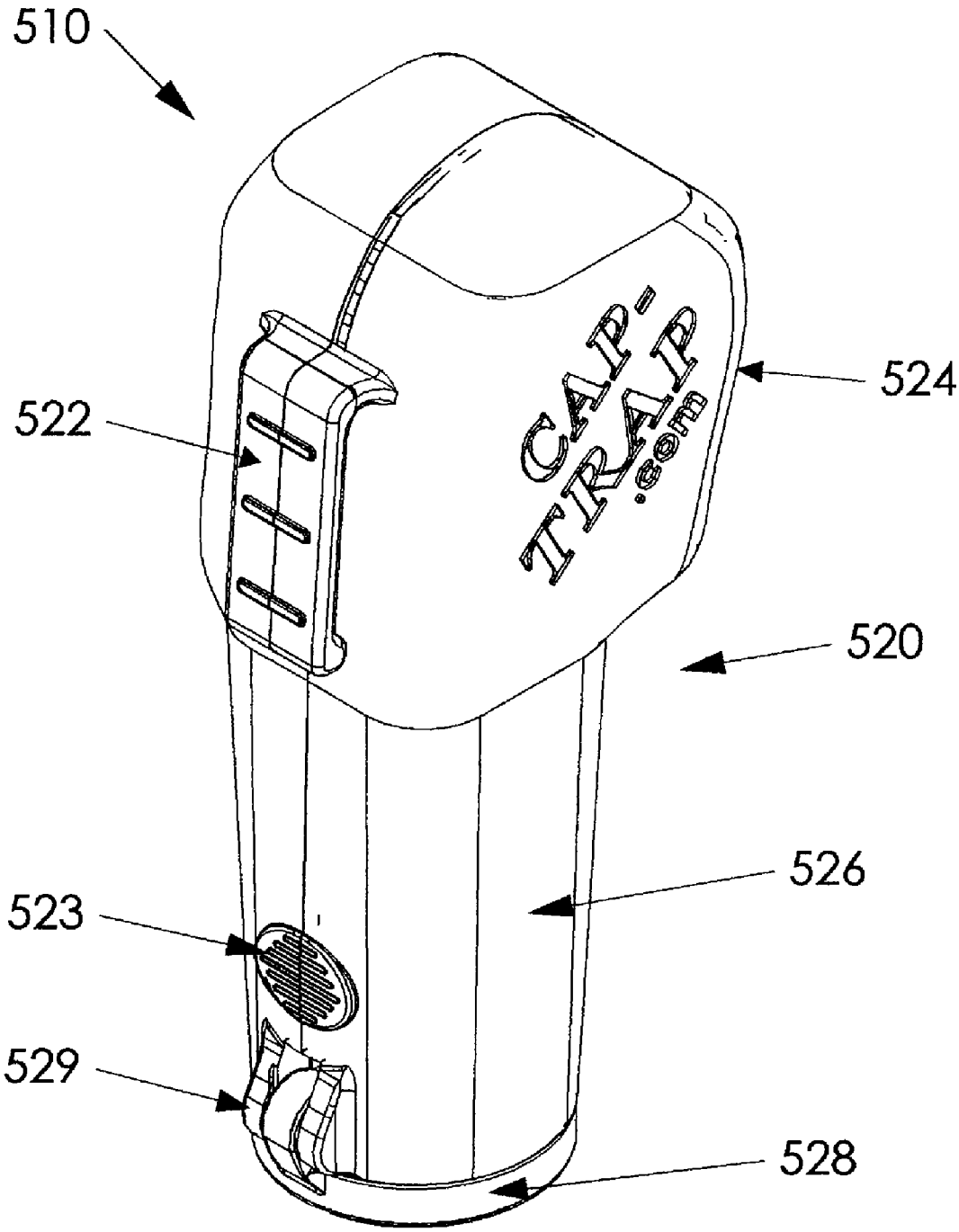
FIG. 34 is a back perspective view of design variation 5.
Figure 35:
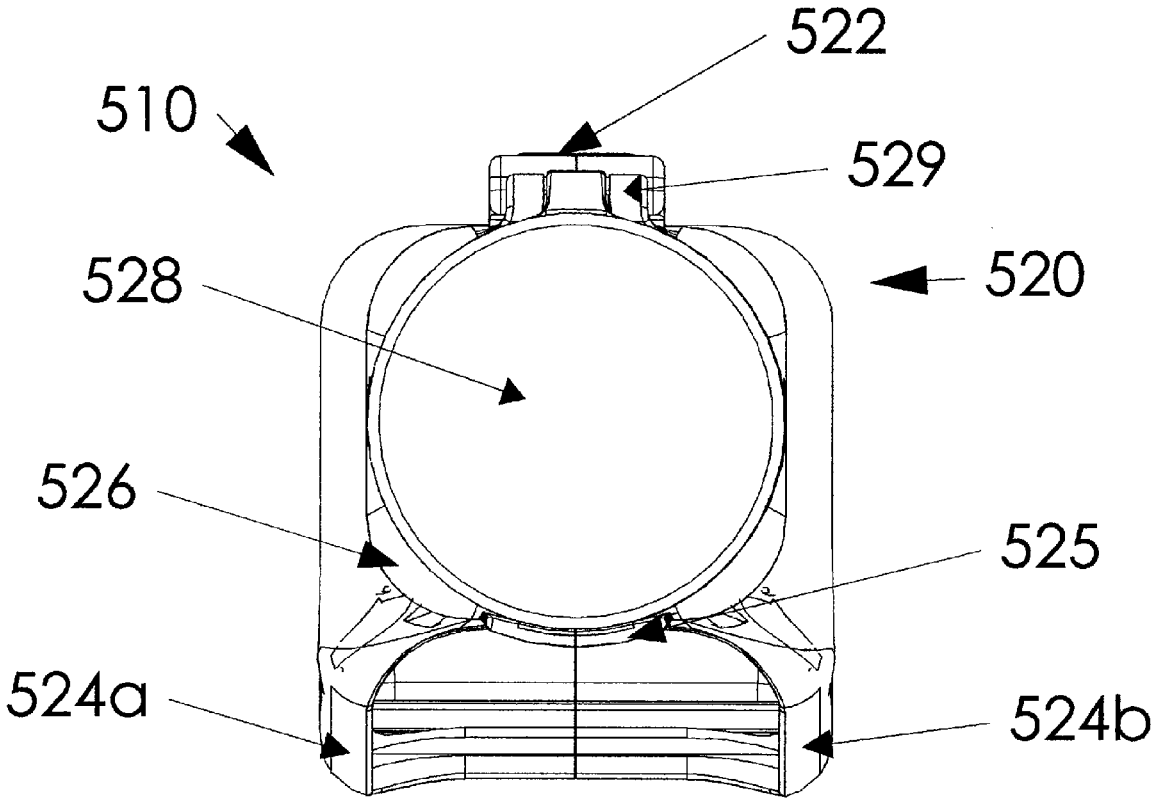
FIG. 35 is a bottom view of design variation 5.
Figure 36:
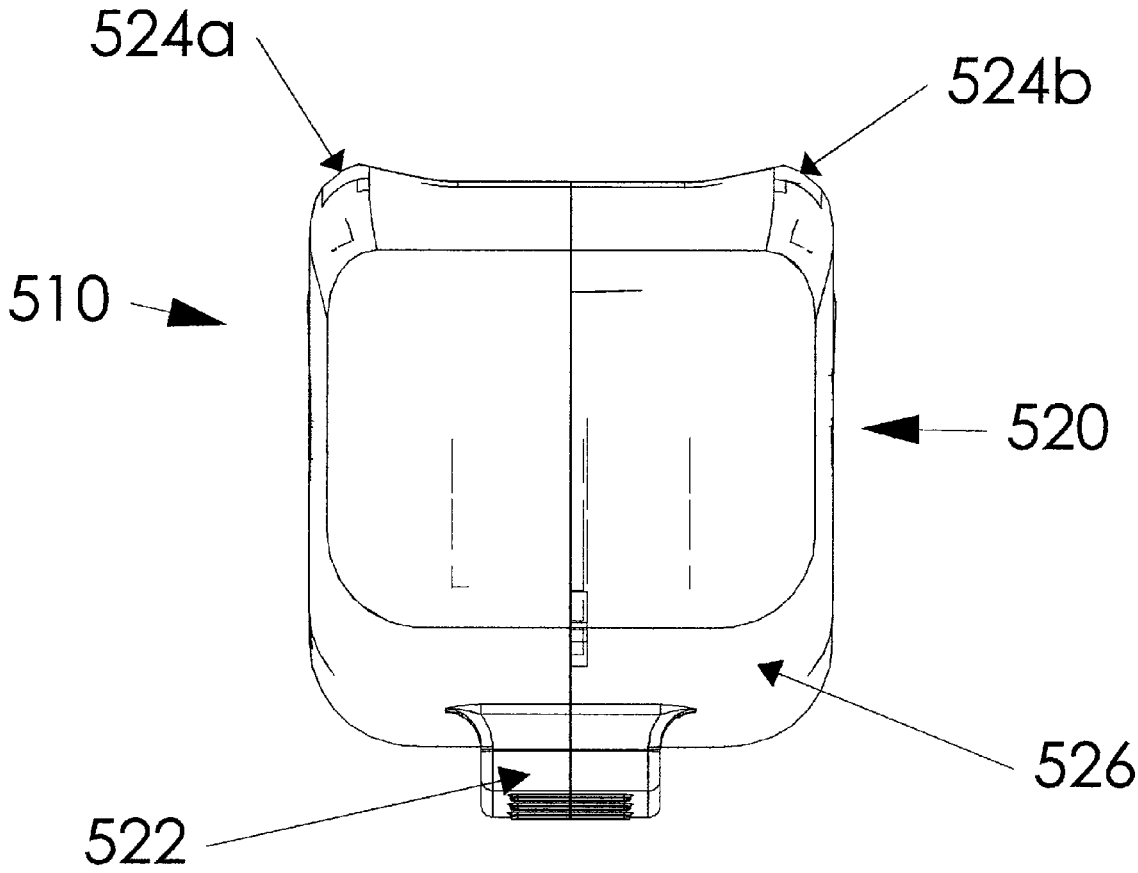
FIG. 36 is a top view of design variation 5.
Figure 37:
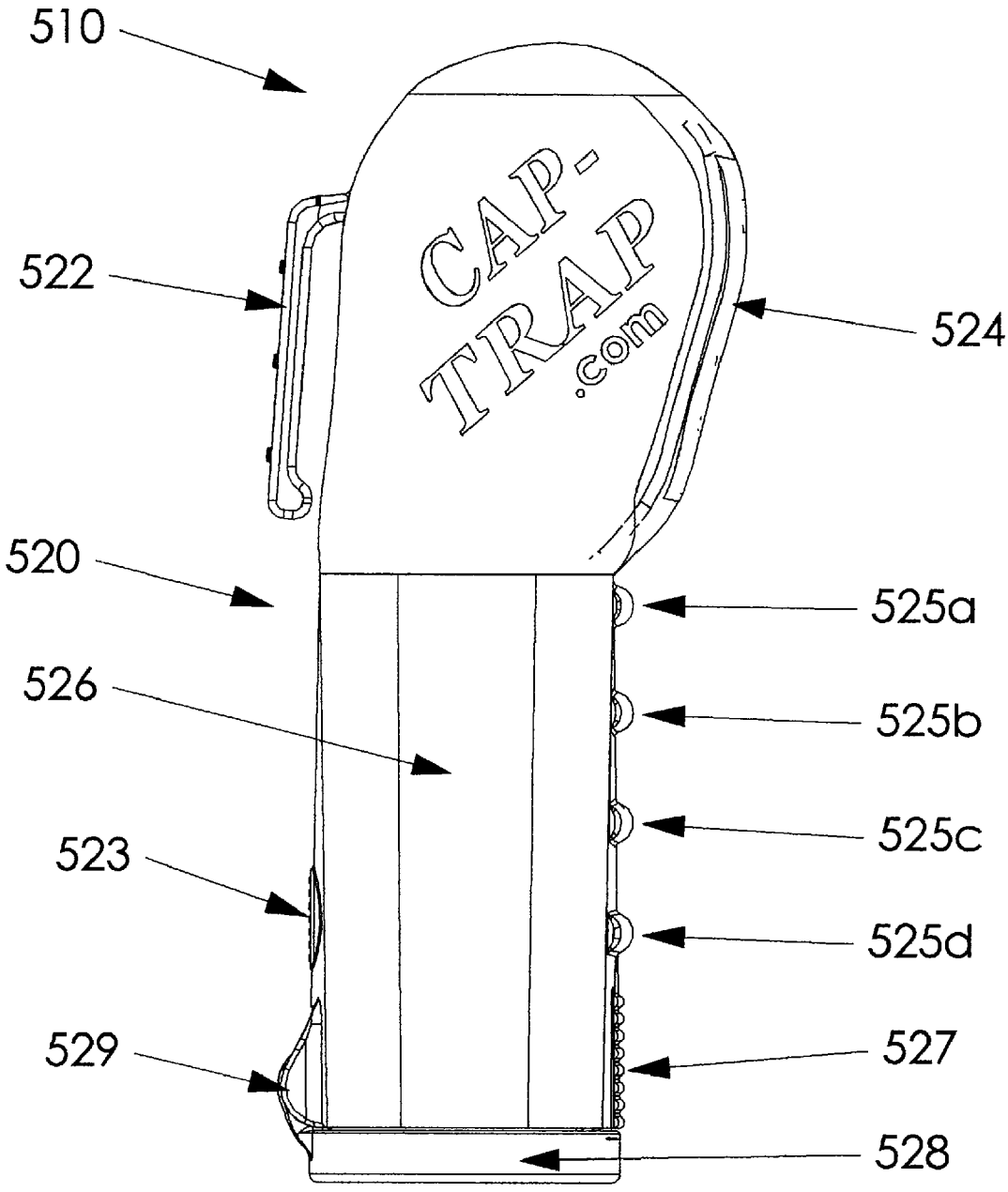
FIG. 37 is a right side view of design variation 5.
Figure 38:
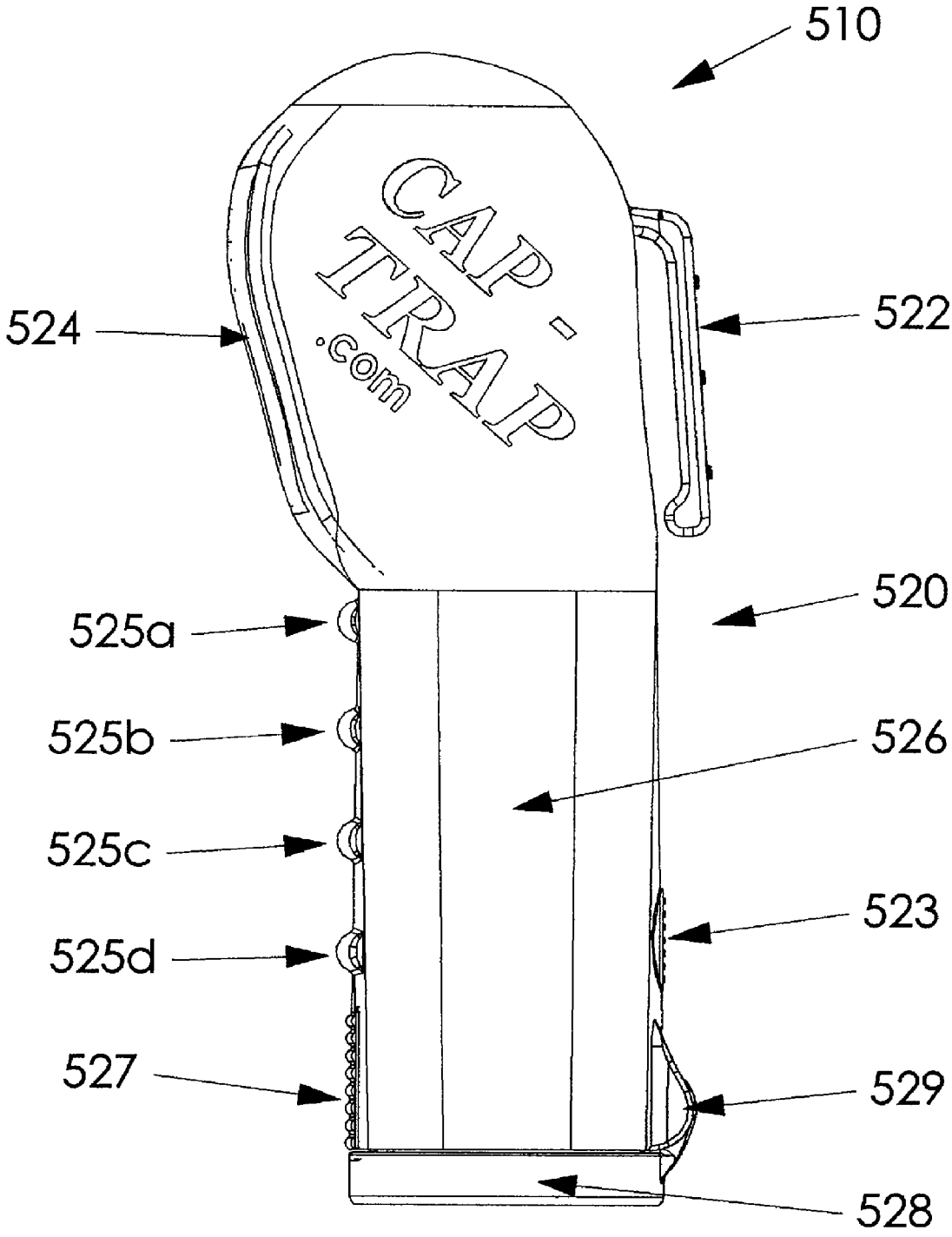
FIG. 38 is a left side view of design variation 5.
Figure 39:
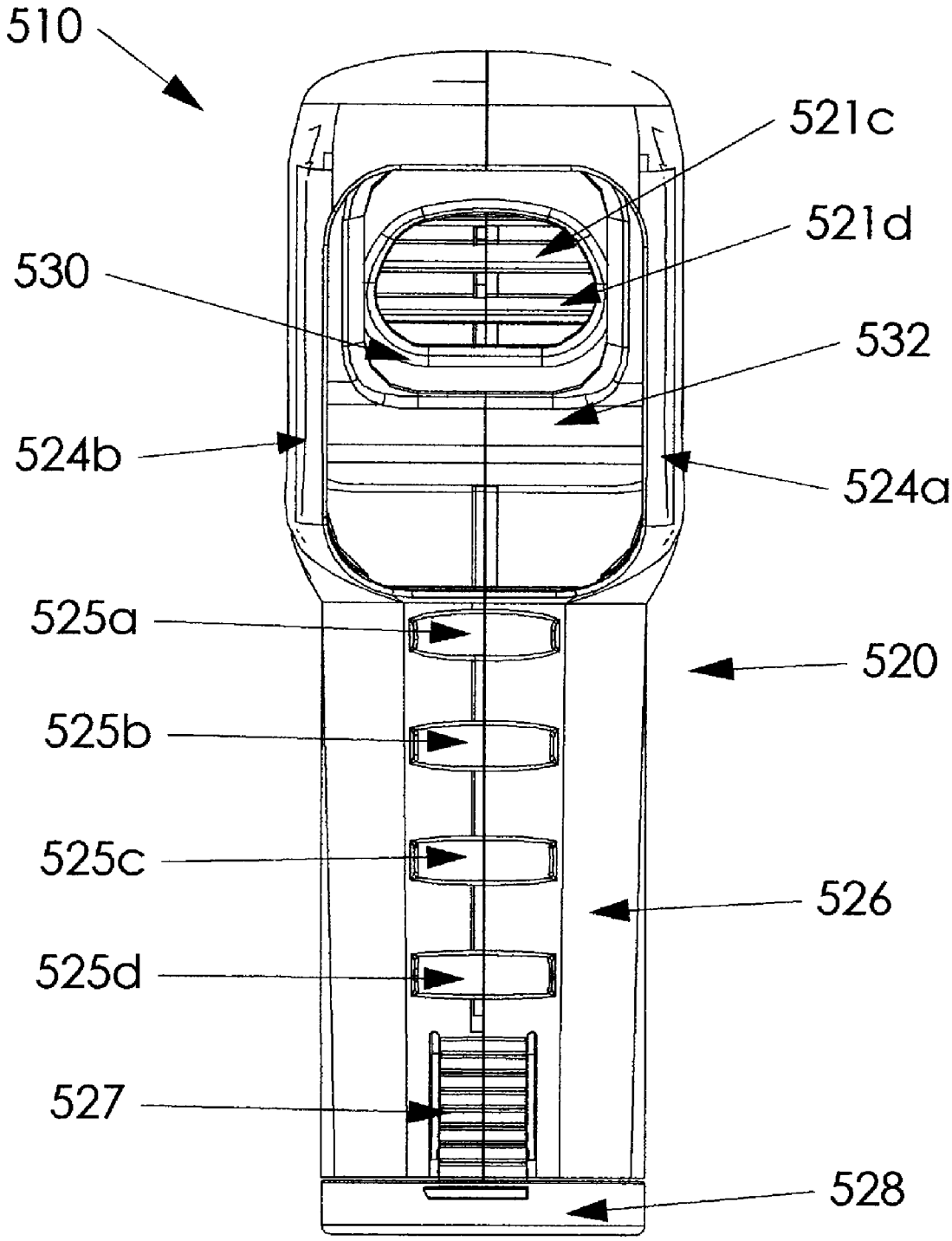
FIG. 39 is a front view of design variation 5.
Figure 40:
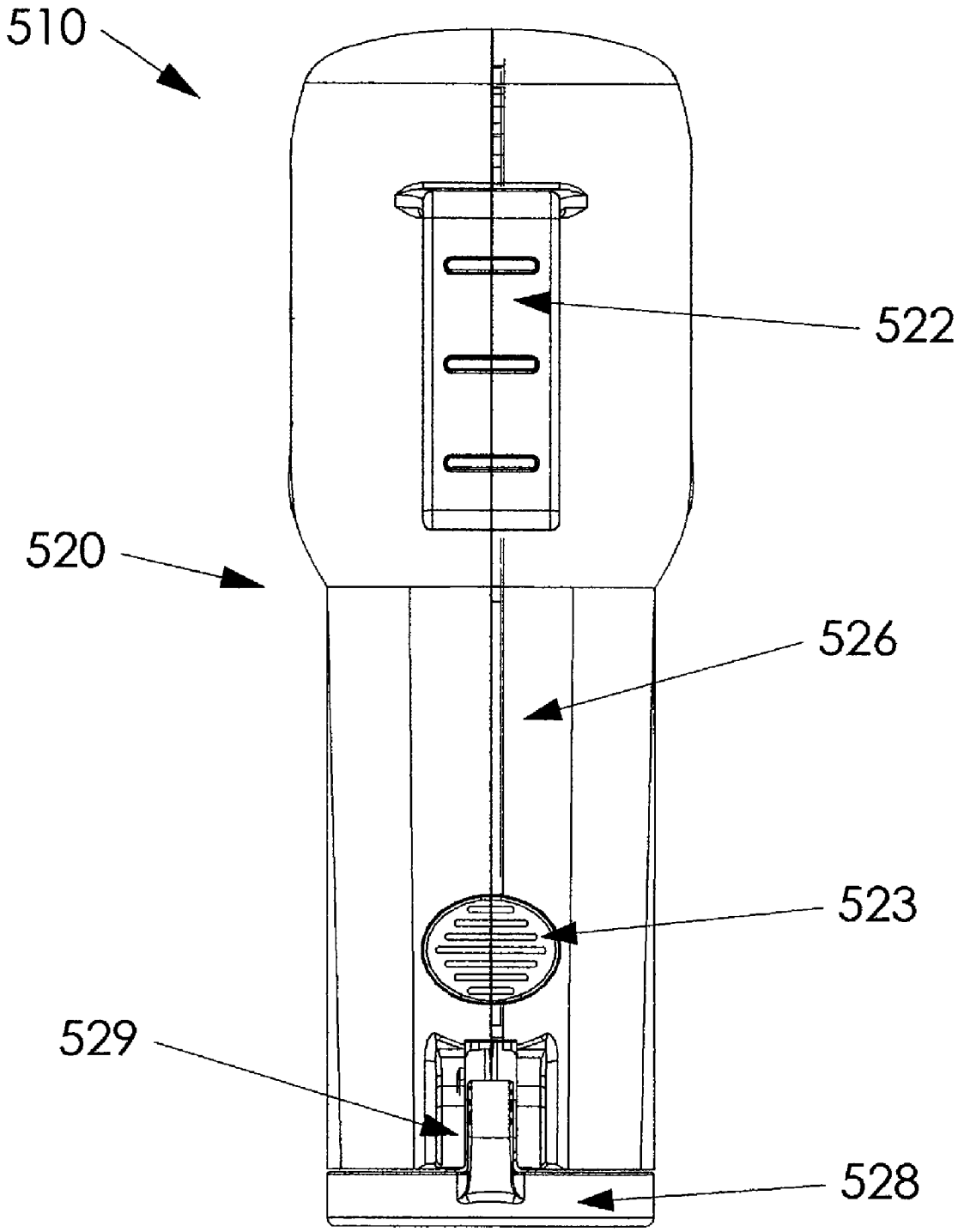
FIG. 40 is a back view of design variation 5.
Figure 41:
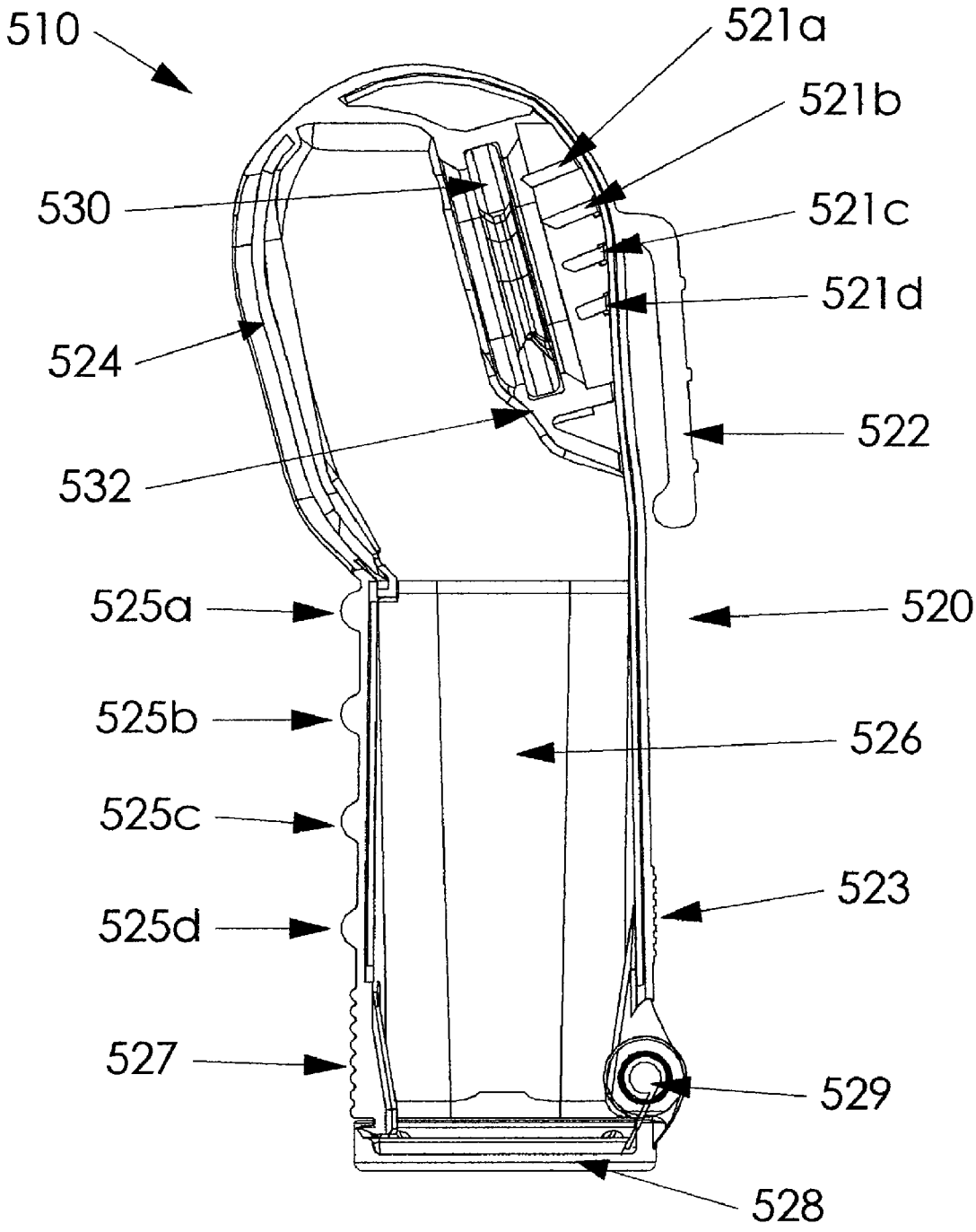
FIG. 41 is an inside cut-away view of design variation 5.
Figure 42:
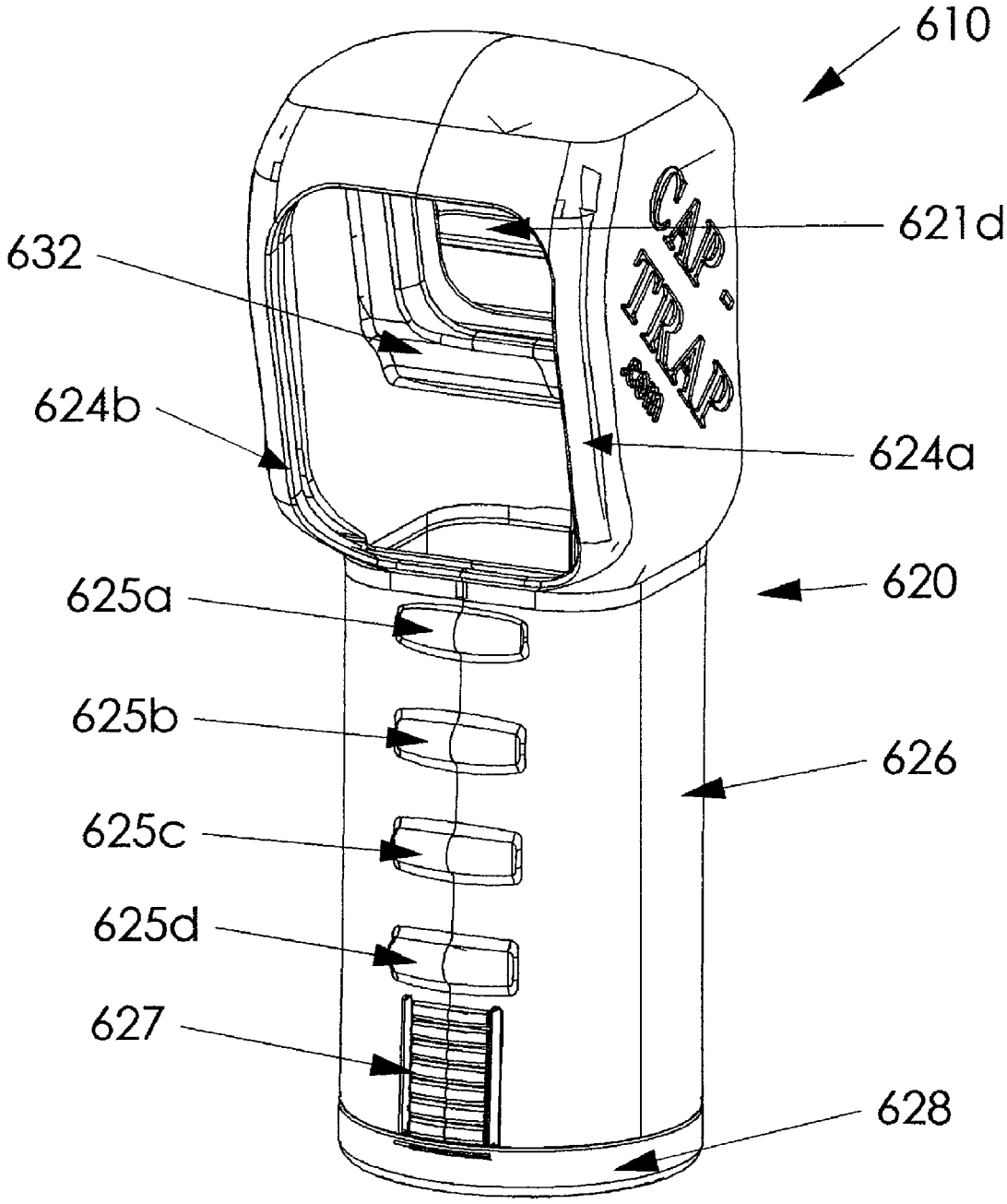
FIG. 42 is a front perspective view of design variation 6 of a bottle opener and bottle cap collecting and disposing device in accordance with the present invention.
Figure 43:
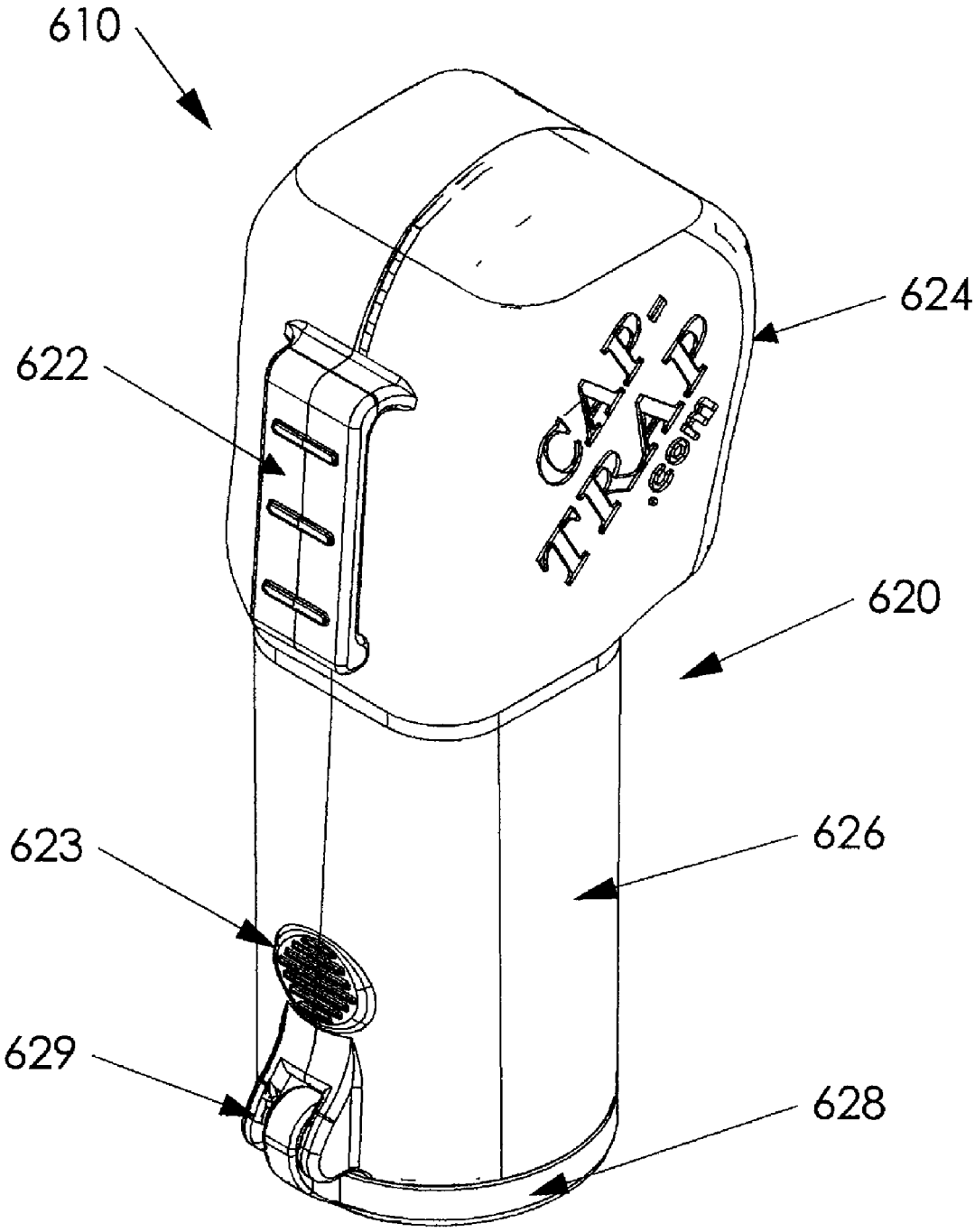
FIG. 43 is a back perspective view of design variation 6.
Figure 44:
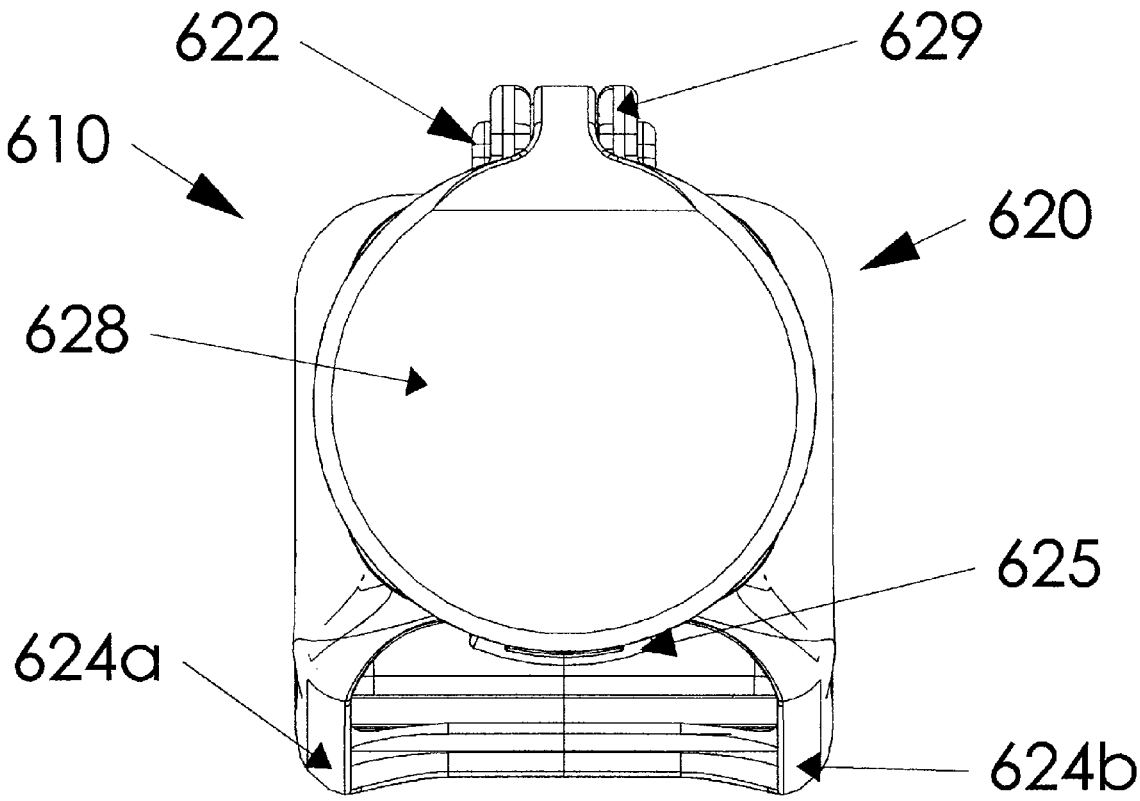
FIG. 44 is a bottom view of design variation 6.
Figure 45:
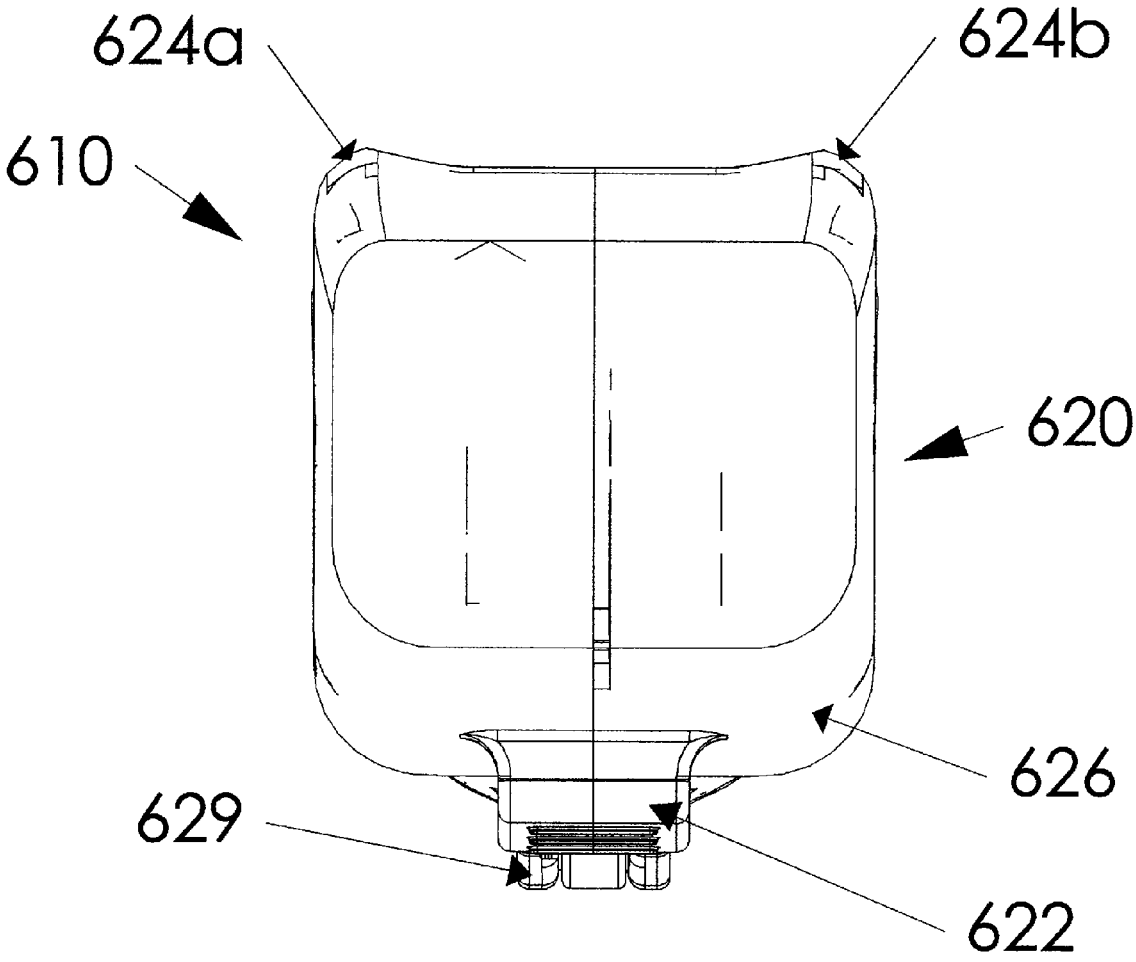
FIG. 45 is a top view of design variation 6.
Figure 46:
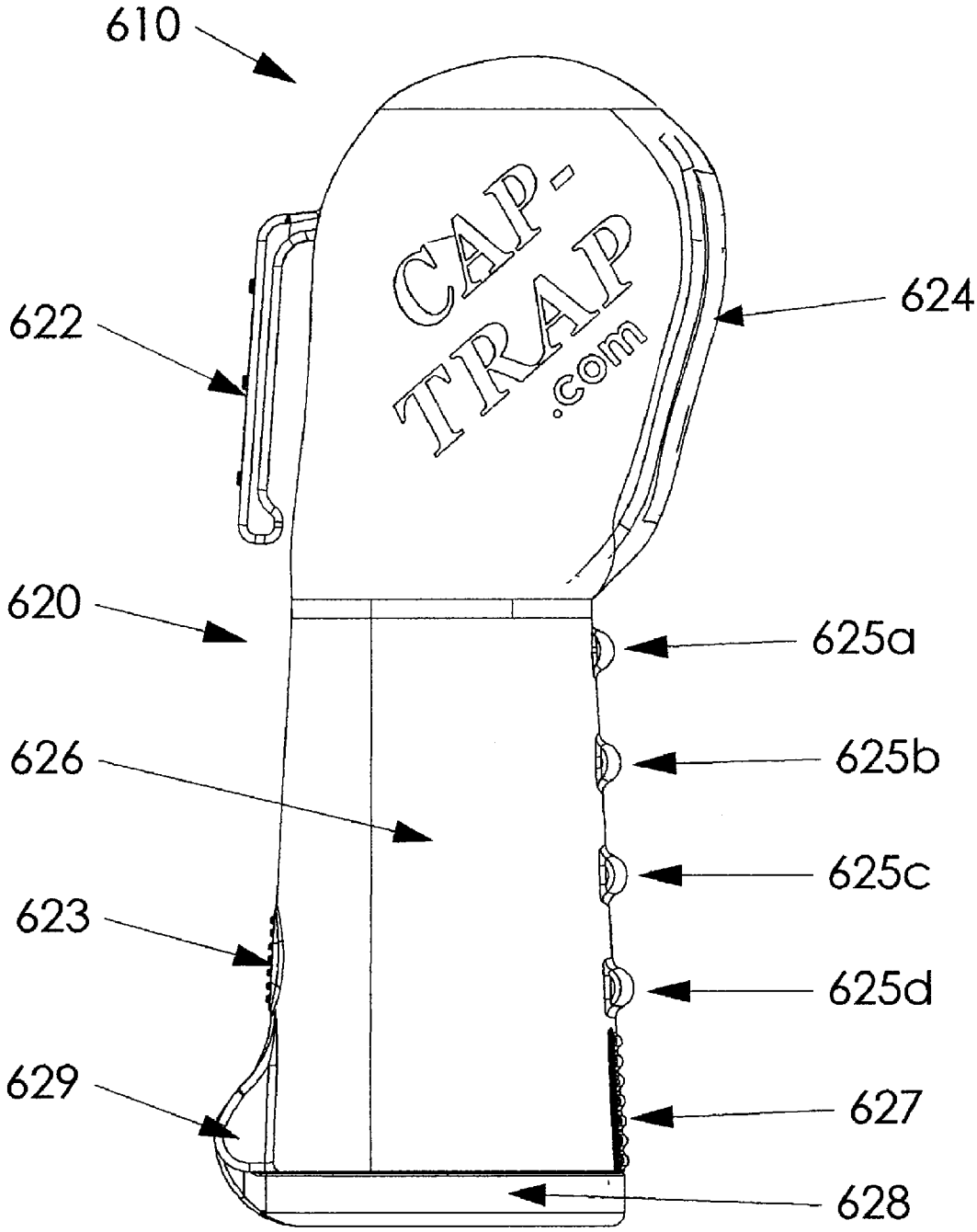
FIG. 46 is a right side view of design variation 6.
Figure 47:
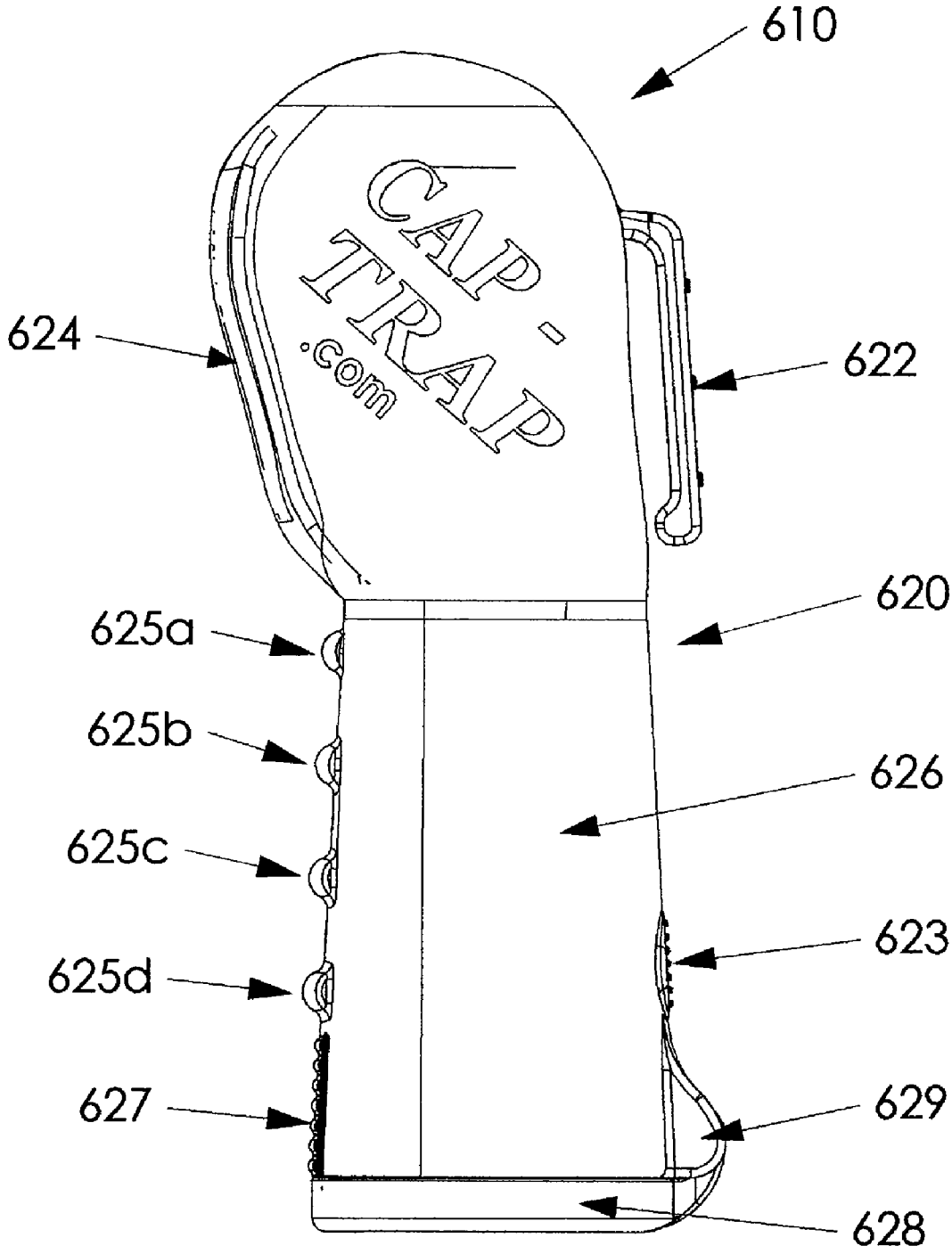
FIG. 47 is a left side view of design variation 6.
Figure 48:
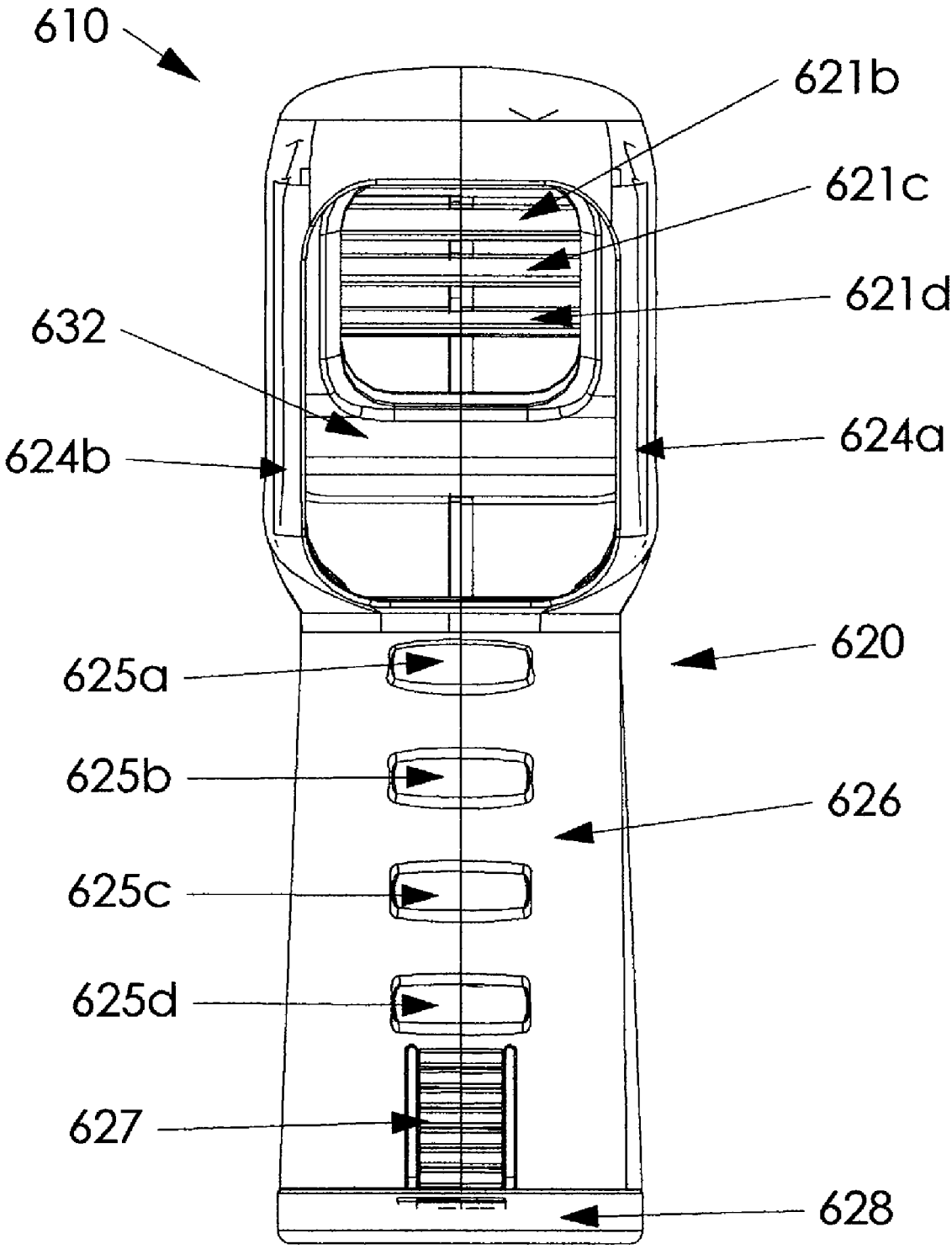
FIG. 48 is a front view of design variation 6.
Figure 49:
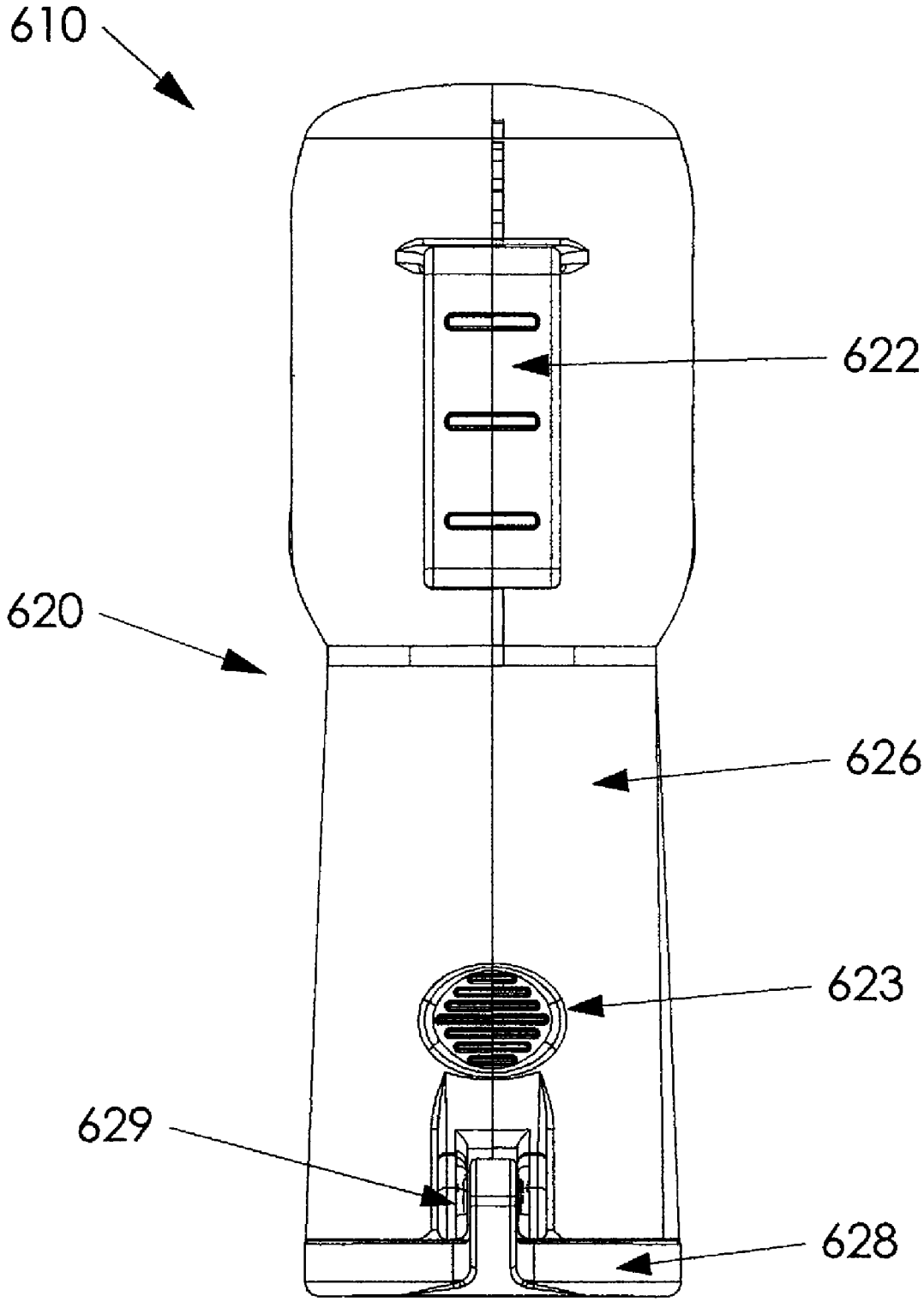
FIG. 49 is a back view of design variation 6.
Figure 50:
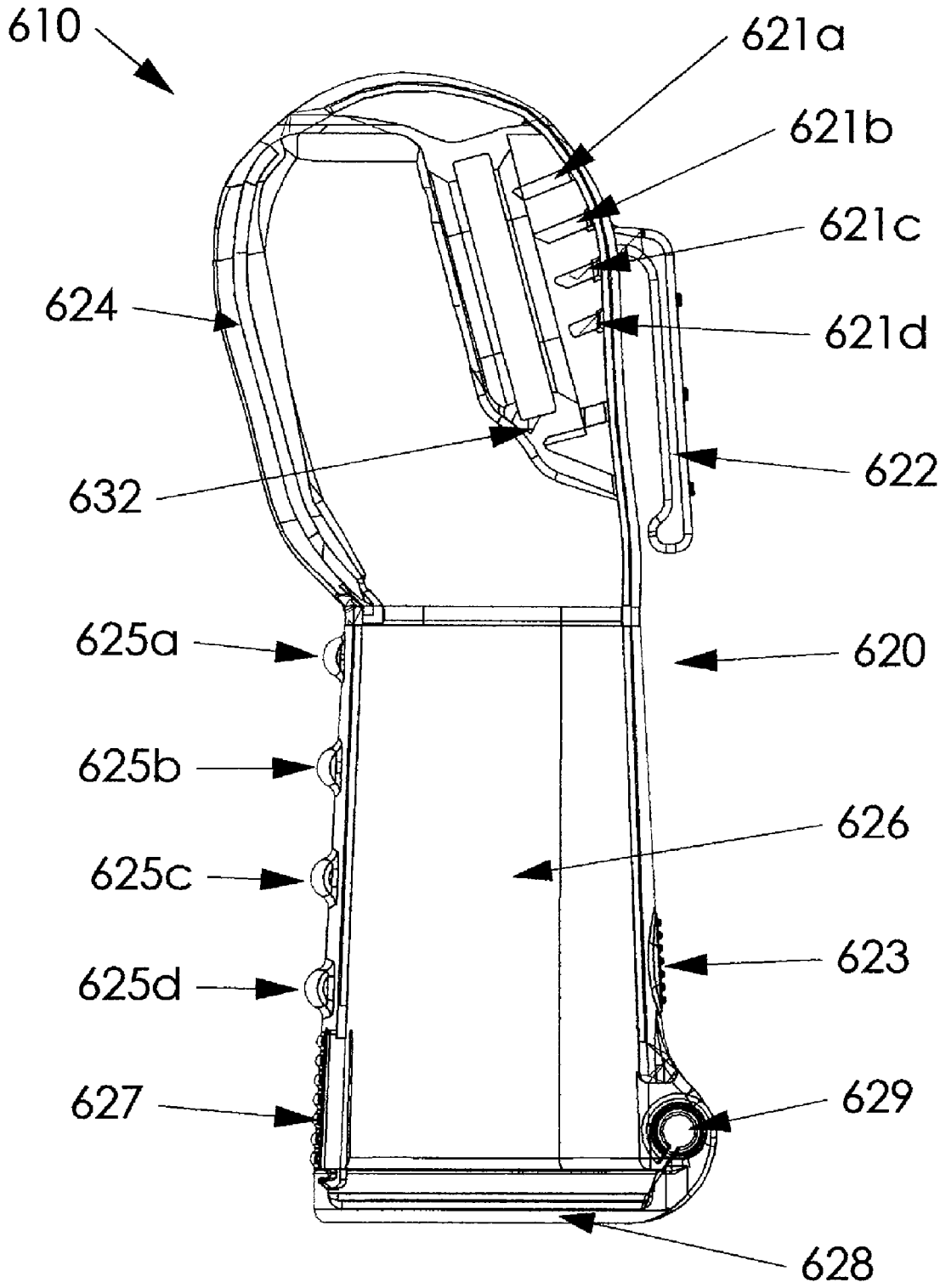
FIG. 50 is an inside cut-away view of design variation 6.
Figure 51:
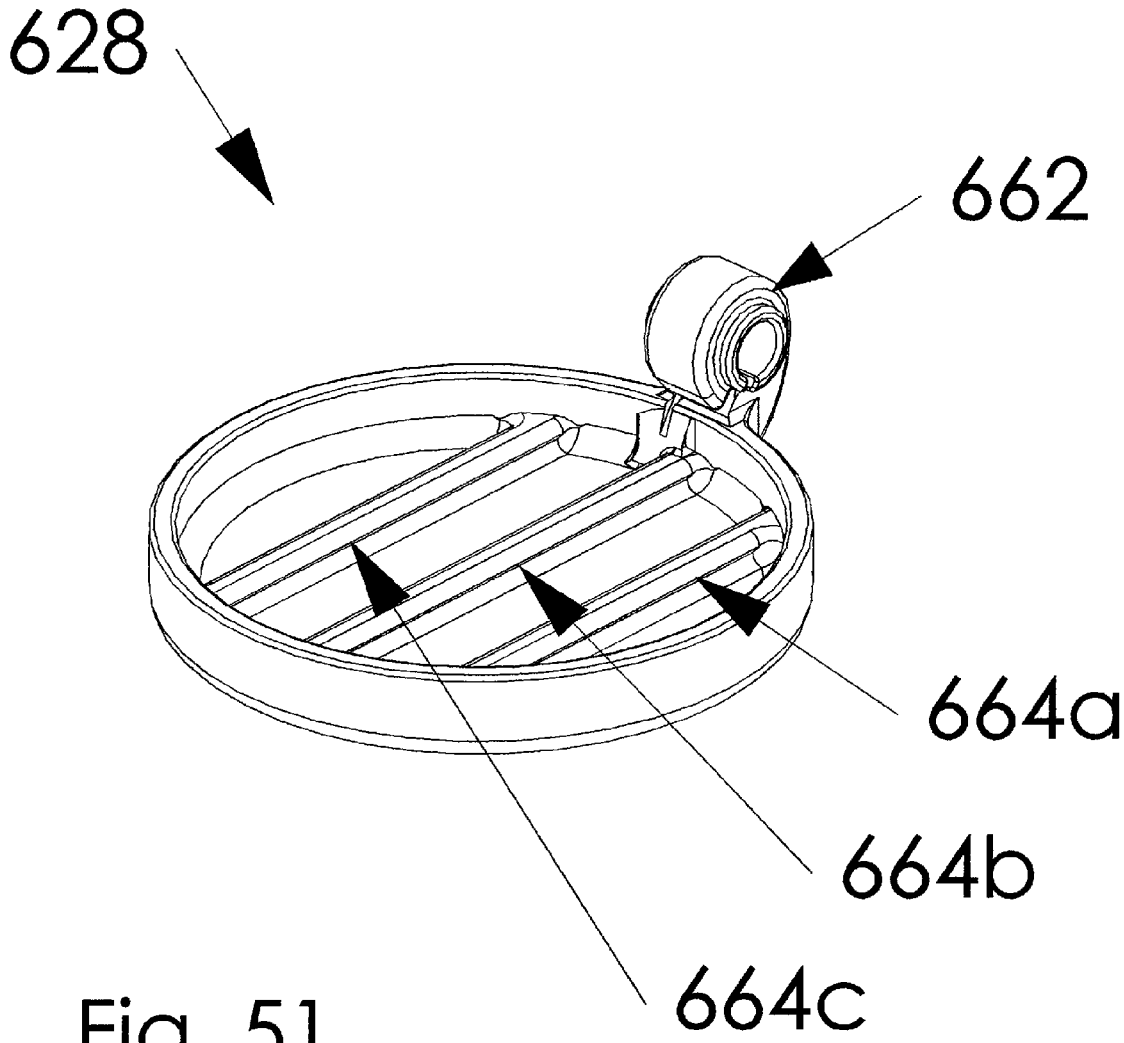
FIG. 51 is a front perspective view of design variation 6 bottom door 628 in detail.
Figure 52:
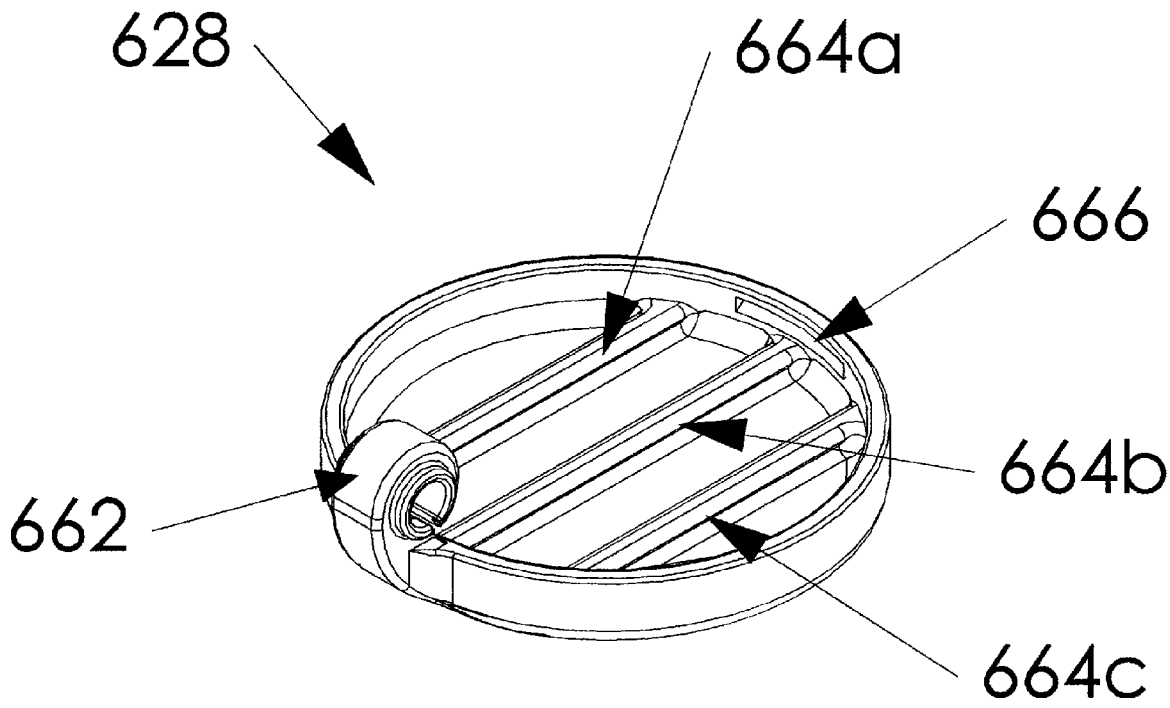
FIG. 52 is a back perspective view of design variation 6 bottom door 628 in detail.
Figure 53:
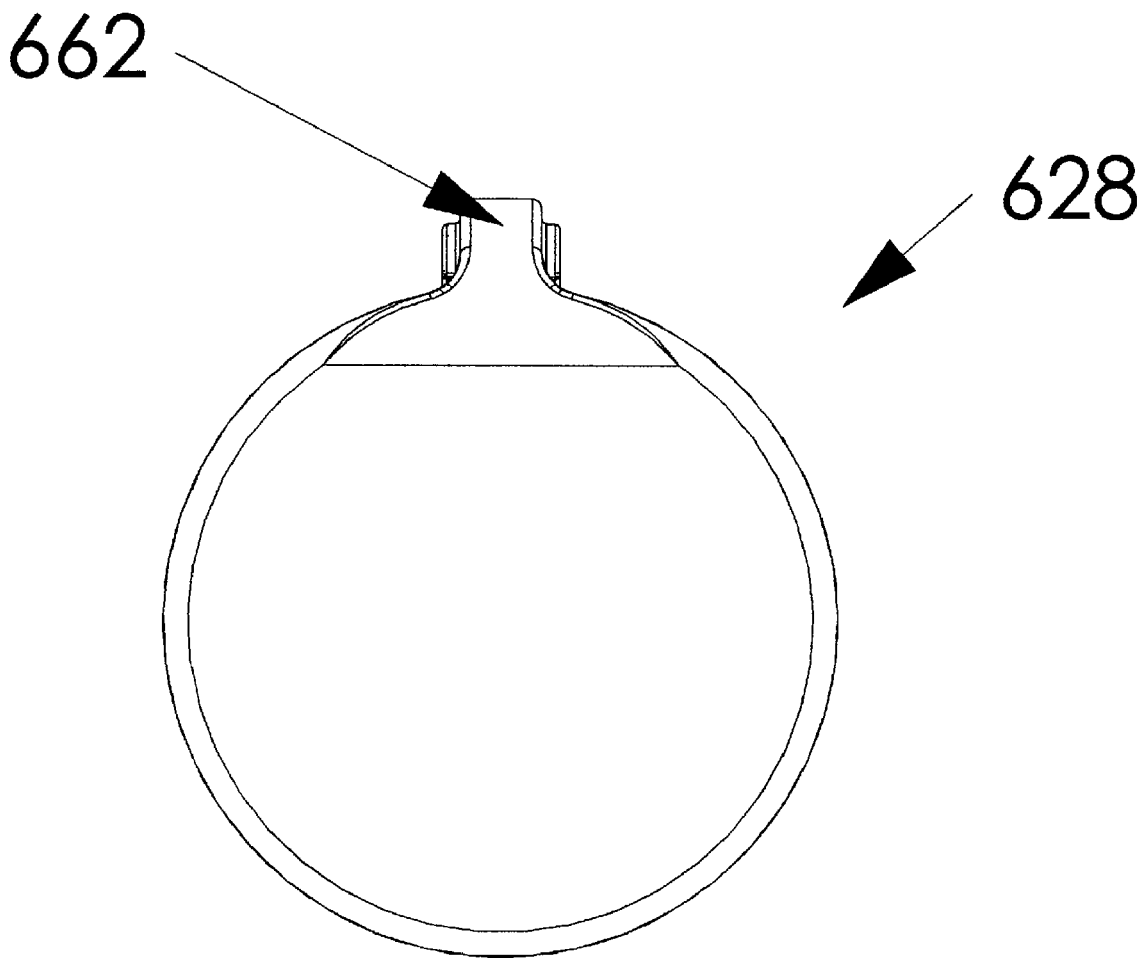
FIG. 53 is a bottom view of design variation 6 bottom door 628 in detail.
Figure 54:
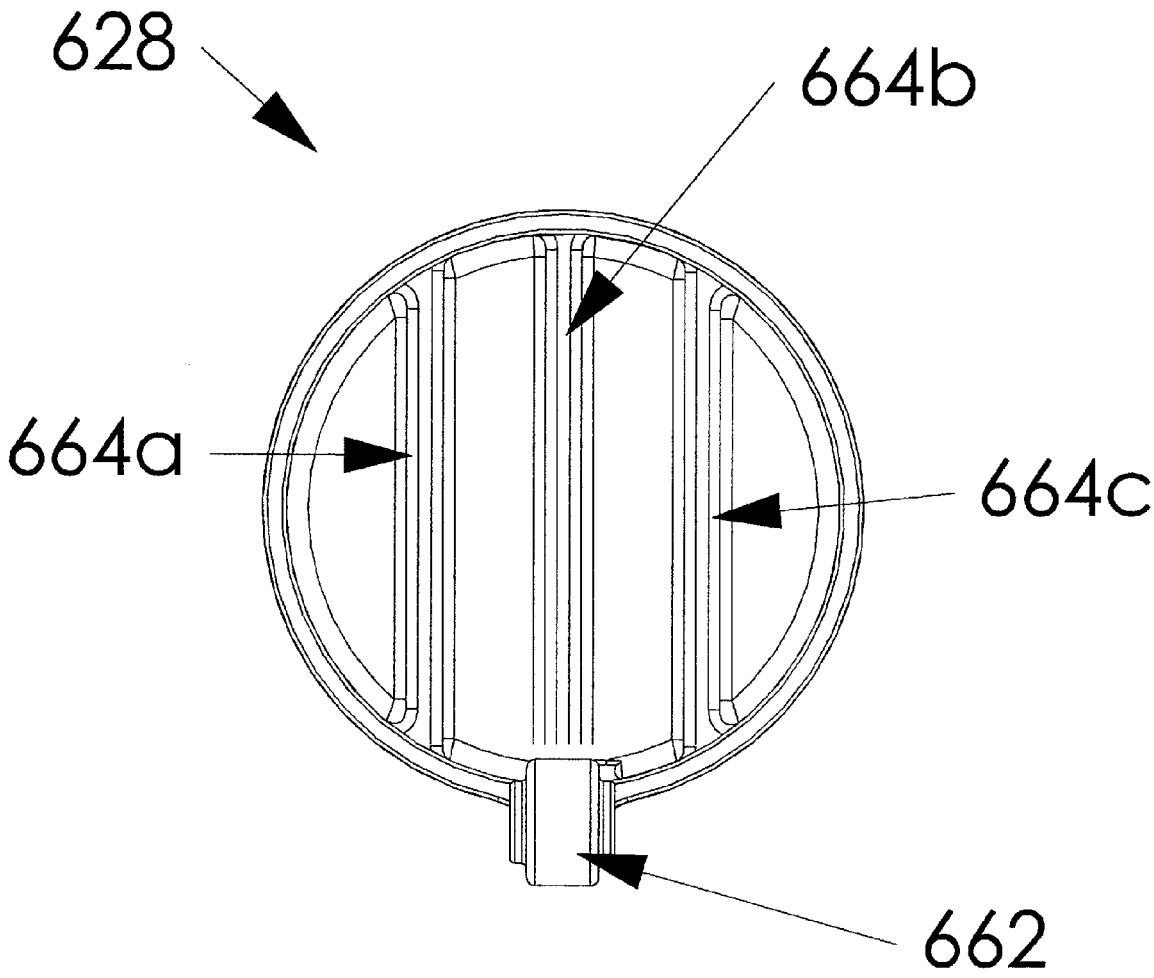
FIG. 54 is a top view of design variation 6 bottom door 628 in detail.
Figure 55:
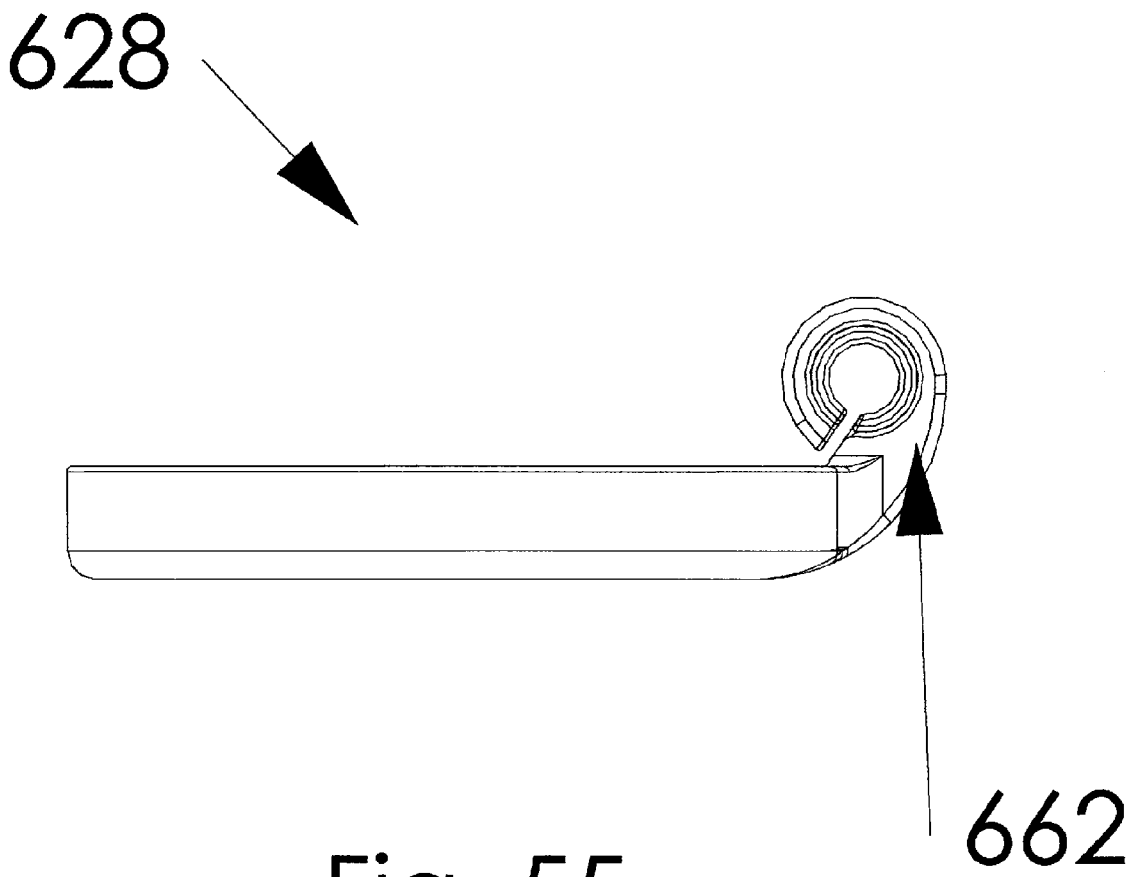
FIG. 55 is a side view of design variation 6 bottom door 628 in detail.
Figure 56:
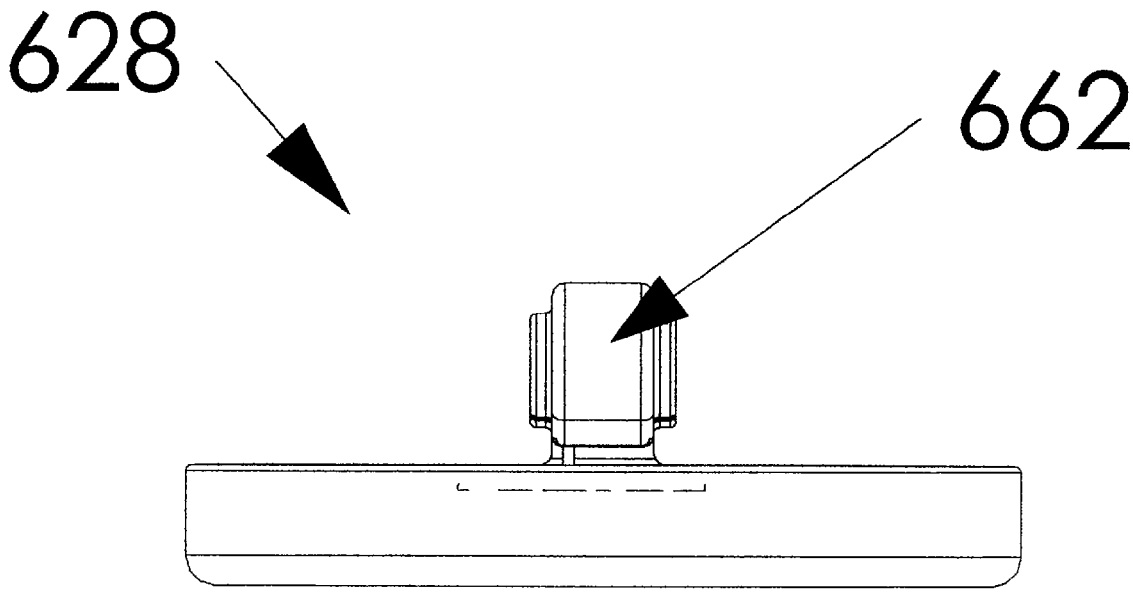
FIG. 56 is a front view of design variation 6 bottom door 628 in detail.
Figure 57:
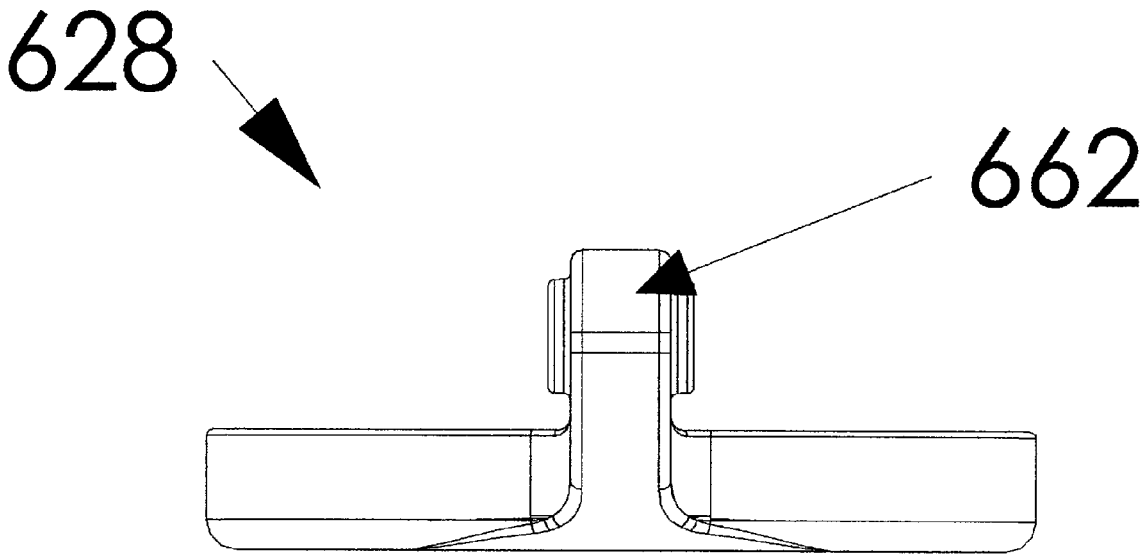
FIG. 57 is a back view of design variation 6 bottom door 628 in detail.
Figure 58:
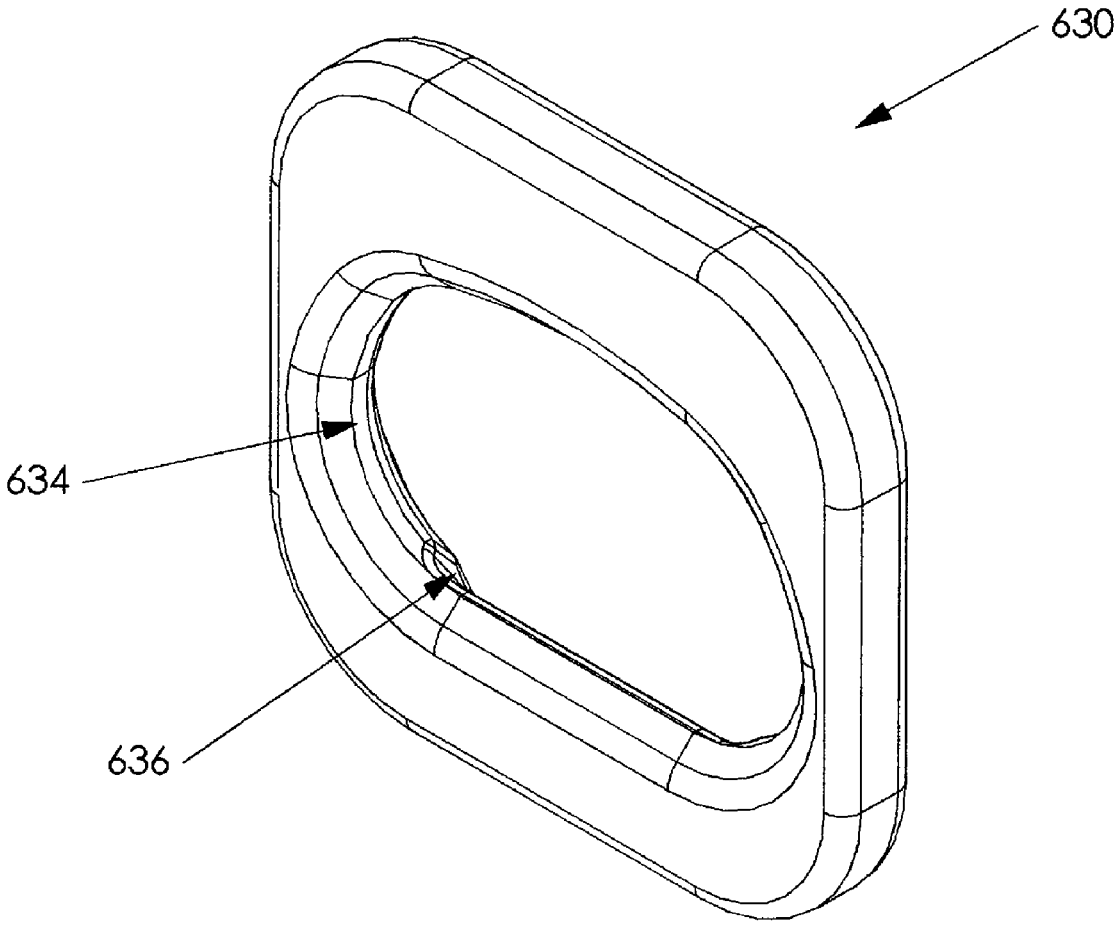
FIG. 58 is a front perspective view of design variation 6 metal piece 630 in detail.
Figure 59:
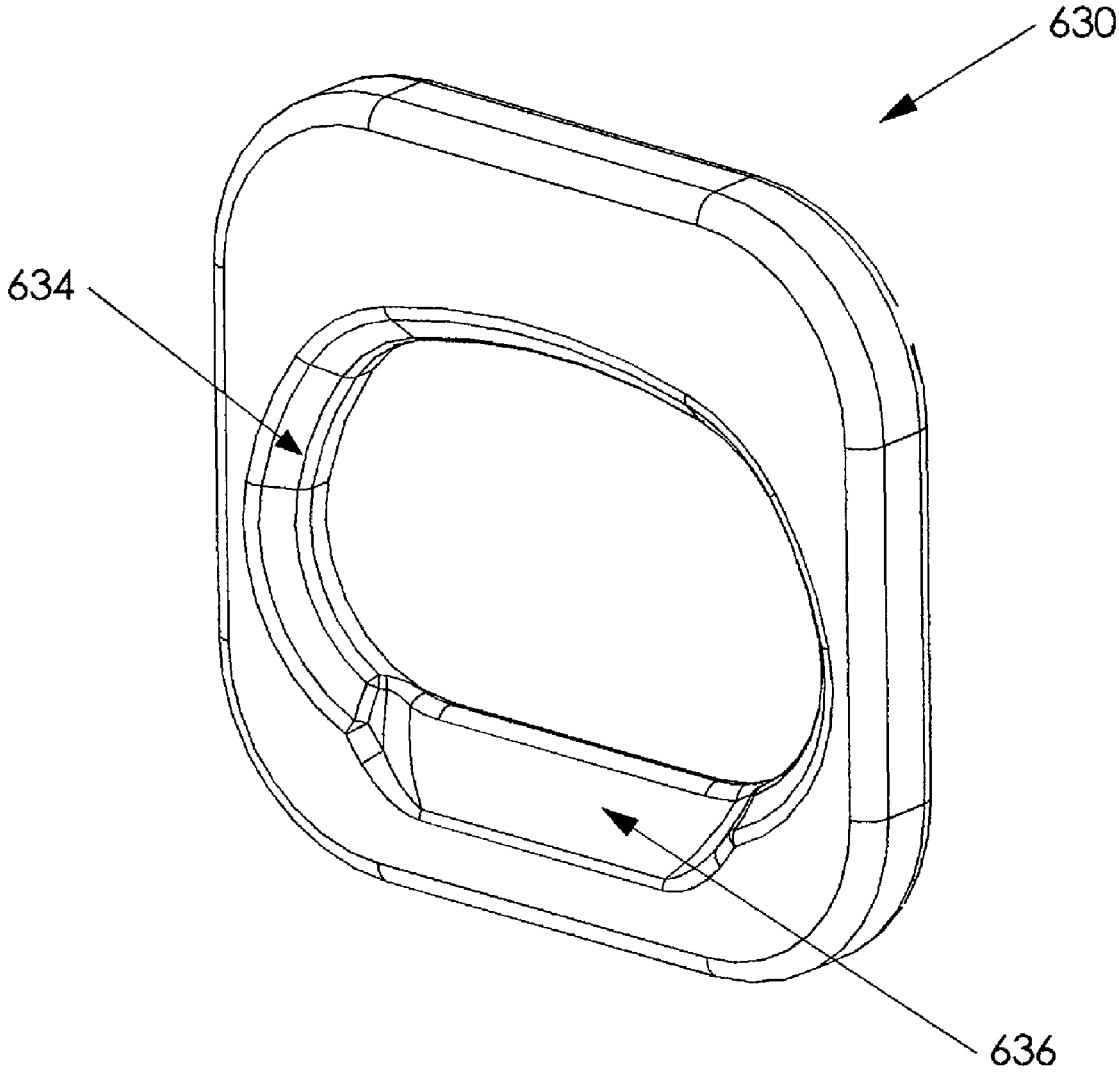
FIG. 59 is a back perspective view of design variation 6 metal piece 630 in detail.
Figure 60:
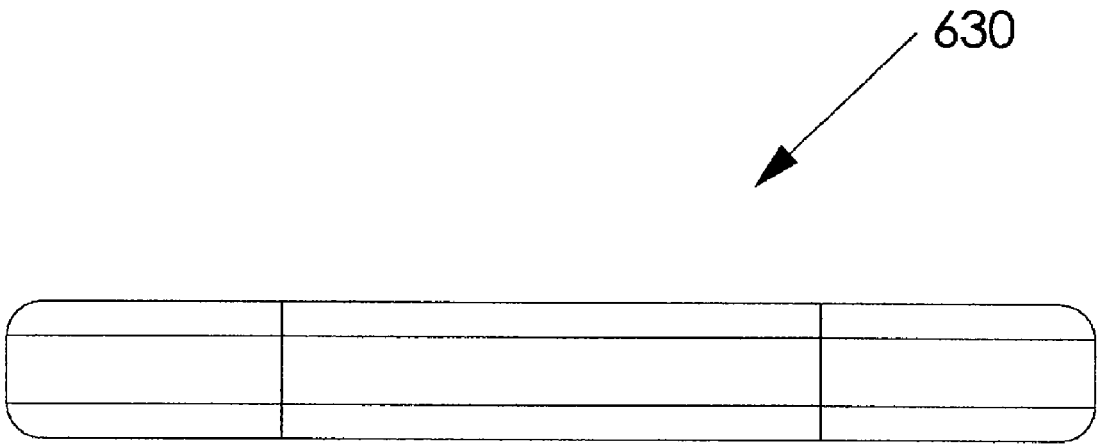
FIG. 60 is a top or bottom view of design variation 6 metal piece 630 in detail.
Figure 61:
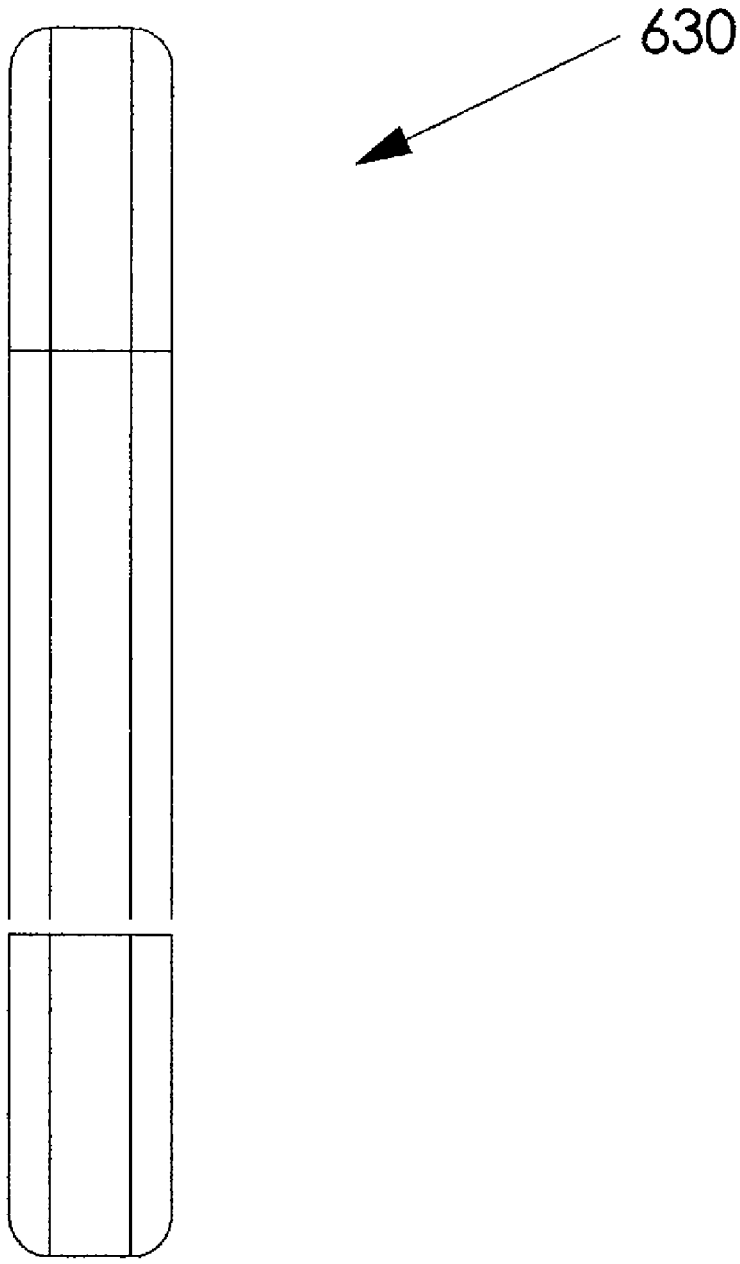
FIG. 61 is a side view of design variation 6 metal piece 630 in detail.
Figure 62:
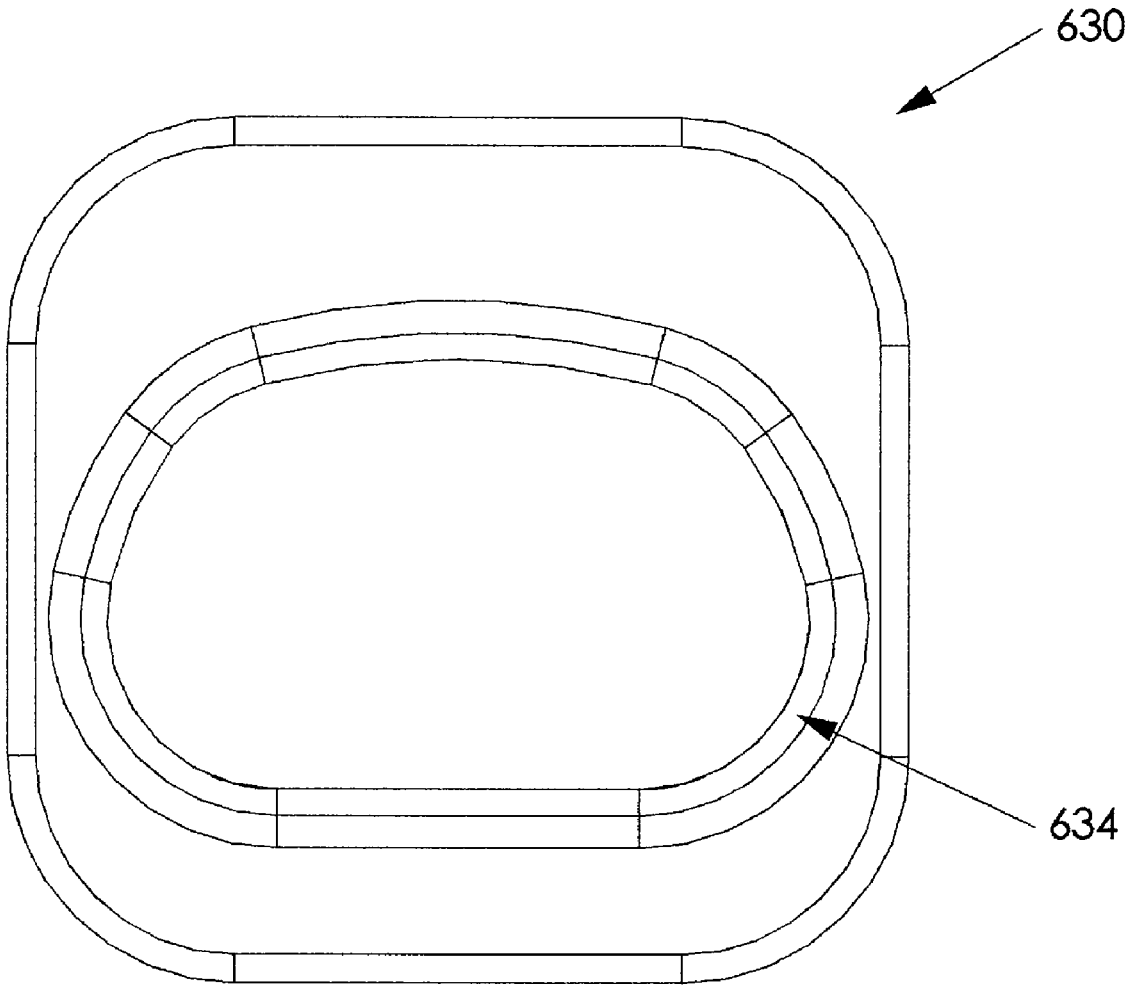
FIG. 62 is a front view of design variation 6 metal piece 630 in detail.
Figure 63:
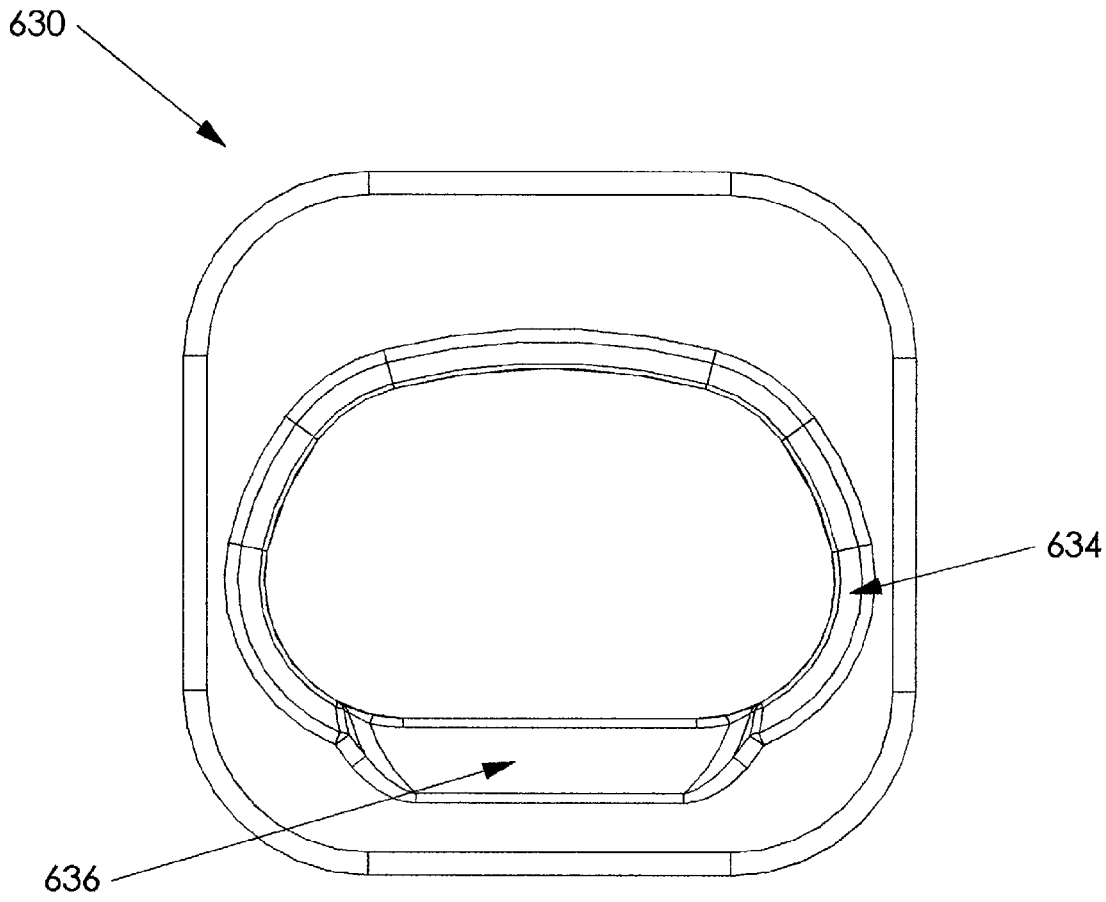
FIG. 63 is a back view of design variation 6 metal piece 630 in detail.
Figure 64:
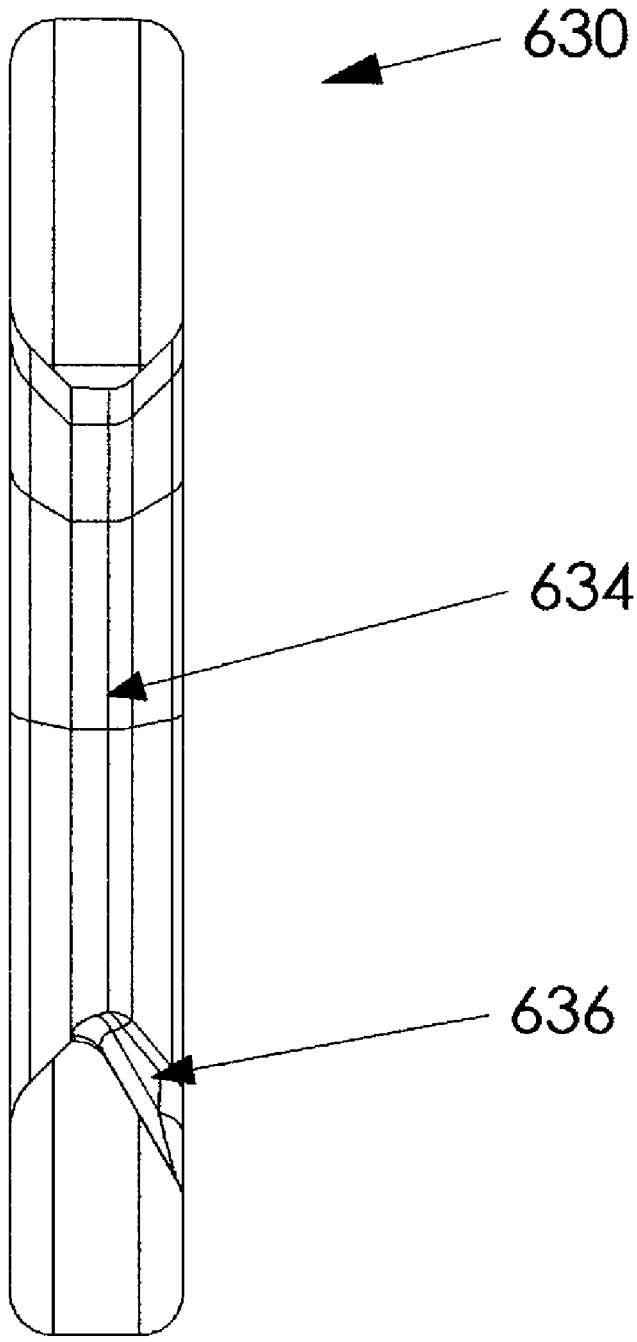
FIG. 64 is an inside cut-away view of design variation 6 metal piece 630 in detail.
Figure 65:
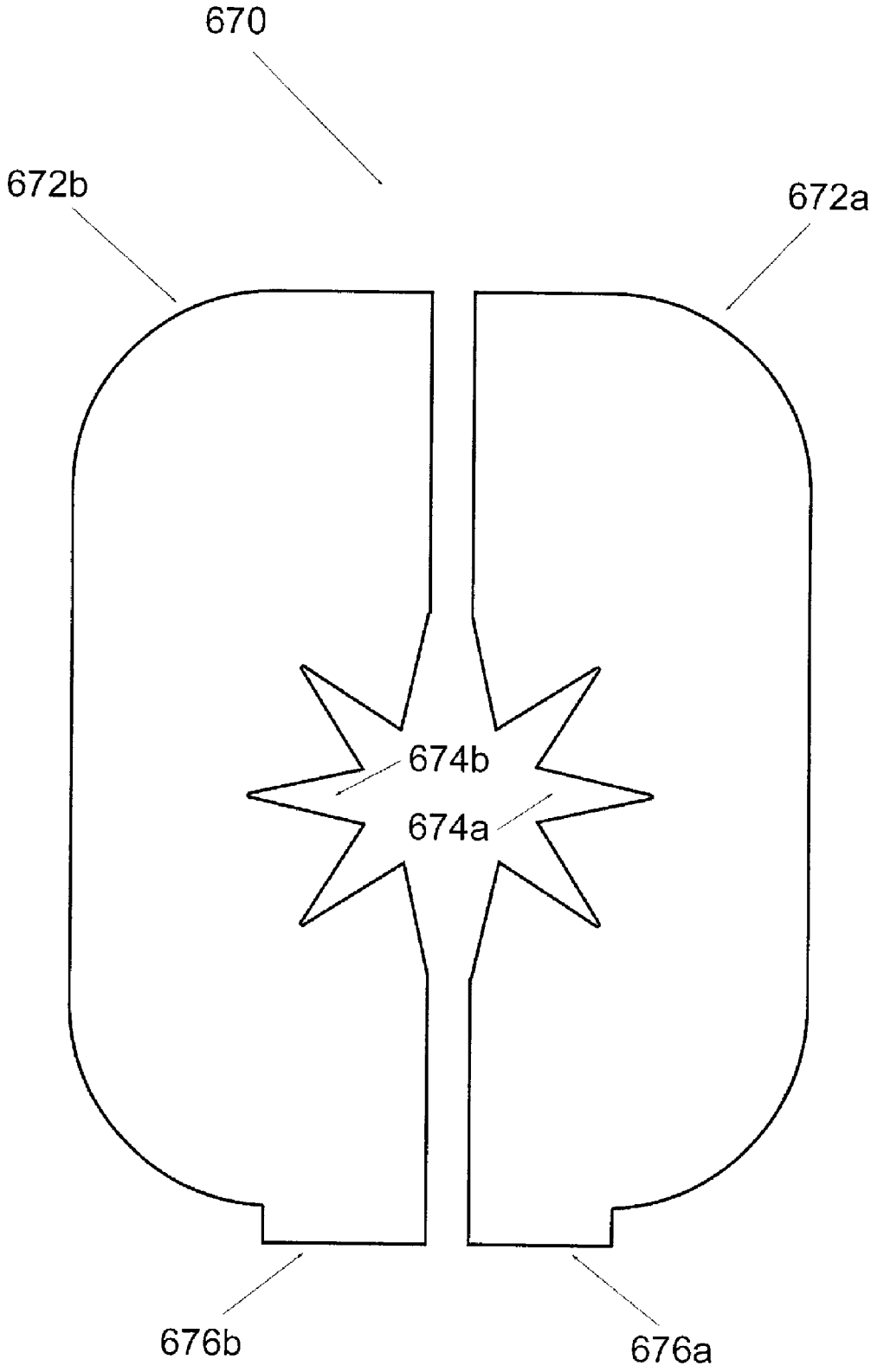
FIG. 65 is a front view of design variation 6 flexible doors design attached to 624.
Figure 66:
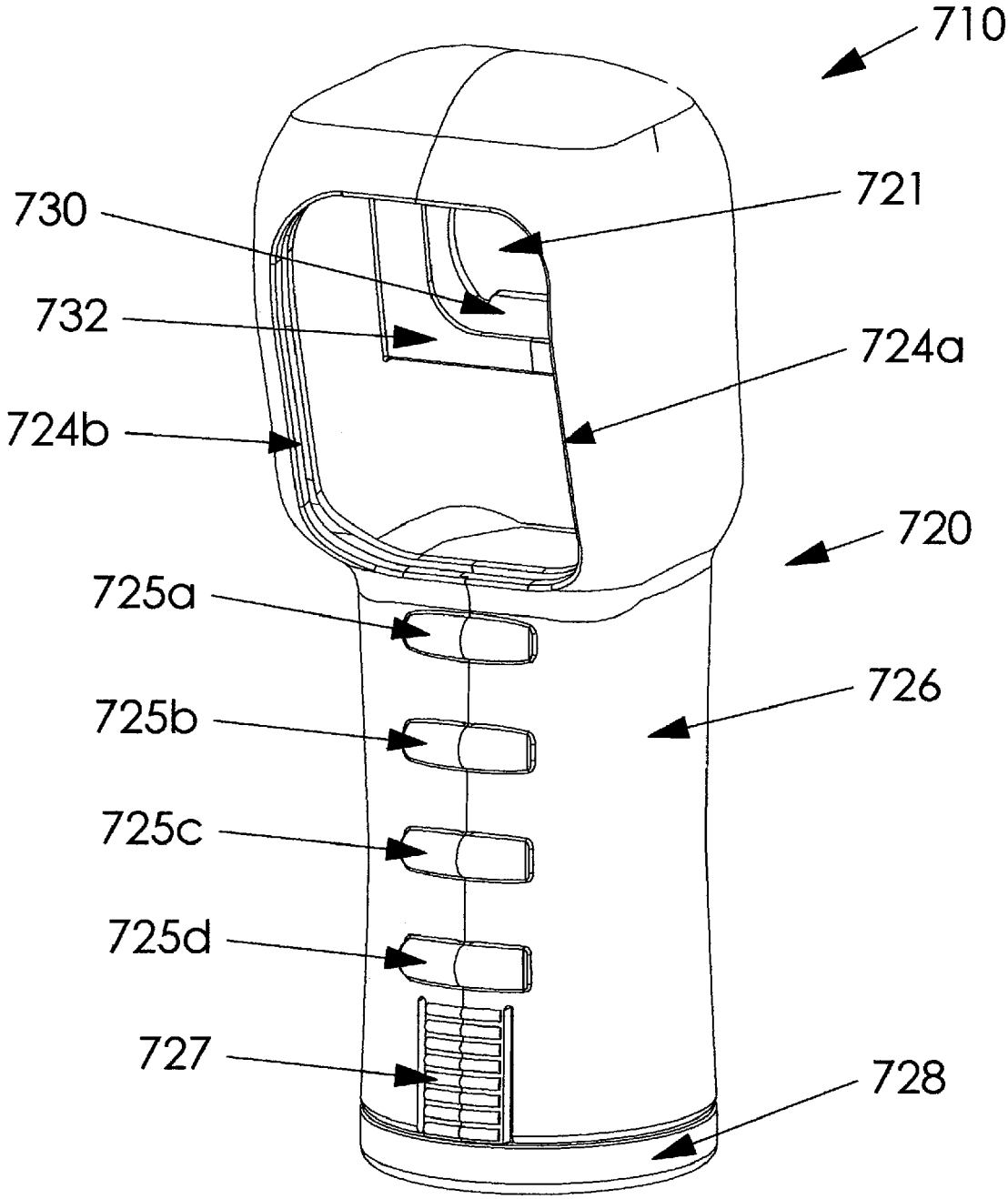
FIG. 66 is a front perspective view of design variation 7 of a bottle opener and bottle cap collecting and disposing device in accordance with the present invention.
Figure 67:
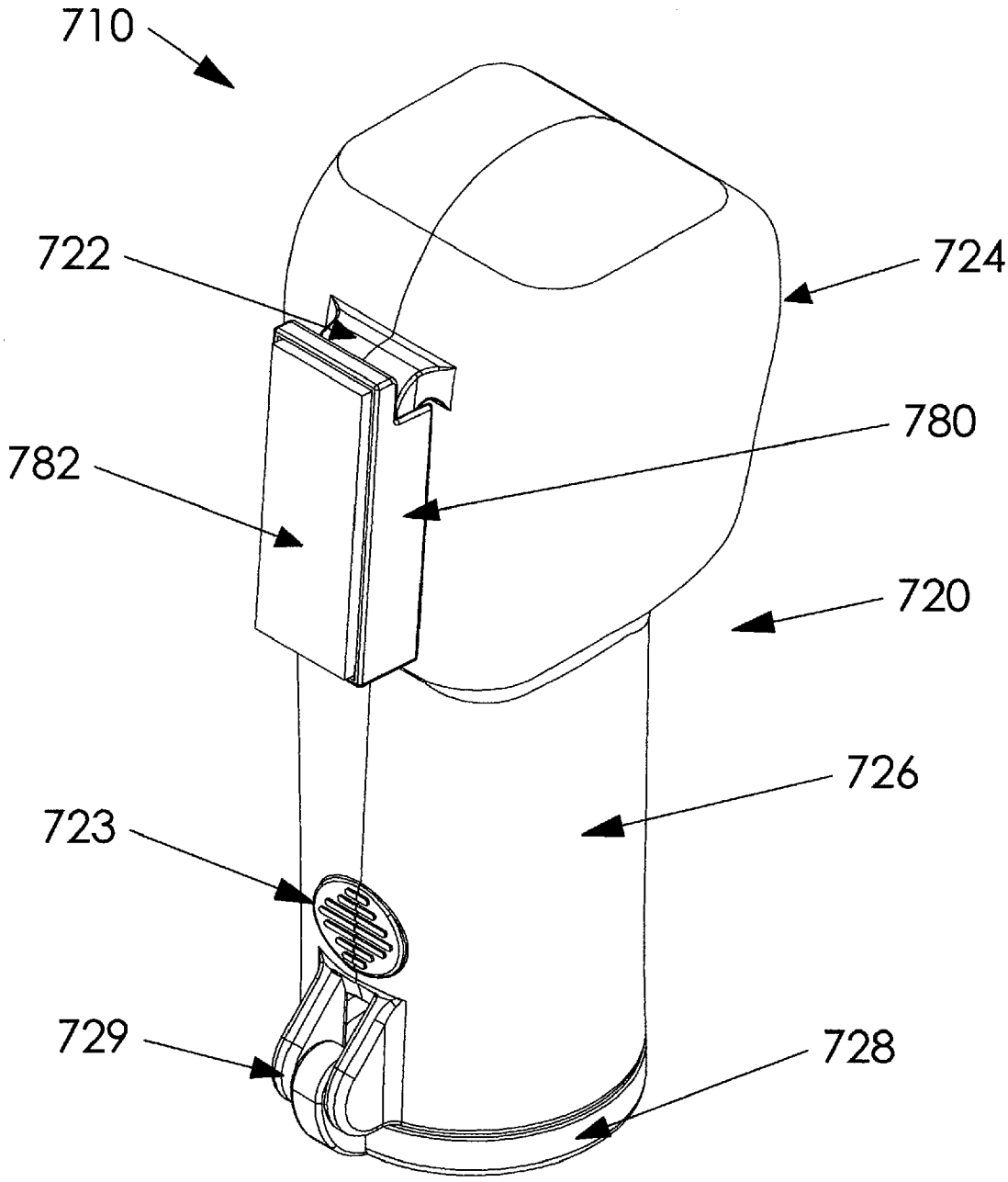
FIG. 67 is a back perspective view of design variation 7.
Figure 68:
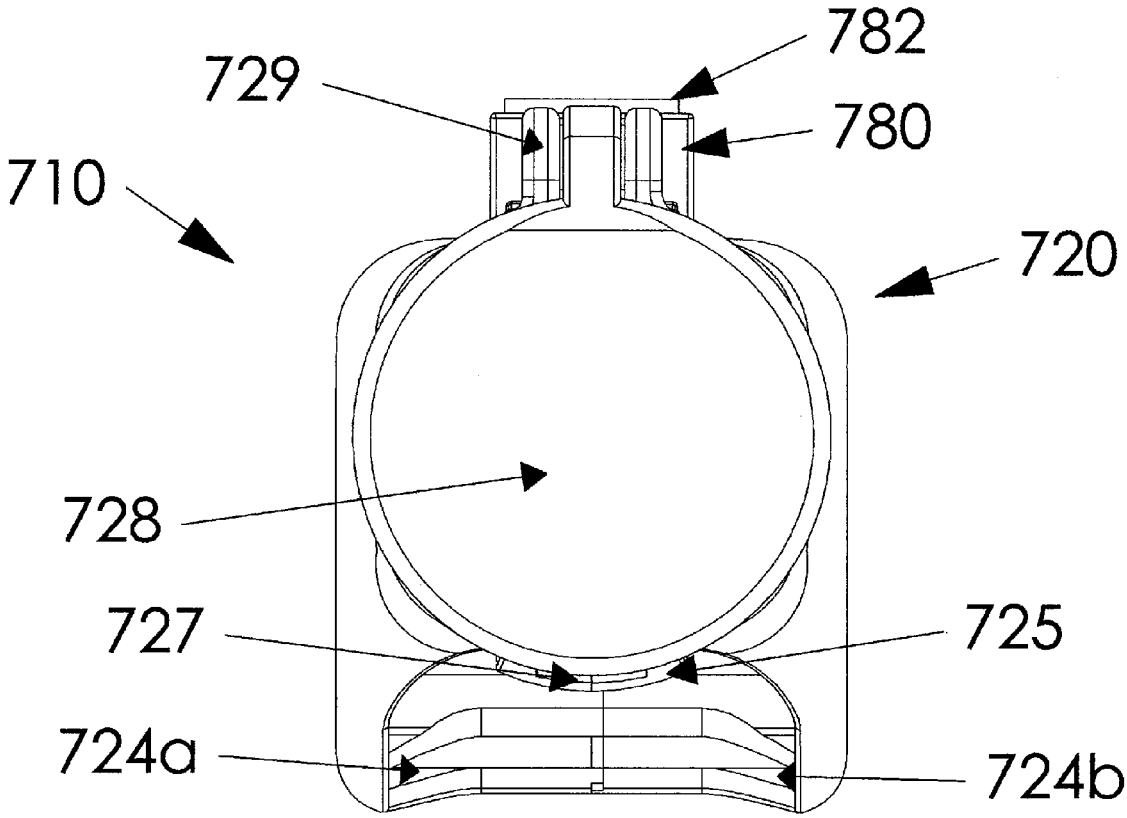
FIG. 68 is a bottom view of design variation 7.
Figure 69:
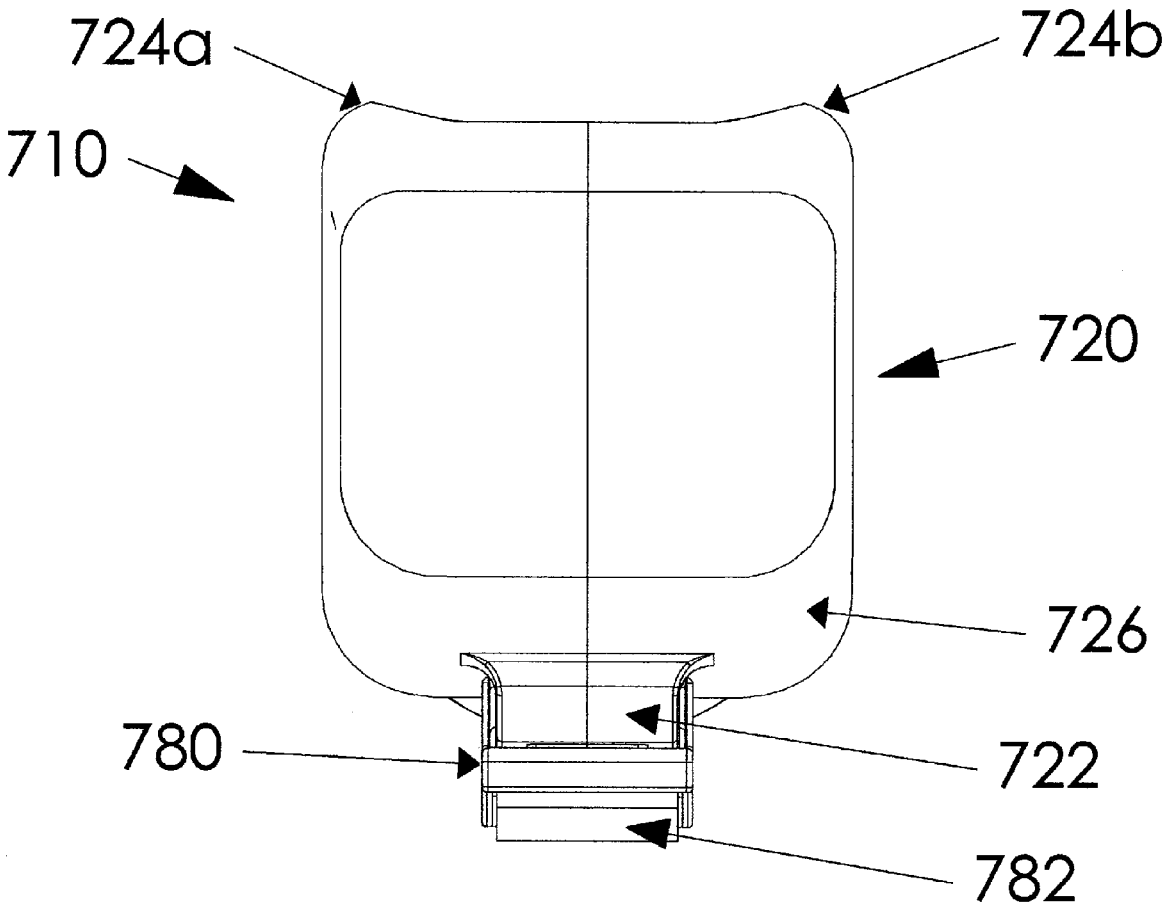
FIG. 69 is a top view of design variation 7.
Figure 70:
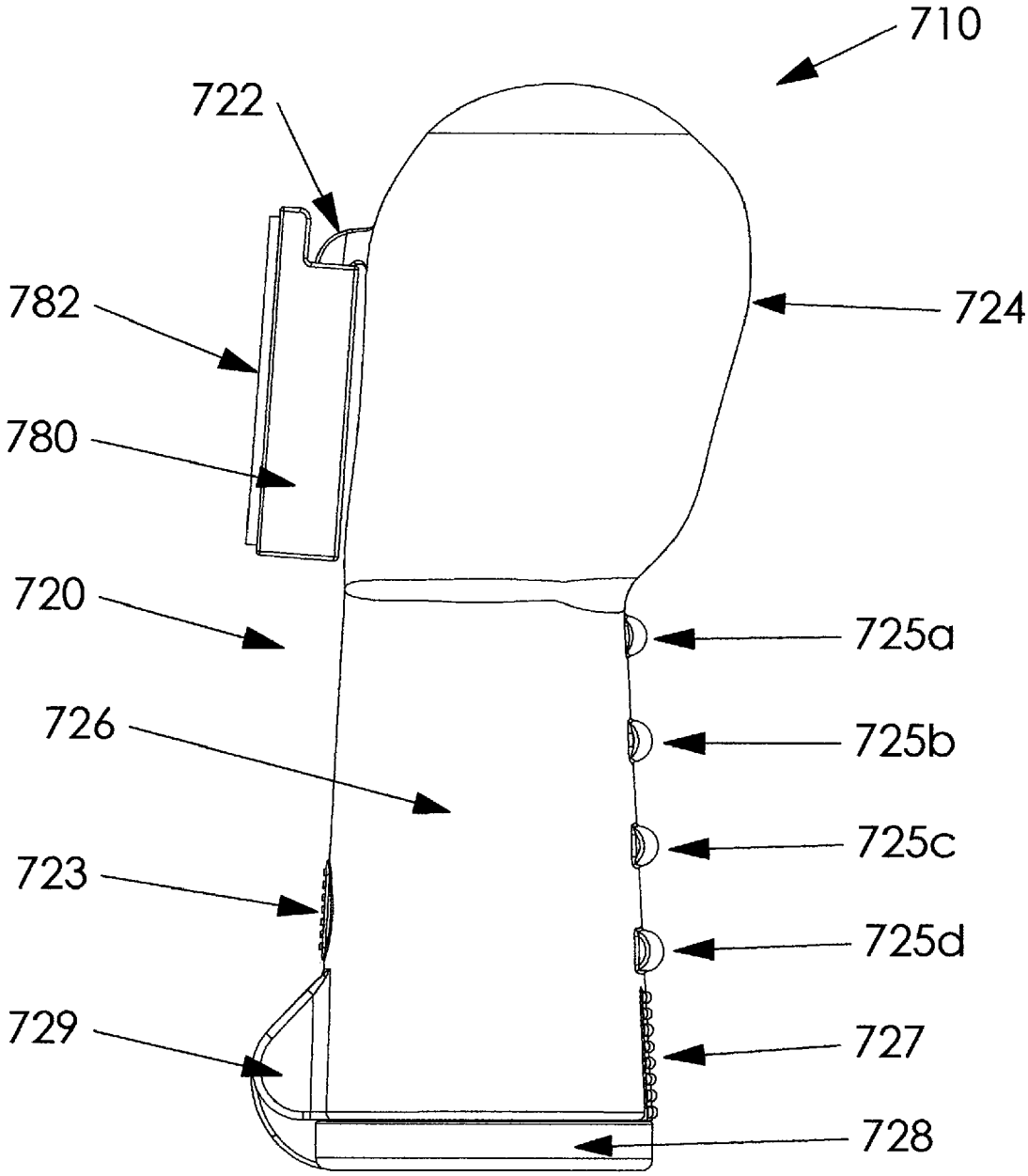
FIG. 70 is a right side view of design variation 7.
Figure 71:
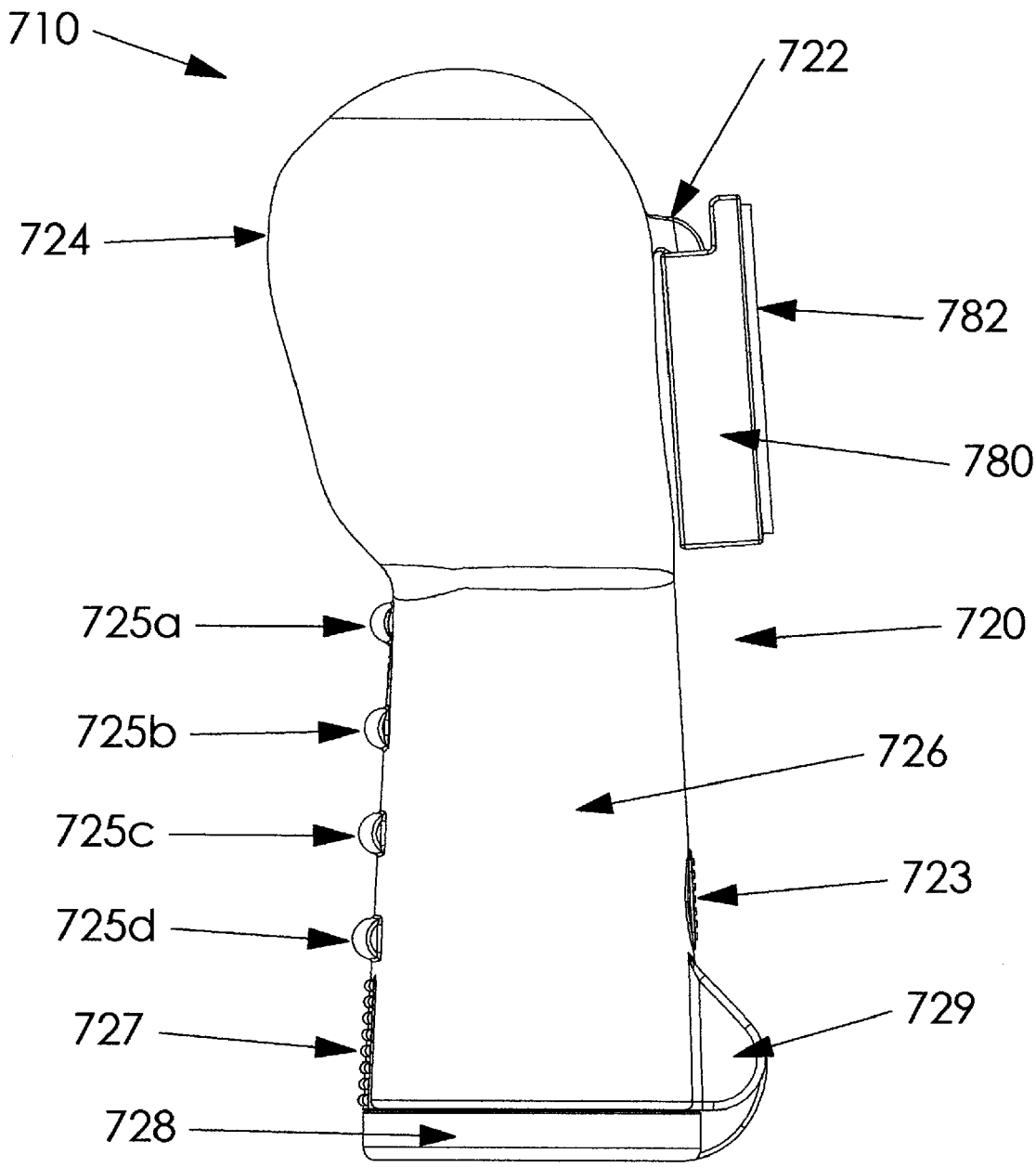
FIG. 71 is a left side view of design variation 7.
Figure 72:
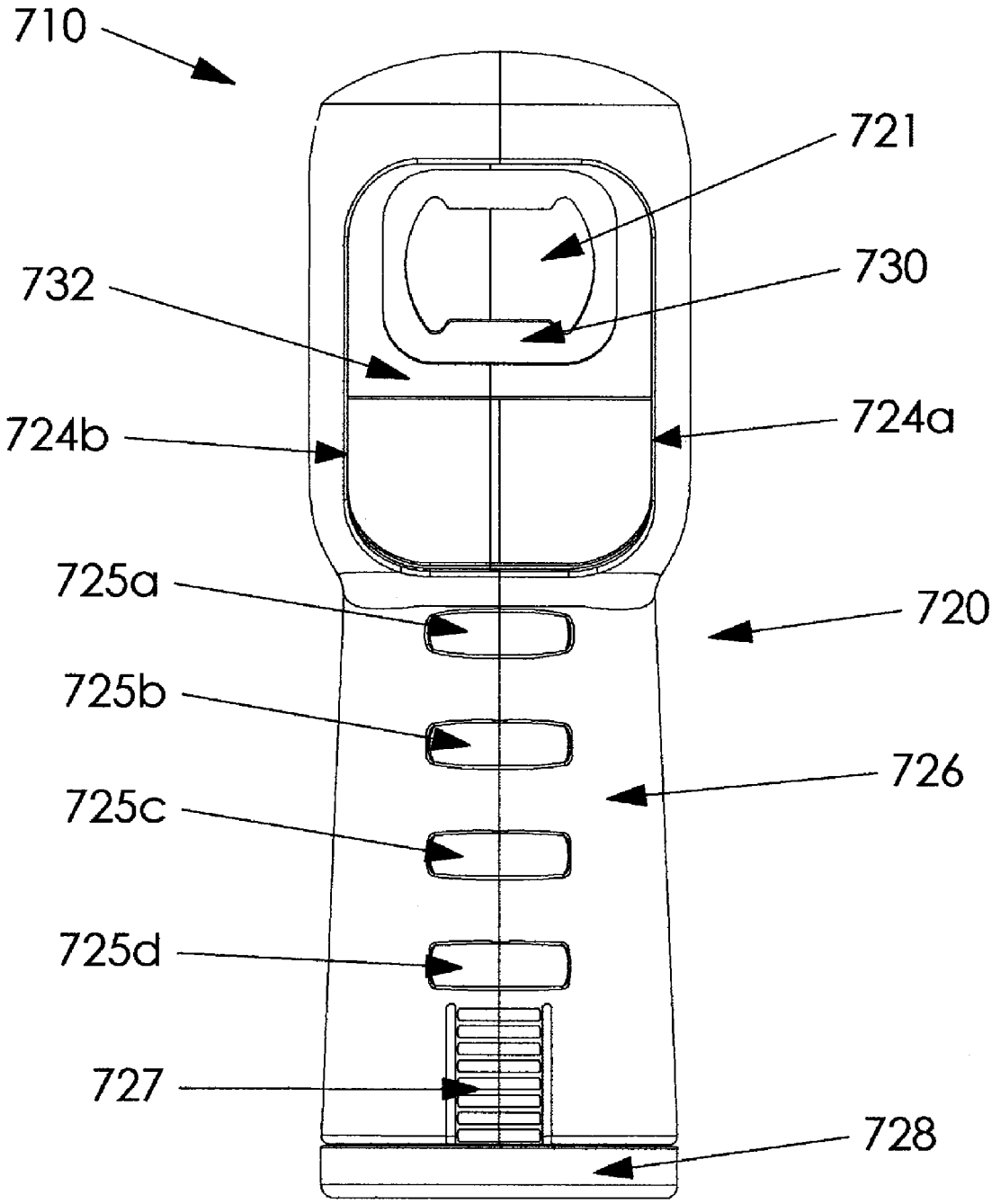
FIG. 72 is a front view of design variation 7.
Figure 73:
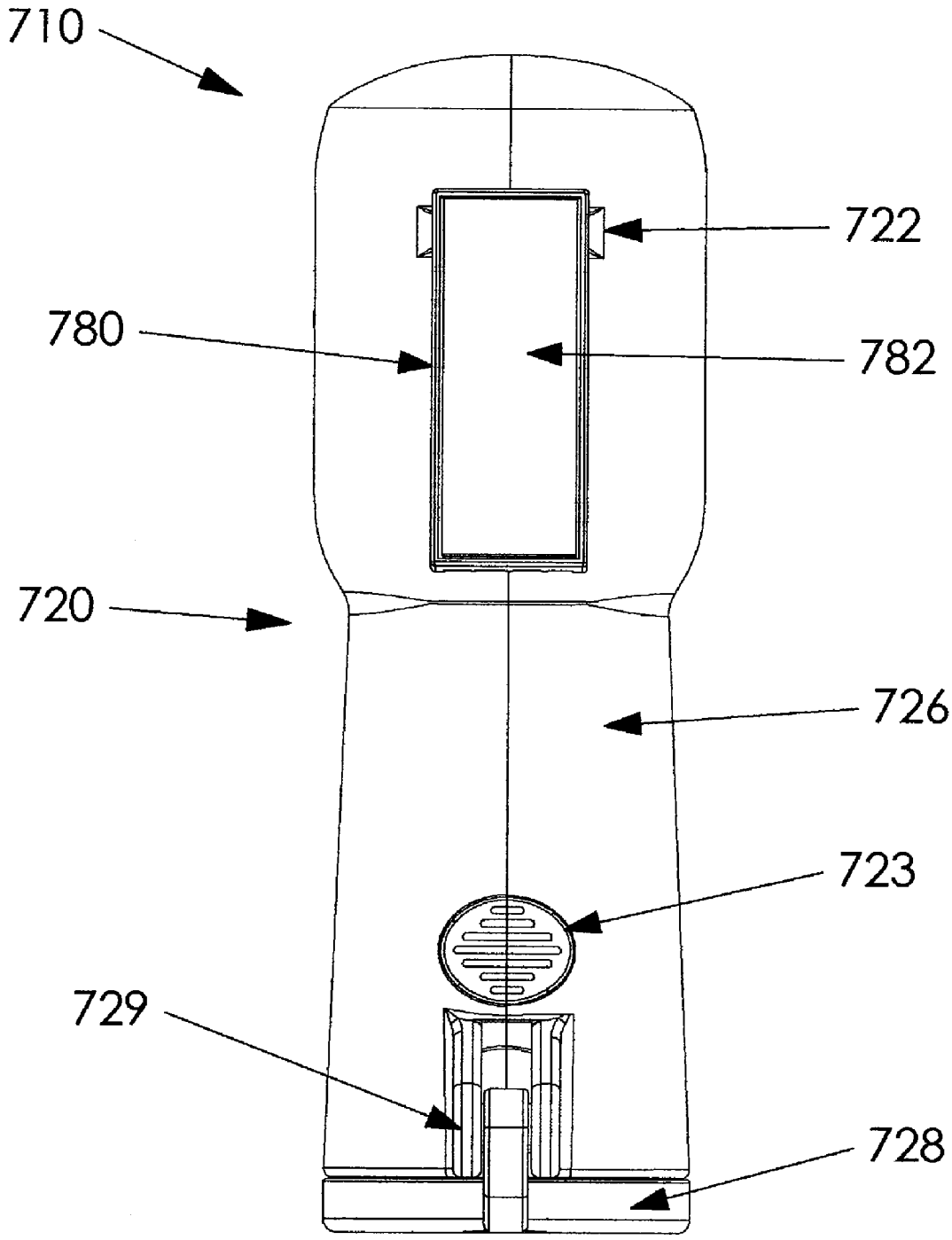
FIG. 73 is a back view of design variation 7.
Figure 74:
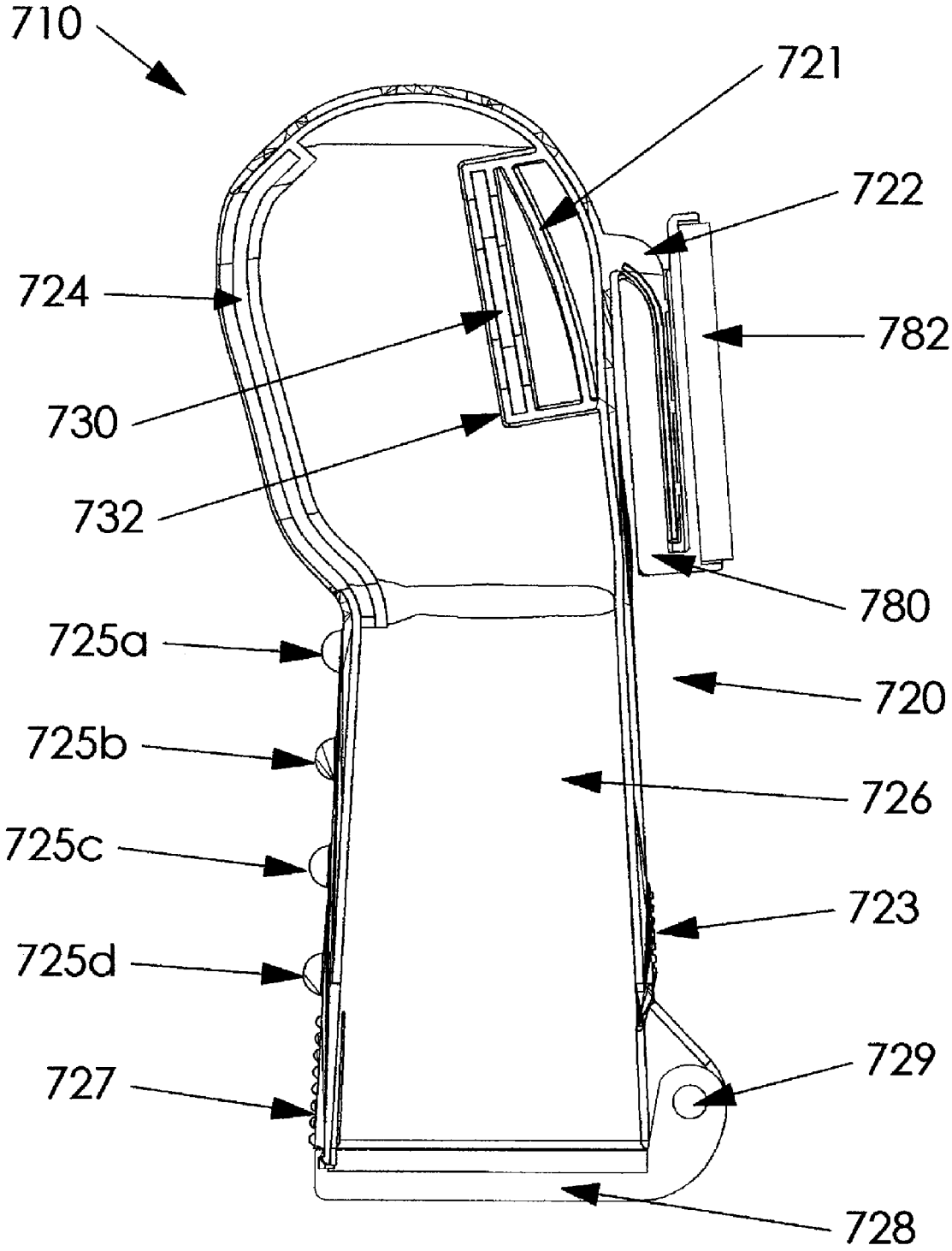
FIG. 74 is an inside cut-away view of design variation 7.
Figure 75:
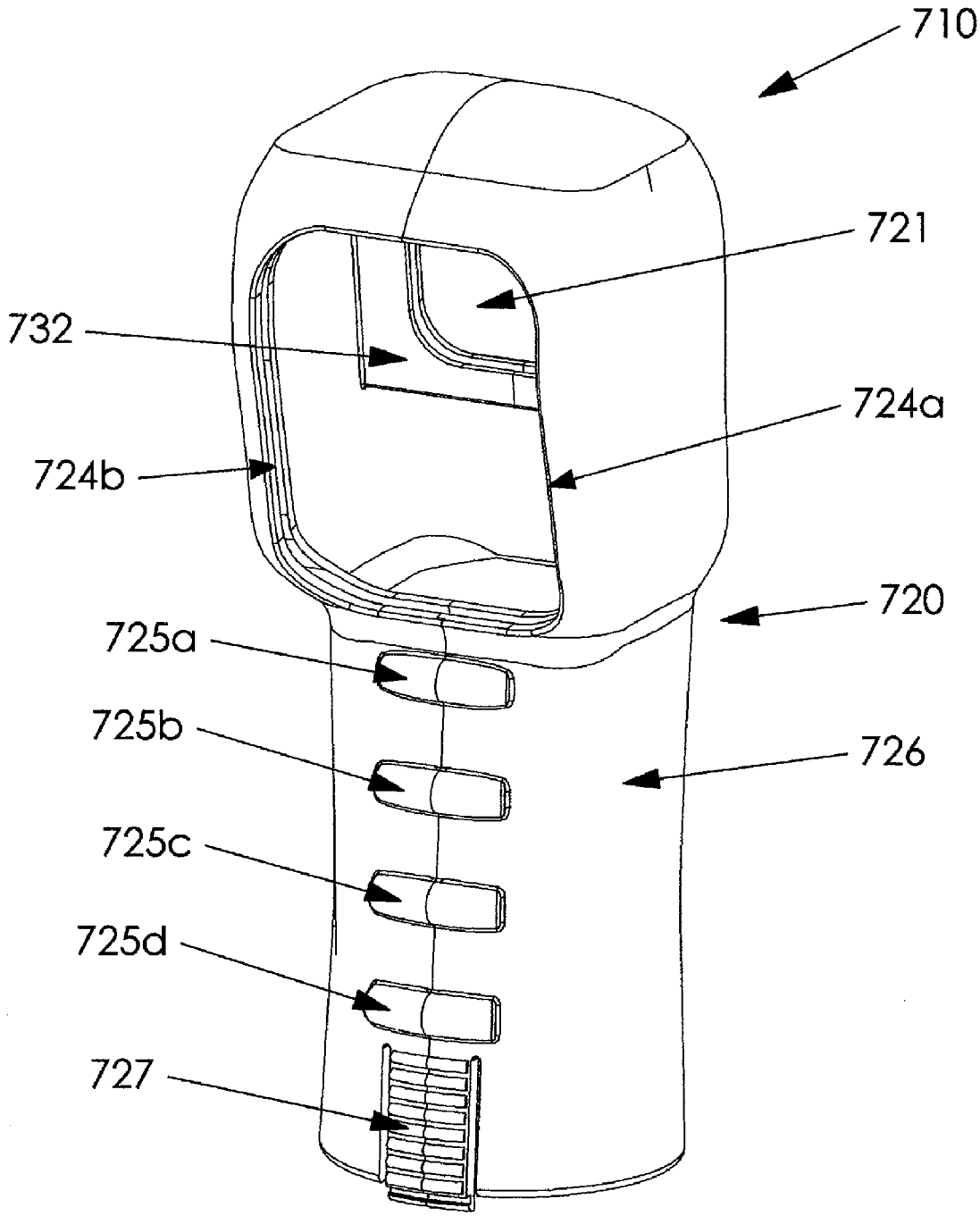
FIG. 75 is a front perspective view of design variation 7 housing body 720 in detail.
Figure 76:
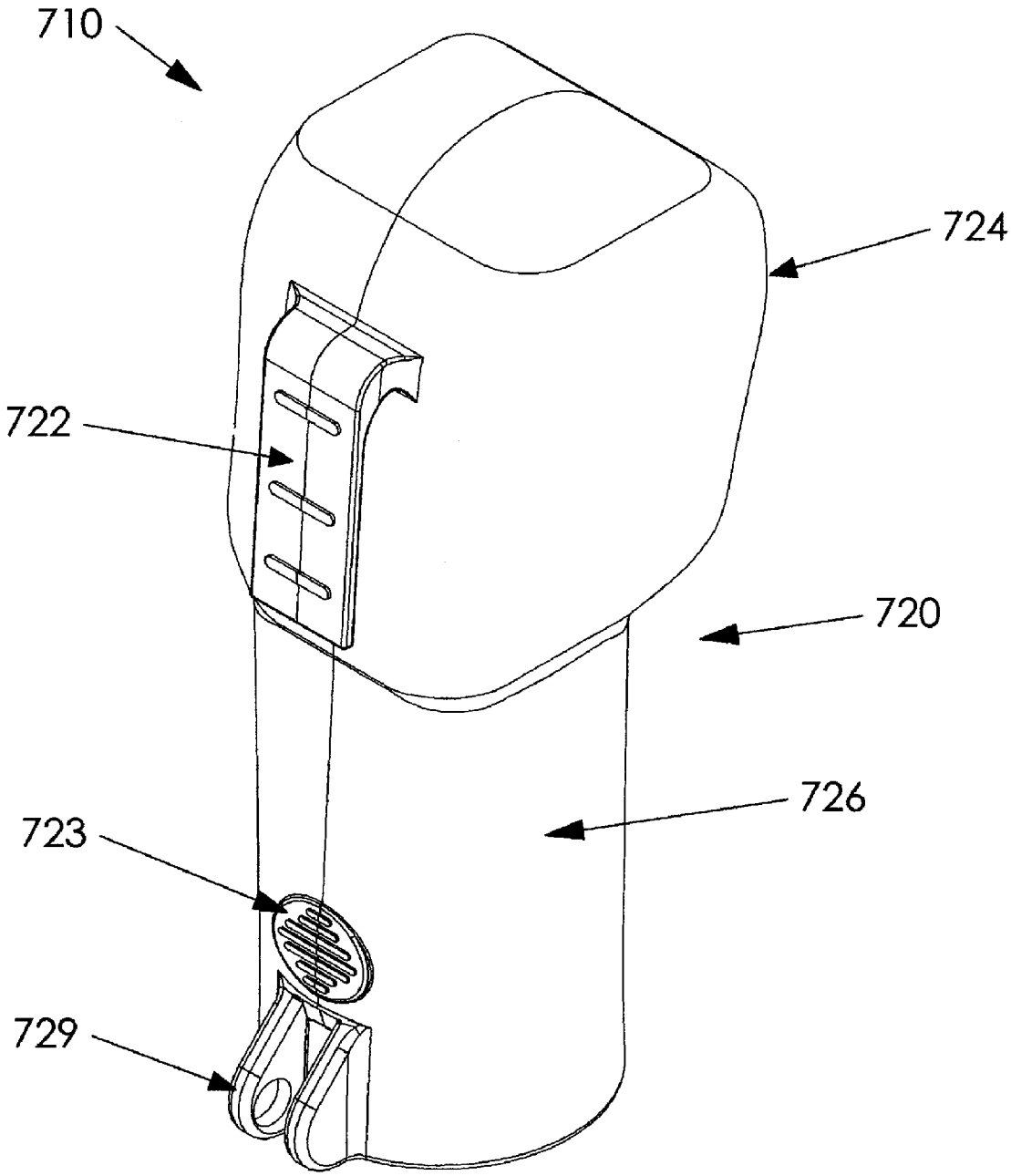
FIG. 76 is a back perspective view of design variation 7 housing body 720 in detail.
Figure 77:
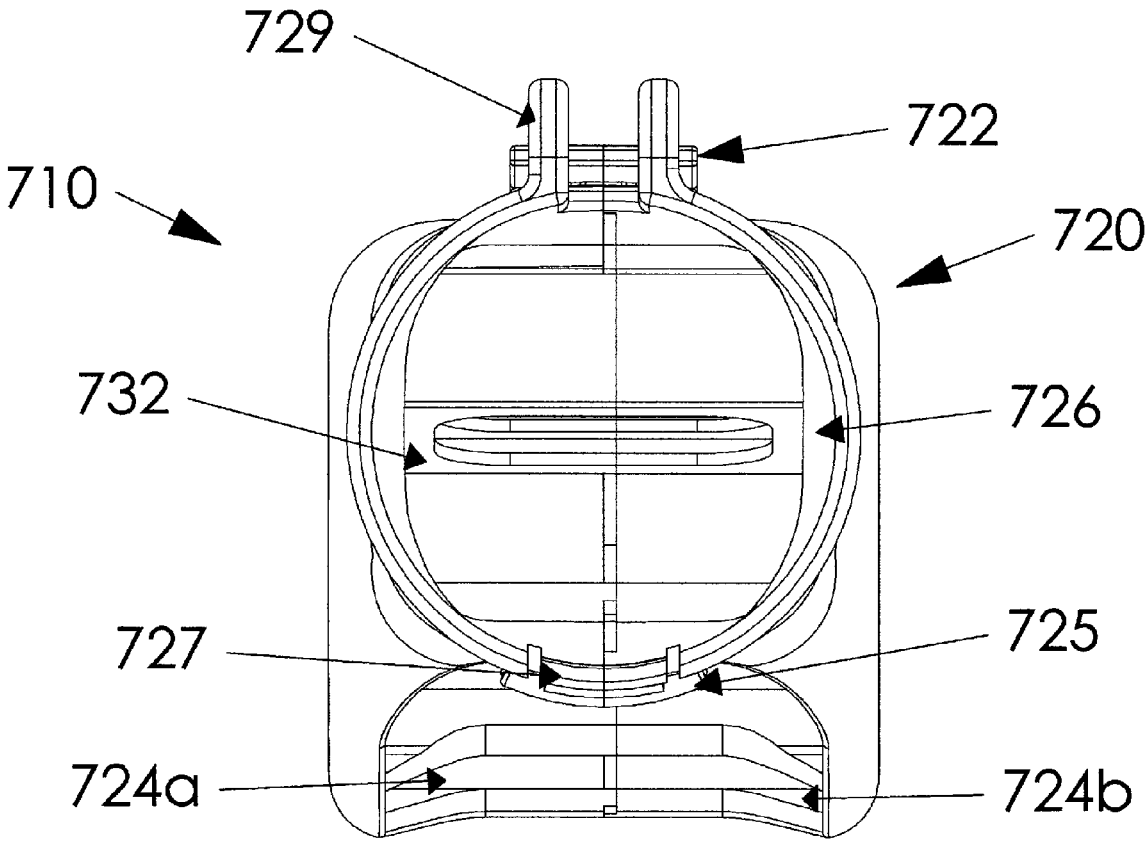
FIG. 77 is a bottom view of design variation 7 housing body 720 in detail.
Figure 78:
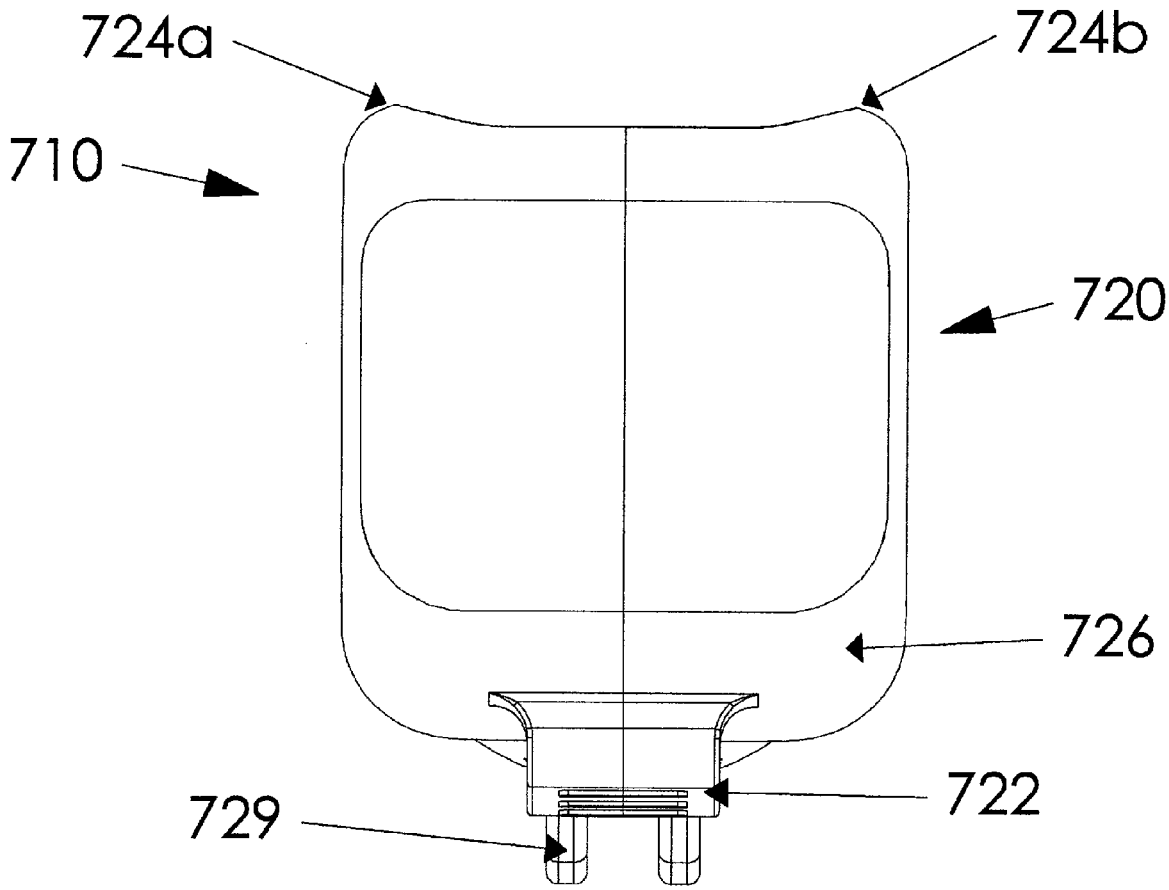
FIG. 78 is a top view of design variation 7 housing body 720 in detail.
Figure 79:
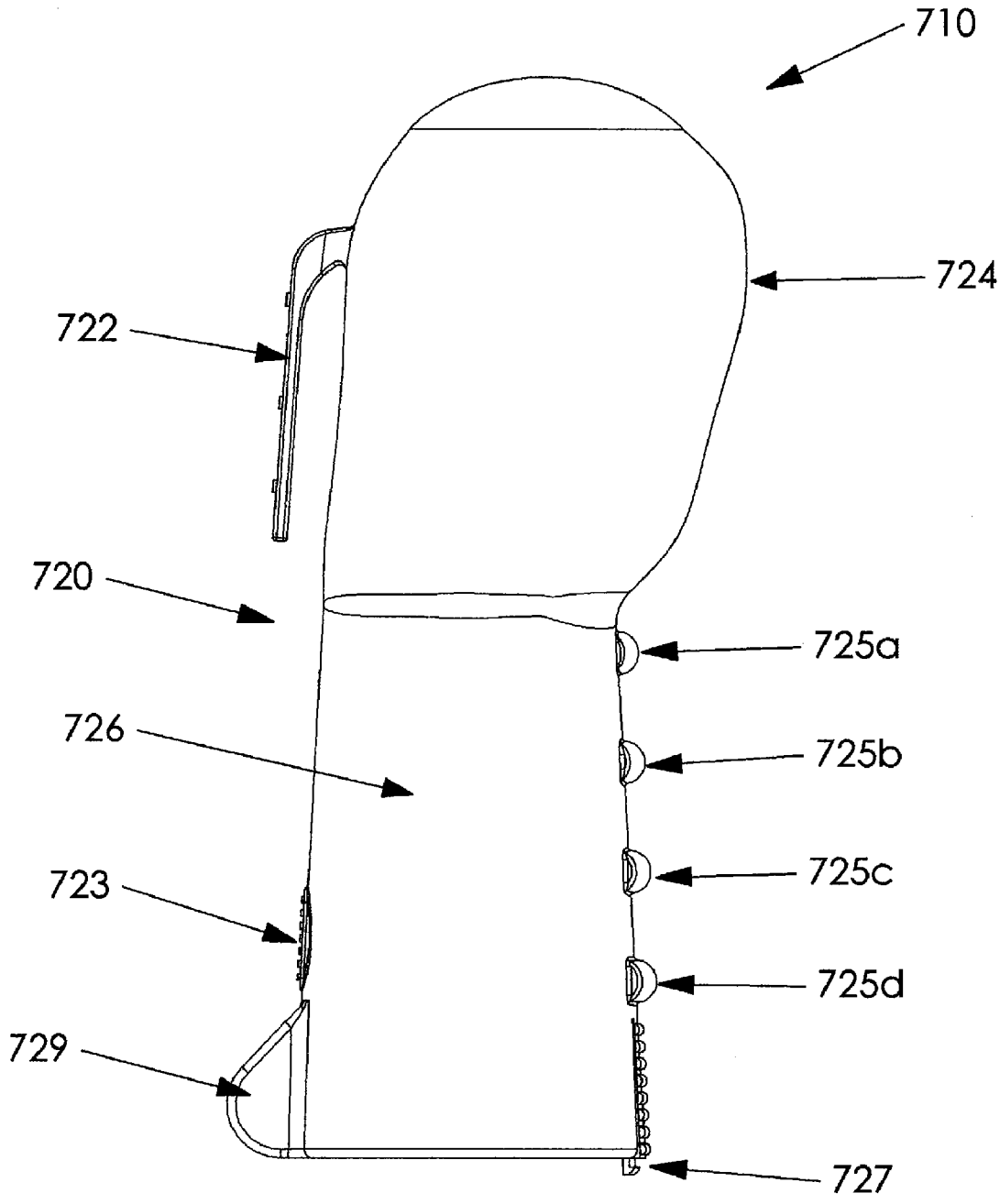
FIG. 79 is a right side view of design variation 7 housing body 720 in detail.
Figure 80:
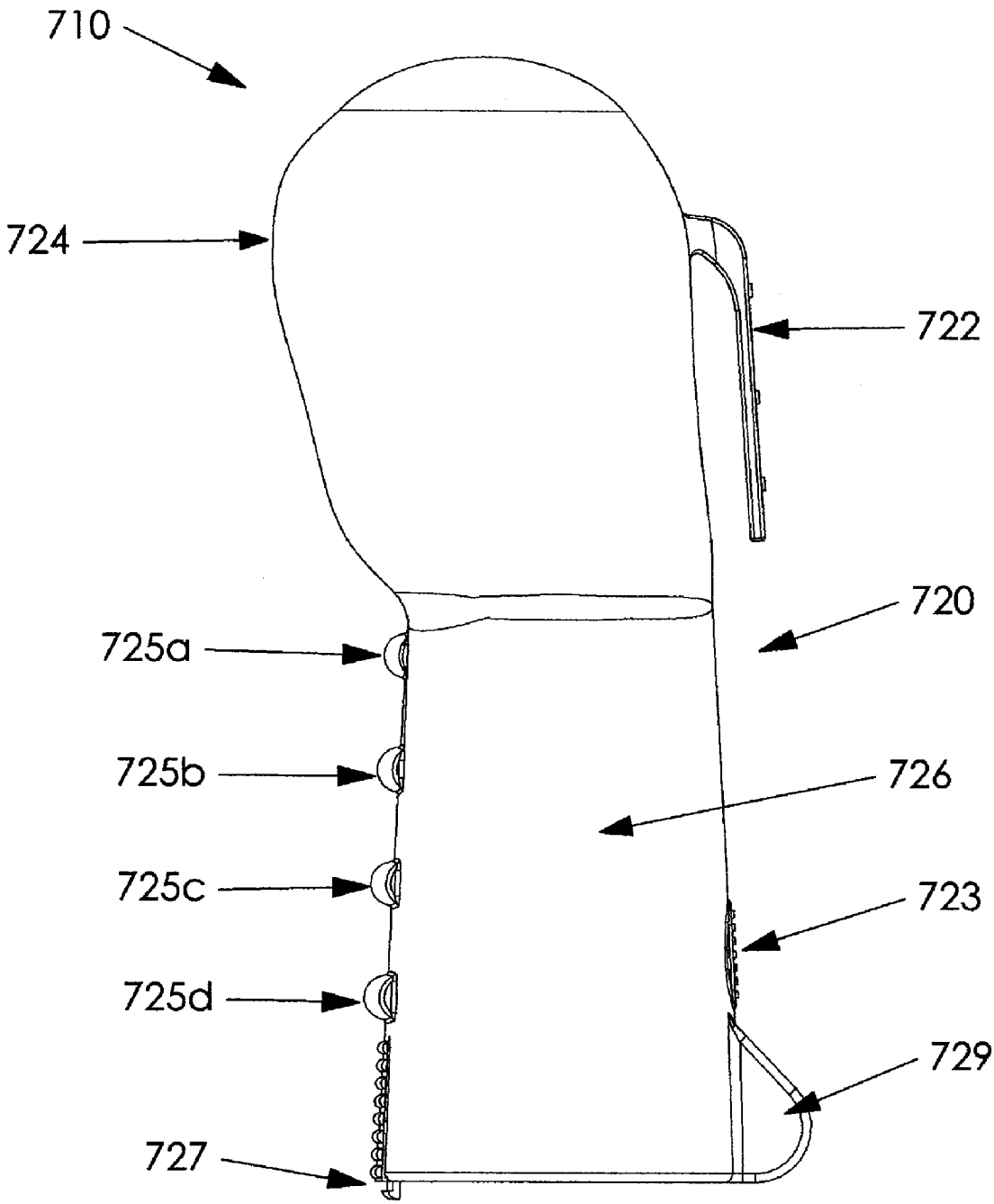
FIG. 80 is a left side view of design variation 7 housing body 720 in detail.
Figure 81:
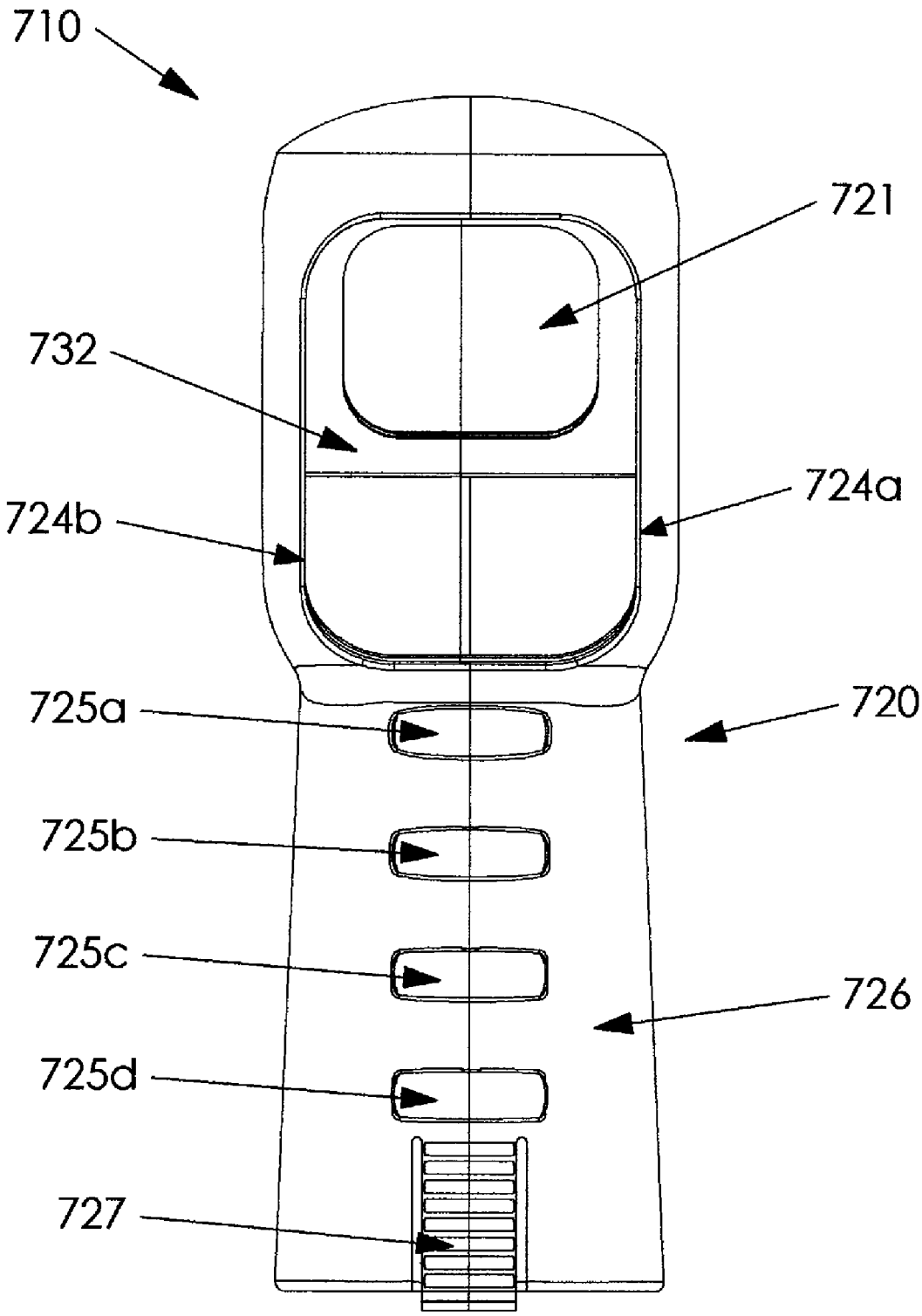
FIG. 81 is a front view of design variation 7 housing body 720 in detail.
Figure 82:
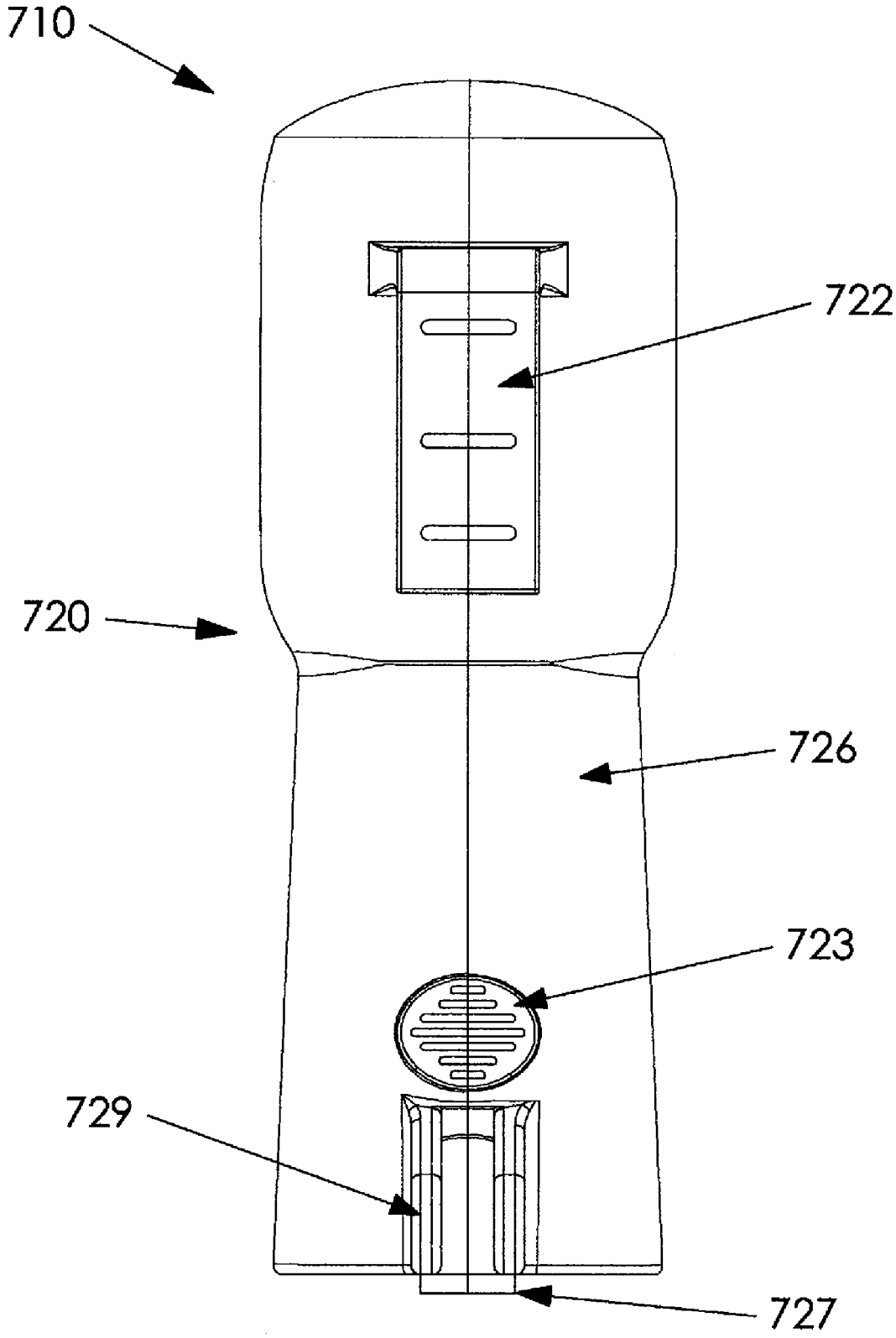
FIG. 82 is a back view of design variation 7 housing body 720 in detail.
Figure 83:
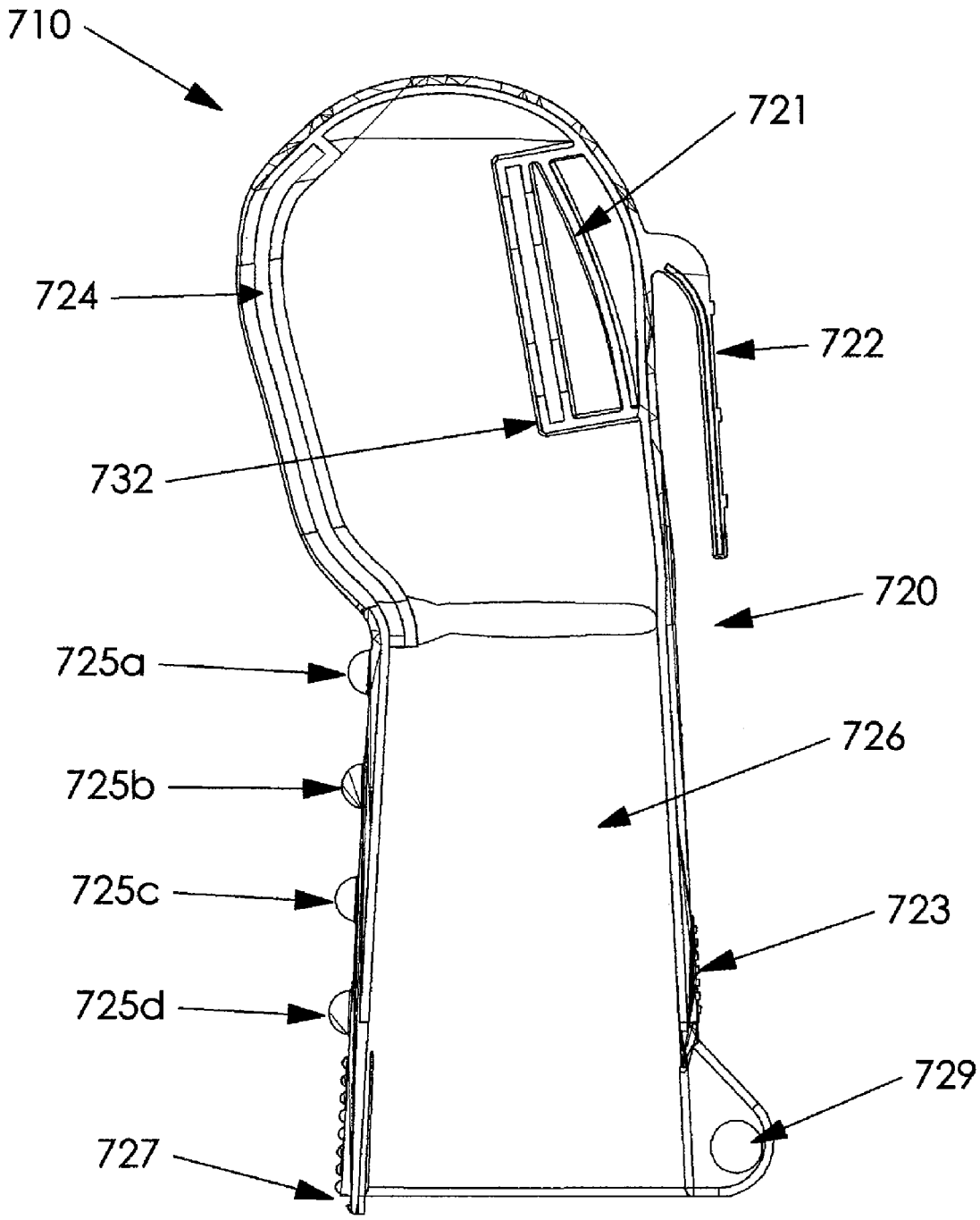
FIG. 83 is an inside cut-away view of design variation 7 housing body 720 in detail.
Figure 84:
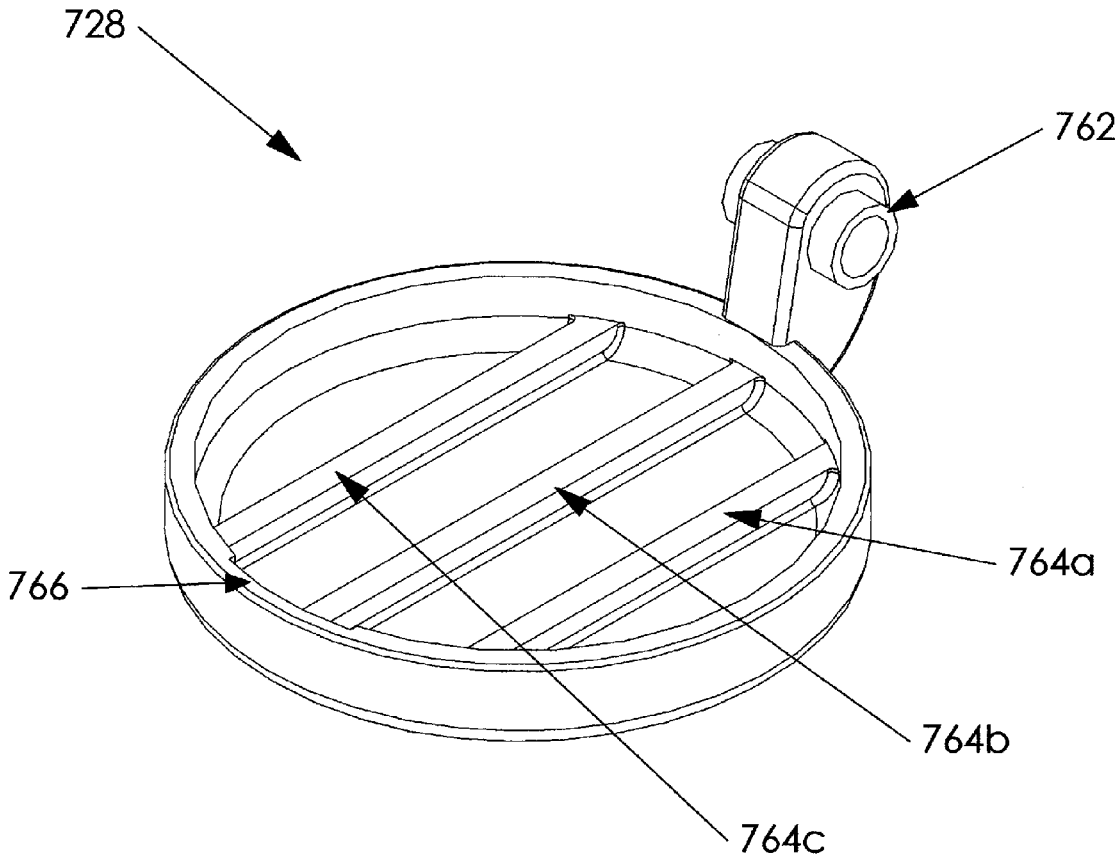
FIG. 84 is a front perspective view of design variation 7 bottom door 728 in detail.
Figure 85:
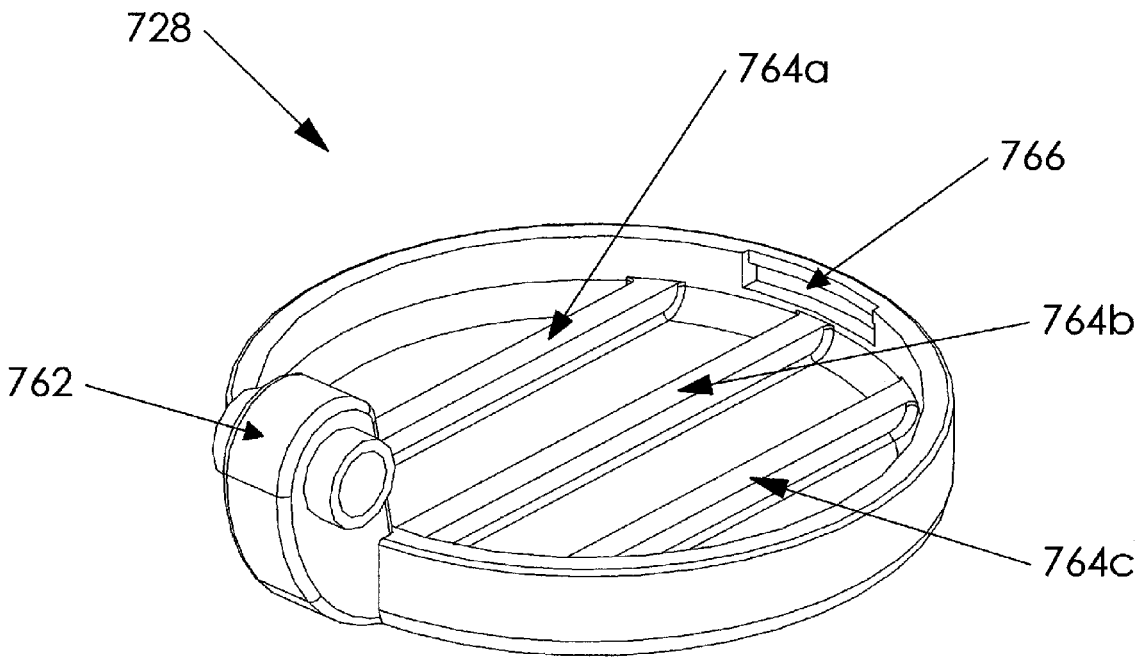
FIG. 85 is a back perspective view of design variation 7 bottom door 728 in detail.
Figure 86:
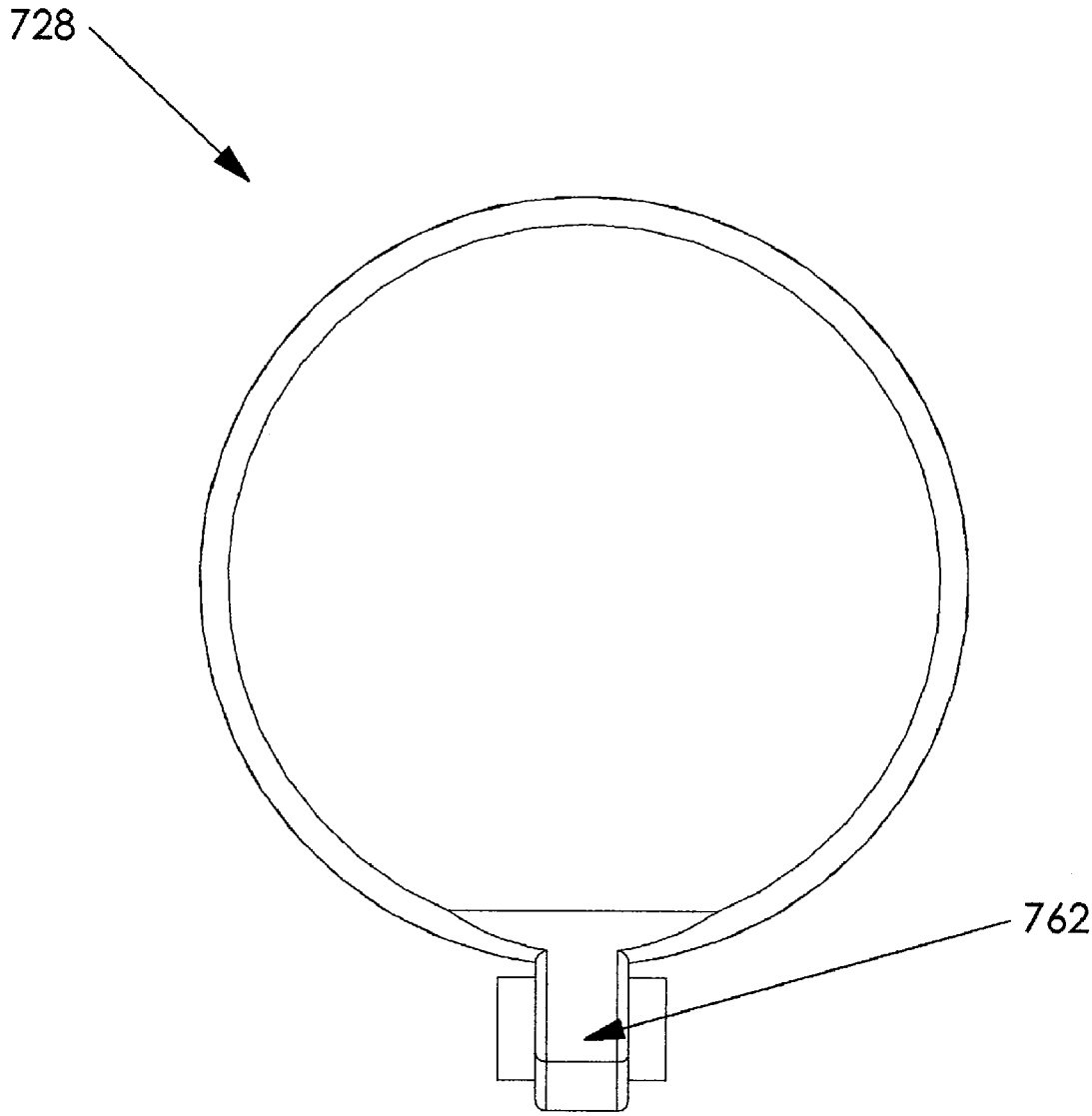
FIG. 86 is a bottom view of design variation 7 bottom door 728 in detail.
Figure 87:
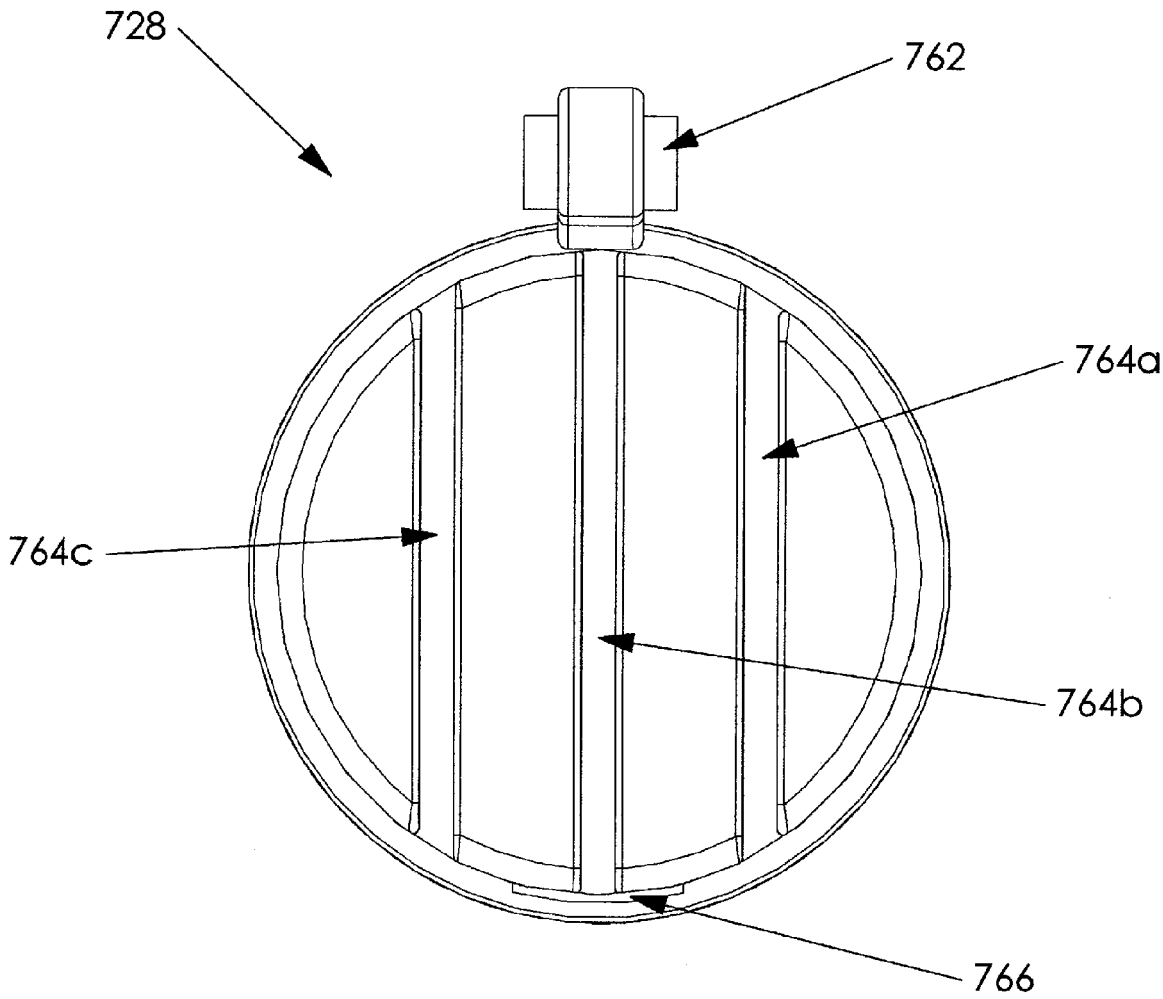
FIG. 87 is a top view of design variation 7 bottom door 728 in detail.
Figure 88:
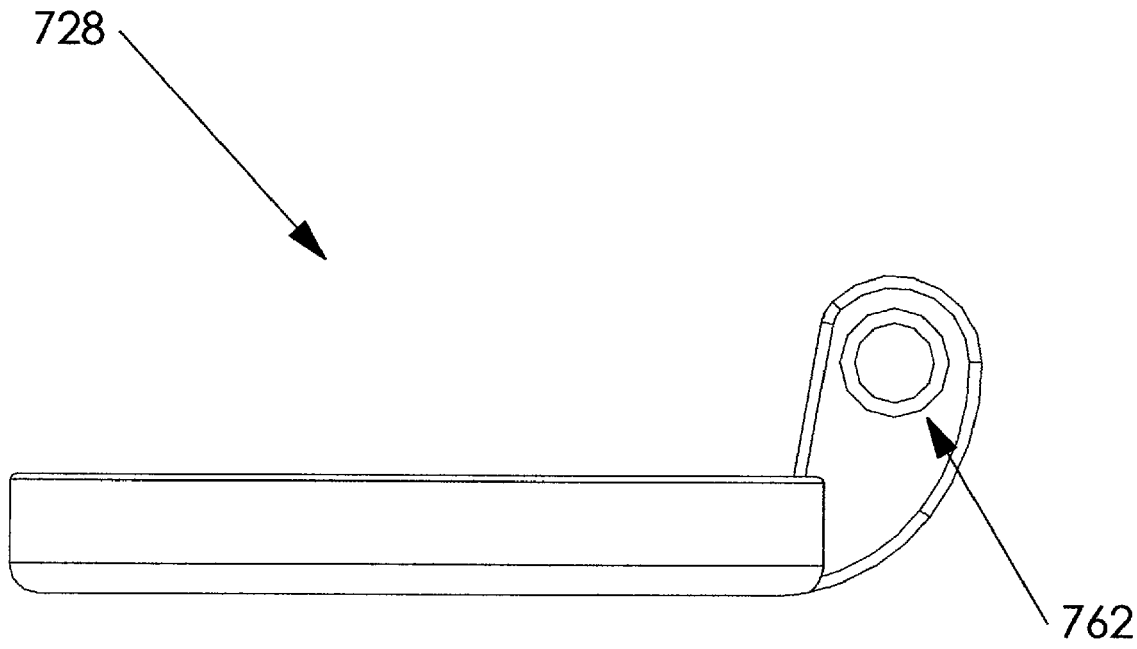
FIG. 88 is a side view of design variation 7 bottom door 728 in detail.
Figure 89:
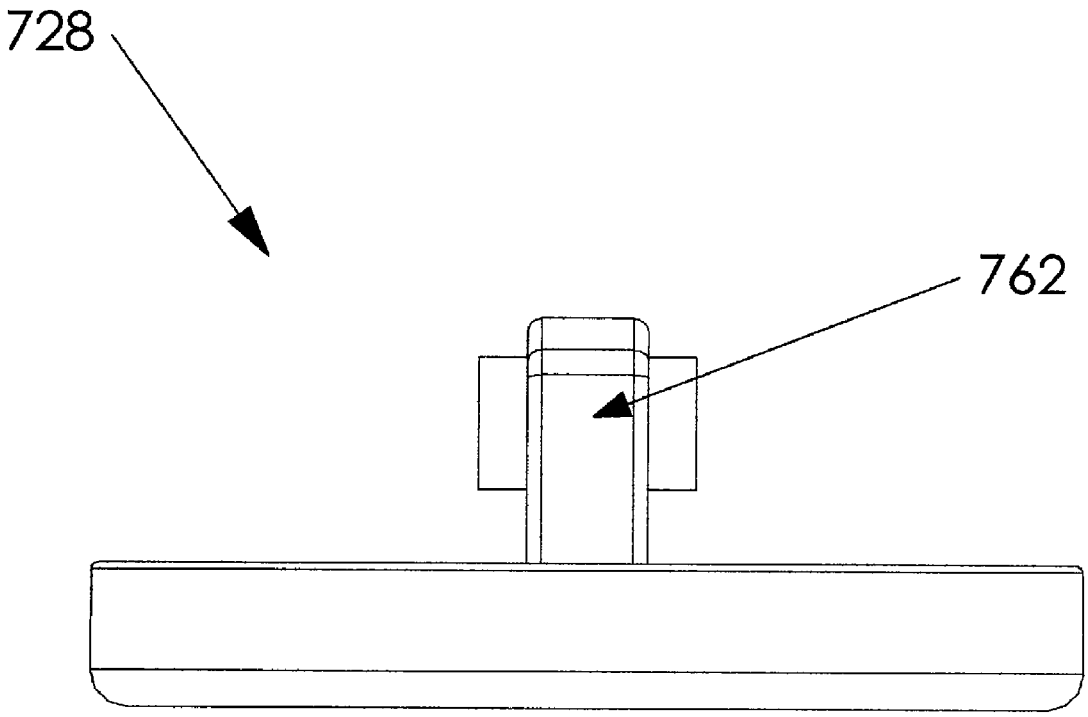
FIG. 89 is a front view of design variation 7 bottom door 728 in detail.
Figure 90:
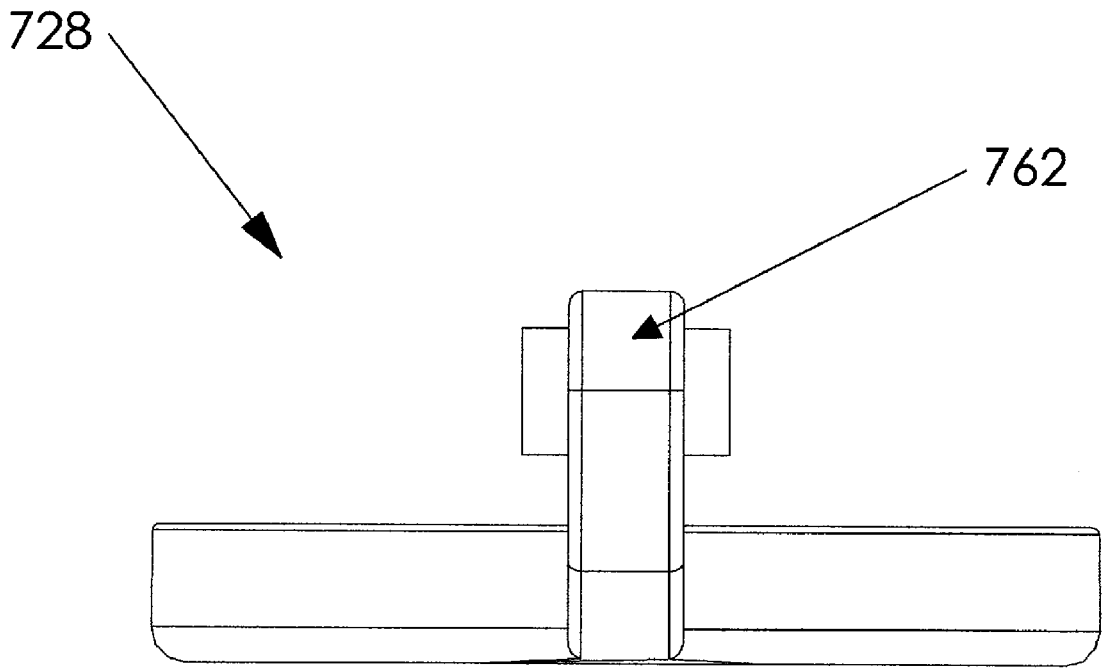
FIG. 90 is a back view of design variation 7 bottom door 728 in detail.
Figure 91:
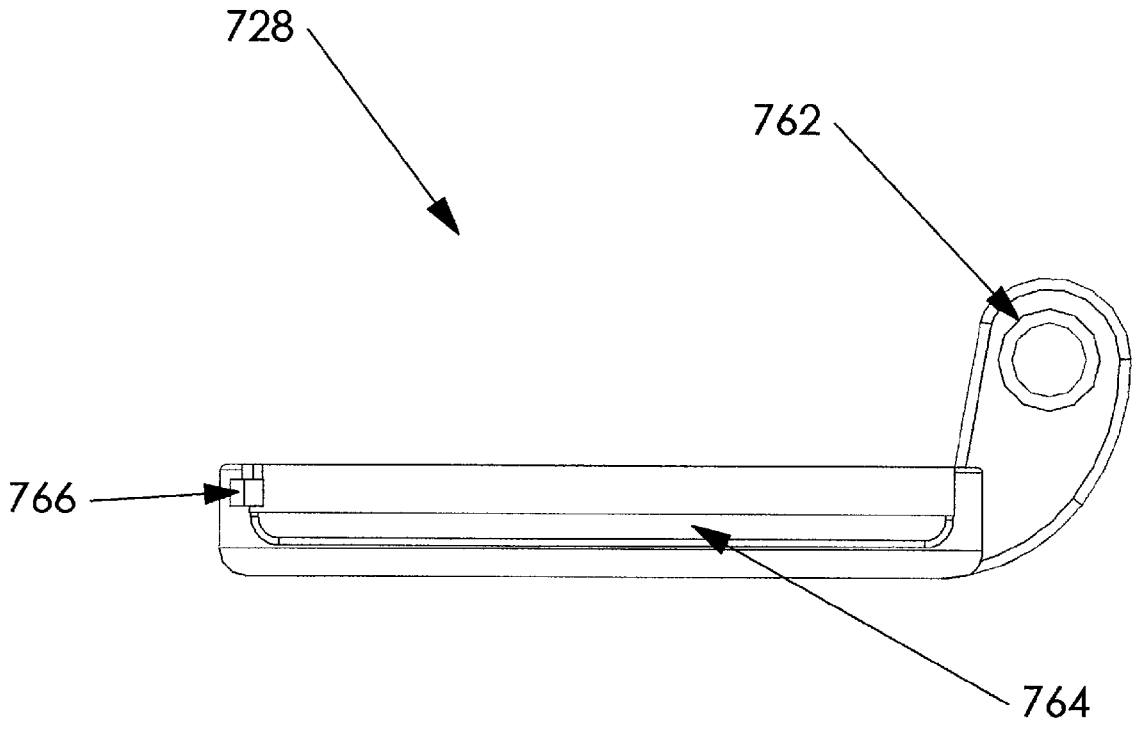
FIG. 91 is an inside cut-away view of design variation 7 bottom door 728 in detail.
Figure 92:
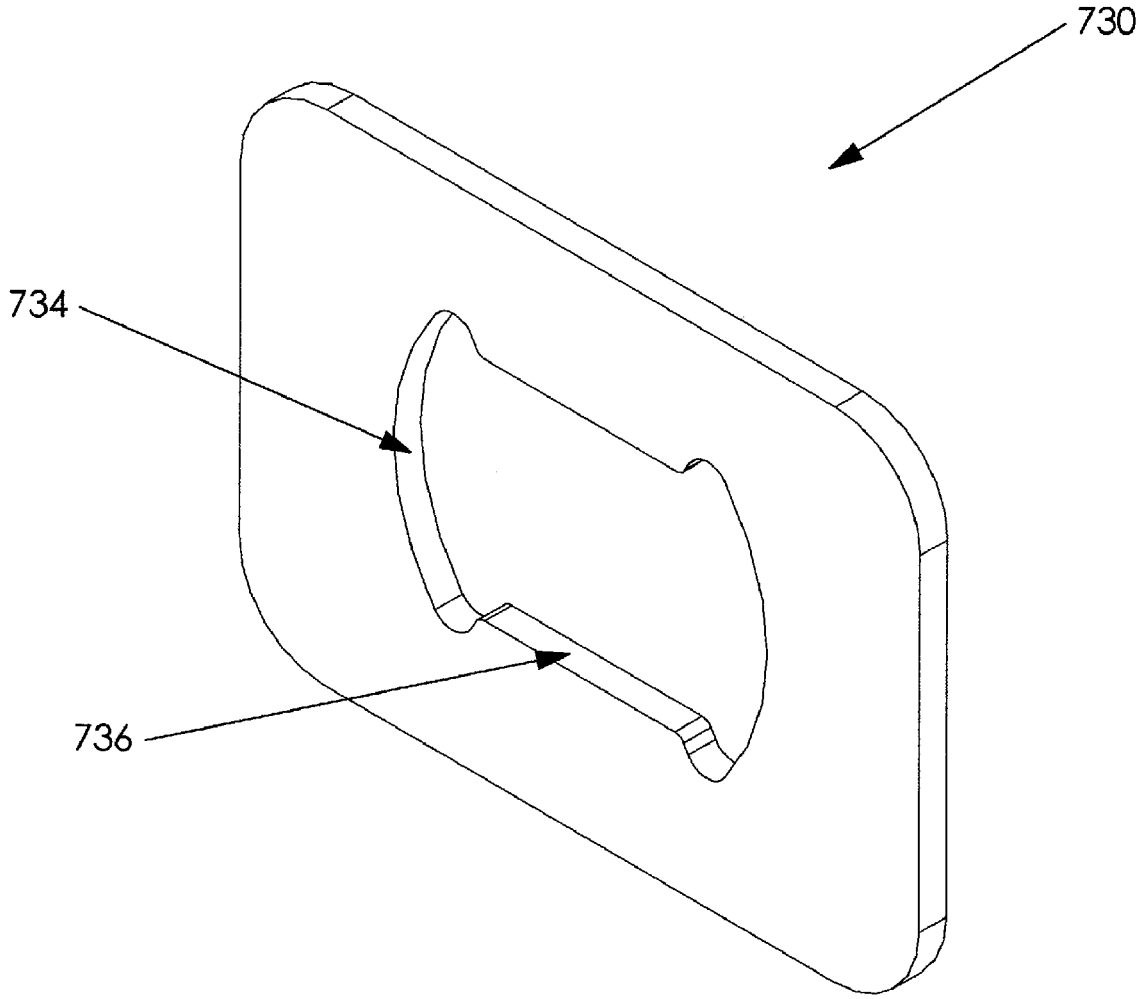
FIG. 92 is a front or back perspective view of design variation 7 metal piece 730 in detail.
Figure 93:
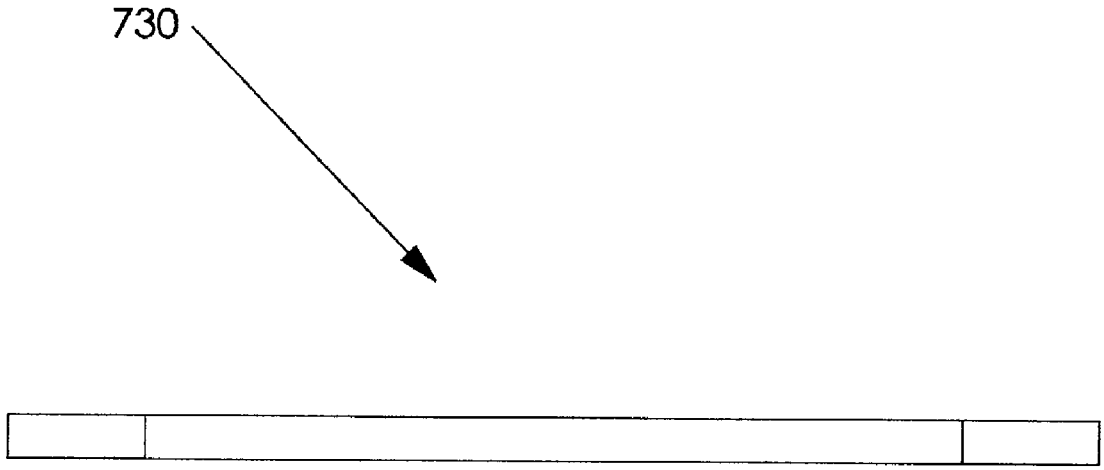
FIG. 93 is a top or bottom view of design variation 7 metal piece 730 in detail.
Figure 94:
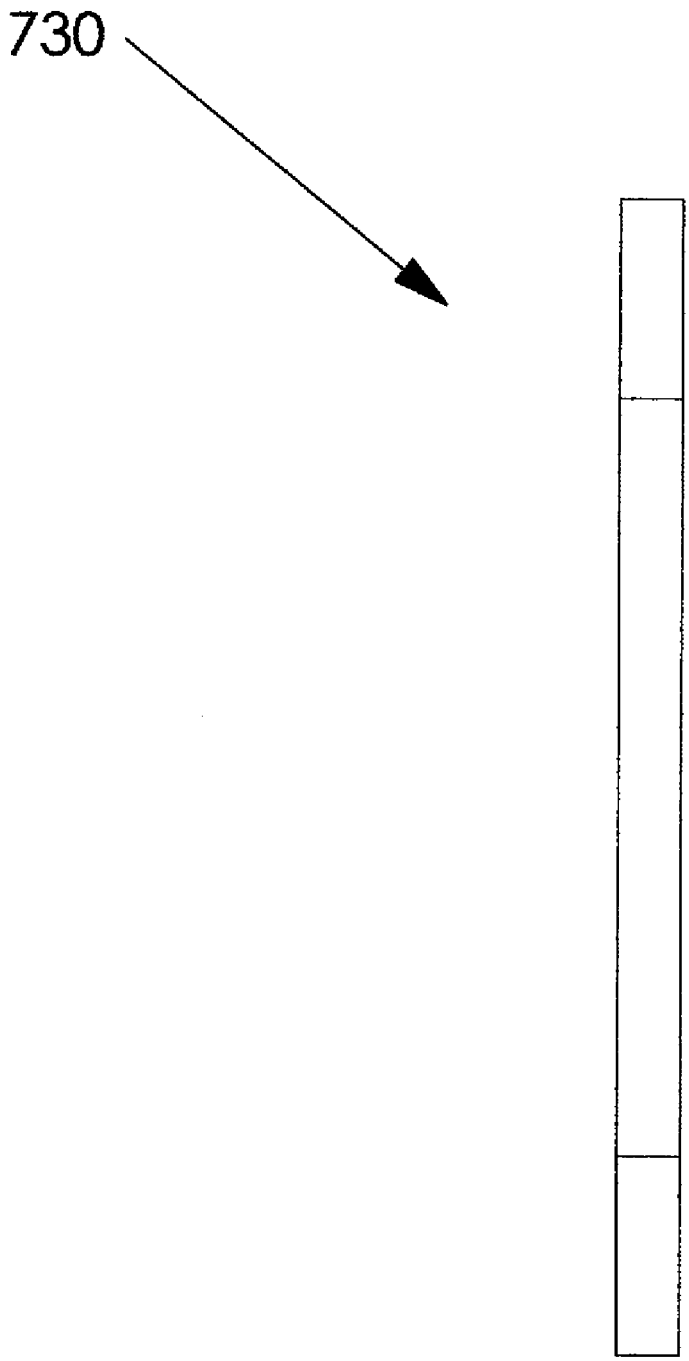
FIG. 94 is a side view of design variation 7 metal piece 730 in detail.
Figure 95:
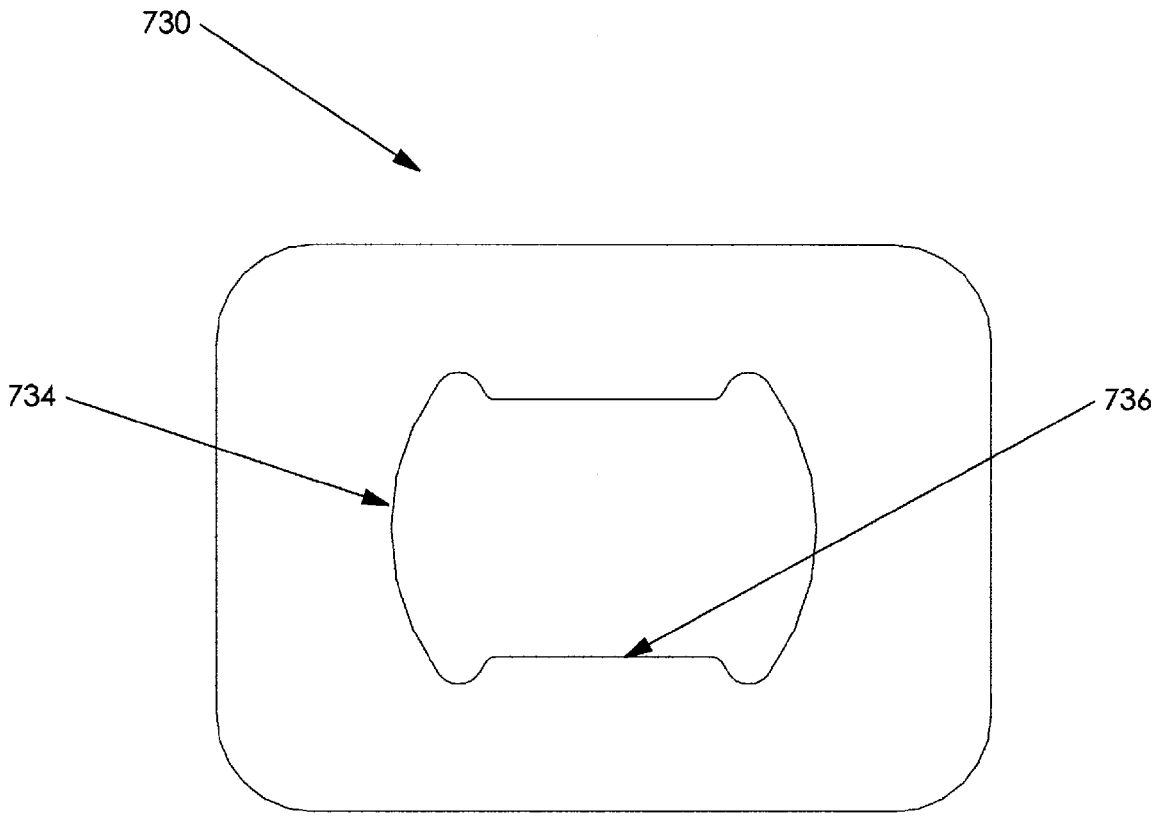
FIG. 95 is a front or back view of design variation 7 metal piece 730 in detail.
Figure 96:
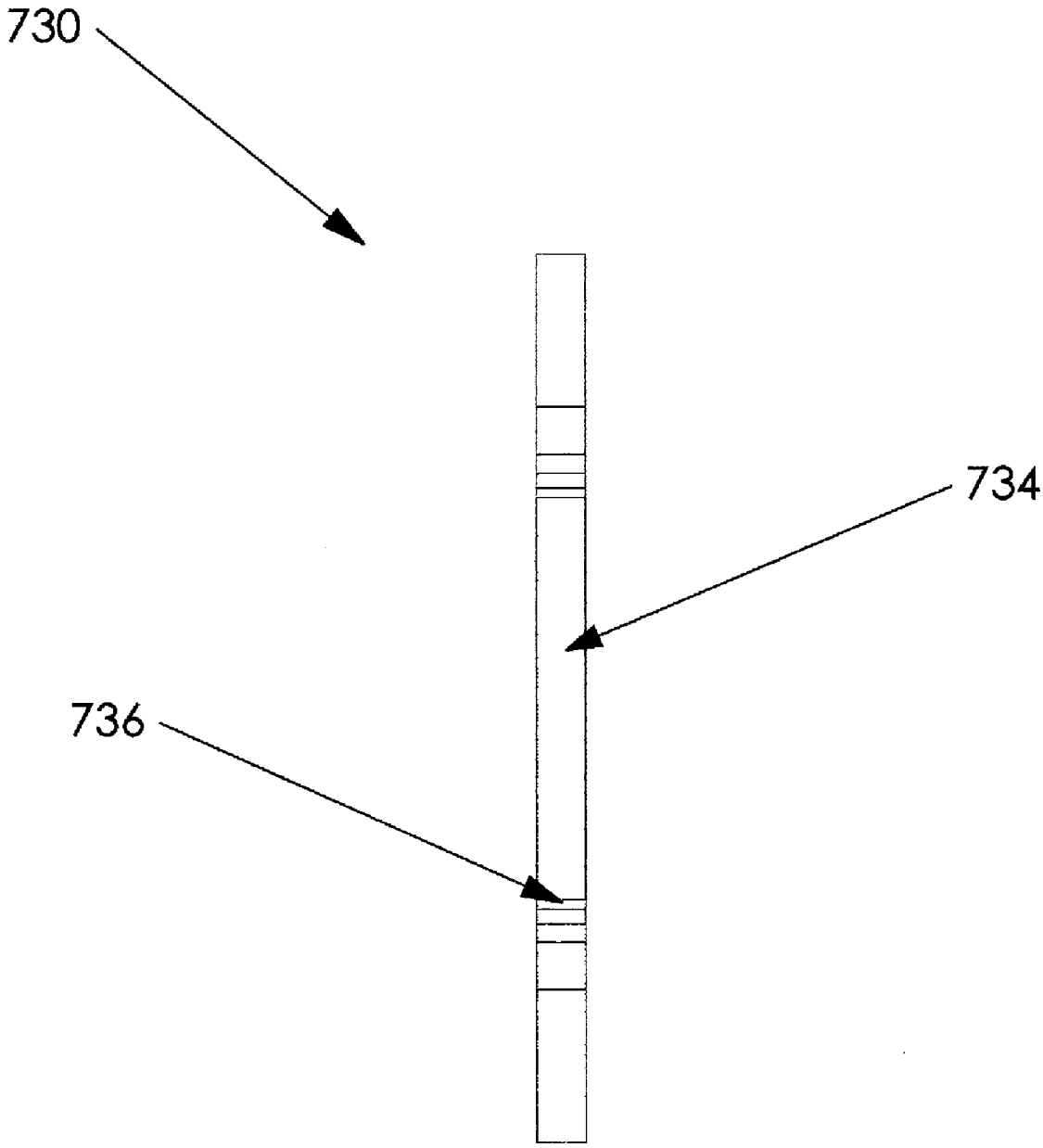
FIG. 96 is an inside cut-away view of design variation 7 metal piece 730 in detail.
Figure 97:
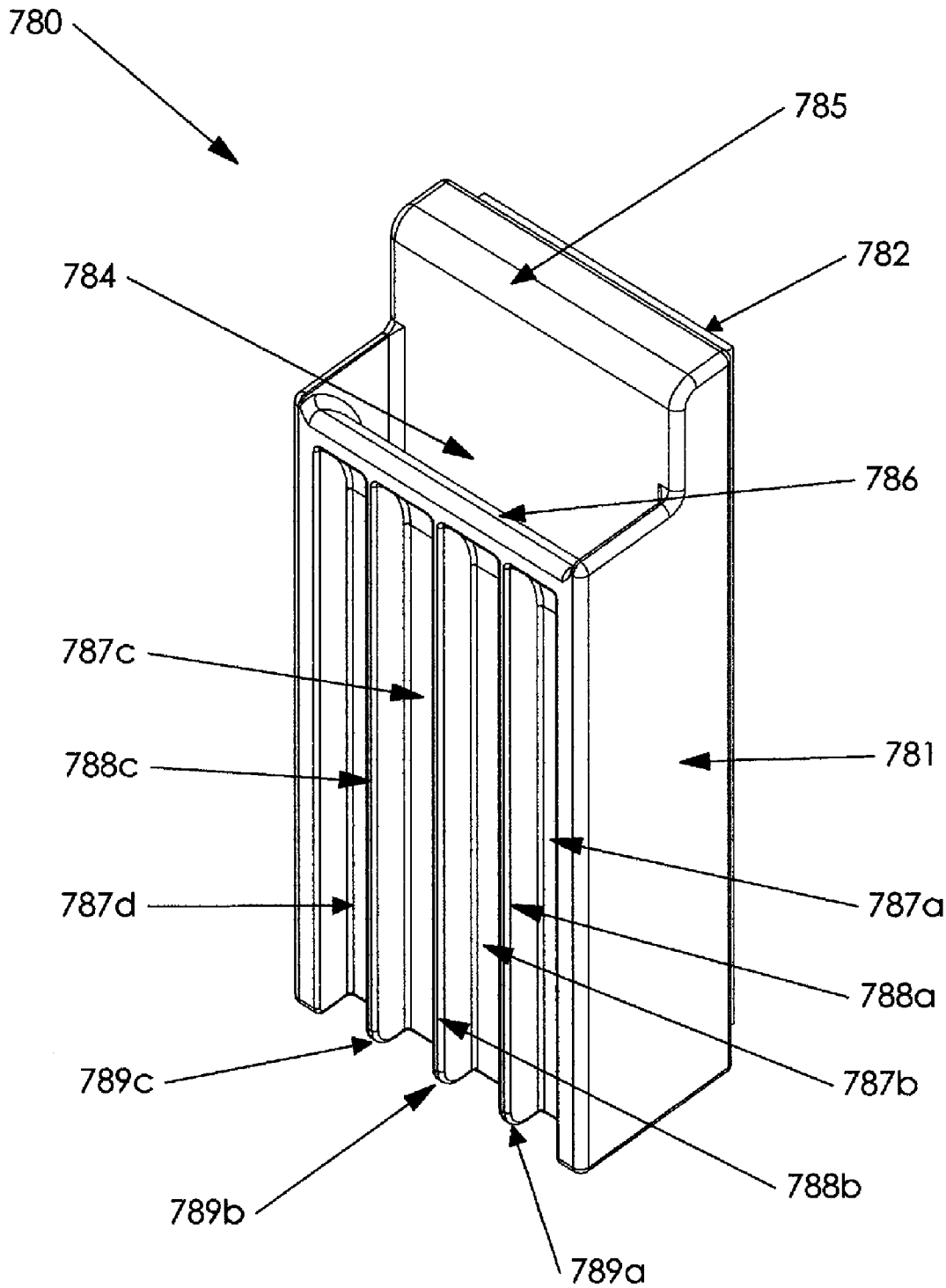
FIG. 97 is a front perspective view of design variation 7 magnet attachment 780.
Figure 98:
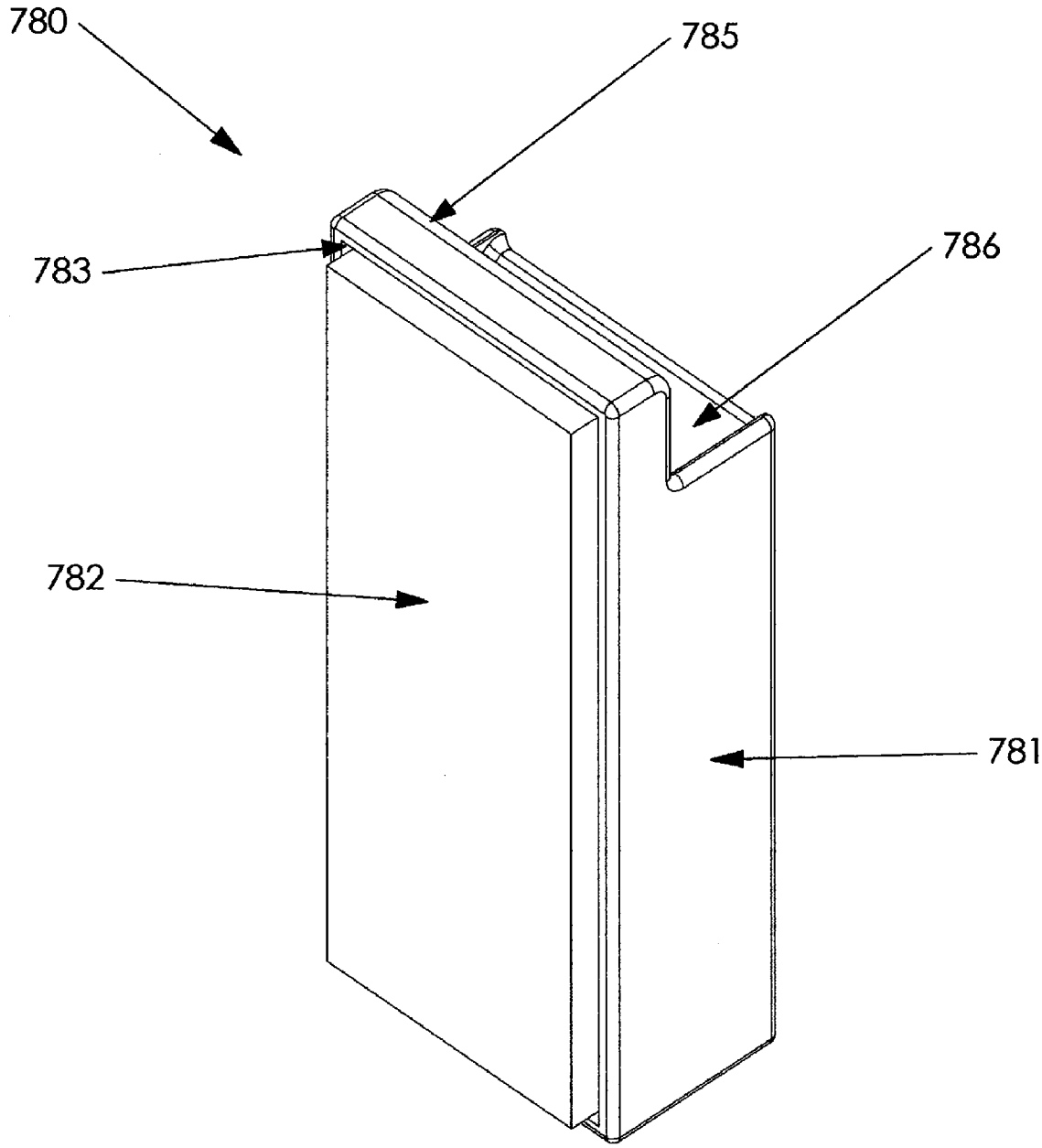
FIG. 98 is a back perspective view of design variation 7 magnet attachment 780.
Figure 99:
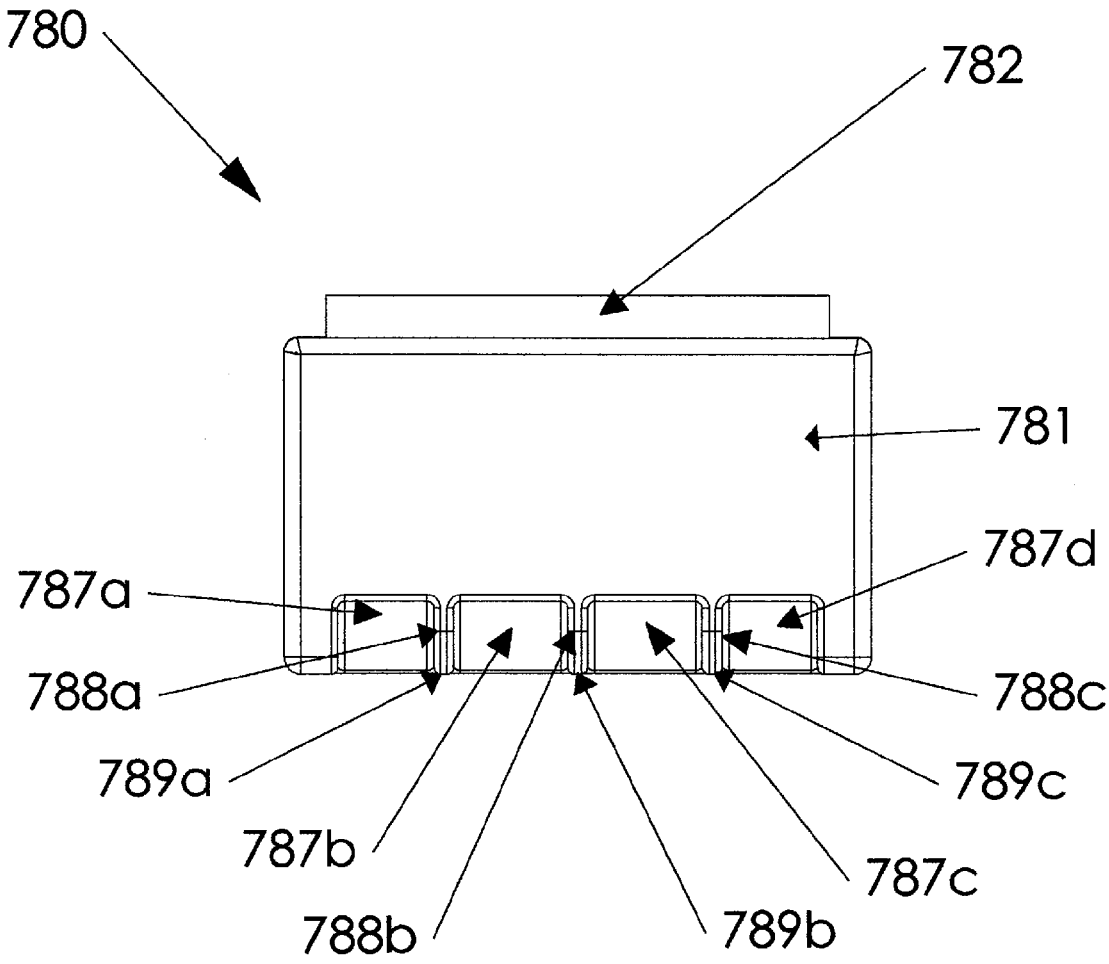
FIG. 99 is a bottom view of design variation 7 magnet attachment 780.
Figure 100:
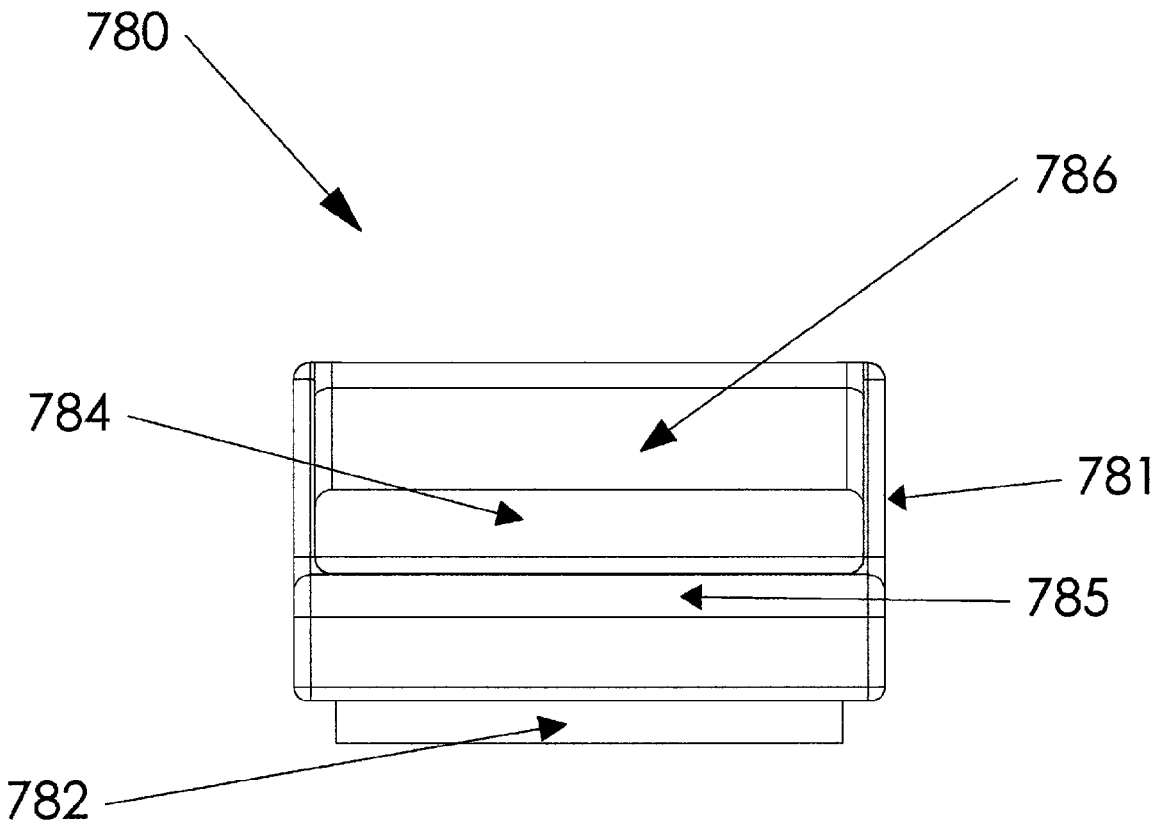
FIG. 100 is a top view of design variation 7 magnet attachment 780.
Figure 101:
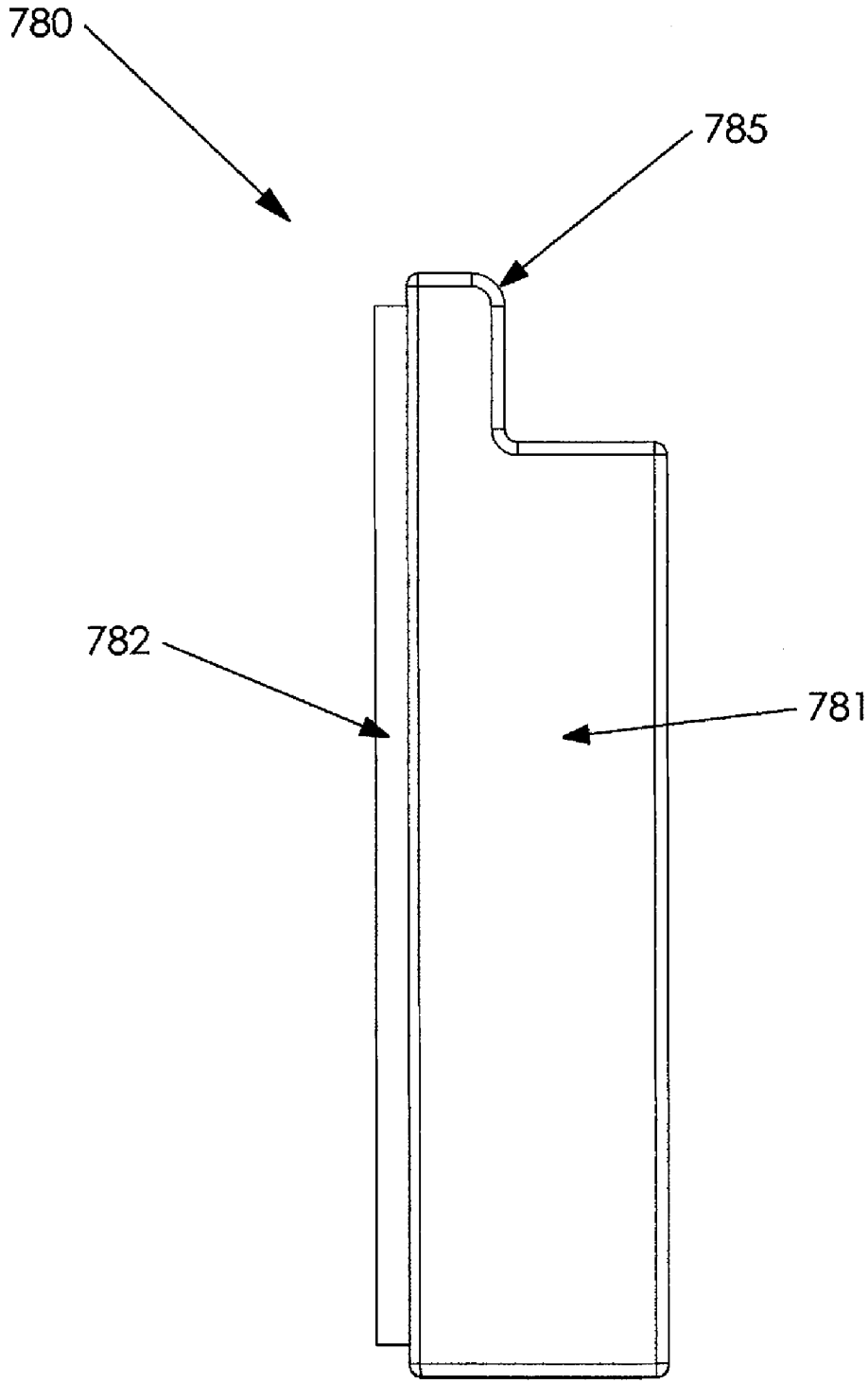
FIG. 101 is a right side view of design variation 7 magnet attachment 780.
Figure 102:
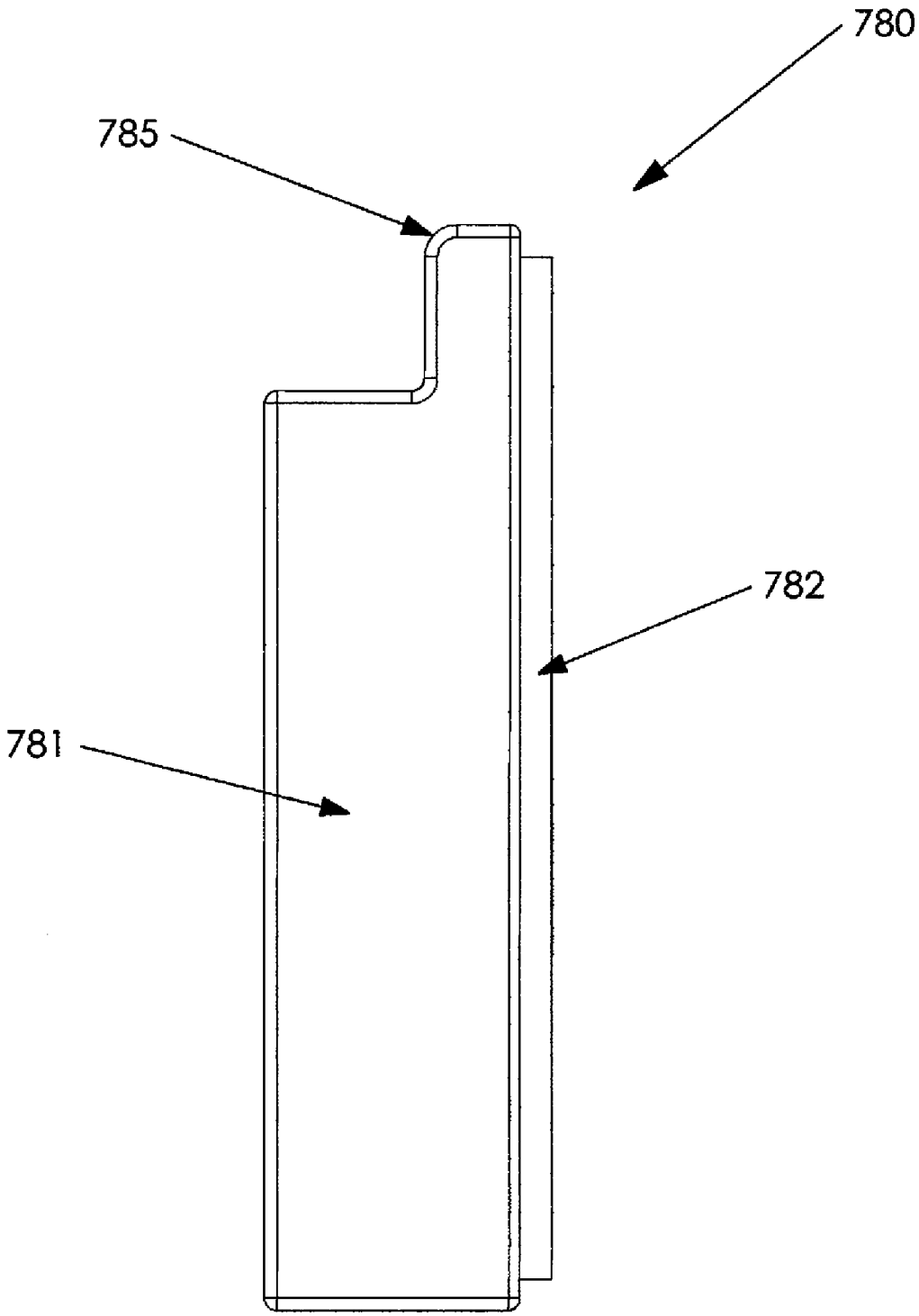
FIG. 102 is a left side view of design variation 7 magnet attachment 780.
Figure 103:
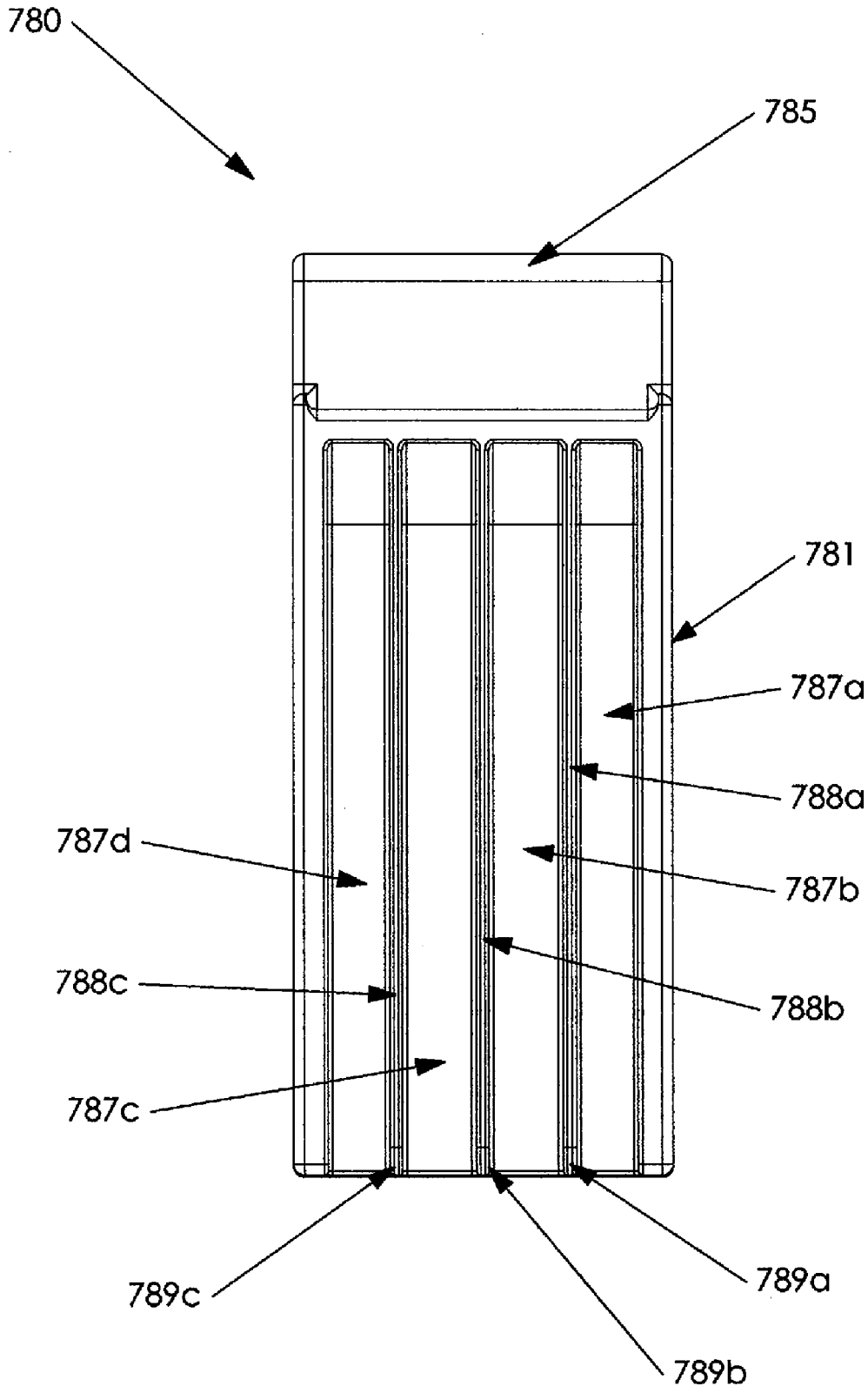
FIG. 103 is a front view of design variation 7 magnet attachment 780.
Figure 104:
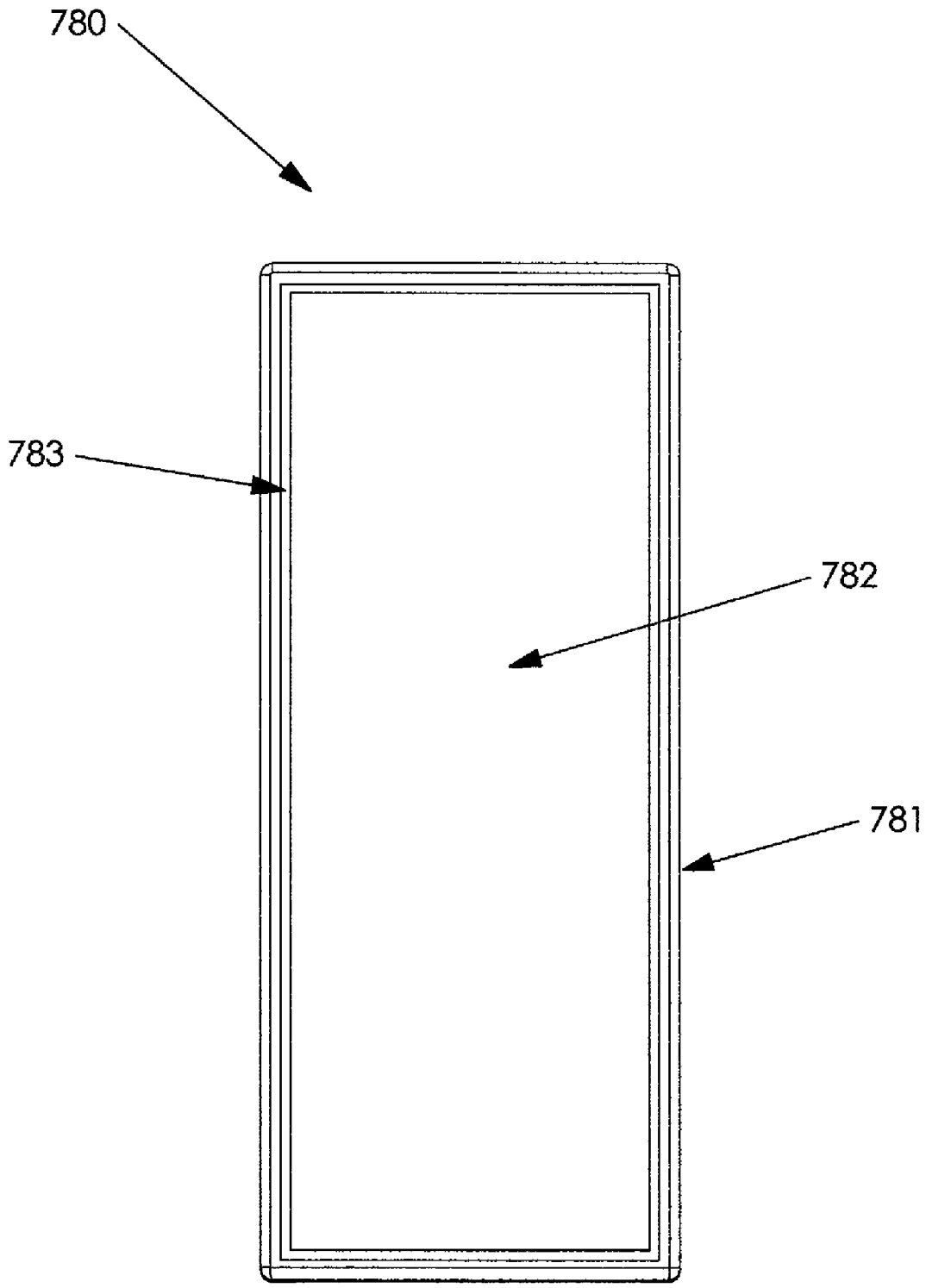
FIG. 104 is a back view of design variation 7 magnet attachment 780.
Figure 105:
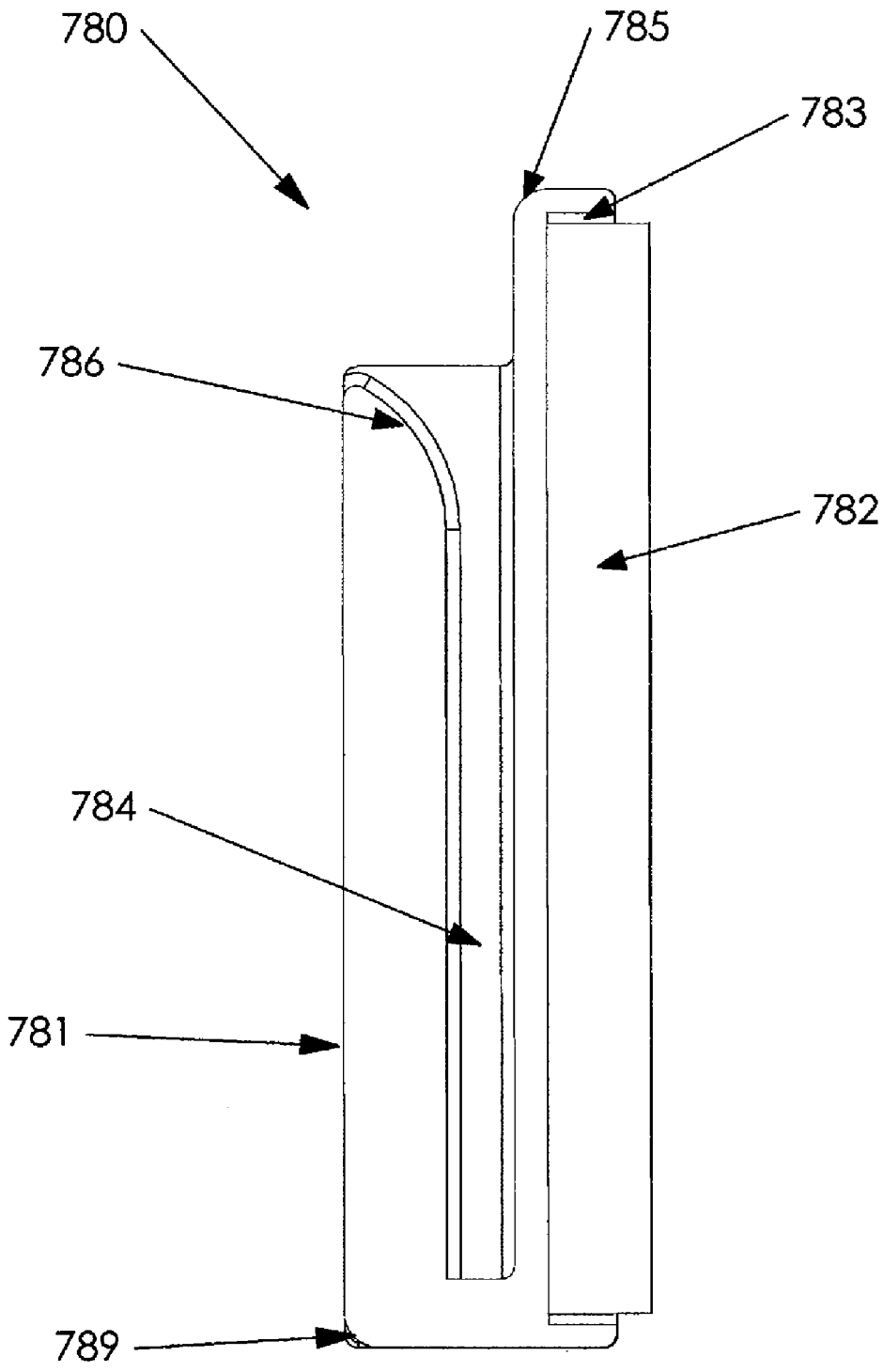
FIG. 105 is an inside cut-away view of design variation 7 magnet attachment 780.
Figure 106:
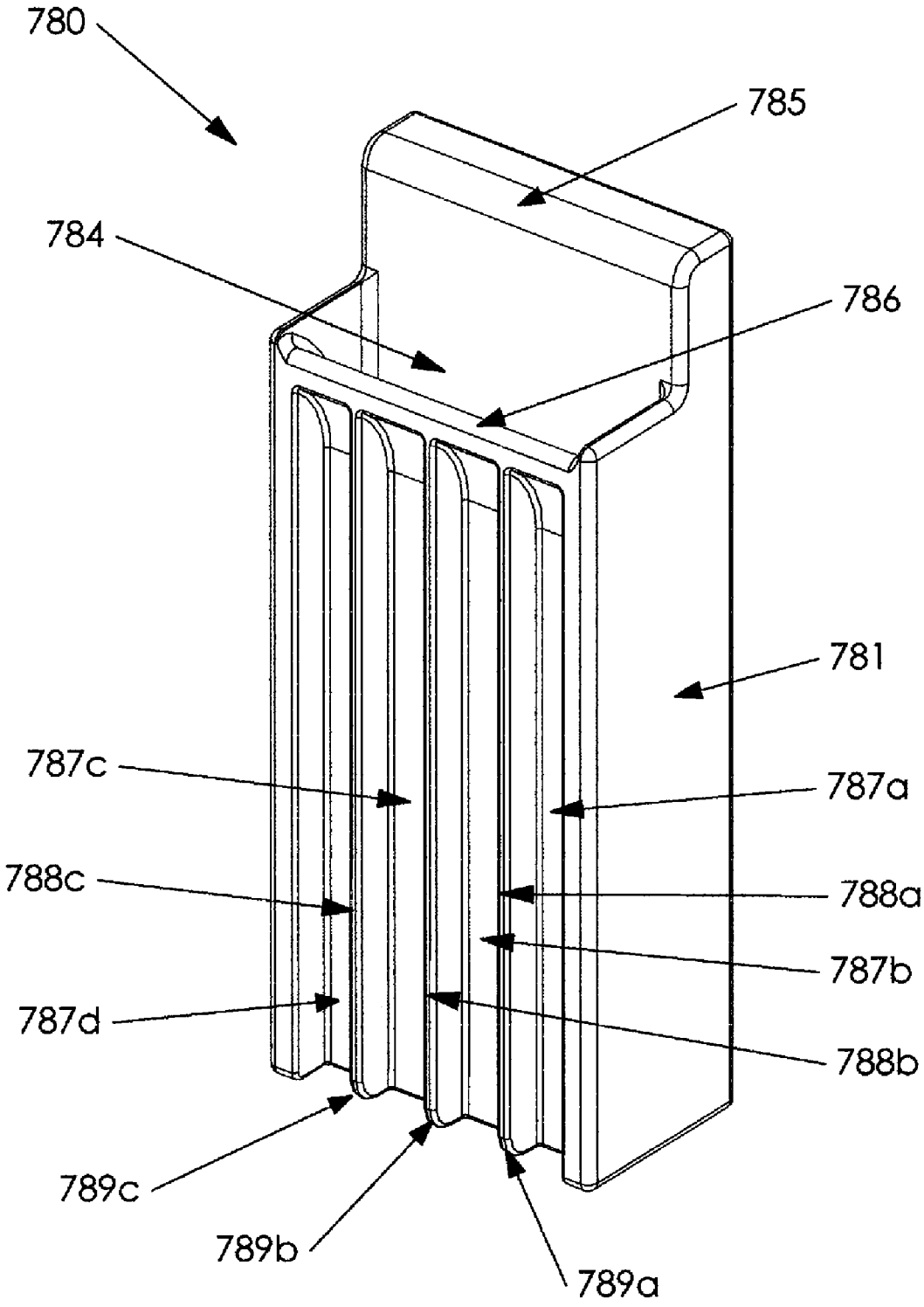
FIG. 106 is a front perspective view of design variation 7 magnet attachment housing body 781 in detail.
Figure 107:
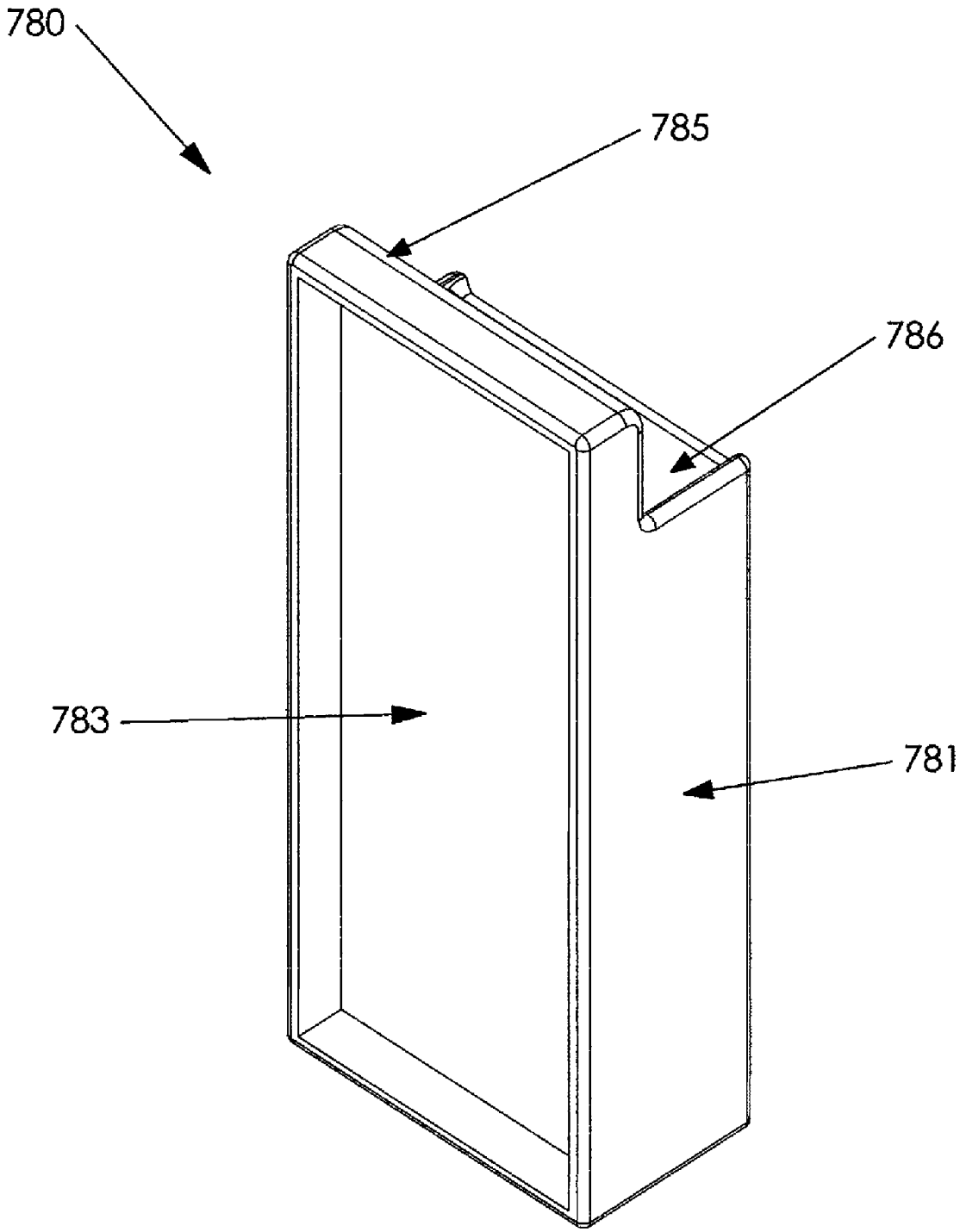
FIG. 107 is a back perspective view of design variation 7 magnet attachment housing body 781 in detail.
Figure 108:
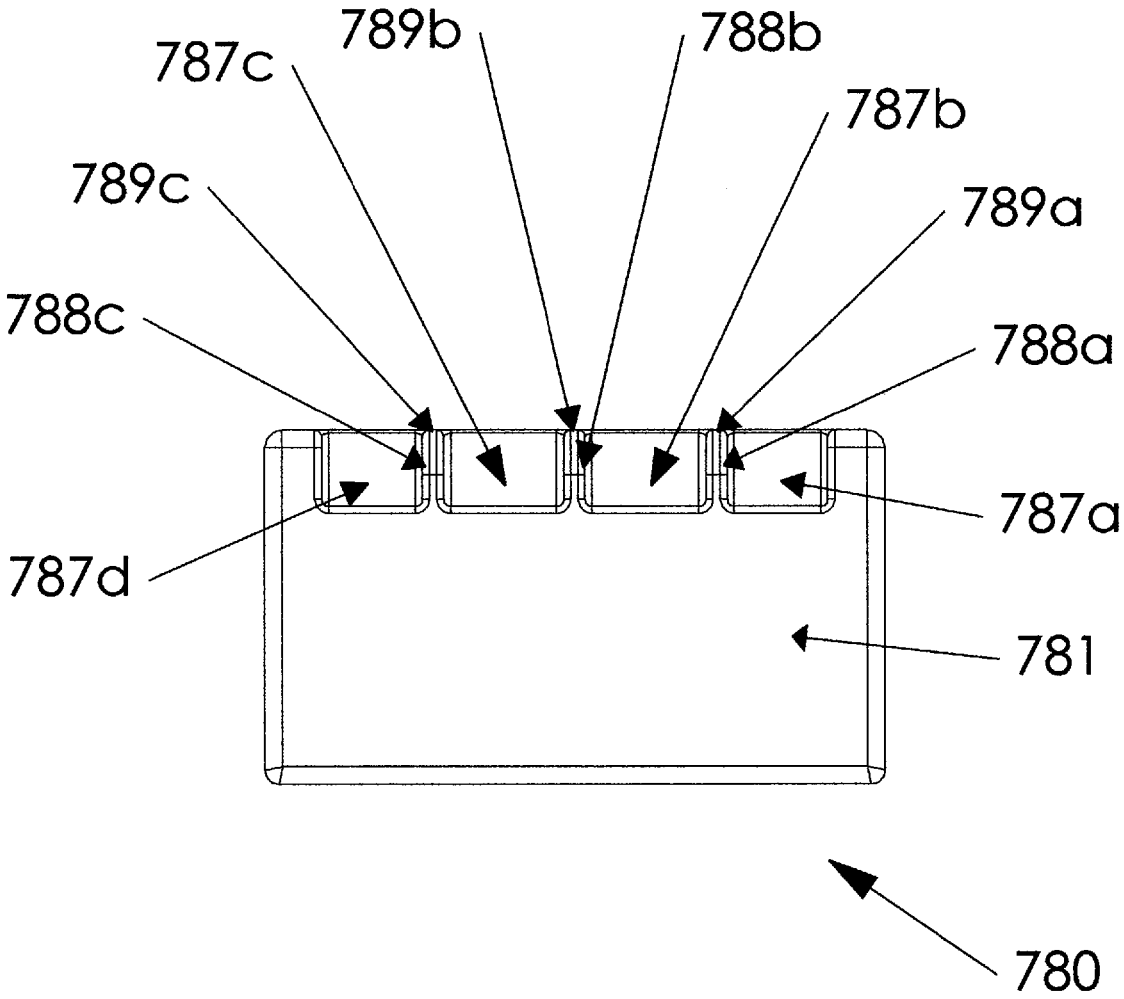
FIG. 108 is a bottom view of design variation 7 magnet attachment housing body 781 in detail.
Figure 109:
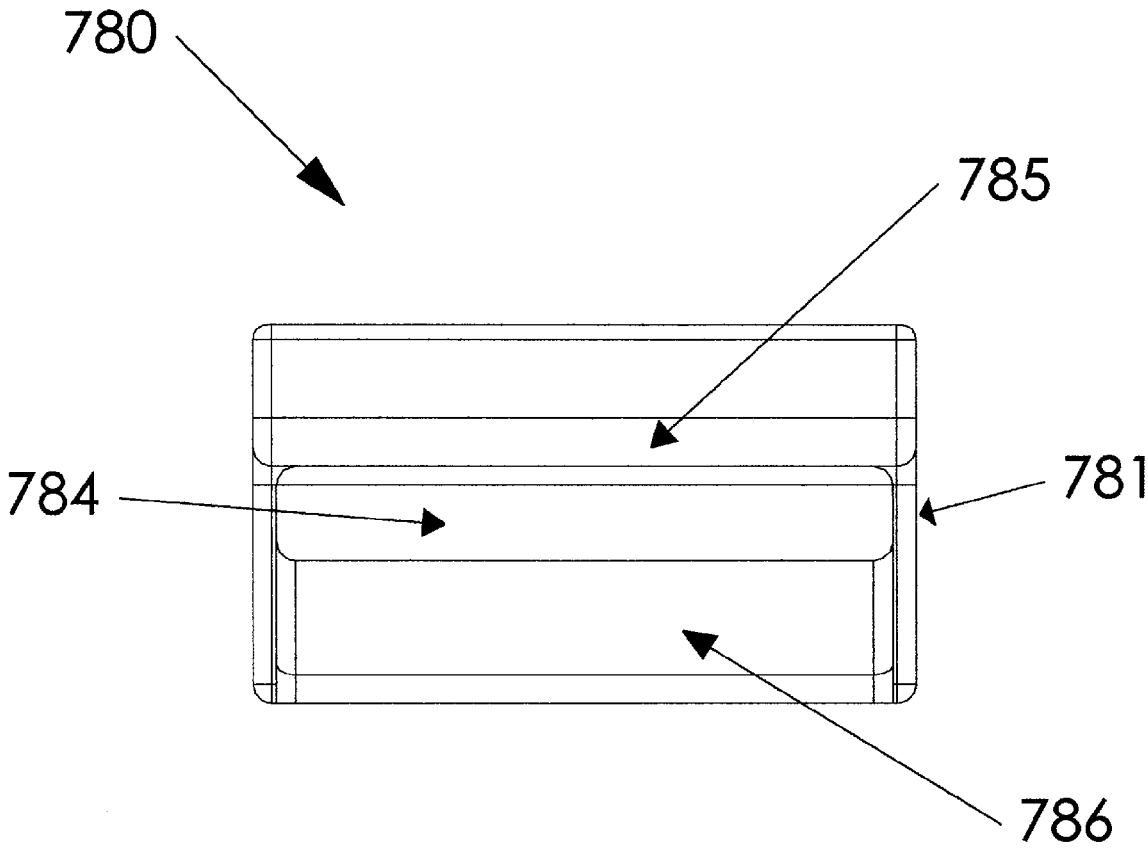
FIG. 109 is a top view of design variation 7 magnet attachment housing body 781 in detail.
Figure 110:
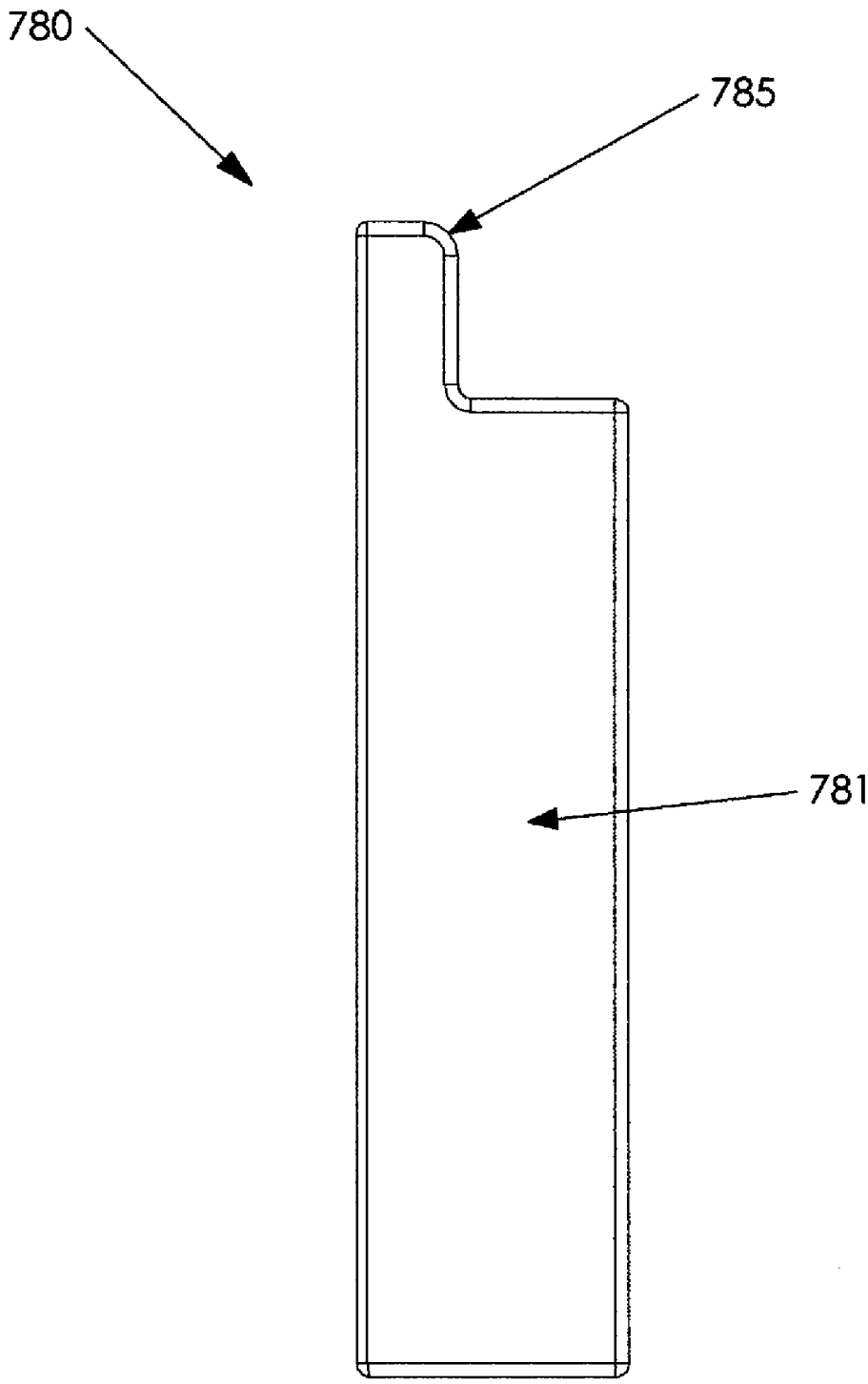
FIG. 110 is a right side view of design variation 7 magnet attachment housing body 781 in detail.
Figure 111:
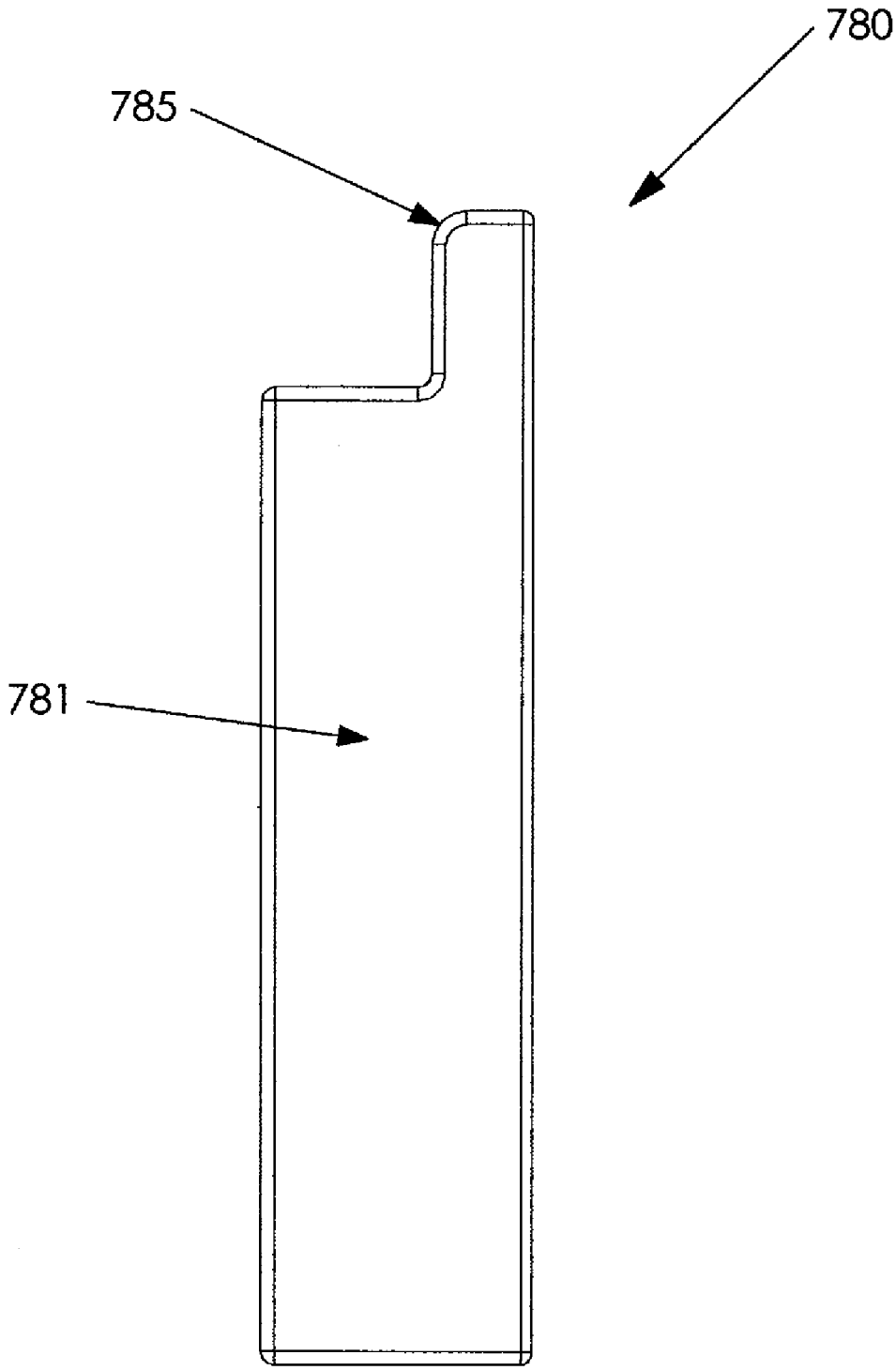
FIG. 111 is a left side view of design variation 7 magnet attachment housing body 781 in detail.
Figure 112:
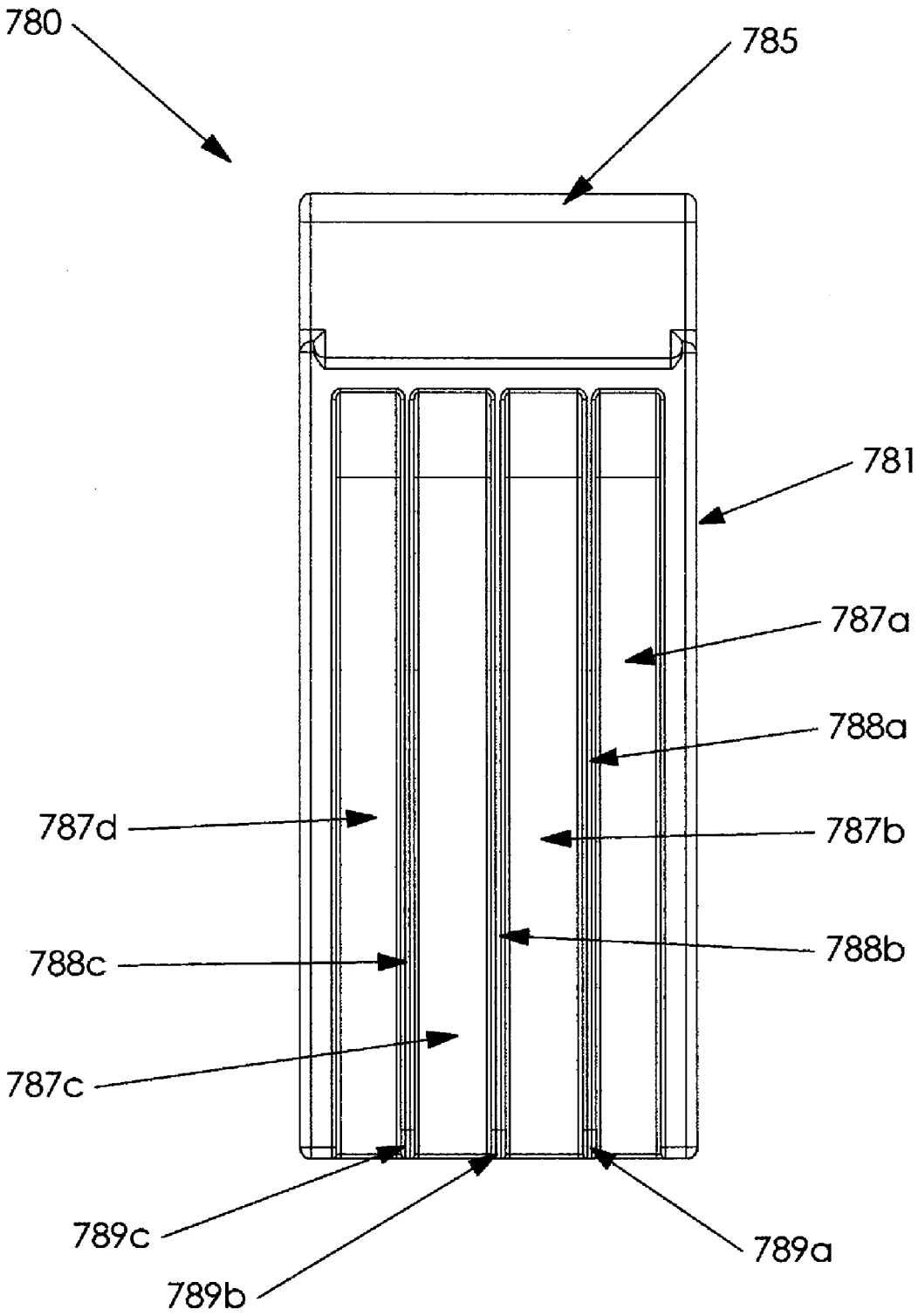
FIG. 112 is a front view of design variation 7 magnet attachment housing body 781 in detail.
Figure 113:
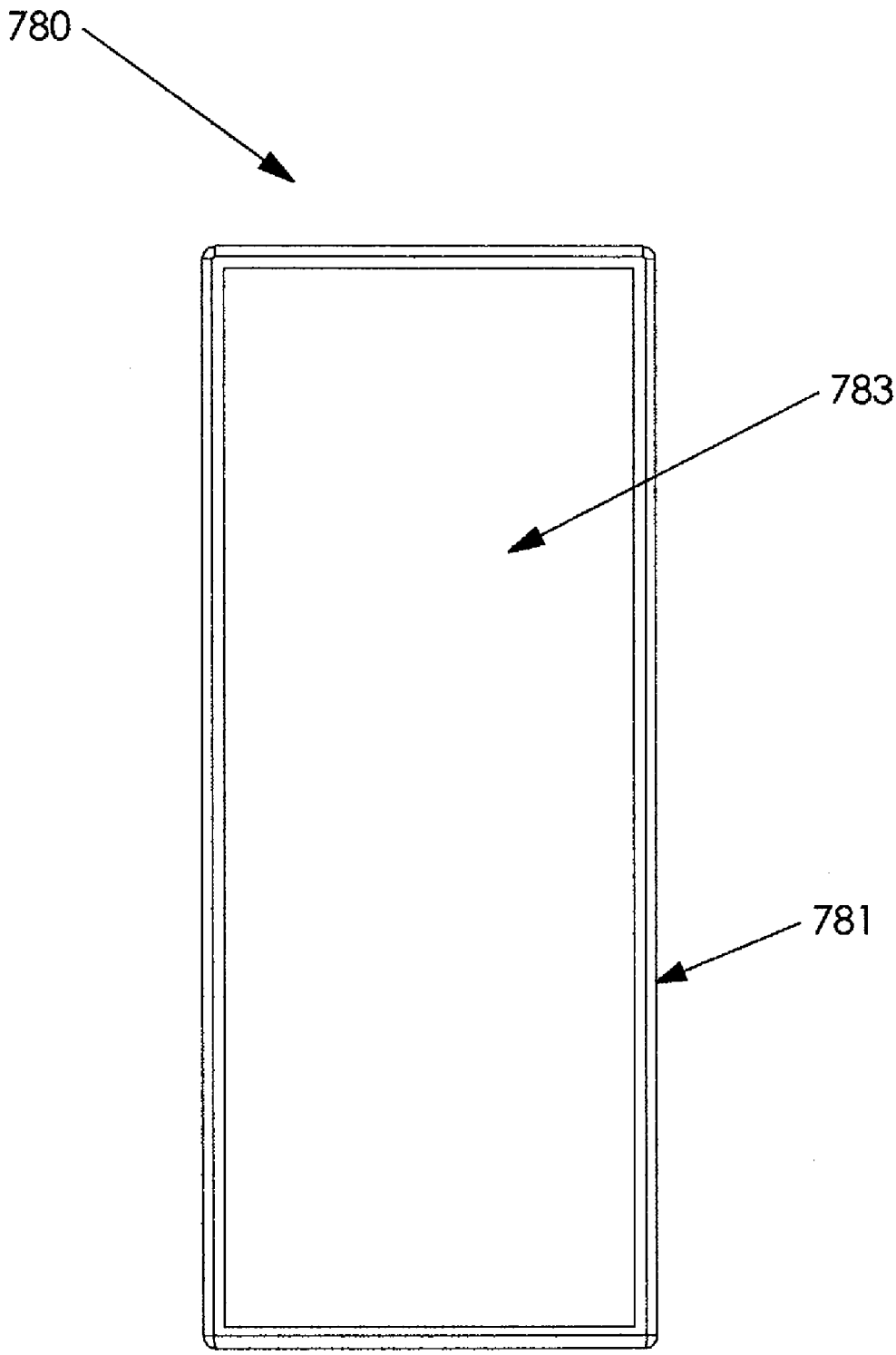
FIG. 113 is a back view of design variation 7 magnet attachment housing body 781 in detail.
Figure 114:
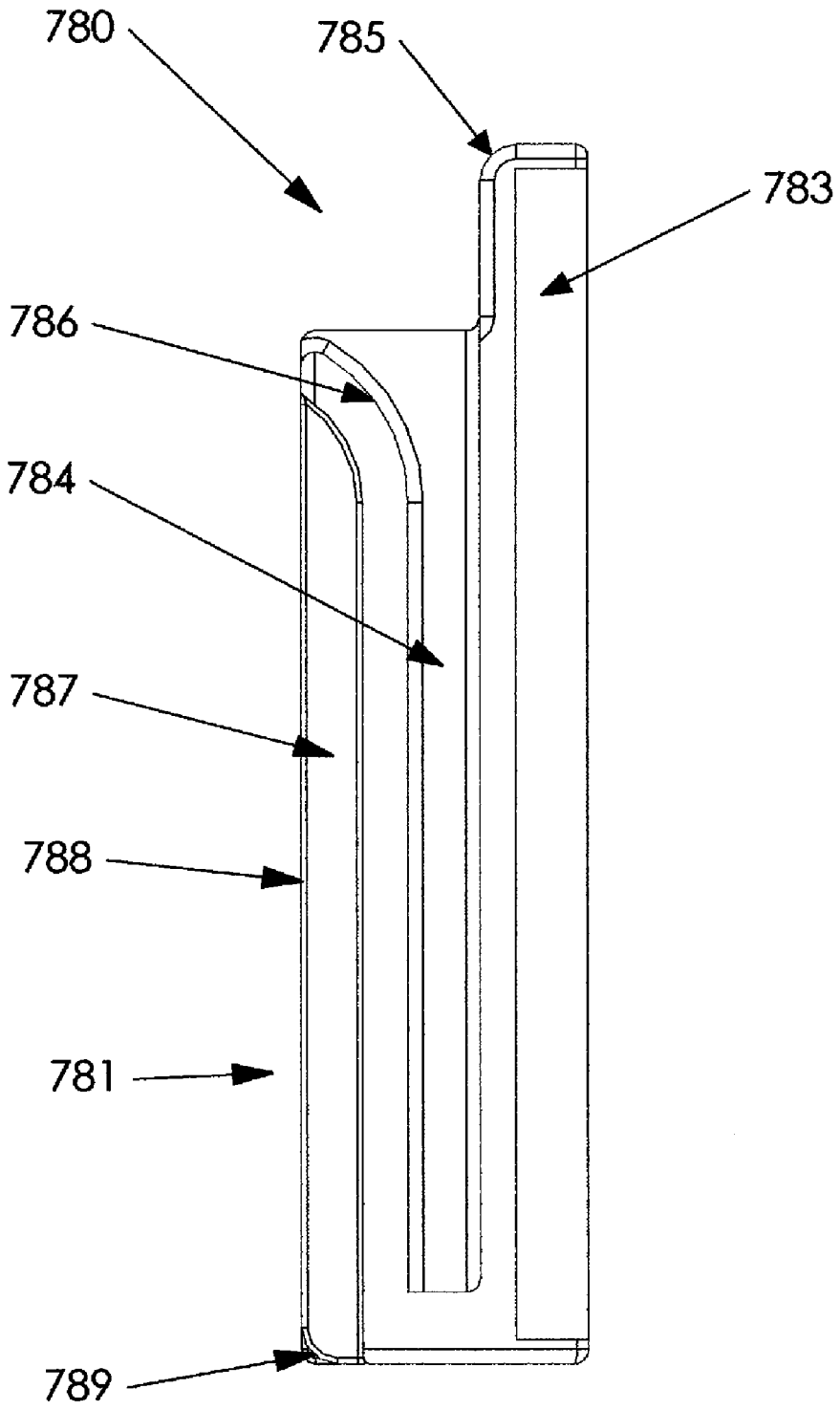
FIG. 114 is an inside cut-away view of design variation 7 magnet attachment housing body 781 in detail.
Figure 115:
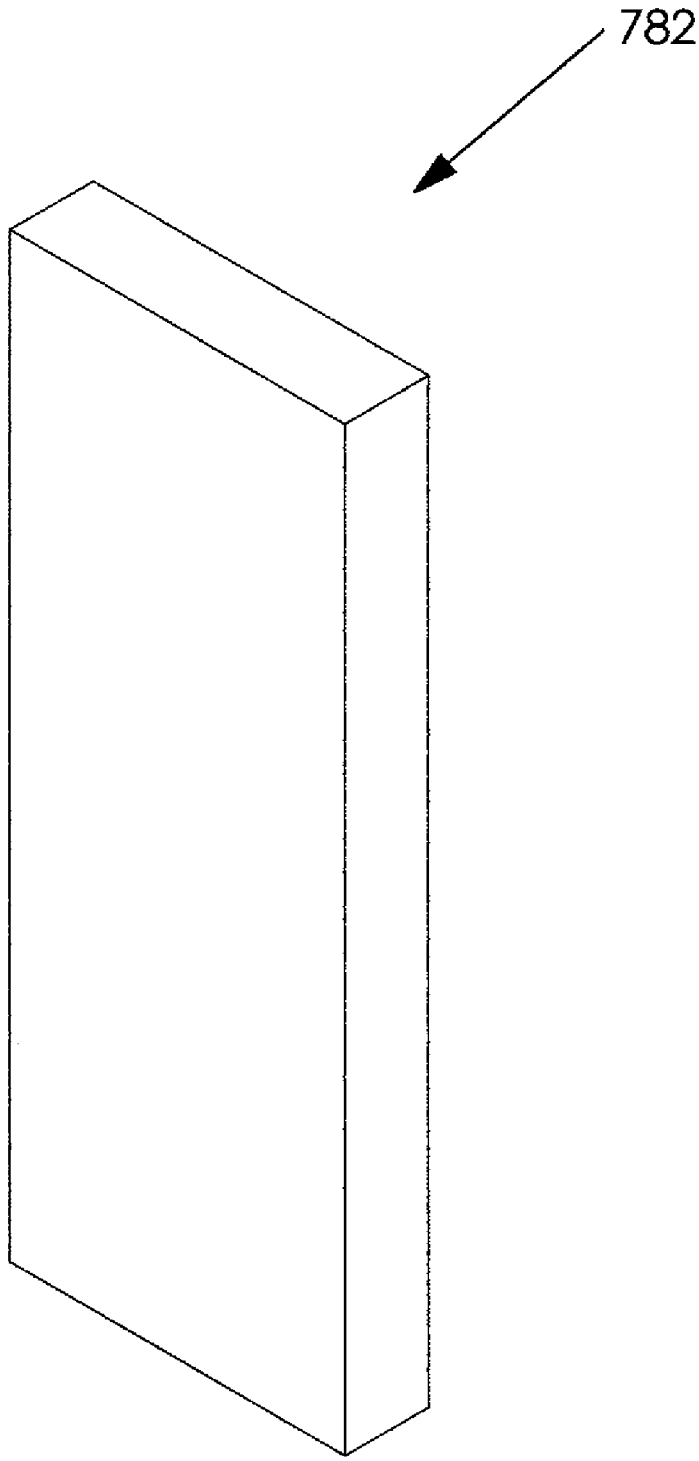
FIG. 115 is a front or back perspective view of design variation 7 magnet attachment magnetic piece 782 in detail.
Figure 116:
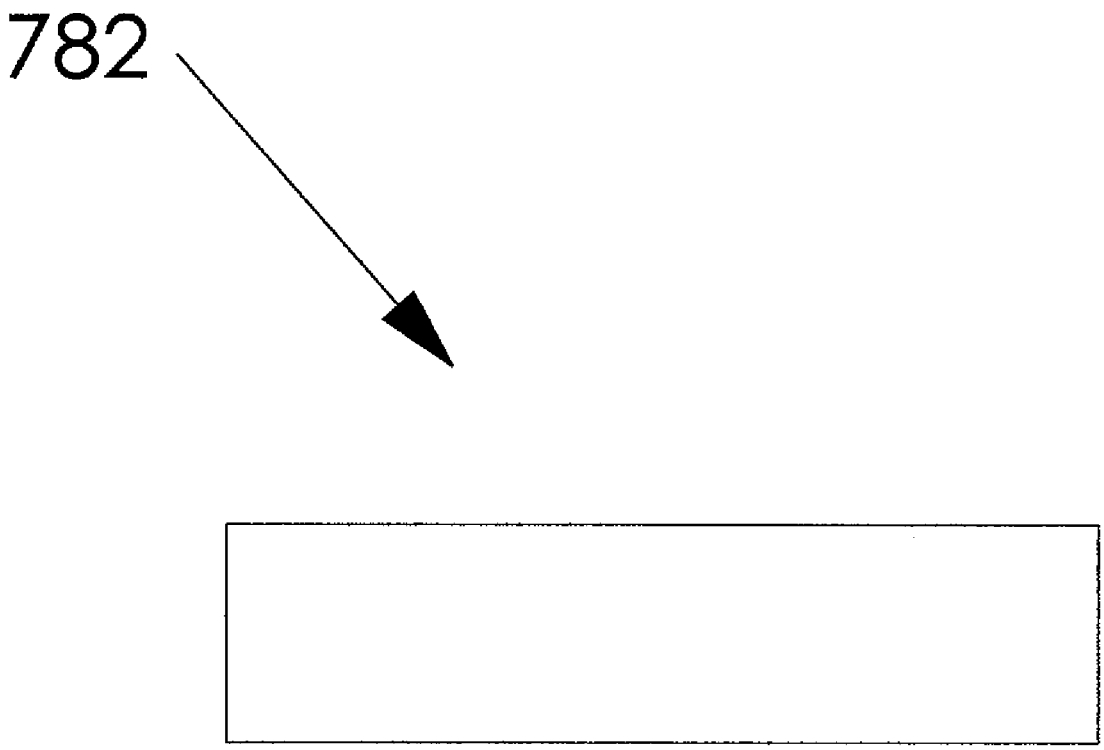
FIG. 116 is a top or bottom view of design variation 7 magnet attachment magnetic piece 782 in detail.
Figure 117:
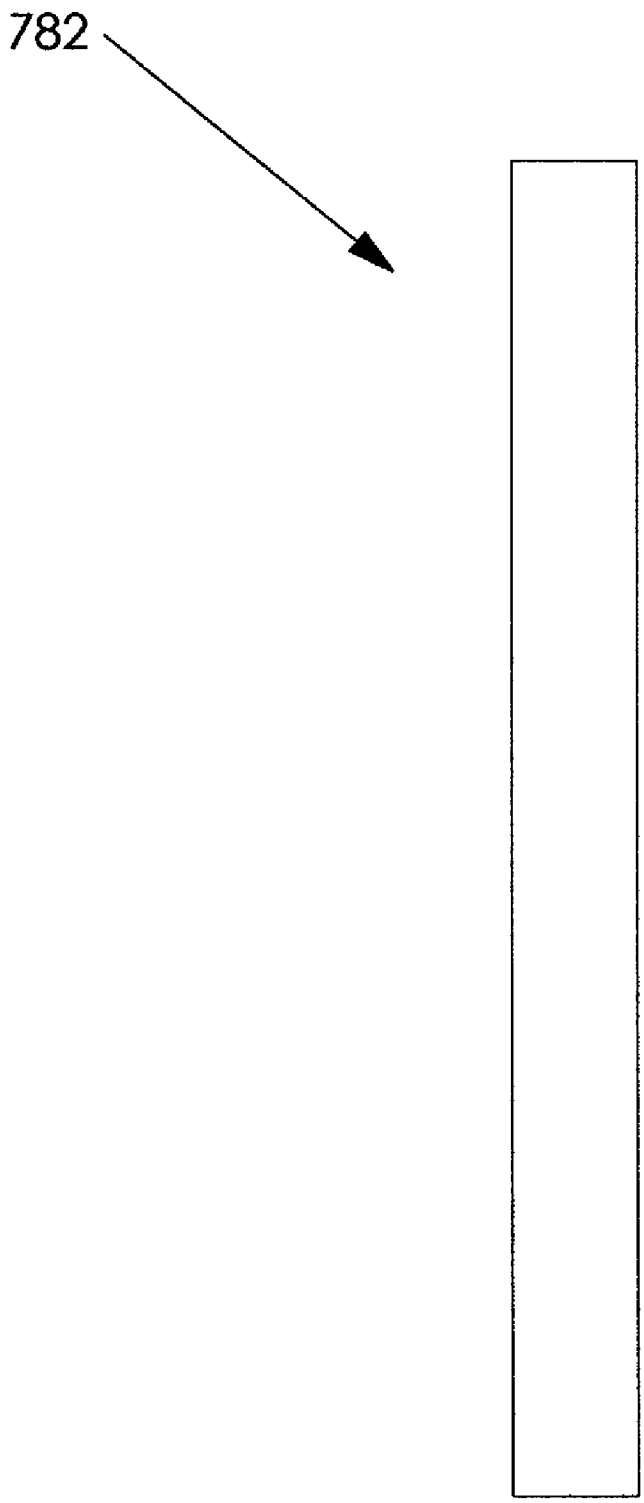
FIG. 117 is a side view of design variation 7 magnet attachment magnetic piece 782 in detail.
Figure 118:
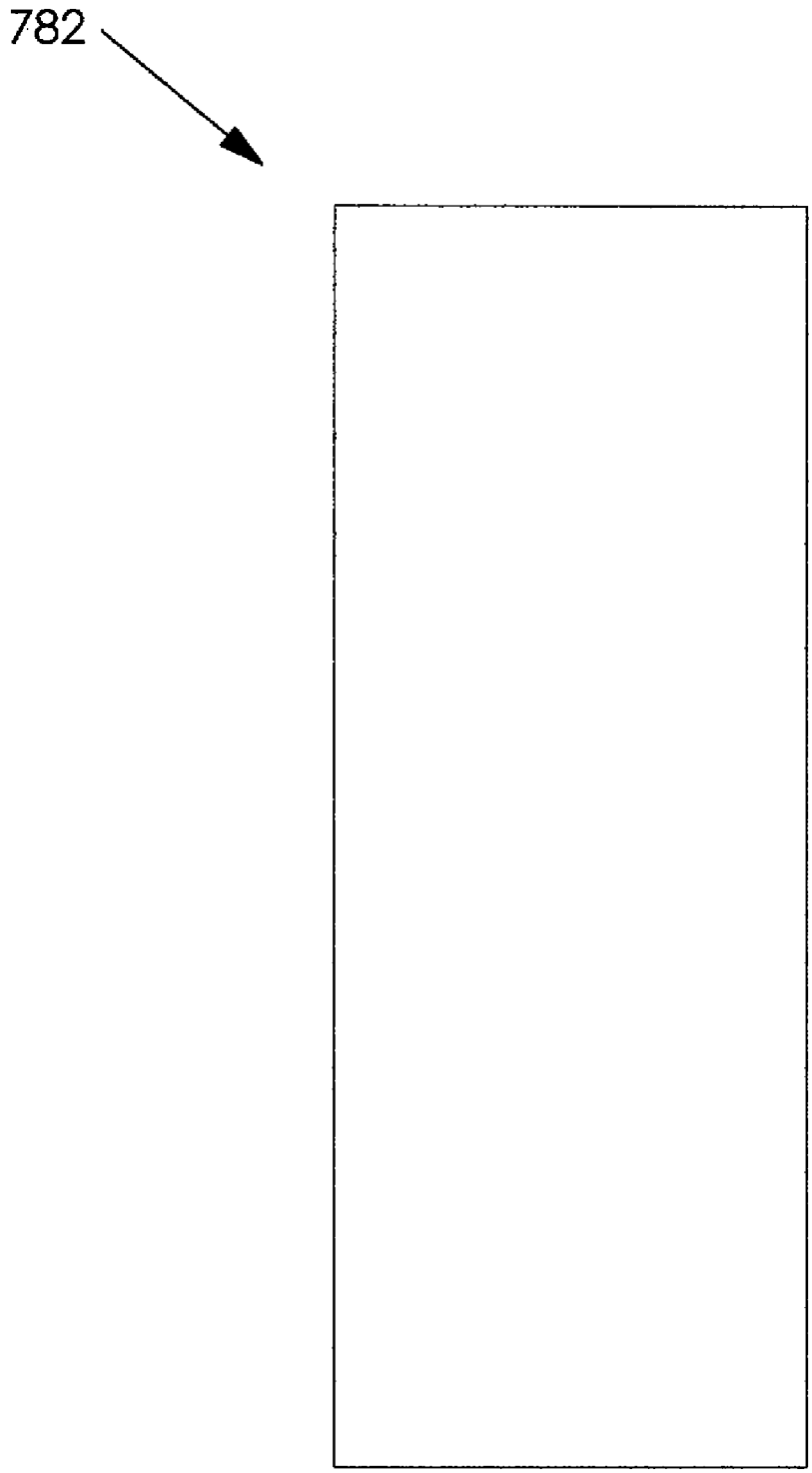
FIG. 118 is a front or back view of design variation 7 magnet attachment magnetic piece 782 in detail.
Figure 119:
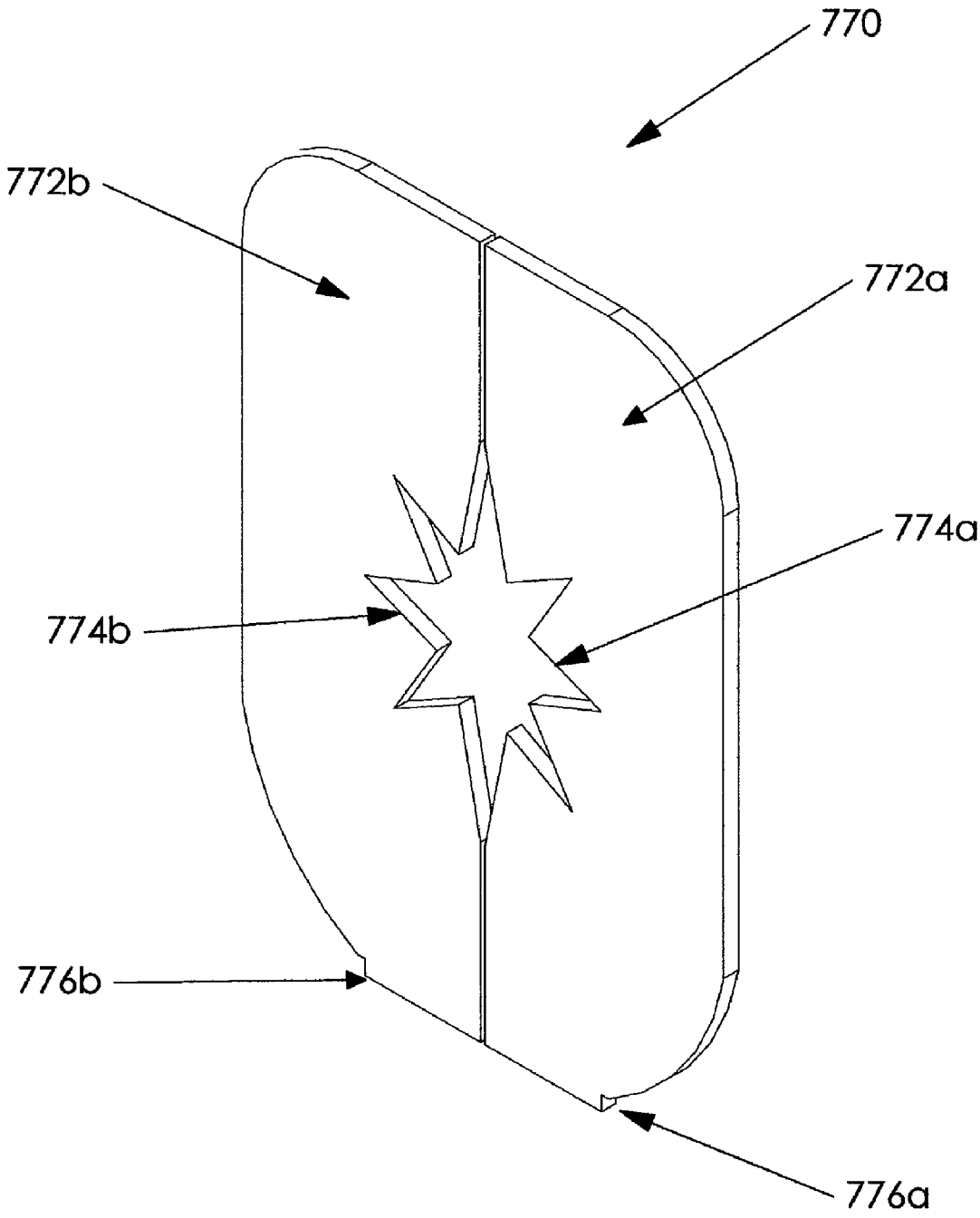
FIG. 119 is a front or back perspective view of design variation 7 set of flexible doors 770 in detail.
Figure 120:
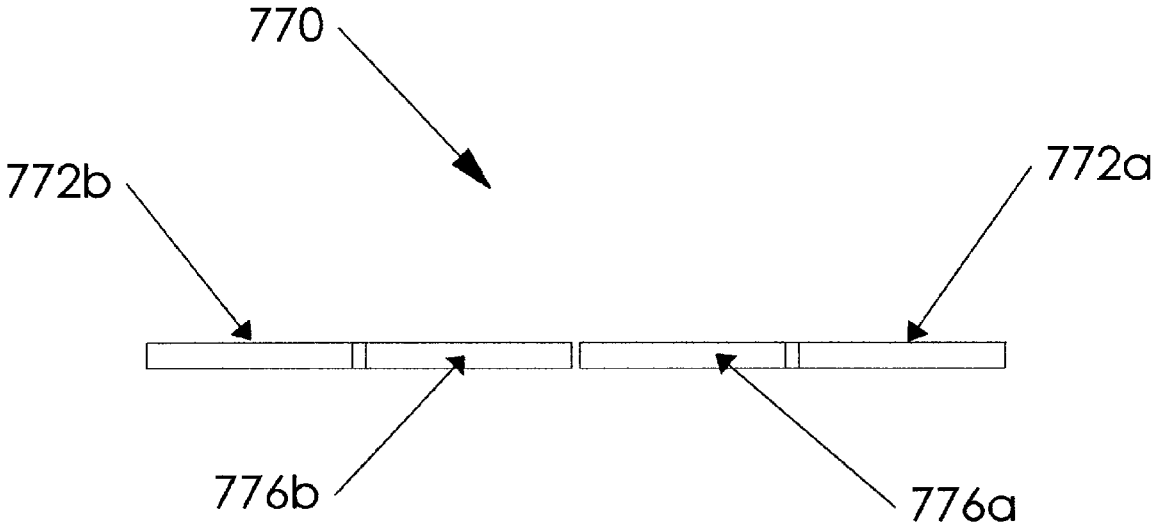
Figure 121:
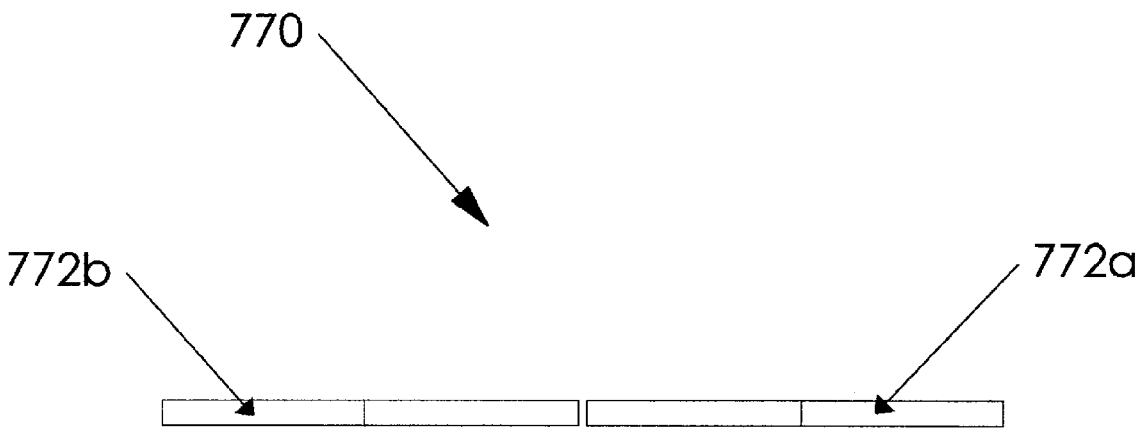
Figure 122:
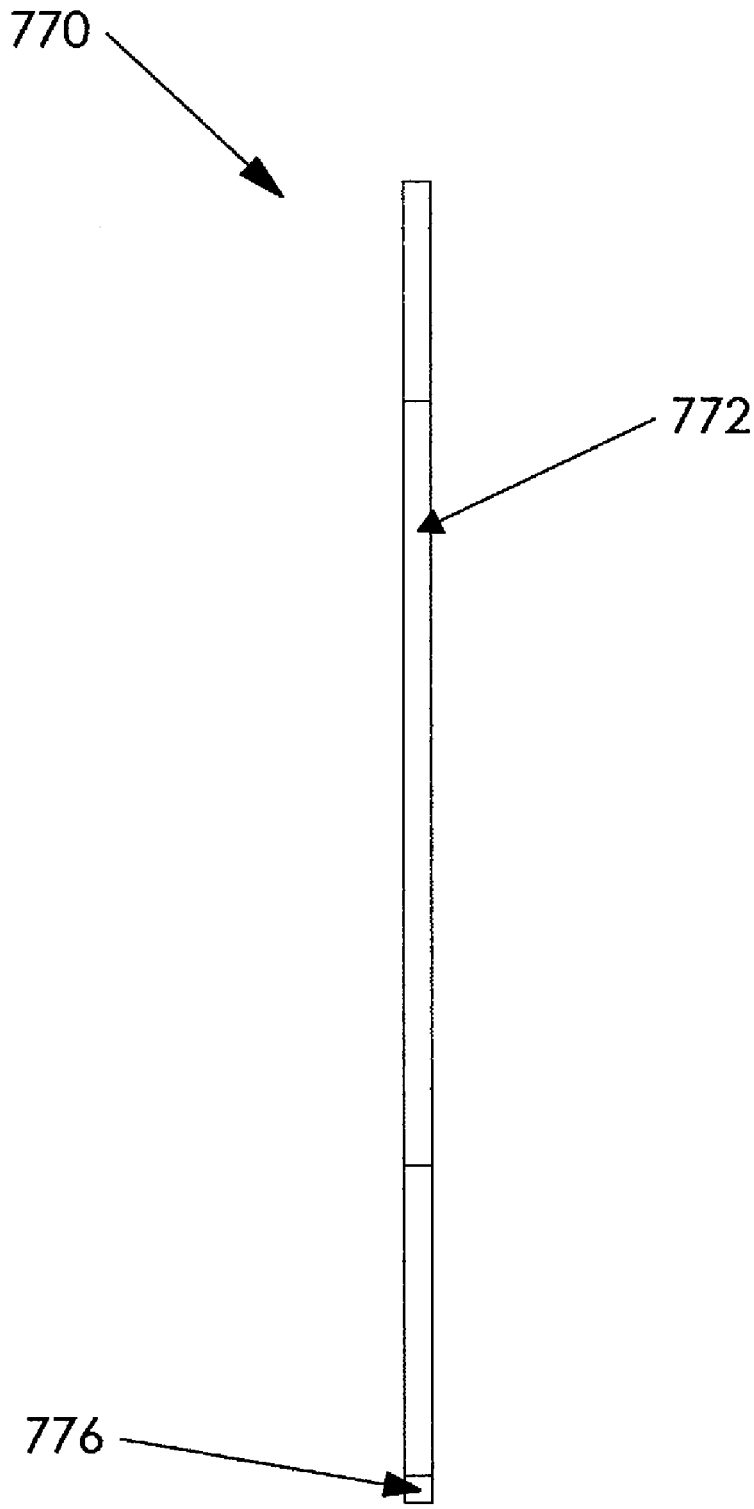

As illustrated with references to FIG. 42, FIG. 43, FIG. 44, FIG. 45, FIG. 46, FIG. 47, FIG. 48, FIG. 49, FIG. 50, FIG. 51, FIG. 52, FIG. 53, FIG. 54, FIG. 55, FIG. 56, FIG. 57, FIG. 58, FIG. 59, FIG. 60, FIG. 61, FIG. 62, FIG. 63, FIG. 64 and FIG. 65, design variation 6 of a bottle opener and bottle cap collecting and disposing device 610, in accordance with the present invention, comprises a housing 620 connecting all components of design variation 6. A bottle cap collection chamber 626 is used to store bottle caps. A belt clip 622 molded into the housing 620 allows the user to hook the bottle opener and bottle cap collecting and disposing device 610 onto his or her belt. Other carrying and/or connecting devices may be included to allow the user to carry the device in a hands-free mode. A metal piece shaped for opening bottles 630 is securely fastened at the location where the metal piece shaped for opening bottles resides 632. The first extended rectangular-shaped piece 621*a*, the second extended rectangular-shaped piece 621*b*, the third extended rectangular-shaped piece 621*c* and the fourth extended rectangular-shaped piece 621*d* are all used to block the bottle cap from falling behind the metal piece shaped for opening bottles 630 after the bottle cap is separated from the bottle. The location of flexible doors 624 used to prevent bottle caps from passing back through the opening of the housing 620 after the user separates the bottle cap from the bottle using the metal piece shaped for opening bottles 630 is also the opening where the top and neck of a bottle is inserted into the housing 620. The location of the left flexible door 624*a* and the location of the right flexible door 624*b* are similar in size and shape. A finger grip ridge 625 molded onto the housing 620 is used to provide a comfortable grip to the user. The first finger grip ridge 625*a*, the second finger grip ridge 625*b*, the third finger grip ridge 625*c* and the fourth finger grip ridge 625*d* are similar in size and shape. A pressure sensitive button-like shape with latch 627 is used to open the bottom door 628 which prevents bottle caps from falling out of the collection chamber 626. A spring-loaded hinge 629 connecting the housing 620 to the bottom door 628, with resistance to the spring while the bottom door 628 is in the closed position, allows the bottom door 628 to open quickly after pressing the pressure sensitive button-like shape with latch 627. The location of the thumb-supported traction 623 is to be used to show where the placement of the thumb should be while pressing the pressure sensitive button-like shape with latch 627. An oval-shaped opening 634 in the metal piece shaped for opening bottles 630 is the location where the bottle cap is partially inserted into during the bottle opening process. A flat and inclined area 636 on the metal piece shaped for opening bottles 630 is used to pry off the bottom end of the bottle cap from the bottle. The location of an internal spring 662 is also the connection point of the bottom door 628 to the housing 620. In reference to the bottom door 628, the left upward ridge 664*a*, the center upward ridge 664*b* and the right upward ridge 664*c* help to prevent bottle caps from getting caught on the inside of the bottom door 628 when it is open as they fall out of the bottle cap collection chamber 626. The indented part 666 of the bottom door 628 latches to the pressure sensitive button-like shape with latch 627 and locks the bottom door 628 in the closed position preventing bottle caps from exiting through the bottle cap collection chamber 626. One or more openings may be formed in the bottom door 628 or in the collection chamber 626 in order to allow any fluid entering the device to drain. A set of flexible doors 670, which are inserted into the location of flexible doors 624, are used to prevent bottle caps from passing back through the opening of the housing 620 after the user separates the bottle cap from the bottle using the metal piece shaped for opening bottles 630. The flexible doors may be formed from at least two pieces of elastomeric material disposed in the housing opening proximate one another and defining an insertion opening there between. The insertion opening is illustrated in FIG. 65 as defining a general star shape. The insertion opening is dimensioned sufficiently small to inhibit passage of the removed cap when the elastomeric material is in a relaxed state, and it is dimensioned sufficiently large to pass the sealed bottle top and cap when the elastomeric material is in a stretched state. The left flexible door 672*a* is shaped as shown and is inserted into the location of the left flexible door 624*a*. The right flexible door 672*b* is shaped as shown and is inserted into the location of the right flexible door 624*b*. The left half of an eight pointed star shape 674*a* and the right half of an eight pointed star shape 674*b* are both used to allow the bottle to be inserted into the opening where the set of flexible doors 670 are attached but also prevents the bottle cap from escaping out of the opening where the set of flexible doors 670 are attached. A general star shape of any form is advantageous regardless of the number of points because the inwardly projecting points of the elastomeric material provide improved swiping action against the bottle top with a reduced stiffness to bending, while at the same time providing improved restriction against the passage of the removed bottle cap through the insertion opening. The flexible doors may take other forms and there may be more than one insertion opening formed by elastomeric material, such as an embodiment using a plurality of rubber strips (e.g. rubber bands) stretched across the housing opening. The rectangular-shaped flap 676*a* is molded to the left flexible door 672*a* which matches the insertion design of the location of the left flexible door 624*a*. The rectangular-shaped flap 676*b* is molded to the right flexible door 672*b* which matches the insertion design of the location of the right flexible door 624*b*. The flexible doors may be formed of an elastomer such as rubber or a relatively thin sheet of plastic or metal or other material that provides a degree of flexibility that is insufficient to resist the insertion of the bottle/cap combination, but that is sufficient to prevent the cap from being removed with the bottle or by itself. In one embodiment, the flexible doors are formed of $1/16^{th}$ inch rubber sheet having sufficient stiffness to be inserted into the proper location in the device and to remain in place during use of the device. The flexible doors 670 are illustrated as being attached to the outer housing of the device; however, in other embodiments, the flexible doors may be attached to the metal bottle opener piece or to an internal structure of the device, so long as they provide the desired function of containing the caps within the housing.

610—Design variation 6 of a bottle opener and bottle cap collecting and disposing device.

620—Housing connecting all components of design variation 6.

621*a*—First extended rectangular-shaped piece molded to 620 used to block the bottle cap from falling behind 630 after bottle and bottle cap separation.

621*b*—Second extended rectangular-shaped piece molded to 620 used to block the bottle cap from falling behind 630 after bottle and bottle cap separation.

621*c*—Third extended rectangular-shaped piece molded to 620 used to block the bottle cap from falling behind 630 after bottle and bottle cap separation.

621*d*—Fourth extended rectangular-shaped piece molded to 620 used to block the bottle cap from falling behind 630 after bottle and bottle cap separation.

622—A belt clip molded into 620 to allow the user to hook 610 onto belt.

623—Location of thumb-supported traction to be used while pressing 627.

624—Location of flexible door used to prevent bottle caps from passing back through the opening of 620 after the user separates the bottle cap from the bottle using 630.

624*a*—Location of left flexible door used to prevent bottle caps from passing back through the opening of 620 after the user separates the bottle cap from the bottle using 630.

624*b*—Location of right flexible door used to prevent bottle caps from passing back through the opening of 620 after the user separates the bottle cap from the bottle using 630.

625—Finger grip ridge used to provide a comfortable grip to the user.

625*a*—First finger grip ridge used to provide a comfortable grip to the user.

625*b*—Second finger grip ridge used to provide a comfortable grip to the user.

625*c*—Third finger grip ridge used to provide a comfortable grip to the user.

625*d*—Fourth finger grip ridge used to provide a comfortable grip to the user.

626—The bottle cap collection chamber used to store bottle caps.

627—Pressure sensitive button-like shape with latch used to open 628 to release bottle caps from 626.

628—Door used to prevent bottle caps from falling out of 626 until 627 is pressed.

629—A spring-loaded hinge connecting 620 to 628 with resistance to the spring while 628 is in the closed position.

630—Metal piece shaped for opening bottles.

632—Location where metal piece shaped for opening bottles resides.

634—Oval-shaped opening in 630 where the bottle cap is partially inserted into during the bottle opening process.

636—Flat and inclined area of 630 used to pry off the bottom end of the bottle cap from the bottle.

662—Location of internal spring and connection point of 628 to 620.

664*a*—Left upward ridge preventing bottle caps from getting caught on the inside of 628 when it is open as they fall out of 626.

664*b*—Center upward ridge preventing bottle caps from getting caught on the inside of 628 when it is open as they fall out of 626.

664*c*—Right upward ridge preventing bottle caps from getting caught on the inside of 628 when it is open as they fall out of 626.

666—Indented part of 628 which latches to 627 and locks 628 in the closed position preventing bottle caps from exiting through 626.

670—Set of flexible doors used to prevent bottle caps from passing back through the opening of 620 after the user separates the bottle cap from the bottle using 630.

672*a*—Left flexible door shaped as shown and inserted into 624*a*.

672*b*—Right flexible door shaped as shown and inserted into 624*b*.

674*a*—Left half of an eight pointed star shape used to allow the bottle to be inserted into the opening where 670 is attached but prevents the bottle cap from escaping out of the opening where 670 is attached.

674*b*—Right half of an eight pointed star shape used to allow the bottle to be inserted into the opening where 670 is attached but prevents the bottle cap from escaping out of the opening where 670 is attached.

676*a*—Rectangular-shaped flap molded to 672*a* which matches the insertion design of 624*a*.

676*b*—Rectangular-shaped flap molded to 672*b* which matches the insertion design of 624*b*.

Figure 123:
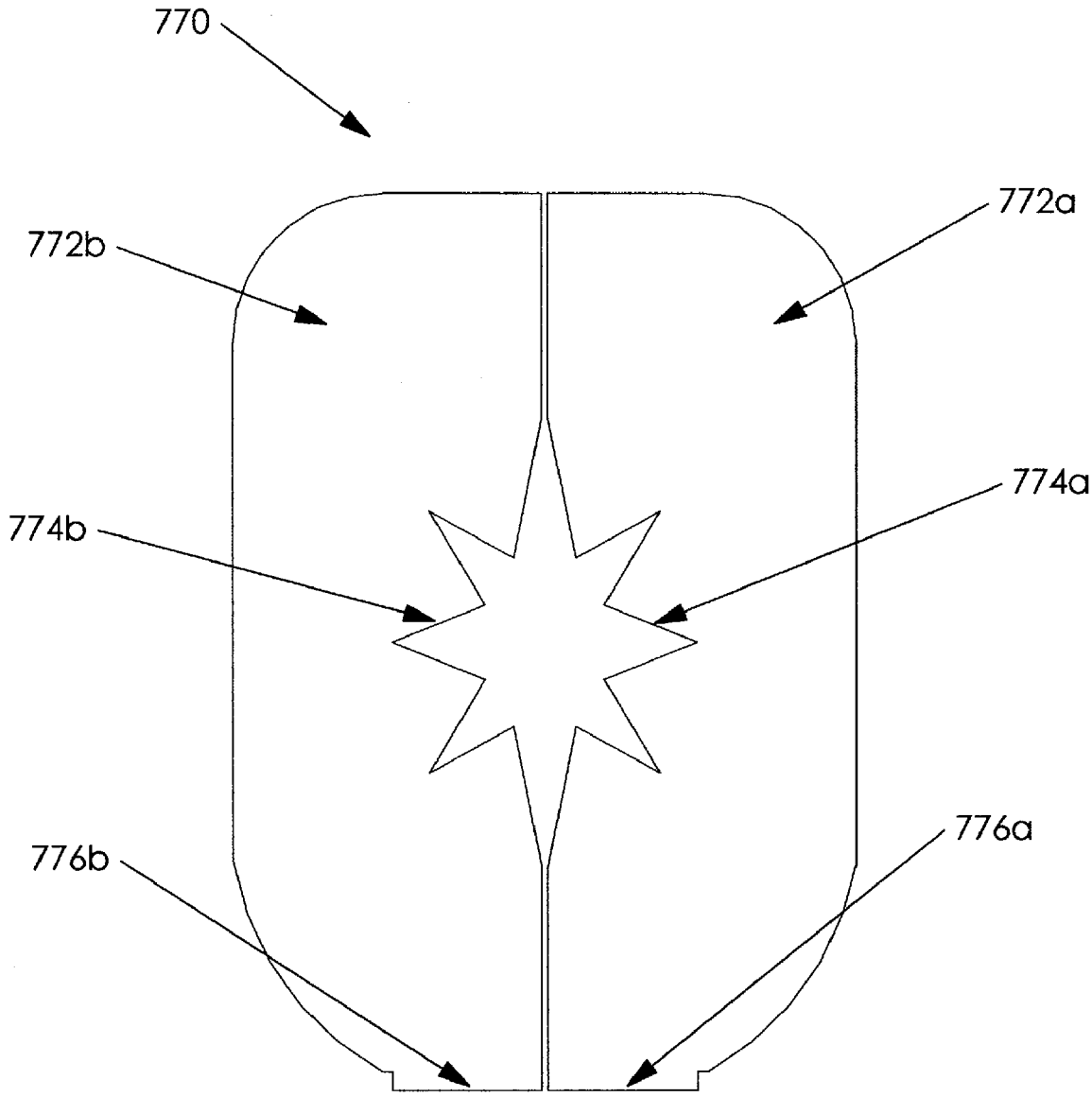
Figure 124:
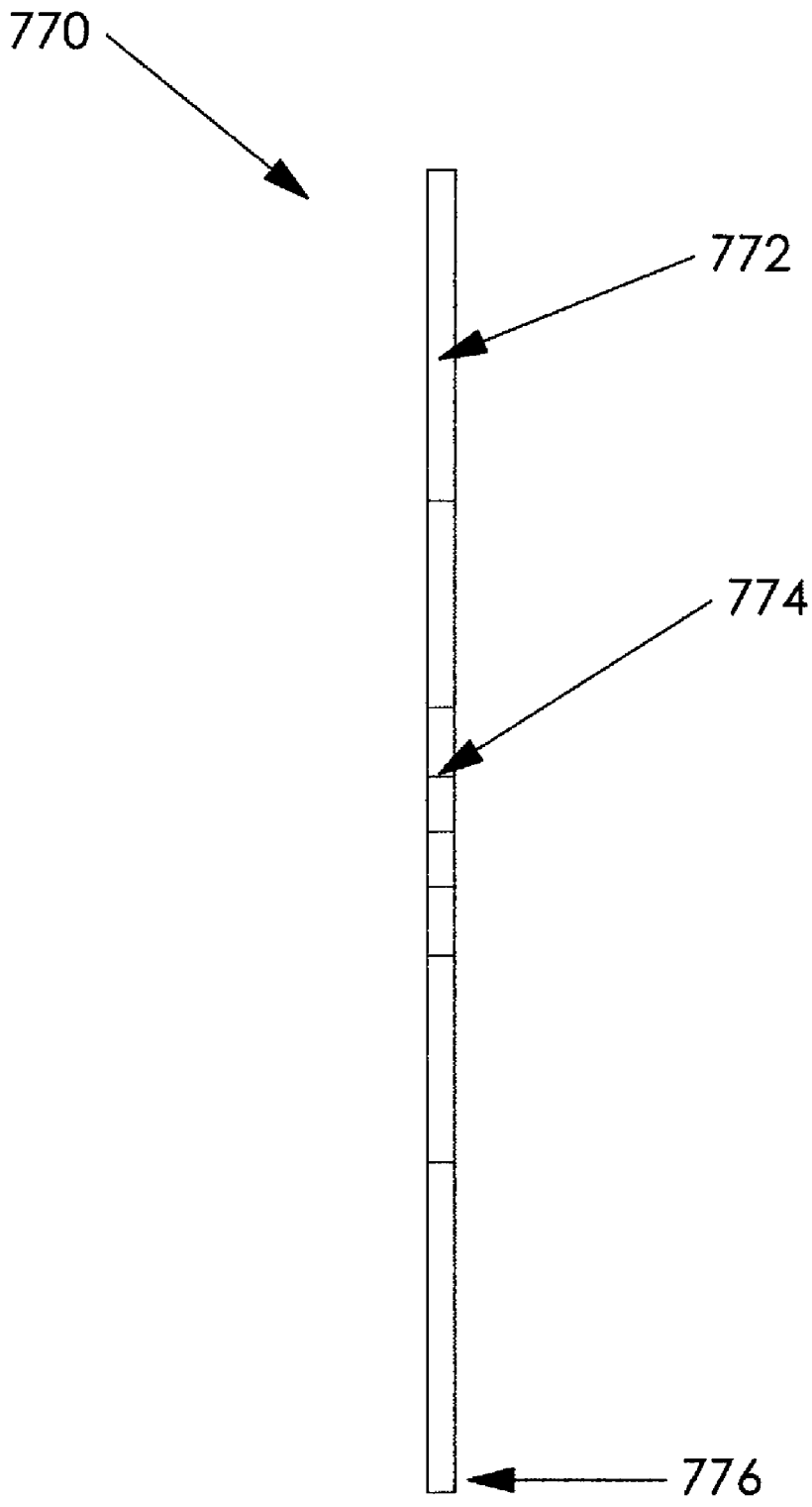
Figure 125:
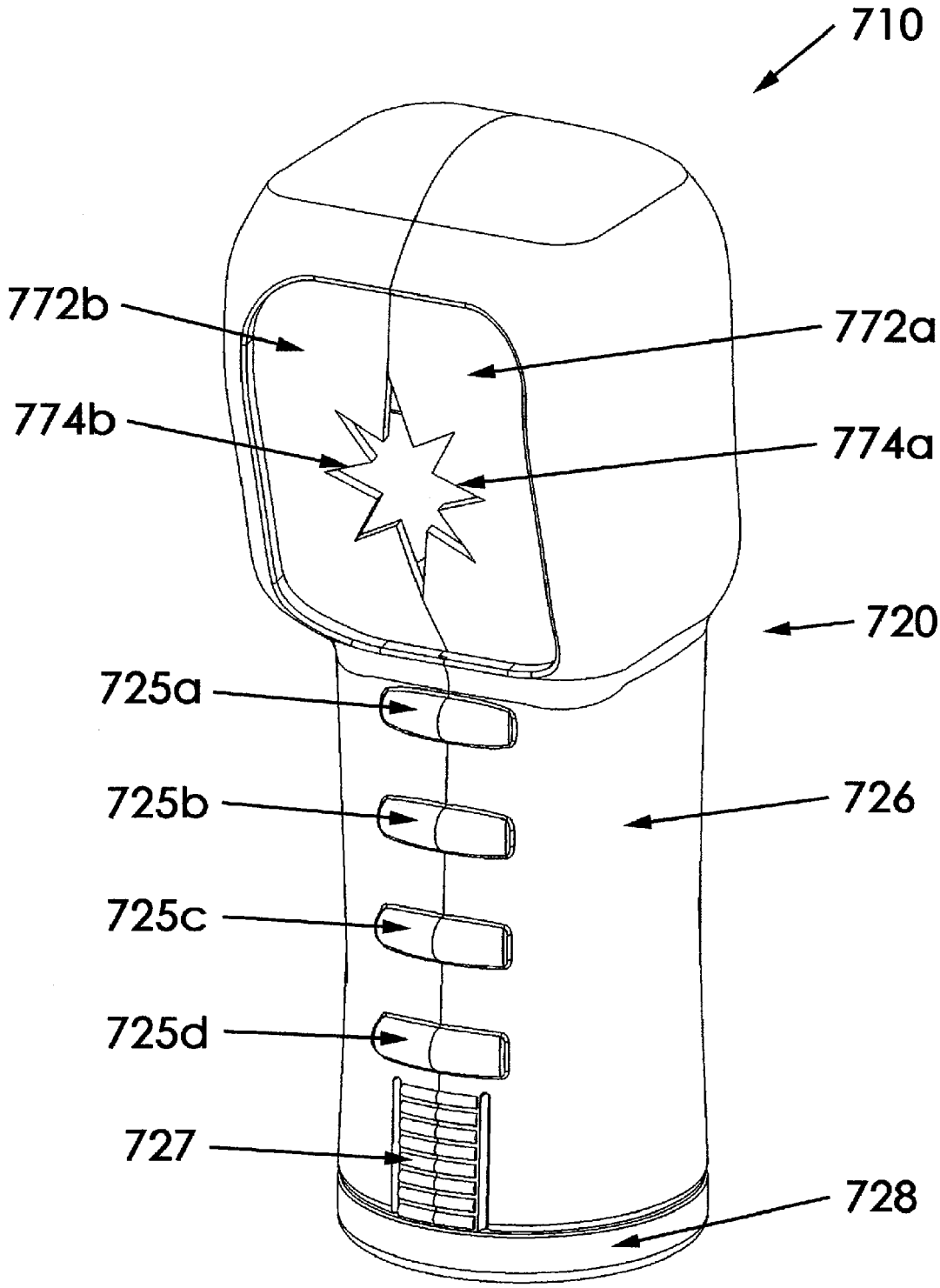
Figure 126:
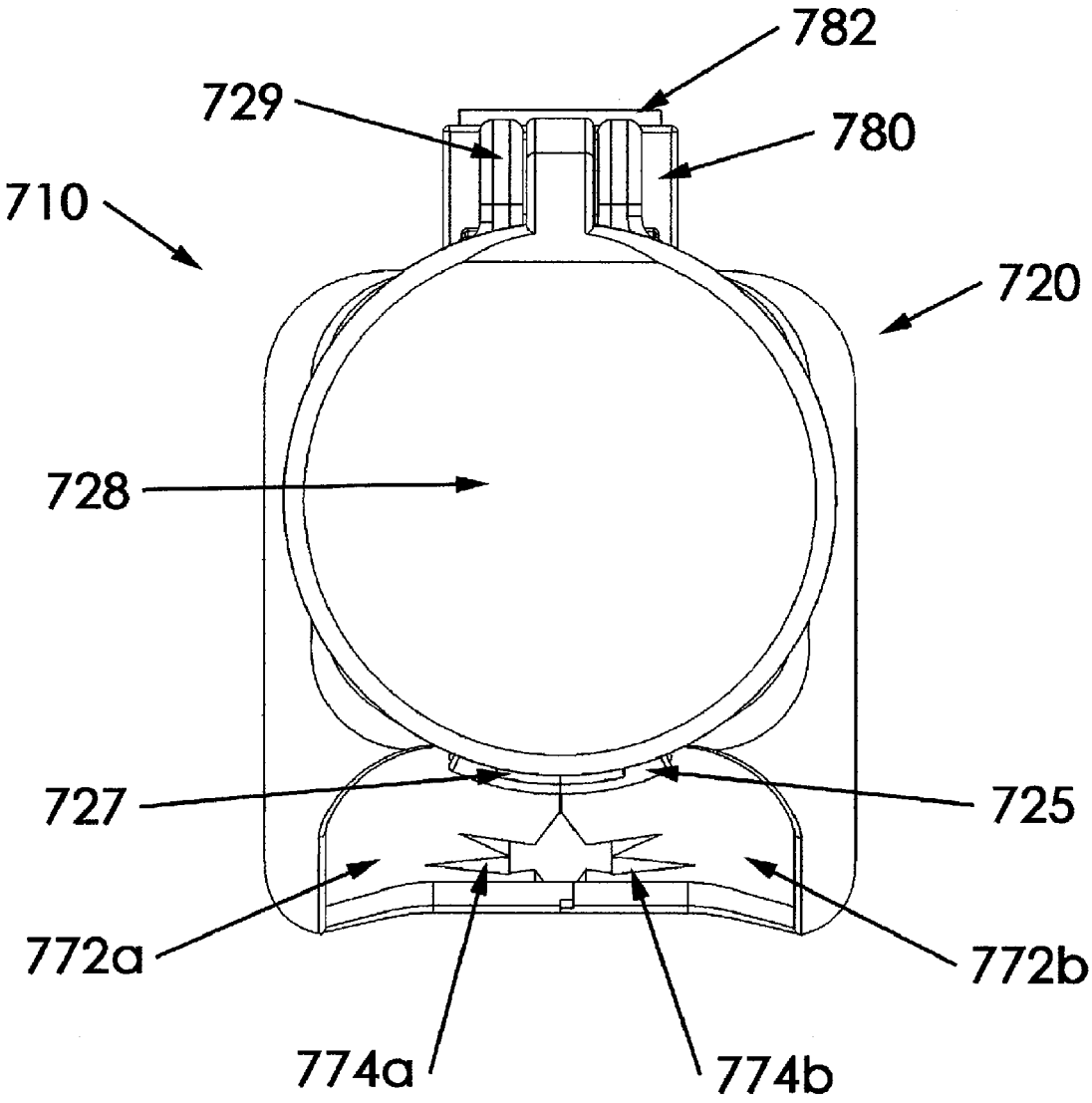
Figure 127:
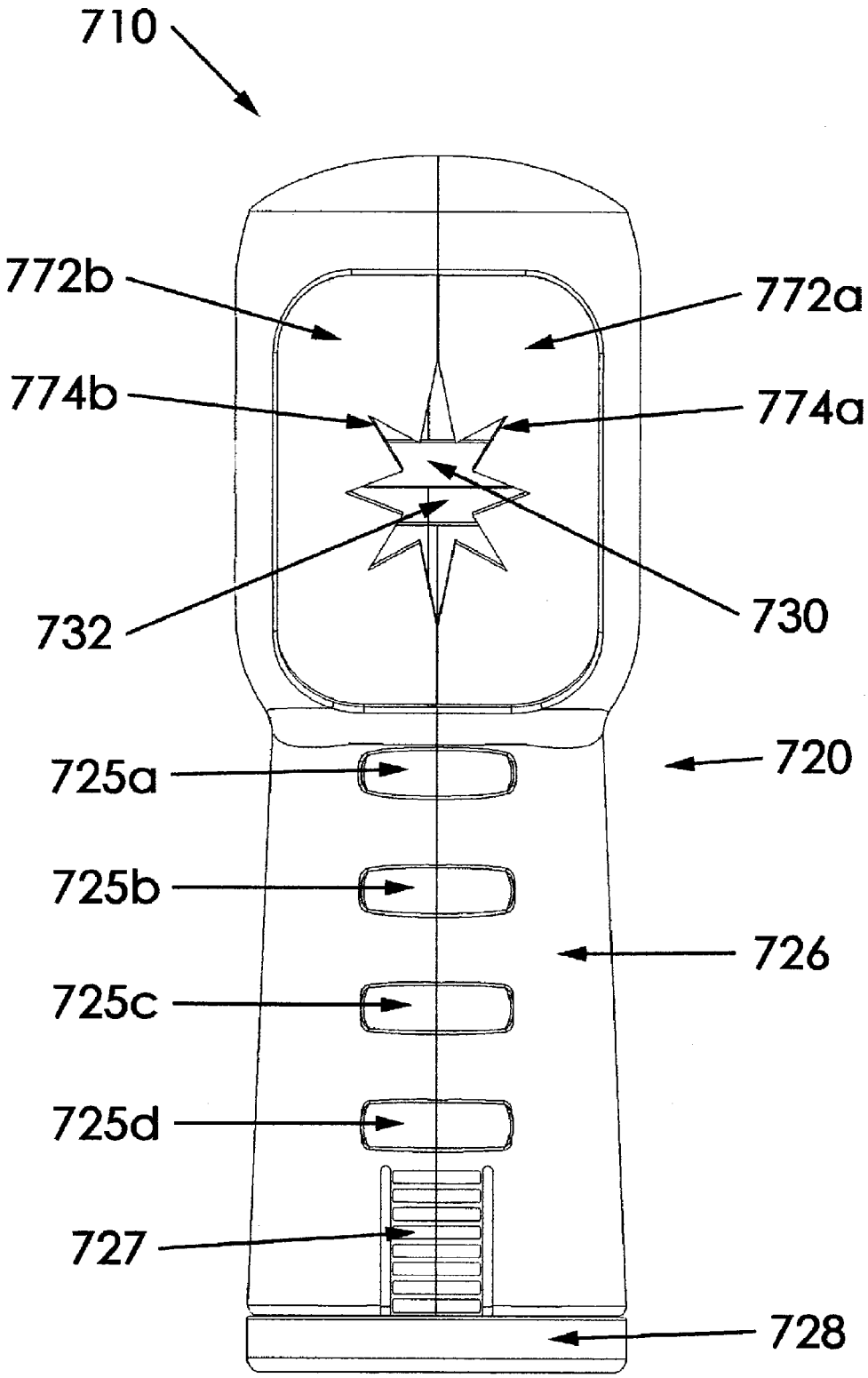
Figure 128:
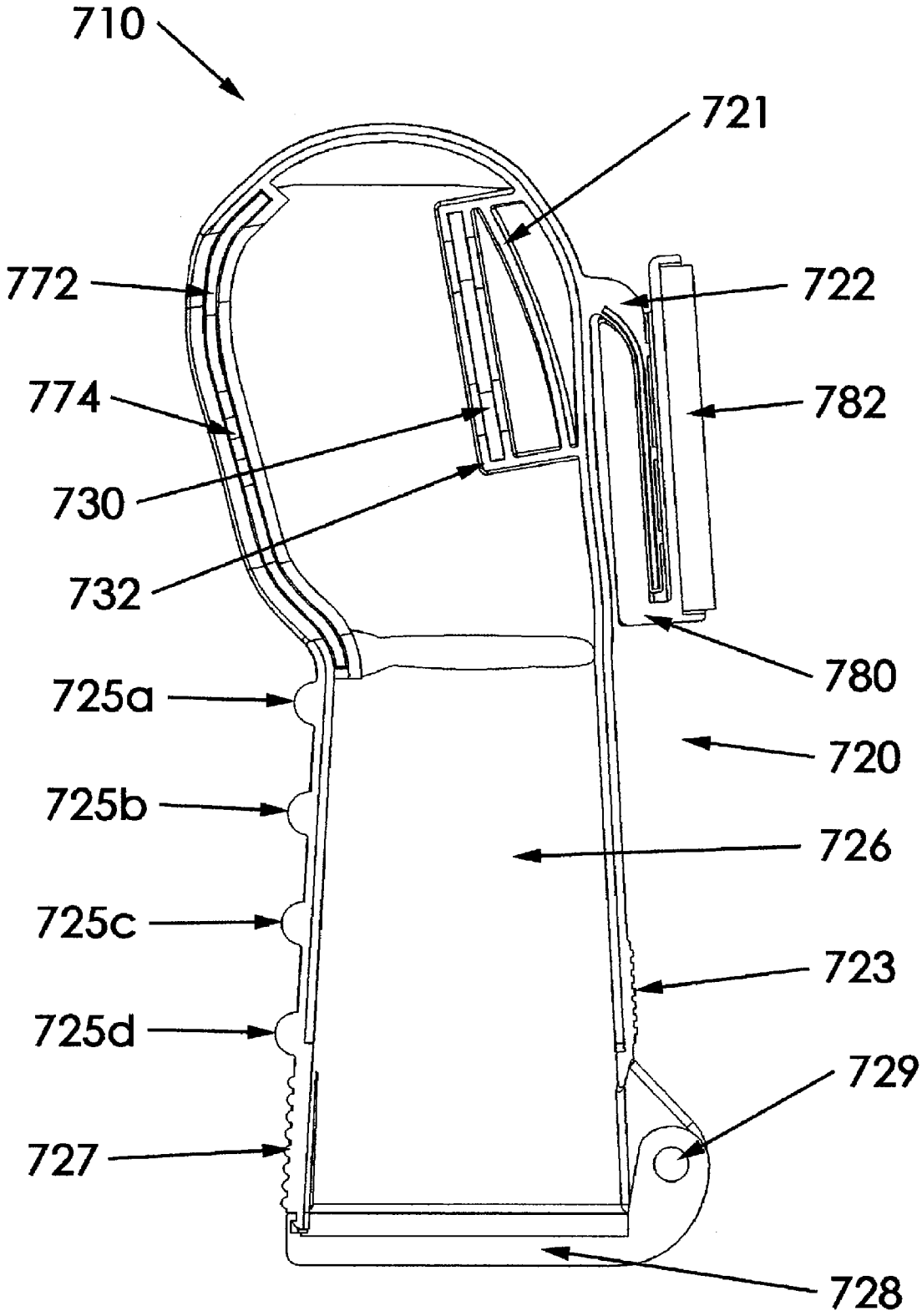

As illustrated with references to FIG. 66, FIG. 67, FIG. 68, FIG. 69, FIG. 70, FIG. 71, FIG. 72, FIG. 73, FIG. 74, FIG. 75, FIG. 76, FIG. 77, FIG. 78, FIG. 79, FIG. 80, FIG. 81, FIG. 82, FIG. 83, FIG. 84, FIG. 85, FIG. 86, FIG. 87, FIG. 88, FIG. 89, FIG. 90, FIG. 91, FIG. 92, FIG. 93, FIG. 94, FIG. 95, FIG. 96, FIG. 97, FIG. 98, FIG. 99, FIG. 100, FIG. 101, FIG. 102, FIG. 103, FIG. 104, FIG. 105, FIG. 106, FIG. 107, FIG. 108, FIG. 109, FIG. 110, FIG. 111, FIG. 112, FIG. 113, FIG. 114, FIG. 115, FIG. 116, FIG. 117, FIG. 118, FIG. 119, FIG. 120, FIG. 121, FIG. 122, FIG. 123, FIG. 124, FIG. 125, FIG. 126, FIG. 127 and FIG. 128, design variation 7 of a bottle opener and bottle cap collecting and disposing device 710, in accordance with the present invention, comprises a housing 720 connecting all components of design variation 7. A bottle cap collection chamber 726 is used to store bottle caps. A belt clip 722 molded into the housing 720 allows the user to hook the bottle opener and bottle cap collecting and disposing device 710 onto his or her belt. Other carrying and/or connecting devices may be included to allow the user to carry the device in a hands-free mode. A metal piece shaped for opening bottles 730 is securely fastened at the location where the metal piece shaped for opening bottles resides 732 with or without the use of an adhesive or another permanent connecting procedure. The curve-shaped piece 721 molded to 720 is used to block the bottle cap from falling behind the metal piece shaped for opening bottles 730 after the bottle cap is separated from the bottle. The location of flexible doors 724 used to prevent bottle caps from passing back through the opening of the housing 720 after the user separates the bottle cap from the bottle using the metal piece shaped for opening bottles 730 is also the opening where the top and neck of a bottle is inserted into the housing 720. The location of the left flexible door 724*a* and the location of the right flexible door 724*b* are similar in size and shape. A finger grip ridge 725 molded onto the housing 720 is used to provide a comfortable grip to the user. The first finger grip ridge 725*a*, the second finger grip ridge 725*b*, the third finger grip ridge 725*c* and the fourth finger grip ridge 725*d* are similar in size and shape. A pressure sensitive button-like shape with latch 727 is used to open the bottom door 728 which prevents bottle caps from falling out of the collection chamber 726. A hinge 729 connecting the housing 720 to the bottom door 728 allows the bottom door 728 to open after pressing the pressure sensitive button-like shape with latch 727. The location of the thumb-supported traction 723 is to be used to show where the placement of the thumb should be while pressing the pressure sensitive button-like shape with latch 727. An oval-shaped opening 734 in the metal piece shaped for opening bottles 730 is the location where the bottle cap is partially inserted into during the bottle opening process. A flat area 736 on the metal piece shaped for opening bottles 730 is used to pry off the bottom end of the bottle cap from the bottle. The location of a hinge 762 is also the connection point of the bottom door 728 to the housing 720. In reference to the bottom door 728, the left upward ridge 764*a*, the center upward ridge 764*b* and the right upward ridge 764*c* help to prevent bottle caps from getting caught on the inside of the bottom door 728 when it is open as they fall out of the bottle cap collection chamber 726. The indented part 766 of the bottom door 728 latches to the pressure sensitive button-like shape with latch 727 and locks the bottom door 728 in the closed position preventing bottle caps from exiting through the bottle cap collection chamber 726. One or more openings may be formed in the bottom door 728 or in the collection chamber 726 in order to allow any fluid entering the device to drain. A set of flexible doors 770, which are inserted into the location of flexible doors 724, are used to prevent bottle caps from passing back through the opening of the housing 720 after the user separates the bottle cap from the bottle using the metal piece shaped for opening bottles 730. The left flexible door 772*a* is shaped as shown and is inserted and securely fastened into the location of the left flexible door 724*a* with or without the use of an adhesive or another permanent connecting procedure. The right flexible door 772*b* is shaped as shown and is inserted and securely fastened into the location of the right flexible door 724*b* with or without the use of an adhesive or another permanent connecting procedure. The left half of an eight pointed star shape 774*a* and the right half of an eight pointed star shape 774*b* are both used to allow the bottle to be inserted into the opening where the set of flexible doors 770 are attached but also prevents the bottle cap from escaping out of the opening where the set of flexible doors 770 are attached. The rectangular-shaped flap 776*a* is molded to the left flexible door 772*a* which matches the insertion design of the location of the left flexible door 724*a*. The rectangular-shaped flap 776*b* is molded to the right flexible door 772*b* which matches the insertion design of the location of the right flexible door 724*b*. The flexible doors may be formed of an elastomer such as rubber or a relatively thin sheet of plastic or metal or other material that provides a degree of flexibility that is insufficient to resist the insertion of the bottle/cap combination, but that is sufficient to prevent the cap from being removed with the bottle or by itself. The flexible doors may be formed of a single piece of elastomeric material having a slit formed therein, or from at least two pieces of elastomeric material disposed in the housing opening proximate one another and defining an insertion opening there between. The insertion opening is illustrated in FIG. 123 as defining a general star shape, however any form of opening may be used, including a simple slit, a round or oval shape, etc. The insertion opening is dimensioned sufficiently small to inhibit passage of the removed cap when the elastomeric material is in a relaxed state, and it is dimensioned sufficiently large to pass the sealed bottle top and cap when the elastomeric material is in a stretched state. A general star shape of any form is advantageous regardless of the number of points because the inwardly projecting points of the elastomeric material provide improved swiping action against the bottle top with a reduced stiffness to bending, while at the same time providing improved restriction against the passage of the removed bottle cap through the insertion opening. The flexible doors may take other forms and there may be more than one insertion opening formed by elastomeric material, such as an embodiment using a plurality of rubber strips (e.g. rubber bands) stretched across the housing opening. In one embodiment, the flexible doors are formed of $1/16^{th}$ inch rubber sheet having sufficient stiffness to be inserted into the proper location in the device and to remain in place during use of the device. The flexible doors 770 are illustrated as being attached to the outer housing of the device; however, in other embodiments, the flexible doors may be attached to the metal bottle opener piece or to an internal structure of the device, so long as they provide the desired function of containing the caps within the housing. The magnet attachment 780 is a removable and separate unit which comprises of a housing 781 and a magnet or magnetic piece 782. The magnet attachment 780 is inserted onto and around the belt clip 722 to allow the bottle opener and bottle cap collecting and disposing device 710 to be magnetically and securely attached to a vertical metal surface, such as a refrigerator, for easy storage and easy retrieval by the user. To attach the magnet attachment 780 to the bottle opener and bottle cap collecting and disposing device 710, the user may place his or her thumb onto the curves used to provide comfort to the user's thumb 789 and align the magnet attachment 780 under the belt clip 722 and then slide the magnet attachment 780 upwards, so that the belt clip 722 resides inside of the open area 784 after the belt clip has surpassed the top curve used to allow smooth insertion 785 and the inside curve used to allow smooth and secure insertion 786. Once the magnet attachment 780 is securely attached to the belt clip 722, the bottle opener and bottle cap collecting and disposing device 710 may be magnetically attached to a vertical or other angled metal surface and will securely hang in place, whether the collection chamber 726 is at maximum bottle cap capacity or it is empty, until the user disconnects it from the metal surface. To remove the magnet attachment 780 from the bottle opener and bottle cap collecting and disposing device 710, the user may grip the sides of the housing 781 with his or her finger and thumb and pull downwards until the belt clip 722 is completely out of the open area 784. The user may then place the magnet attachment 780 onto the vertical or other angled metal surface separately for easy storage and retrieval. The user may use the bottle opener and bottle cap collecting and disposing device 710 in the same manner whether the magnet attachment 780 is connected to the belt clip 722 or not. The magnet or magnetic piece 782 resides inside of an indented area 783 and is permanently connected to the housing 781 by adhesive or another permanent connecting procedure. The open area where the belt clip 722 is inserted 784 is slightly larger in dimensions than the belt clip 722 to allow for easy attachment and detachment. The top curve used to allow smooth insertion 785 prevents the magnet attachment 780 from getting caught on the outside ridges of the belt clip 722 during attachment. The inside curve used to allow smooth and secure insertion 786 prevents the magnet attachment 780 from getting caught on the belt clip 722 and also adds resistance to the inside of the belt clip 722 so that the magnet attachment 780 will securely remain in place after it is fully inserted onto the belt clip 722. The opening used to allow easy removal of the housing 781 from the mold 787 may be necessary during the manufacturing process. The first opening 787*a*, the second opening 787*b*, the third opening 787*c* and the fourth opening 787*d* are connected by support beams used to add stability 788. The first support beam 788*a* is used to add stability between the first opening 787*a* and the second opening 787*b*. The second support beam 788*b* is used to add stability between the second opening 787*b* and the third opening 787*c*. The third support beam 788*c* is used to add stability between the third opening 787*c* and the fourth opening 787*d*. The left curve used to provide comfort to the user's thumb 789*a* is at the bottom end of the first support beam 788*a*. The center curve used to provide comfort to the user's thumb 789*b* is at the bottom end of the second support beam 788*b*. The right curve used to provide comfort to the user's thumb 789*c* is at the bottom end of the third support beam 788*c*. In lieu of a magnet, attachment of the device to a storage surface may be accomplished with a hook and loop type fastener, wherein one part of the fastener is attached to the storage surface and the cooperating second part of the fastener is attached to the bottle opener device, either directly or via an attachment that cooperates with the belt clip.

The following dimensional information is provided for one embodiment of variation 7 of the invention. The height of the bottle opener and bottle cap collecting and disposing device 710 is approximately 6⅝$^{th}$ inches and the width is approximately 2 inches. The width of the front opening of the housing 720 where the bottle is inserted is approximately 1 11/16$^{th}$ inch to allow wider bottle necks to be inserted with ease. The height of the front opening of the housing 720 where the bottle neck is inserted is approximately 2½ inches to allow enough space for the neck of the bottle to move within during the vertical lifting motion of the bottle opening process. The height of the flexible doors 770 is approximately 3 inches and the width of each door is approximately 1 inch for a combined width of approximately 2 inches for both doors side by side. The thickness of the flexible doors 770 is approximately 1/16$^{th}$ inch. The distance from the flexible doors 770 to the location where metal piece shaped for opening bottles resides 732 is approximately 1¼$^{th}$ inch to allow enough distance for the bottle caps to easily move through and down at any angle into the collection chamber 726 without getting stuck. The inside top width of the collection chamber 726 is approximately 1½ inch and the bottom diameter of the collection chamber 726 is larger and is approximately 1⅞$^{th}$ inch to allow the bottle caps to easily fall down through the collection chamber 726 after the bottom door 728 is opened. The diameter of the bottom door 728 is approximately 2 inches. The metal piece shaped for opening bottles 730 has an approximate width of 2 inches, an approximate height of 1 7/16$^{th}$ inch and an approximate thickness of 0.08 inch which may be made of stainless steel or another strong material which will not break during the bottle opening process.

710—Design variation 7 of a bottle opener and bottle cap collecting and disposing device.

720—Housing connecting all components of design variation 7.

721—A curve-shaped piece molded to 720 used to block the bottle cap from falling behind 730 after bottle and bottle cap separation.

722—A belt clip molded into 720 to allow the user to hook 710 onto belt.

723—Location of thumb-supported traction to be used while pressing 727.

724—Location of flexible door used to prevent bottle caps from passing back through the opening of 720 after the user separates the bottle cap from the bottle using 730.

724*a*—Location of left flexible door used to prevent bottle caps from passing back through the opening of 720 after the user separates the bottle cap from the bottle using 730.

724*b*—Location of right flexible door used to prevent bottle caps from passing back through the opening of 720 after the user separates the bottle cap from the bottle using 730.

725—Finger grip ridge used to provide a comfortable grip to the user.

725*a*—First finger grip ridge used to provide a comfortable grip to the user.

725*b*—Second finger grip ridge used to provide a comfortable grip to the user.

725*c*—Third finger grip ridge used to provide a comfortable grip to the user.

725*d*—Fourth finger grip ridge used to provide a comfortable grip to the user.

726—The bottle cap collection chamber used to store bottle caps.

727—Pressure sensitive button-like shape with latch used to open 728 to release bottle caps from 726.

728—Door used to prevent bottle caps from falling out of 726 until 727 is pressed.

729—A hinge connecting 720 to 728.

730—Metal piece shaped for opening bottles.

732—Location where metal piece shaped for opening bottles resides.

734—Oval-shaped opening in 730 where the bottle cap is partially inserted into during the bottle opening process.

736—Flat area of 730 used to pry off the bottom end of the bottle cap from the bottle.

762—Location of hinge and connection point of 728 to 720.

764—Upward ridge preventing bottle caps from getting caught on the inside of 728 when it is open as they fall out of 726.

764*a*—Left upward ridge preventing bottle caps from getting caught on the inside of 728 when it is open as they fall out of 726.

764*b*—Center upward ridge preventing bottle caps from getting caught on the inside of 728 when it is open as they fall out of 726.

764*c*—Right upward ridge preventing bottle caps from getting caught on the inside of 728 when it is open as they fall out of 726.

766—Indented part of 728 which latches to 727 and locks 728 in the closed position preventing bottle caps from exiting through 726.

770—Set of flexible doors used to prevent bottle caps from passing back through the opening of 720 after the user separates the bottle cap from the bottle using 730.

772—Flexible door shaped as shown and inserted into 724.

772*a*—Left flexible door shaped as shown and inserted into 724*a*.

772*b*—Right flexible door shaped as shown and inserted into 724*b*.

774—Half of an eight pointed star shape used to allow the bottle to be inserted into the opening where 770 is attached but prevents the bottle cap from escaping out of the opening where 770 is attached.

774*a*—Left half of an eight pointed star shape used to allow the bottle to be inserted into the opening where 770 is attached but prevents the bottle cap from escaping out of the opening where 770 is attached.

774*b*—Right half of an eight pointed star shape used to allow the bottle to be inserted into the opening where 770 is attached but prevents the bottle cap from escaping out of the opening where 770 is attached.

776—Rectangular-shaped flap molded to 772 which matches the insertion design of 724.

776*a*—Rectangular-shaped flap molded to 772*a* which matches the insertion design of 724*a*.

776*b*—Rectangular-shaped flap molded to 772*b* which matches the insertion design of 724*b*.

780—Magnet attachment which slides on and off of 722 used to hang 710 onto a vertical metal surface.

781—Housing connecting all components of 780.

782—Magnet or magnetic piece.

783—Indented area where 782 resides partially inside of 781.

784—Open area where 722 is inserted.

785—Top curve used to allow smooth insertion of 780 onto 722.

786—Inside curve used to allow smooth and secure insertion of 780 onto 722.

787—Opening used to allow easy removal of 781 from the mold during manufacturing.

787*a*—First opening used to allow easy removal of 781 from the mold during manufacturing.

787*b*—Second opening used to allow easy removal of 781 from the mold during manufacturing.

787*c*—Third opening used to allow easy removal of 781 from the mold during manufacturing.

787*d*—Fourth opening used to allow easy removal of 781 from the mold during manufacturing.

788—Support beam used to add stability between multiple instances of 787.

788*a*—Support beam used to add stability between 787*a* and 787*b*.

788*b*—Support beam used to add stability between 787*b* and 787*c*.

788*c*—Support beam used to add stability between 787*c* and 787*d*.

789—Curve used to provide comfort to the user's thumb when inserting 780 onto 722.

789*a*—Left curve used to provide comfort to the user's thumb when inserting 780 onto 722.

789*b*—Center curve used to provide comfort to the user's thumb when inserting 780 onto 722.

789*c*—Right curve used to provide comfort to the user's thumb when inserting 780 onto 722.

Figure 129:
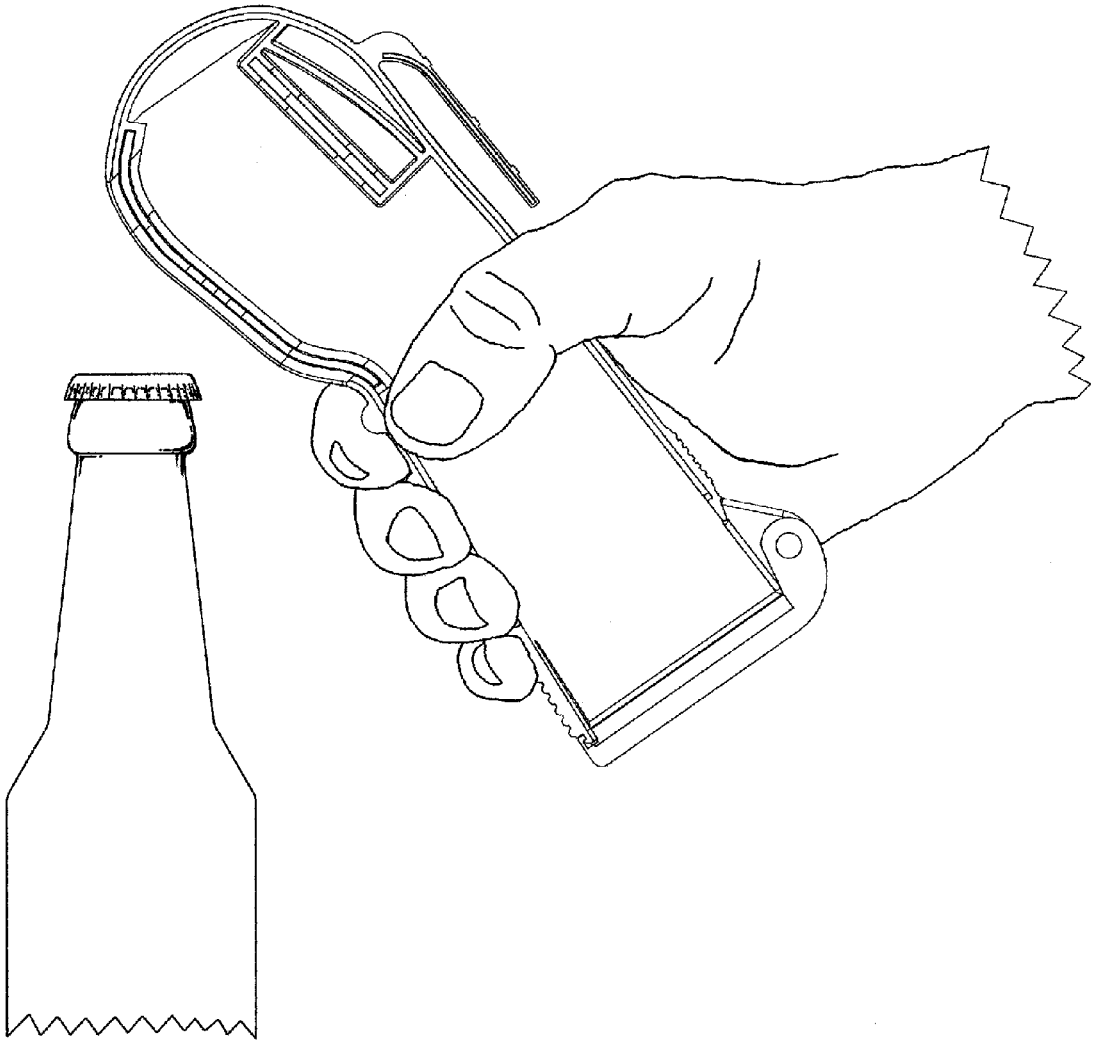
Figure 130:
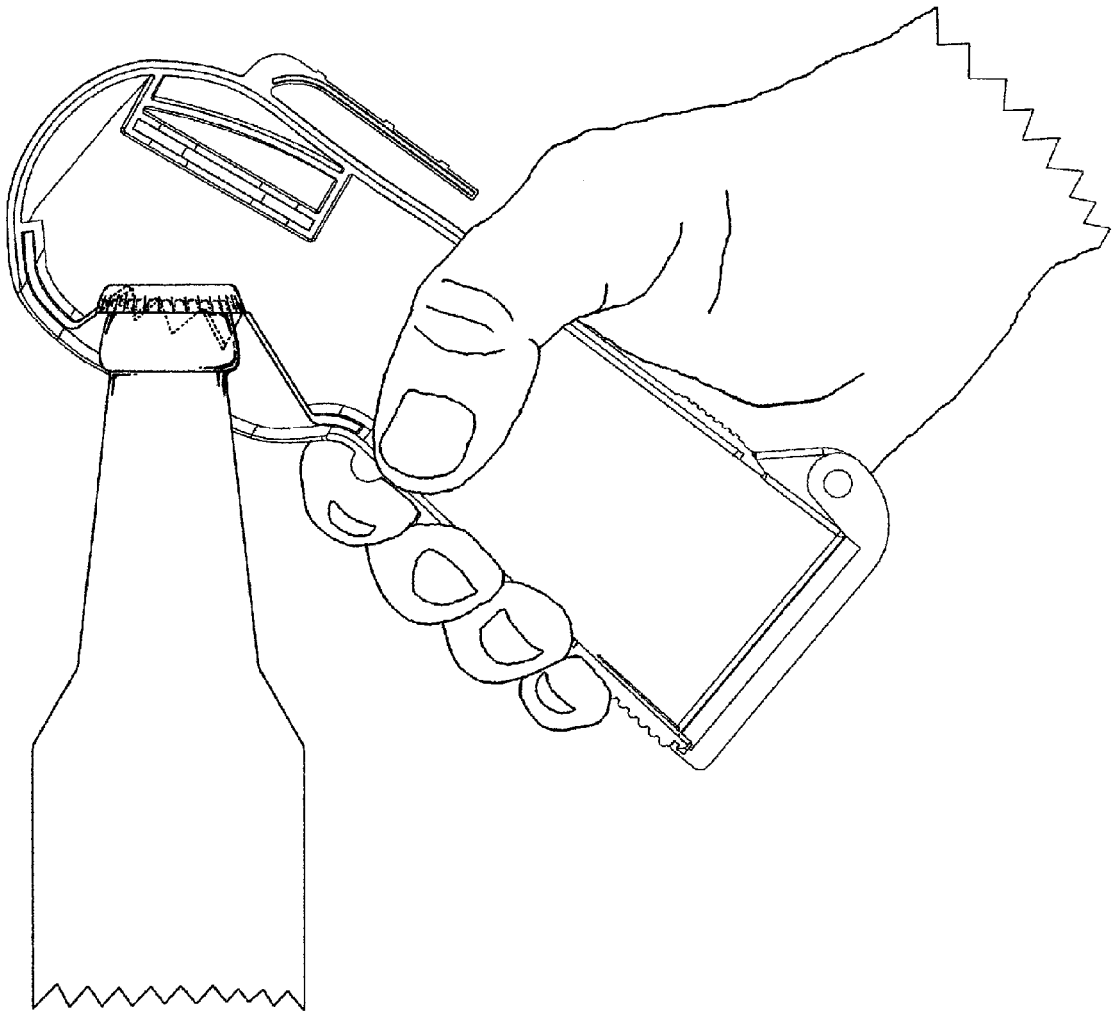
Figure 131:
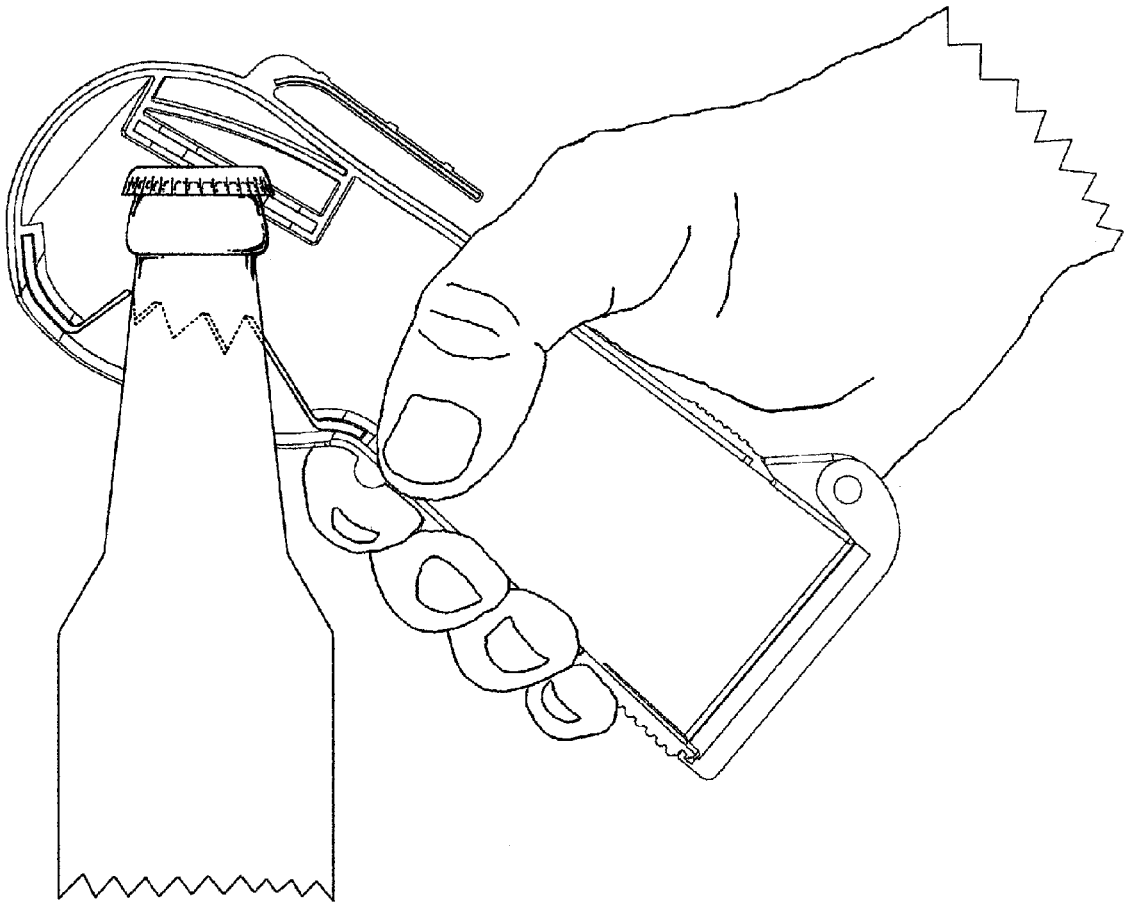

As illustrated with references to FIG. 129, FIG. 130, FIG. 131, FIG. 132, FIG. 133, FIG. 134 and FIG. 135, the bottle opening and bottle cap collecting procedure using design variation 7 of a bottle opener and bottle cap collecting and disposing device 710 is displayed in 7 steps. FIG. 129 refers to step 1 of the bottle opening and bottle cap collecting procedure where the user has the bottle opener and bottle cap collecting and disposing device 710 in his or her hand and approaches an unopened bottle. FIG. 130 refers to step 2 of the bottle opening and bottle cap collecting procedure where the user begins to insert the unopened bottle through the flexible doors 770 by lowering the bottle opener and bottle cap collecting and disposing device 710 downwards at an approximate angle of 45 degrees. FIG. 131 refers to step 3 of the bottle opening and bottle cap collecting procedure where the user has completely inserted the unopened bottle through the flexible doors 770 by lowering the bottle opener and bottle cap collecting and disposing device 710 downwards at an approximate angle of 45 degrees and properly aligns the metal piece shaped for opening bottles 730 around the unopened bottle's bottle cap with the flat area 736 just below the inside lower edge of the bottle cap. FIG. 132 refers to step 4 of the bottle opening and bottle cap collecting procedure where the user lifts the bottle opener and bottle cap collecting and disposing device 710 upwards which also raises the flat area 736 of the metal piece shaped for opening bottles 730 which also separates the bottle cap from the bottle's top lip causing the bottle to now be open. FIG. 133 refers to step 5 of the bottle opening and bottle cap collecting procedure where the user continues to lift the bottle opener and bottle cap collecting and disposing device 710 upwards with the bottle cap separated from the opened bottle and the flexible doors 770 invert and lightly grip the opened bottle's neck. FIG. 134 refers to step 6 of the bottle opening and bottle cap collecting procedure where the user has completely pulled the bottle opener and bottle cap collecting and disposing device 710 up and away from the opened bottle while the flexible doors 770 automatically close preventing the bottle cap from exiting through the flexible doors 770 while securely containing the bottle cap inside of the housing 720. FIG. 135 refers to step 7 of the bottle opening and bottle cap collecting procedure where the user turns the bottle opener and bottle cap collecting and disposing device 710 upright away from the opened bottle while the captured bottle cap falls by way of gravity down into the bottle cap collection chamber 726 and rests on the inside top of the bottom door 728. The user may repeat steps 1 through 7 again and again until the bottle cap collection chamber 726 is at or below the maximum bottle cap capacity. After the bottle cap collection chamber 726 is at or below the maximum bottle cap capacity, the user may proceed to the bottle cap disposing procedure.

As illustrated with references to FIG. 136, FIG. 137 and FIG. 138, the bottle cap disposing procedure using design variation 7 of a bottle opener and bottle cap collecting and disposing device 710 is displayed in 3 steps. FIG. 136 refers to step 1 of the bottle cap disposing procedure where the bottle cap collection chamber 726 is at or below the maximum bottle cap capacity and the user is holding the bottle opener and bottle cap collecting and disposing device 710 in his or her hand as shown over a disposal receptacle and applies pressure with his or her middle finger on the pressure sensitive button-like shape with latch 727 and also applies pressure with his or her thumb on the location of thumb-supported traction 723 simultaneously. FIG. 137 refers to step 2 of the bottle cap disposing procedure where the bottle cap collection chamber 726 is at or below the maximum bottle cap capacity and the user is holding the bottle opener and bottle cap collecting and disposing device 710 in his or her hand as shown over a disposal receptacle while the bottom door 728 opens downward by way of gravity. FIG. 138 refers to step 3 of the bottle cap disposing procedure where the bottle cap collection chamber 726 is at or below the maximum bottle cap capacity and the user is holding the bottle opener and bottle cap collecting and disposing device 710 in his or her hand as shown over a disposal receptacle and the bottom door 728 is completely open while the bottle caps fall downwards completely out of the bottle cap collection chamber 726 and into the disposal receptacle by way of gravity. After all of the bottle caps have completely fallen out of the bottle cap collection chamber 726 and into the disposal receptacle, the user may close the bottom door 728 by lifting it upwards until it is securely connected to the pressure sensitive button-like shape with latch 727 and is back to the original closed position and the bottle opener and bottle cap collecting and disposing device 710 is ready to be used again for the bottle opening and bottle cap collecting procedure.

As illustrated with references to FIG. 139, FIG. 140, FIG. 141 and FIG. 142, a bottle opener and bottle cap collecting and disposing device with an alternate exterior design 810 is shown in many different examples. FIG. 139 displays the housing 820 to be three dimensionally shaped like a football helmet with optional printing of a team logo on the sides. The front opening of the football helmet is where the flexible doors 870 and the opening of the housing 820 are positioned to conform to the regular operation of the bottle opener and bottle cap collecting and disposing device 810. The exterior of the collection chamber 826 may be decorated or molded to compliment or conform to the theme of the alternate exterior design of the housing 820. The exterior of the bottom door 828 may be decorated or molded to compliment or conform to the theme of the alternate exterior design of the housing 820. With reference to FIG. 139, the housing 820 can be designed in many other different three dimensional shapes, such as baseball helmets, sport hats and other head gear, and may or may not include printing of a team or company logo on the sides of the shape. FIG. 140 displays the housing 820 to be three dimensionally shaped like a football with optional printing of a team logo on the sides. An opening which is cut into the football shape is where the flexible doors 870 and the opening of the housing 820 are positioned to conform to the regular operation of the bottle opener and bottle cap collecting and disposing device 810. The exterior of the collection chamber 826 may be decorated or molded to compliment or conform to the theme of the alternate exterior design of the housing 820. The exterior of the bottom door 828 may be decorated or molded to compliment or conform to the theme of the alternate exterior design of the housing 820. With reference to FIG. 140, the housing 820 can be designed in many other different three dimensional shapes, such as a baseball, a soccer ball, a basketball, a bowling ball and other balls or spherical shapes, and may or may not include printing of a team or company logo on the sides of the shape. FIG. 141 displays the housing 820 to be three dimensionally shaped like Santa Claus. The wide open mouth of Santa Claus is where the flexible doors 870 and the opening of the housing 820 are positioned to conform to the regular operation of the bottle opener and bottle cap collecting and disposing device 810. The exterior of the collection chamber 826 may be decorated or molded to compliment or conform to the theme of the alternate exterior design of the housing 820. The exterior of the bottom door 828 may be decorated or molded to compliment or conform to the theme of the alternate exterior design of the housing 820. With reference to FIG. 141, the housing 820 can be designed in many other different three dimensional real or fictitious characters or animals, such as a political figure, a cartoon character, a movie actor, a tiger, a dinosaur and other icons or creatures. FIG. 142 displays the housing 820 to be three dimensionally shaped like a human hand holding a ball. An opening which is cut into the ball shape is where the flexible doors 870 and the opening of the housing 820 are positioned to conform to the regular operation of the bottle opener and bottle cap collecting and disposing device 810. The exterior of the collection chamber 826 may be decorated or molded to compliment or conform to the theme of the alternate exterior design of the housing 820. The exterior of the bottom door 828 may be decorated or molded to compliment or conform to the theme of the alternate exterior design of the housing 820. With reference to FIG. 142, the housing 820 can be designed in many other different three dimensional realistic or abstract shapes or themes, such as a planet, a building, a boat, a car, a rock formation and other landmarks, vehicles or parts of the human or animal anatomy.

810—A bottle opener and bottle cap collecting and disposing device with an alternate exterior design.

820—An alternate exterior design of the housing connecting all components of 810.

826—An alternate exterior design of the bottle cap collection chamber used to store bottle caps.

828—An alternate exterior design of the door used to prevent bottle caps from falling out of 826.

870—Set of flexible doors used to prevent bottle caps from passing back through the opening of 820.

The components and elements described in the foregoing description may be altered to accommodate for complexities in manufacturing, device functionality and comfort to the user. For example, the housing of the invention can be larger or smaller in design to allow a more comfortable grip to the user or to store more or less bottle caps in the collection chamber. The maximum bottle cap capacity of the bottle cap collection chamber is approximately 25 bottle caps and may be more or less due to the actual device size or the random arrangement of the bottle caps as they freely move around inside of the collection chamber during the usage of the device. The bottom door design can be two halves which open outward simultaneously. The bottom door can also be a twist-off design, a cap-like design or any design that will not only close the bottle cap exit point of the housing, but also be opened to allow the bottle caps to be completely removed from the housing. The inside opening design of the metal bottle opener piece can be more or less circular, square or rectangular in shape or any design shape that will assist the user in prying off the bottle cap from the bottle. The metal piece shaped for opening bottles can be made of another material, such as plastic, and/or molded directly into the plastic main body of the bottle opener and bottle cap collecting and disposing device. The bottle opener piece may be metal or any other material having adequate material properties for the intended purpose. Any metal component of the device may be formed of a stainless steel or aluminum or other such material that is resistive to corrosion and that is compatible with the fluid contained in the bottles and with any fluid used to clean the device. The design of the flexible, double doors can be more or less circular, square, rectangular or star-shaped, or any shape or design which will allow the bottle with secured cap to be inserted into the housing, and will allow the bottle to be withdrawn after the cap is removed from the bottle top, but also prevent the bottle cap from exiting after it is separated from the bottle. The flexible doors may or may not be flexible. While the bottom door and the flexible doors are in their closed positions, the bottle caps remain trapped inside of the housing or collection chamber and will not exit even if the device is turned upside-down or held at any angle by the user. The device may include any additional features made of any material, such as living hinges, rubber bands and/or spring resisted tracks, designed to grip and hold the bottom and/or the sides of the bottle cap which may suspend the bottle cap before and/or after it has been removed from the bottle and may allow the bottle cap to be guided into the collection chamber. All or some of the parts and components of the entire device may or may not be connected permanently by adhesive or another permanently connecting procedure. Other features and details of the invention may be changed according to their relationship to the broad scope of the invention. All or some of the parts and components of all of the design variations can be interchangeable between all or some of the design variations and/or combined.

In some embodiments, all or part of the collection chamber, or all or part of the entire device, may be transparent or translucent in order to allow the user to see the alignment of the bottle opener piece with the cap, and/or to see the number of removed caps that are stored in the collection chamber. All or part of the device may be made of any solid color, multiple colors or even a material that will enable the device to glow in the dark. Light emitting devices, such as LED's, lamps, etc. may be incorporated into the device for purely decorative purposes and/or for aiding the user in using the device in a poorly illuminated space. The device design may incorporate advertising information, such as being made in the colors of a school or sports team or in the color scheme of a product or advertiser. The device exterior design may incorporate a three dimensional likeness to a variety of real or fictitious characters or shapes, such as a sports helmet, a sports ball, a cartoon character, an animal, and so on. A sound-emitting device may be incorporated into the device for emitting sounds associated with advertising and/or for purely amusement purposes during the use of the device. A scent-emitting device may be incorporated into the device for emitting scents associated with advertising and/or for purely amusement purposes during the use of the device.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts.

The invention claimed is:

1. An apparatus comprising:

a housing;

an opening formed in the housing for receiving a bottle top sealed with a pry-off bottle cap;

a prying device disposed within the housing opposed to the opening for receiving the sealed bottle top and cap and for exerting an opening force to remove the cap from the bottle top; and an elastomeric material disposed in the opening and effective to allow passage of the sealed bottle top and cap, to provide a swiping action against the bottle top as it is removed from the housing, and to resist passage of the removed cap through the opening;

wherein the elastomeric material comprises an insertion opening, the insertion opening being dimensioned sufficiently small to inhibit passage of the removed cap when the elastomeric material is in a relaxed state, and the insertion opening being dimensioned sufficiently large to pass the sealed bottle top and cap when the elastomeric material is in a stretched state.

2. The apparatus of claim 1, further comprising a belt clip attached to or formed integral with the housing.

3. The apparatus of claim 2, further comprising a magnet attachment removably attachable to the belt clip.

4. The apparatus of claim 1, further comprising:

a second opening formed in the housing; and a door associated with the second opening for alternatively obstructing and opening the second opening for selective release of the removed cap.

5. The apparatus of claim 1, wherein the insertion opening comprises a general star shape.

6. An apparatus comprising:

a housing comprising an opening;

a bottle cap opening device disposed within the housing for receiving a bottle top sealed with a bottle cap introduced into the housing through the opening;

a space between the opening and the bottle cap opening device adequate for passage of the bottle cap once it is removed from the bottle top by the opening device; and a flexible member disposed in the opening for swiping the received bottle top and for resisting passage of the removed cap through the opening;

wherein the flexible member comprises an elastomeric material defining an insertion opening, the insertion opening being dimensioned sufficiently small to inhibit passage of the removed cap when the elastomeric material is in a relaxed state, and the insertion opening being dimensioned sufficiently large to pass the sealed bottle top and cap when the elastomeric material is in a stretched state.

7. The apparatus of claim 6, further comprising a belt clip associated with the housing.

8. The apparatus of claim 7, further comprising an attachment device removably attachable to the belt clip and to a support surface for temporary storage of the apparatus on the support surface.

9. The apparatus of claim 8, wherein the attachment device further comprises at least one of the group consisting of a magnet and a magnetic material.

10. An apparatus comprising:

a housing defining an upper chamber in spatial communication with a lower chamber;

an opening in the housing for the passage of a bottle top sealed with a cap into the upper chamber;

a prying device disposed within the upper chamber and spaced apart from the opening so that the bottle cap when removed by the prying device from the bottle top may pass freely between the prying device and the opening from the upper chamber to the lower chamber under the influence of gravity; and the opening at least partially blocked by a swiping member effective to allow entry and withdrawal of the bottle top and to resist passage of the removed cap through the opening;

wherein the swiping member comprises an elastomeric material defining an insertion opening sized sufficiently small when in a relaxed state to prohibit passage of the cap.

11. The apparatus of claim 10, further comprising:

a belt clip associated with the housing; and a temporary storage device selectively attachable to the belt clip and to a storage surface.

* * * * *